US012371911B2

(12) United States Patent
De La O et al.

(10) Patent No.: US 12,371,911 B2
(45) Date of Patent: Jul. 29, 2025

(54) CROWN ELEMENTS, BASEBOARD ELEMENTS, SPLINES, AND RELATED METHODS

(71) Applicant: SAS IP, LLC, Peoria, AZ (US)

(72) Inventors: Phil De La O, Glendale, AZ (US); William Michael Hatch, Peoria, AZ (US)

(73) Assignee: SAS IP, LLC, Peoria, AZ (US)

( * ) Notice: Subject to any disclaimer, the term of this patent is extended or adjusted under 35 U.S.C. 154(b) by 0 days.

(21) Appl. No.: 18/123,807

(22) Filed: Mar. 20, 2023

(65) Prior Publication Data

US 2023/0228102 A1 Jul. 20, 2023

Related U.S. Application Data

(63) Continuation of application No. 17/101,478, filed on Nov. 23, 2020, now Pat. No. 11,608,647, which is a continuation of application No. PCT/US2019/033857, filed on May 23, 2019.

(60) Provisional application No. 62/675,739, filed on May 23, 2018.

(51) Int. Cl.

| | |
|---|---|
| ***E04F 19/02*** | (2006.01) |
| ***E04F 13/07*** | (2006.01) |
| ***E04F 19/04*** | (2006.01) |
| ***E04F 19/06*** | (2006.01) |

(52) U.S. Cl.

CPC ..... *E04F 19/0436* (2013.01); *E04F 19/0486* (2013.01); *E04F 19/061* (2013.01); *E04F 19/02* (2013.01); *E04F 19/022* (2013.01); *E04F 19/045* (2013.01); *E04F 19/0477* (2013.01)

(58) Field of Classification Search

None

See application file for complete search history.

(56) References Cited

U.S. PATENT DOCUMENTS

| | | | | |
|---|---|---|---|---|
| 1,250,594 | A * | 12/1917 | Knapp | E04F 19/0436 52/288.1 |
| 3,158,960 | A | 12/1964 | Newton et al. | |
| 3,188,772 | A | 6/1965 | Tennison, Jr. | |
| 3,235,920 | A | 2/1966 | Davis | |
| 3,237,352 | A | 3/1966 | Edwards | |
| 3,242,622 | A | 3/1966 | Snead | |
| 3,640,039 | A | 2/1972 | McKee et al. | |
| 3,735,538 | A | 5/1973 | Ramins | |
| 4,391,077 | A | 7/1983 | Giess | |
| 4,663,906 | A | 5/1987 | Weinar | |

(Continued)

FOREIGN PATENT DOCUMENTS

| | | | |
|---|---|---|---|
| AU | 2004201720 | A1 | 11/2004 |
| CN | 202915027 | U | 5/2013 |

(Continued)

*Primary Examiner* — Phi D A

(74) *Attorney, Agent, or Firm* — BRYAN CAVE LEIGHTON PAISNER LLP

(57) ABSTRACT

A system comprising a first baseboard element, a second baseboard element, and a spline configured to couple with the first baseboard element and the second baseboard element. Another system comprising a first crown element, a second crown element, and a spline configured to couple with the first crown element and the second crown element. Other embodiments are disclosed herein.

20 Claims, 75 Drawing Sheets

(56) References Cited

U.S. PATENT DOCUMENTS

| | | | |
|---|---|---|---|
| 4,809,479 | A | 3/1989 | Tierno |
| 4,825,601 | A | 5/1989 | Halverson |
| 4,949,520 | A | 8/1990 | Bear |
| 5,090,174 | A | 2/1992 | Fragale |
| 5,426,898 | A | 6/1995 | Larsen |
| 5,560,170 | A | 10/1996 | Ganser et al. |
| 5,791,093 | A | 8/1998 | Diamond |
| 5,813,179 | A | 9/1998 | Koenig, Jr. et al. |
| 5,819,490 | A | 10/1998 | Current |
| 5,836,113 | A | 11/1998 | Bachman |
| 5,944,203 | A | 8/1999 | Vlah |
| 5,956,914 | A | 9/1999 | Williamson |
| D432,671 | S | 10/2000 | Grosfillex |
| 6,186,605 | B1 | 2/2001 | Nelson |
| D443,073 | S | 5/2001 | Wilson |
| 6,675,545 | B2 | 1/2004 | Chen et al. |
| D489,832 | S | 5/2004 | Koenig, Jr. |
| 6,802,161 | B1 | 10/2004 | Robinson |
| D528,669 | S | 9/2006 | Zarb |
| 7,451,574 | B2 | 11/2008 | Spek |
| 7,487,623 | B2 | 2/2009 | Rodolofo et al. |
| D599,916 | S | 9/2009 | Polston |
| 7,823,336 | B2 | 11/2010 | Brochu et al. |
| 8,104,234 | B1 | 1/2012 | Sawyer |
| 8,435,095 | B1 | 5/2013 | Abbas |
| 8,468,767 | B1 | 6/2013 | McBride |
| 8,495,844 | B1 | 7/2013 | Johnson, Sr. |
| 8,661,751 | B1 | 3/2014 | Lawrie et al. |
| 8,689,511 | B2 | 4/2014 | Fleming, III |
| D740,968 | S | 10/2015 | Stanfill |
| 9,481,321 | B2 | 11/2016 | Fisher |
| 9,808,733 | B2 | 11/2017 | Lambert |
| 10,011,995 | B2 | 7/2018 | Monteer |
| 10,024,064 | B2 | 7/2018 | Monteer |
| D853,589 | S | 7/2019 | Jackson et al. |
| 11,608,647 | B2 * | 3/2023 | De La O ..... E04F 19/0486 |
| 2001/0039774 | A1 | 11/2001 | Beirise et al. |
| 2002/0124485 | A1 | 9/2002 | Pulte |
| 2003/0037495 | A1 | 2/2003 | Shaw |
| 2003/0121217 | A1 | 7/2003 | Grizenko |
| 2003/0213195 | A1 | 11/2003 | Mathis et al. |
| 2005/0055936 | A1 * | 3/2005 | Murphy, Jr. ..... B29C 66/435 52/506.01 |
| 2005/0257443 | A1 | 11/2005 | Lin |
| 2007/0199269 | A1 | 8/2007 | Mees |
| 2008/0005986 | A1 | 1/2008 | Thompson |
| 2008/0172963 | A1 * | 7/2008 | Harrison ..... E04F 13/0733 52/287.1 |
| 2008/0295439 | A1 | 12/2008 | Janesky |
| 2009/0056252 | A1 | 3/2009 | Taylor |
| 2009/0139167 | A1 | 6/2009 | Donaldson |
| 2011/0179733 | A1 | 7/2011 | Picken |
| 2012/0102849 | A1 | 5/2012 | Shugart |
| 2013/0255171 | A1 | 10/2013 | Rutherford |
| 2017/0051517 | A1 | 2/2017 | Hatch |

FOREIGN PATENT DOCUMENTS

| | | |
|---|---|---|
| GB | 1421484 A | 1/1976 |
| JP | 4611133 | 1/2011 |
| KR | 19990001663 | 1/1999 |
| KR | 200232401 | 9/2001 |
| WO | 199410404 | 5/1994 |

* cited by examiner

CROWN ELEMENTS, BASEBOARD ELEMENTS, SPLINES, AND RELATED METHODS

CROSS-REFERENCE TO RELATED APPLICATIONS

This application is a continuation of U.S. patent application Ser. No. 17/101,478, filed Nov. 23, 2020, entitled "CROWN ELEMENTS, BASEBOARD ELEMENTS, SPLINES, AND RELATED METHODS." U.S. patent application Ser. No. 17/101,478 is a continuation of PCT No. PCT/US19/33857, filed May 23, 2019, entitled "CROWN ELEMENTS, BASEBOARD ELEMENTS, SPLINES, AND RELATED METHODS." PCT No. PCT/US19/33857 claims the benefit of U.S. Patent Application No. 62/675,739, filed May 23, 2018, entitled "CROWN ELEMENTS, BASEBOARD ELEMENTS, SPLINES, AND RELATED METHODS." U.S. patent application Ser. No. 17/101,478, PCT No. PCT/US19/33857, and U.S. Patent Application No. 62/675,739 are herein incorporated by this reference in their entirety.

TECHNICAL FIELD

This disclosure relates generally to construction elements, and relates more particularly to crown elements, baseboard elements, and splines.

BACKGROUND

In a construction environment, it is often desirable to protect an underlying bare surface (such as, for example, a wall or floor) from dirt, grime, grease, bacteria, animals, and any other deleterious elements. For example, in a commercial environment (such as, for example, a restaurant, cafeteria, or food stand) surface finishing items are generally installed over a bare surface to create a finished or working surface. Generally, such surface finishing items cover and treat bare surfaces using one or more of wall board, sheet rock, plaster, backsplashes, tile, wallpaper, carpeting, wood, paneling, vinyl, etc.

With the installation of these finishing items, it is typical to install conventional construction trim elements (such as, for example, baseboards, crown molding, and wainscoting) to cover or seal a transition from one finishing item to the other. Such conventional construction trim elements have inherent flaws that allow or promote the above-mentioned deleterious elements to accumulate or grow at the location of those conventional construction trim elements and/or contact base surfaces underlying the surface finishing items. For example, almost all of these conventional construction trim elements are installed using standard securing techniques (such as, for example, nails, staples, glues, and caulks) that are ineffective to seal the finishing items. Moreover, such trim elements may degrade, peel, warp, etc., over time by using such standard securing techniques.

BRIEF DESCRIPTION OF THE DRAWINGS

A more complete understanding of a construction element may be derived by referring to the detailed description and claims when considered in connection with the following illustrative figures. In the following figures, like reference numbers refer to similar elements and steps throughout the figures.

Figure 1A:
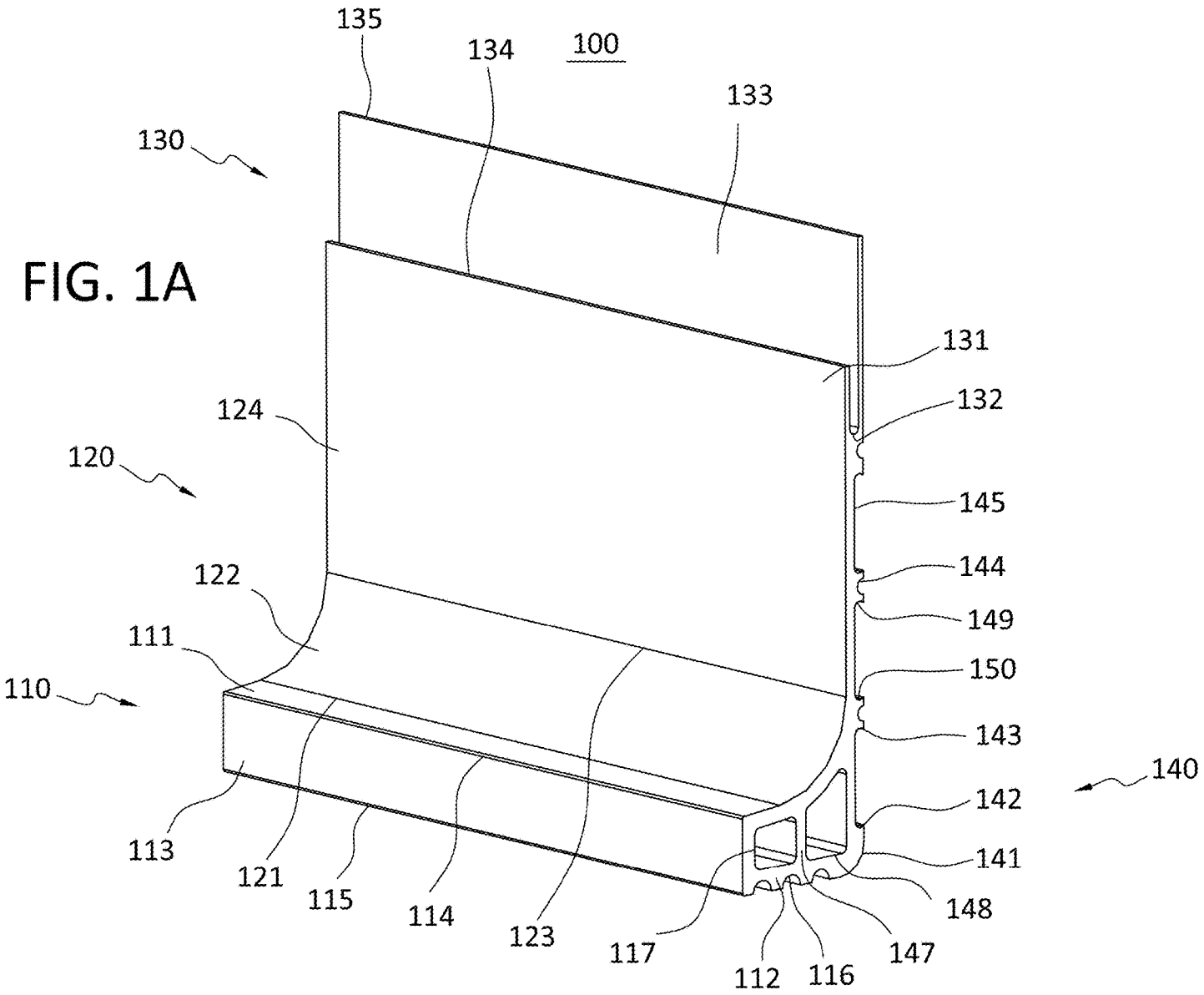
FIGS. 1A-3B representatively illustrate exemplary embodiments of baseboard elements.

Elements and/or any steps among the figures are illustrated for simplicity and clarity and have not necessarily been rendered according to any particular sequence. For example, steps that may be performed concurrently or in different order may be illustrated in the figures to help to improve understanding of embodiments of the construction element. Moreover, elements may be constructed in various combinations and/or permutations.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant. "Mechanical coupling" and the like should be broadly understood and include mechanical coupling of all types.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In the same or different embodiments, "approximately" can mean within plus or minus five percent of the stated value. In further embodiments, "approximately" can mean within plus or minus three percent of the stated value. In yet other embodiments, "approximately" can mean within plus or minus one percent of the stated value. In some embodiments, "approximately" can mean within plus or minus ten degrees of the stated value. In the same or different embodiments, "approximately" can mean within plus or minus five degrees of the stated value. In yet other embodiments, "approximately" can mean within plus or minus one degree of the stated value.

As used herein, the terms "comprise", "comprises", "comprising", "having", "including", "includes", "is" or any variation thereof, are intended to reference a non-exclusive inclusion, such that a process, method, article, composition, system, device, or apparatus that comprises a list of elements does not include only those elements recited, but may also include other elements not expressly listed or inherent to such process, method, article, composition, system, device, or apparatus. Other combinations and/or modifications of the above-described structures, arrangements, applications, proportions, elements, materials or components used in the practice of a construction element, in addition to those not specifically recited, may be varied or otherwise particularly adapted to specific environments, manufacturing specifications, design parameters or other operating requirements without departing from the general principles of the same.

DESCRIPTION OF EXAMPLES OF EMBODIMENTS

Among other representative embodiments, a system can comprise: a first baseboard element, which can comprise: a first nose portion, which can comprise: a first nose top section and/or a first nose bottom section, wherein the first nose top section is located opposite the first nose bottom section; and/or a first nose front section extending between the first nose top section and/or the first nose bottom section; a first riser portion coupled to the first nose portion, the first riser portion, which can comprise: a first riser section extending approximately perpendicular to the first nose bottom section; and/or a first riser bend extending between the first nose top potion and/or the first riser section; a first wall groove portion, which can comprise: a first groove front section extending approximately parallel to the first riser section; a first groove back section extending approximately parallel to the first groove front section; and/or a first groove bend extending between the first groove front section and/or the first groove back section; and/or a first spline coupling portion; a second baseboard element, which can comprise: a second nose portion, which can comprise: a second nose top section and/or a second nose bottom section, wherein the first nose top section is opposite the second nose bottom section; and/or a second nose front section extending between the second nose top section and/or the second nose bottom section; a second riser portion coupled to the second nose portion, the second riser portion, which can comprise: a second riser section extending approximately perpendicular to the second nose bottom section; and/or a second riser bend extending between the second nose top potion and/or the second riser section; a second wall groove portion, which can comprise: a second groove front section extending approximately parallel to the second riser section; a second groove back section extending approximately parallel to the second groove front section; and/or a second groove bend extending between the second groove front section and/or the second groove back section; and/or a second spline coupling portion; and/or a spline configured to couple with the first spline coupling portion and/or the second spline coupling portion to couple together the first baseboard element and/or the second baseboard element.

Other representative embodiments can comprise: a system, which can comprise: a baseboard element, which can comprise: a baseboard nose portion, which can comprise: a baseboard nose top section and/or a baseboard nose bottom section, wherein the baseboard nose top section is located opposite the baseboard nose bottom section; and/or a baseboard nose front section extending between the baseboard nose top section and/or the baseboard nose bottom section; a baseboard riser portion coupled to the baseboard nose portion, the baseboard riser portion, which can comprise: a baseboard riser section extending approximately perpendicular to the baseboard nose bottom section; and/or a baseboard riser bend extending between the baseboard nose top potion and/or the baseboard riser section; a baseboard wall groove portion, which can comprise: a baseboard groove front section extending approximately parallel to the baseboard riser section; a baseboard groove back section extending approximately parallel to the baseboard groove front section; and/or a baseboard groove bend extending between the baseboard groove front section and/or the baseboard groove back section; and/or a baseboard spline coupling portion, which can comprise: a baseboard spline receiver groove configured to accept a spline; and/or a spline end cap, which can comprise: a spline nose portion, which can comprise: a spline nose top section extending approximately parallel to a spline nose bottom section; and/or a spline nose front section extending between the spline nose top section and/or the spline nose bottom section; a spline riser portion extending approximately parallel to the spline nose front section, the spline riser portion, which can comprise: a spline riser section extending approximately perpendicular to the spline nose bottom section; and/or a spline riser bend extending between the spline nose top potion and/or the spline riser section; a spline wall groove portion, which can comprise: a spline groove front section extending approximately parallel to the spline nose front section; a spline groove back section extending approximately parallel to the spline groove front section; and/or a spline groove bend extending between the spline groove front section and/or the spline groove back section; a first lateral side consisting of a flat surface Other representative embodiments can comprise: a method of providing a spline, which can comprise: providing a spline mold, the spline mold configured to produce the spline, wherein the spline comprises: a spline nose portion, which can comprise: a spline nose top section and/or a spline nose bottom section, wherein the spline nose top section is located opposite the spline nose bottom section; and/or a spline nose front section extending between the spline nose top section and/or the spline nose bottom section; a spline riser portion coupled to the spline nose portion, the spline riser portion, which can comprise: a spline riser section extending approximately perpendicular to the spline nose bottom section; and/or a spline riser bend extending between the spline nose top potion and/or the spline riser section; a spline wall groove portion, which can comprise: a spline groove front section extending approximately parallel to the spline riser section; a spline groove back section extending approximately parallel to the spline groove front section; and/or a spline groove bend extending between the spline groove front section and/or the spline groove back section; and/or a spline plate extending from a lateral side of the spline riser portion; filling the spline mold with a polymer; and/or cooling the polymer.

Other representative embodiments can comprise: a system, which can comprise: a first crown element, which can comprise: a first nose portion, which can comprise: a first nose top section and/or a first nose bottom section, wherein the first nose top section is located opposite the first nose bottom section; and/or a first nose front section extending between the first nose top section and/or the first nose bottom section; a first ceiling portion extending from and/or approximately perpendicular to the first nose top section; a first riser portion coupled to the first nose portion, the first riser portion, which can comprise: a first riser section extending approximately perpendicular to the first nose top section; and/or a first riser bend extending between the first nose front section and/or the first riser section; a first wall groove portion, which can comprise: a first groove front section extending approximately perpendicular to the first nose top section; a first groove back section extending approximately parallel to the first groove front section; and/or a first groove bend extending between the first groove front section and/or the first groove back section; and/or a first spline coupling portion, which can comprise: a first spline receiver groove configured to accept a spline; a second crown element, which can comprise: a second nose portion, which can comprise: a second nose top section and/or a second nose bottom section, wherein the first nose top section is opposite the second nose bottom section; and/or a second nose front section extending between the second nose top section and/or the second nose bottom section; a second ceiling portion extending from and/or perpendicular to the second nose top section; a second riser portion coupled to the second nose portion, the second riser portion, which can comprise: a second riser section extending approximately perpendicular to the second nose top section; and/or a second riser bend extending between the second nose top section and/or the second riser section; a second wall groove portion, which can comprise: a second groove front section extending approximately perpendicular to the second nose top section; a second groove back section extending approximately parallel to the second groove front section; and/or a second groove bend extending between the second groove front section and/or the second groove back section; and/or a second spline receiver portion, which can comprise: a second spline receiver groove configured to accept the spline; and/or a spline configured to couple with the first spline coupling portion and/or the second spline coupling portion to couple together first crown element and/or the second crown element.

Other representative embodiments can comprise: a system, which can comprise: a crown element, which can comprise: a crown nose portion, which can comprise: a crown nose top section and/or a crown nose bottom section, wherein the crown nose top section is located opposite the crown nose bottom section; and/or a crown nose front section extending between the crown nose top section and/or the crown nose bottom section; a crown ceiling portion extending from and/or approximately perpendicular to the crown nose top section; a crown riser portion coupled to the crown nose portion, the crown riser portion, which can comprise: a crown riser section extending approximately perpendicular to the crown nose top section; and/or a crown riser bend extending between the crown nose front section and/or the crown riser section; a crown wall groove portion, which can comprise: a crown groove front section extending approximately perpendicular to the crown nose top section; a crown groove back section extending approximately parallel to the crown groove front section; and/or a crown groove bend extending between the crown groove front section and/or the crown groove back section; and/or a crown spline coupling portion, which can comprise: a crown spline receiver groove configured to accept a spline; a spline end cap, which can comprise: a spline nose portion, which can comprise: a spline nose top section extending approximately parallel to a spline nose bottom section; and/or a spline nose front section extending between the spline nose top section and/or the spline nose bottom section; a spline ceiling portion extending from and/or approximately perpendicular to the spline nose top section; a spline riser portion extending approximately parallel to the spline nose front section, the spline riser portion, which can comprise: a spline riser section extending approximately perpendicular to the spline nose bottom section; and/or a spline riser bend extending between the spline nose top potion and/or the spline riser section; a spline wall groove portion, which can comprise: a spline groove front section extending approximately parallel to the spline nose front section; a spline groove back section extending approximately parallel to the spline groove front section; and/or a spline groove bend extending between the spline groove front section and/or the spline groove back section; a first lateral side consisting of a flat surface.

A construction element may be described herein by terms of various functional elements and various method steps. Such functional elements may be realized by any number of hardware components adapted to perform generalized or specific functions to achieve various results. For example, the construction element may employ various construction element components, e.g., various materials, such as stainless steel, standard steel grades, aluminum, copper, various alloy combinations, vinyl, and any other natural and/or synthetic materials whether now known or developed in the future. Moreover, the construction element may comprise various structural configurations, for example, tongue and grooves, slots, laps, welds, snaps, latches, wells, and the like, which may carry out a variety of functions. And each structural configuration may comprise any number or permutations of configurations; for example, various scale, gauge, finish, size, geometry, surface texture, and the like may be employed.

Other representative embodiments can comprise: a system, which can comprise: a crown spline, which can comprise: a crown nose portion, which can comprise: a crown nose top section and a crown nose bottom section, wherein the crown nose top section is located opposite the crown nose bottom section; and a crown nose front section extending between the crown nose top section and the crown nose bottom section; a crown ceiling portion extending from and approximately perpendicular to the crown nose top section; a crown riser portion coupled to the crown nose portion, the crown riser portion, which can comprise: a crown riser section extending approximately perpendicular to the crown nose top section; and a crown riser bend extending between the crown nose front section and the crown riser section; and a first spline extending from the first crown lateral side configured to couple with a spline receiving groove of a crown element; a baseboard spline, which can comprise: a baseboard nose portion, which can comprise: a baseboard nose top section and a baseboard nose bottom section, wherein the baseboard nose top section is located opposite the baseboard nose bottom section; and a baseboard nose front section extending between the baseboard nose top section and the baseboard nose bottom section; a baseboard riser portion coupled to the baseboard nose portion, the baseboard riser portion, which can comprise: a baseboard riser section extending approximately perpendicular to the baseboard nose bottom section; and a baseboard riser bend extending between the baseboard nose top potion and the baseboard riser section; and a second spline extending from the first baseboard lateral side configured to couple with a spline receiver groove of a baseboard element; and a wall element coupled to and extending between the crown element and the baseboard element, the wall element, which can comprise: a wall corner portion comprising a corner bend; a wall groove portion, which can comprise: a wall groove front section extending from the wall groove corner portion; a wall groove back section extending approximately parallel to the wall groove front section; and a wall groove bend extending between the wall groove front section and the wall groove back section.

Those skilled in the art will understand that the construction element may be practiced as part of any variety of construction element and/or finishing applications, whether for commercial, industrial, and/or residential, purpose; and any particular system, method, and/or purpose described is merely exemplary for the construction element. Those skilled in the art will further understand that the construction element may be practiced by any number of other applications and environments, whether now known or developed in the future. Finally, those skilled in the art will understand that the construction element may employ any number of conventional techniques for manufacturing, installing, packaging, marketing, distributing, and/or selling the construction element.

In many embodiments, a construction element (such as, for example, baseboards, crown molding, and wainscoting) can (1) operate to seal and/or operate as a transition from one surface finishing item to another (such as, for example, wall board, sheet rock, plaster, backsplashes, tile, wallpaper, carpeting, wood, paneling, or vinyl), (2) prevent deleterious materials (such as, for example, dirt, grime, grease, bacteria, or animals) from accumulating or growing at the location of the construction element, and (3) prevent the deleterious materials from contacting the base surfaces underlying the surface finishing items. In some embodiments, the construction element can be referred to as a construction trim element.

Various embodiments can include a system. The system can include a first baseboard element, a second baseboard element, and a spline configured to couple with the first baseboard element and the second baseboard element. In a number of embodiments, the first baseboard element can include a first nose portion, a first riser portion coupled to the first nose portion, and a first wall groove portion. The first nose portion can include a first nose bottom section. The first riser portion can include a first riser section extending approximately perpendicular to the first nose bottom section. The first wall groove portion can include a first groove front section extending approximately parallel to the first riser section along a first direction approximately perpendicular to the first nose bottom section. The first wall groove portion further can include a first groove back section extending approximately parallel to the first groove front section along the first direction.

In some embodiments, the second baseboard element can include a second nose portion, a second riser portion coupled to the second nose portion, and a second wall groove portion. The second nose portion can include a second nose bottom section. The second riser portion can include a second riser section extending approximately perpendicular to the second nose bottom section. The second wall groove portion can include a second groove front section extending approximately parallel to the second riser section along a second direction approximately perpendicular to the second nose bottom section. The second wall groove portion also can include a second groove back section extending approximately parallel to the second groove front section along the second direction.

Various embodiments additionally can include another system. The system can include a first crown element, a second crown element, and a spline configured to couple with the first crown element and the second crown element. In many embodiments, the first crown element can include a first nose portion, a first ceiling portion, a first riser portion, and a first wall groove portion. The first crown element can include a first nose top section, a first ceiling portion extending from and approximately perpendicular to the first nose top section, and a first riser portion coupled to the first nose portion. The first riser portion can include a first riser section extending approximately perpendicular to the first nose top section. The first wall groove portion can include a first groove front section extending approximately perpendicular to the first nose top section and a first groove back section extending approximately parallel to the first groove front section.

In several embodiments, the second crown element can include a second nose portion, a second ceiling portion, a second riser portion coupled to the second nose portion, and a second wall groove portion. The second nose portion can include a second nose top section. The second riser section can extend approximately perpendicular to the second nose top section. The second wall groove portion can include a second groove front section extending approximately perpendicular to the second nose top section, and a second groove back section extending approximately parallel to the second groove front section.

Various representative implementations of a baseboard element may be applied to any construction system. Referring now to FIG. 1A, an exemplary embodiment of a baseboard element 100 is shown in an isometric view. In many embodiments, baseboard element 100 can comprise a single, integrated piece.

In some embodiments, baseboard element 100 can comprise a nose portion 110, riser portion 120, wall groove portion 130, and/or a spline receiver portion 140. In some embodiments, nose portion 110 can further comprise a nose top section 111, a nose bottom section 112, and/or a nose front section 113. In the same or different embodiments, nose top section 111 can have a substantially planar shape. In the same or different embodiments, nose top section 111 can extend approximately parallel to nose bottom section 112 and approximately perpendicular to nose front section 113.

Figure 1B:
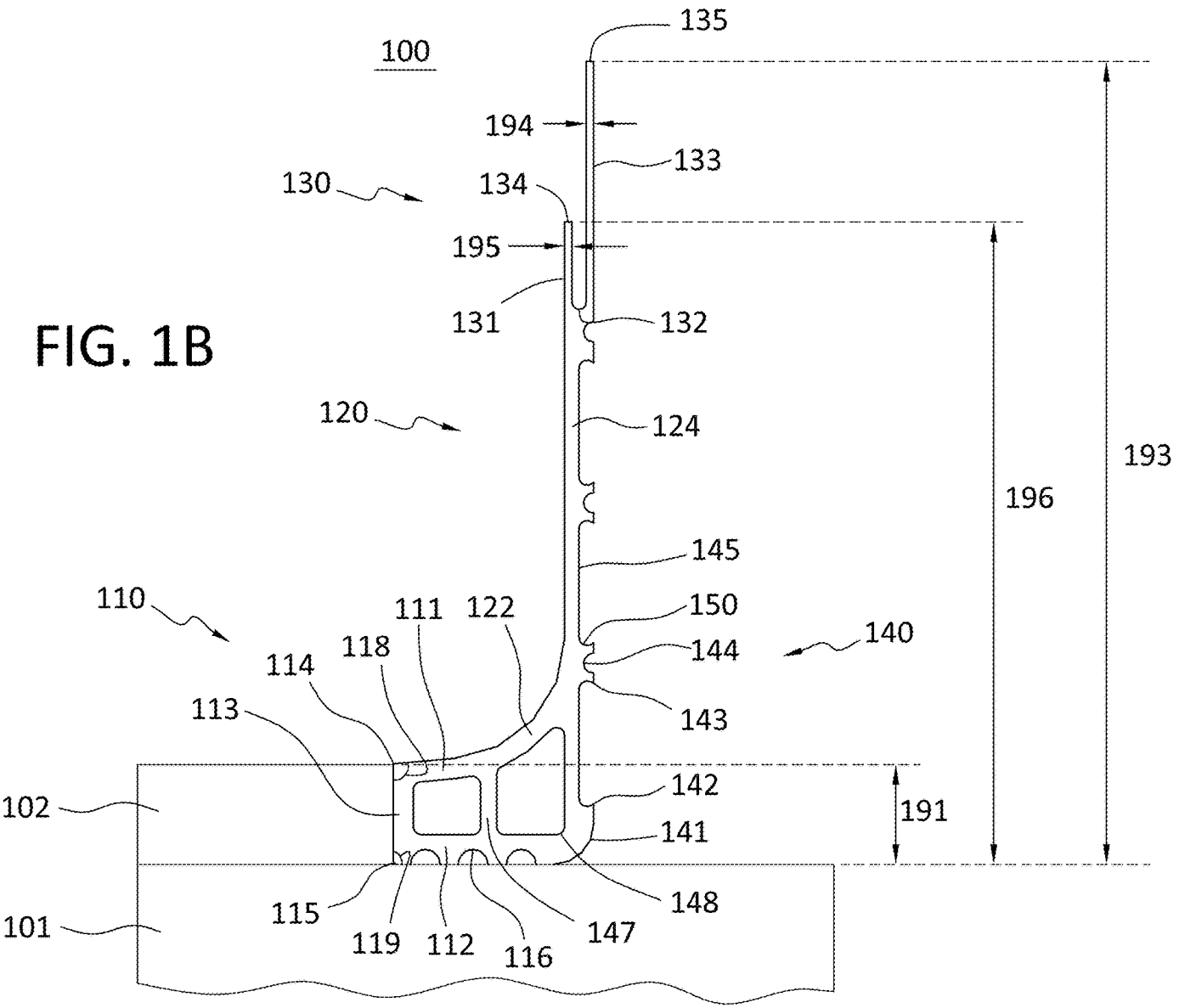

In some embodiments, nose front section 113 can have a substantially planar shape. In the same or different embodiments, nose front section 113 extends between nose top section 111 and nose bottom section 112. In the same or different embodiments, nose portion 110 can comprise top nose bend 114. In further embodiments, top nose bend 114 can extend between nose top section 111 and nose front section 113. In the same or different embodiments, nose portion 110 can comprise bottom nose bend 115. In further embodiments, bottom nose bend 115 can extend between nose bottom section 112 and nose front section 113. In the same or different embodiments, nose bottom section 112 can comprise one or more nose bottom grooves 116. In some embodiments, nose bottom grooves 116 can be configured to receive epoxy, glue, or sealant such that a baseboard element 100 is coupled to a ground surface 101 (FIG. 1B). In some embodiments, the coupling of baseboard element 100 to ground surface 101 (FIG. 1B) occurs in a way that is water tight and/or air tight.

In further embodiments, nose portion 110 further comprises a nose spline receiver groove 117. Nose spline receiver groove 117 can be a spline coupling portion. In some embodiments, the spline coupling portion can comprise one or more recesses or female portions, as described below, and in other embodiments (not shown in FIGS. 1A and 1B), the spline coupling portion can comprise one or more male portions. As shown in FIG. 1A, nose spline receiver groove 117 can comprise a variety of shapes configured to receive a variety of spline nub shapes, such that inserting a spline nub into nose spline receiver groove 117 couples baseboard element 100 to a spline. Incorporation of nose spline receiver groove 117 into baseboard element 100 can save on production costs and weight due to reducing material used to manufacture baseboard element 100. In various embodiments, nose spline receiver groove 117 can comprise a substantially rectangular shape, a substantially circular shape, a substantially triangular shape, and/or a substantially semi-circular shape. Incorporation of nose spline receiver groove 117 into baseboard element 100 can save on production costs and weight due to reducing material used to manufacture baseboard element 100.

In some embodiments, riser portion 120 can comprise riser bend bottom interface 121, riser bend 122, riser bend top interface 123, and/or riser section 124. In the same or different embodiments, riser bend bottom interface 121 can extend from nose top section 111. In the same or different embodiments, riser bend 122 can extend from riser bend bottom interface 123. In the same or different embodiments, riser bend 122 can have a substantially arcuate shape, which allows for easy and thorough cleaning and/or disinfection because the lack of sharp corners and crevices prevents microorganisms from evading disinfectant. When riser bend 122 has a substantially arcuate shape, laminar airflow can also be enhanced because air streams do not encounter sharp corners. As an example, the substantially arcuate shape of riser bend 122 can be a concave shape or a convex shape. In some embodiments, riser bend top interface 123 can extend from riser bend 122. In the same or different embodiments, riser section 124 can extend from riser top interface 123. In various embodiments, riser section 124 has a substantially planar shape, can be parallel to nose front section 113, and/or be perpendicular to nose bottom section 112.

In the same or different embodiments, wall groove portion 130 can comprise a groove front section 131, a groove bend 132, a groove back section 133, a groove front edge 134, and/or a groove back edge 135. In some embodiments, groove front section 131 can extend from riser section 124. As an example, groove front section 131 and riser section 124 can be coplanar with each other. In various embodiments, groove front section 131 has a substantially planar shape, can be parallel to nose front section 113, and/or be perpendicular to nose bottom section 112. In the same or different embodiments, groove front section 131 terminates at groove front edge 134. In various embodiments, groove front edge 134 can have a substantially planar shape or a substantially arcuate shape. In further embodiments, groove bend 132 can extend from groove front end 131. In various embodiments, groove bend 132 can have a substantially planar shape. In the same or different embodiments, groove bend 132 can form a 180 degree bend, such that groove back section 133 can be approximately parallel to groove front section 131. In various embodiments, groove back section 133 can extend from groove bend 132 and terminate at groove back edge 135. In further embodiments, groove back edge 135 can have a substantially planar shape or a substantially arcuate shape. Groove back section 133 can extend higher than groove front end 131 such that groove back edge 135 is higher than groove front edge 134.

In the same or different embodiments, spline receiver portion 140 can be a spline coupling portion. In some embodiments, the spline coupling portion can comprise one or more recesses or female portions, as described below, and in other embodiments (not shown in FIGS. 1A and 1B), the spline coupling portion can comprise one or more male portions. As shown in FIG. 1A, spline receiver portion 140 can comprise spline receiver bend 141, bottom receiver nub 142, middle receiver nubs 143, top receiver nub 149, receiver back grooves 144, receiver sections 145, back spline receiver groove 148, and/or spline groove separator 147.

In some embodiments, spline receiver bend 141 can extend from nose bottom section 112 and/or nose bottom grooves 116. In various embodiments, spline receiver bend 141 can have a substantially arcuate shape. In further embodiments, spline receiver bend 141 can form a right angle. In some embodiments, bottom receiver nub 142 can extend from spline receiver bend 141. In different embodiments, bottom receiver nub 142 does not extend from spline receiver bend 141, but instead extends from a bottom-most one of middle receiver nubs 143. Receiver back grooves 144 can be located within middle receiver nubs 143 and within top receiver nub 149. In the same or different embodiments, top receiver nub 149 can extend from groove back section 133. In further embodiments, receiver back grooves 144 can be configured to receive epoxy, glue, or sealant such that a baseboard element 100 is coupled to a wall surface (not shown). In some embodiments, the coupling of baseboard element 100 to wall surface (not shown) occurs in a way that is water tight and/or air tight.

In some embodiments, receiver sections 145 can be spline coupling portions. In some embodiments, the spline coupling portions can comprise one or more recesses or female portions, as described below, and in other embodiments (not shown in FIGS. 1A and 1B), the spline coupling portions can comprise one or more male portions. As shown in FIG. 1A, receiver sections 145 extend between bottom receiver nub 142 and a bottom-most one of middle receiver nubs 143, between adjacent ones of middle receiver nubs 143, and/or between a top-most one of middle receiver nubs 143 and top receiver nub 149. Receiver sections 145 can extend approximately parallel to nose front section 113 and approximately perpendicular to nose bottom section 112. In various embodiments, outer edges of bottom receiver nub 142, middle receiver nubs 143, and/or top receiver nub 149 can have receiver nub bends 150, which also can be located at the outer edges of receiver sections 145. In some embodiments, each of receiver nub bends 150 can have a substantially arcuate or substantially planar shape. When receiver nub bends 150 have arcuate shapes, a coupling of baseboard element 100 at receiver sections 145 to a spline can be easier. In the same or different embodiments, spline plates can be configured to be inserted into receiver sections 145 such that the spline plates are held in place by adjacent ones of top receiver nub 149, middle receiver nubs 143, and/or bottom receiver nub 142. In a different embodiment, the baseboard element can be devoid of any middle receiver nubs, and can have only one receiver section located between a top receiver nub and a bottom receiver nub.

In various embodiments, back spline receiver groove 148 can be a spline coupling portion. In some embodiments, the spline coupling portion can comprise one or more recesses or female portions, as described below, and in other embodiments (not shown in FIGS. 1A and 1B), the spline coupling portion can comprise one or more male portions. As shown in FIG. 1A, back spline receiver groove 148 can be proximate to spline receiver bend 141. In the same or different embodiments, back spline receiver groove 148 can comprise a variety of shapes configured to receive a variety of spline nub shapes such that inserting a spline nub into back spline receiver groove 148 couples baseboard element 100 to a spline. In various embodiments, spline groove separator 147 extends between back spline receiver groove 148 and nose spline receiver groove 117. Incorporation of back spline receiver groove 148 into baseboard element 100 can save on production costs and weight due to reducing material used to manufacture baseboard element 100.

Referring now to FIG. 1B, a side profile view of baseboard element 100 is shown. In some embodiments, top nose bend 114 can form top nose angle 118 between nose top section 111 and nose front section 113. In various embodiments, top nose angle 118 can be an approximately right angle. In the same or different embodiments, top nose angle 118 can be an acute angle or an obtuse angle. When top nose angle 118 is an approximately right angle, flooring material 102 can lay flush against nose front section 113, thus providing an approximately flat surface across nose top section 111 and flooring material 102. When top nose angle 118 is an obtuse angle, a channel can be formed with flooring material 102, which can be used as an aid for applying adhesive or sealant.

In further embodiments, nose bottom bend 115 can form bottom nose angle 119 between nose bottom section 112 and nose front section 113. In various embodiments, bottom nose angle 119 can be an approximately right angle. In the same or different embodiments, bottom nose angle 119 can be an acute angle or an obtuse angle. When bottom nose angle 119 is an approximately right angle, flooring material 102 can lay flush against nose front section 113, thus providing an approximately flat surface across nose top section 111 and flooring material 102. When bottom nose angle 119 is an acute angle, a channel can be formed with flooring material 102, which can be used as an aid for applying adhesive or sealant. In some embodiments, a height of nose front section 191 from nose top section 111 to nose bottom section 112 can be approximately 0.6266 inches (1.5916 centimeters), a length of nose bottom section 192 from nose front section 113 to spline receiver bend 141 can be approximately 1.25 inches (3.175 centimeters), a height of baseboard element 193 from nose bottom section 112 to groove back edge 135 can be approximately 5.0 inches (12.7 centimeters), a thickness of groove back section 194 can be approximately 0.045 inches (0.1143 centimeters), a thickness of groove front section 195 can be approximately 0.045 inches (0.1143 centimeters), a width 197 of groove bend 132 from groove front section 131 to groove back section 133 can be approximately 0.130 inches (0.330 centimeters), and/or a height 196 from nose bottom section 112 to groove front edge 134 can be approximately 4.0 inches (10.16 centimeters). In different embodiments, each of these dimensions can be increased or decreased by up to one percent, five percent, ten percent, fifteen percent, twenty percent, or twenty-five percent. Height of nose front section 191 can be designed to match a height of flooring material 102. Width 197 of groove bend 132 can be designed to accommodate a width of a wall overlay material. Thickness of groove front section 195, a height of groove front section 131, and adjacent portions of baseboard element 100 can be designed to be strong enough to support the wall overlay material.

Figure 2A:
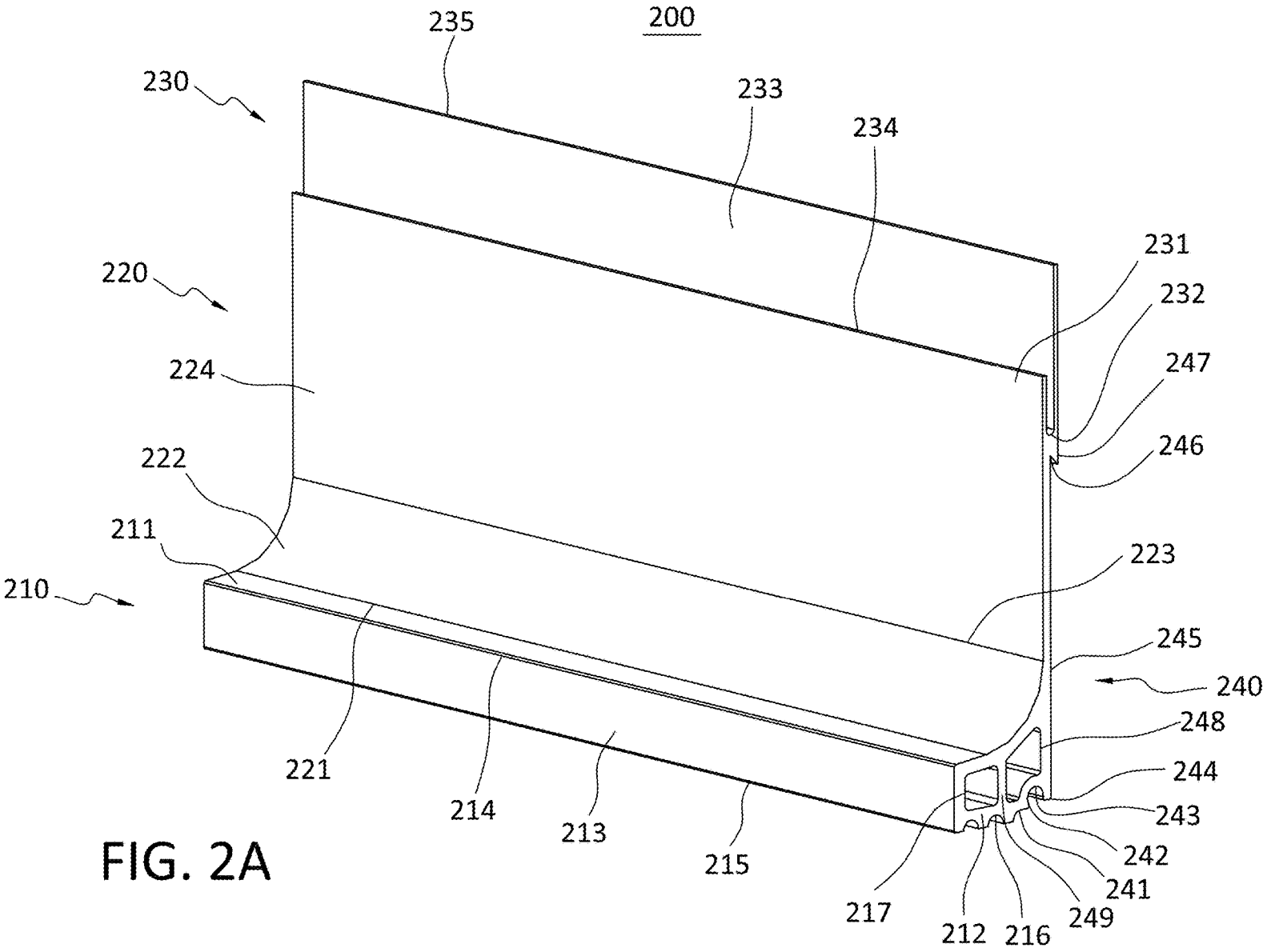

Turning to FIG. 2A, an exemplary embodiment of a baseboard element 200 is shown in an isometric view. In many embodiments, baseboard element 200 can comprise a single integrated piece. In many embodiments, baseboard element 200 and baseboard element 100 (FIGS. 1A and 1B) can be similar to each other. For example, baseboard element 200 can be longer than baseboard element 100 (FIGS. 1A and 1B), but otherwise can have the same general shape as baseboard element 100 (FIGS. 1A-1B). In the same or different embodiments (not shown in FIG. 2A), baseboard element 200 and baseboard element 100 (FIGS. 1A and 1B) can be symmetrical with each other. In the same or different embodiments (also not shown in FIG. 2A), baseboard element 200 and baseboard element 100 (FIGS. 1A and 1B) can be identical with each other. In the same or different embodiments, baseboard element 200 can have the details shown in FIG. 2A and described in the subsequent paragraphs.

In some embodiments, baseboard element 200 can comprise a nose portion 210, a riser portion 220, a wall groove portion 230, and/or a spline receiver portion 240. In some embodiments, nose portion 210 can further comprise a nose top section 211, a nose bottom section 212, and/or a nose front section 213. In the same or different embodiments, nose top section 211 can have a substantially planar shape. In the same or different embodiments, nose top section 211 can extend approximately parallel to nose bottom section 212 and approximately perpendicular to nose front section 213.

Figure 2B:
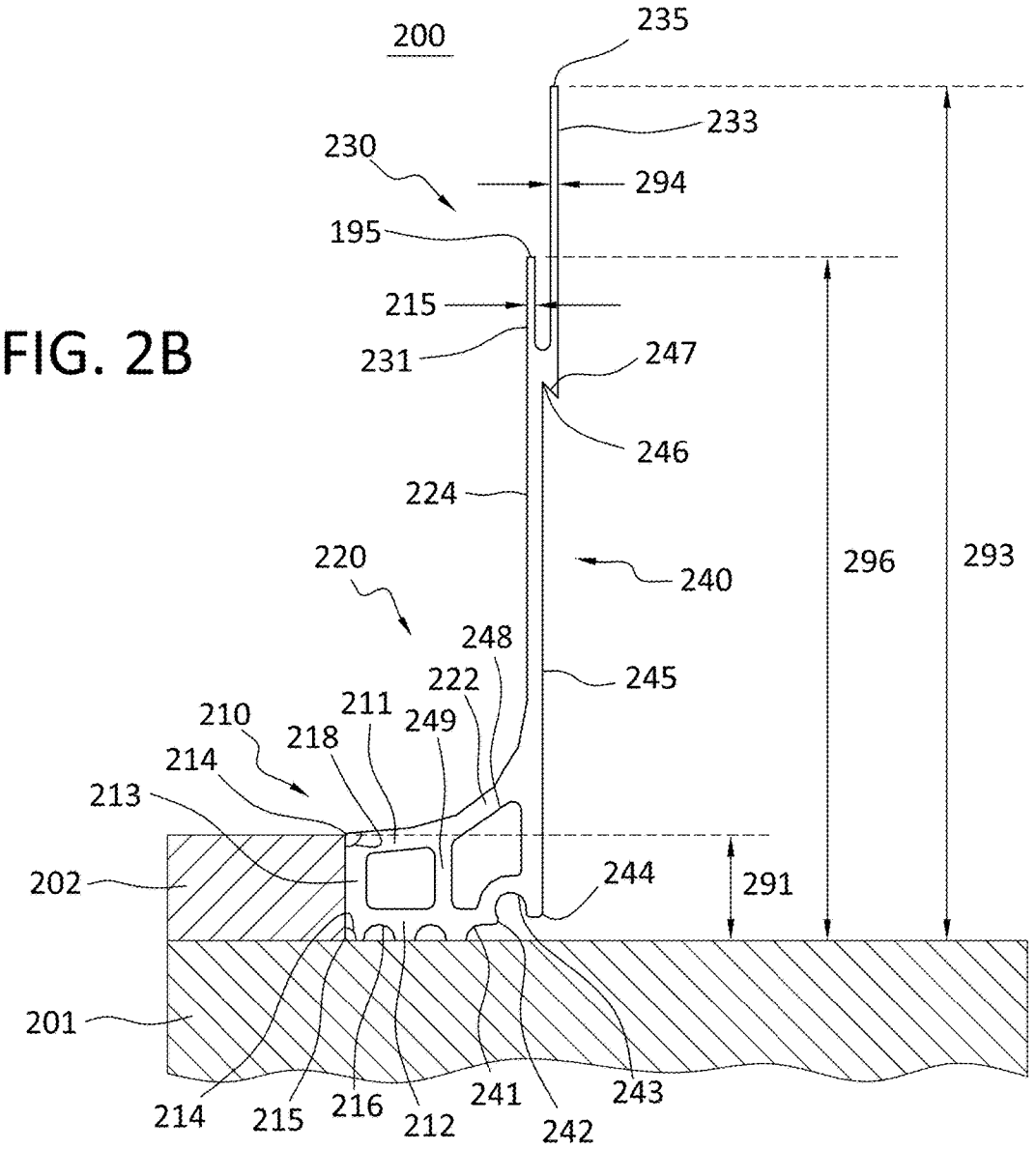

In some embodiments, nose front section 213 can have a substantially planar shape. In the same or different embodiments, nose front section 213 extends between nose top section 211 and nose bottom section 212. In the same or different embodiments, nose portion 210 can comprise top nose bend 214. In further embodiments, top nose bend 214 can extend between nose top section 211 and nose front section 213. In the same or different embodiments, nose portion 210 can comprise bottom nose bend 215. In further embodiments, bottom nose bend 215 can extend between nose bottom section 212 and nose front section 213. In the same or different embodiments, nose bottom section 212 can comprise one or more nose bottom grooves 216. In some embodiments, nose bottom grooves 216 can be configured to receive epoxy, glue, or sealant such that a baseboard element 200 is coupled to a ground surface 201 (FIG. 2B). In some embodiments, the coupling of baseboard element 200 to ground surface 201 (FIG. 2B) occurs in a way that is water tight and/or air tight.

In further embodiments, nose portion 210 further comprises a nose spline receiver groove 217. Nose spline receiver groove 217 can be a spline coupling portion. In some embodiments, the spline coupling portion can comprise one or more recesses or female portions, as described below, and in other embodiments (not shown in FIGS. 2A and 2B), the spline coupling portion can comprise one or more male portions. As shown in FIG. 2A, nose spline receiver groove 217 can comprise a variety of shapes configured to receive a variety of spline nub shapes, such that inserting a spline nub into nose spline receiver groove 217 couples baseboard element 200 to a spline. In various embodiments, nose spline receiver groove 217 can comprise a substantially rectangular shape, a substantially circular shape, a substantially triangular shape, and/or a substantially semi-circular shape. Incorporation of nose spline receiver groove 217 into baseboard element 200 can save on production costs and weight due to reducing material used to manufacture baseboard element 200.

In some embodiments, riser portion 220 can comprise riser bend bottom interface 221, riser bend 222, riser bend top interface 223, and/or riser section 224. In the same or different embodiments, riser bend bottom interface 221 can extend from nose top section 211. In further embodiments, riser bend 222 can extend from riser bend bottom interface 223. In the same or different embodiments, riser bend 222 can have a substantially arcuate shape, which allows for easy and thorough cleaning and/or disinfection because the lack of sharp corners and crevices prevents microorganisms from evading disinfectant. When riser bend 222 has a substantially arcuate shape, laminar airflow can also be enhanced because air streams do not encounter sharp corners. As an example, the substantially arcuate shape of riser bend 222 can be a concave shape or a convex shape or a convex shape. In some embodiments, riser bend top interface 223 can extend from riser bend 222. In the same or different embodiments, riser section 224 can extend from riser top interface 223. In various embodiments, riser section 224 has a substantially planar shape, can be parallel to nose front section 213, and/or be perpendicular to nose bottom section 212.

In the same or different embodiments, wall groove portion 230 can comprise a groove front section 231, a groove bend 232, a groove back section 233, a groove front edge 234, and/or a groove back edge 235. In some embodiments, groove front section 231 can extend from the riser section 224. As an example, groove front section 231 and riser section 224 can be coplanar with each other. In various embodiments, groove front section 231 has a substantially planar shape, can be parallel to nose front section 213, and/or be perpendicular to nose bottom section 212. In the same or different embodiments, groove front section 231 terminates at groove front edge 234. In various embodiments, groove front edge 234 can have a substantially planar shape or a substantially arcuate shape. In further embodiments, groove bend 232 can extend from groove front end 231. In various embodiments, groove bend 232 can have a substantially planar shape. In the same or different embodiments, groove bend 232 can form a 180 degree bend, such that groove back section 233 can be approximately parallel to groove front section 231. In various embodiments, groove back section 233 can extend from groove bend 232 and terminate at groove back edge 235. In further embodiments, groove back edge 235 can have a substantially planar shape or a substantially arcuate shape. Groove back section 233 can extend higher than groove front end 231 such that groove back edge 235 is higher than groove front edge 234.

In the same or different embodiments, spline receiver portion 240 can be a spline coupling portion. In some embodiments, the spline coupling portion can comprise one or more recesses or female portions, as described below, and in other embodiments (not shown in FIGS. 2A and 2B), the spline coupling portion can comprise one or more male portions. As shown in FIG. 2A, spline receiver portion 240 can comprise front key groove 241, front key bend 242, back key groove 243, back key bend 244, receiver section 245, top receiver nub bend 246, top receiver nub 247, back spline receiver groove 248, and/or spline groove separator 249. In some embodiments, front key groove 241 can extend from nose bottom section 212 and/or nose bottom grooves 216.

In various embodiments, front key groove 241 can have a substantially arcuate, substantially planar, or substantially hyperbolic shape. In the same or different embodiments, front key groove 241 can be configured to receive a front key of a spline in order to aid in the coupling of baseboard element 200 and a spline. In some embodiments, front key bend 242 can extend between front key groove 241 and back key groove 243. In various embodiments, front key bend 242 can form an approximately right angle. In the same or different embodiments, front key bend 242 can form an acute angle or an obtuse angle. In some embodiments, back key groove 243 can have a substantially arcuate, substantially circular, substantially planar, substantially triangular, or substantially rectangular shape. In the same or different embodiments, back key groove 243 can be configured to receive a back key of a spline in order to aid in the coupling of baseboard element 200 and a spline. In various embodiments, back key bend 244 extends between back key groove 243 and receiver section 245. In various embodiments, back key bend 244 can form an approximately right angle. In the same or different embodiments, back key bend 244 can form an acute angle or an obtuse angle.

In some embodiments, receiver section 245 can be a spline coupling portion. In some embodiments, the spline coupling portion can comprise one or more recesses or female portions, as described below, and in other embodiments (not shown in FIGS. 2A and 2B), the spline coupling portion can comprise one or more male portions. As shown in FIG. 2A, receiver section 245 extends approximately parallel to nose front section 213 and approximately perpendicular to nose bottom section 212. In various embodiments, top receiver nub bend 246 extends between receiver section 245 and top receiver nub 247. In some embodiments, top receiver nub bend 246 can have a substantially arcuate or substantially planar shape. When top receiver nub bend 246 has an arcuate shape, coupling of baseboard element 200 to a spline can be easier.

In various embodiments, back spline receiver groove 248 can be a spline coupling portion. In some embodiments, the spline coupling portion can comprise one or more recesses or female portions, as described below, and in other embodiments (not shown in FIGS. 2A and 2B), the spline coupling portion can comprise one or more male portions. As shown in FIG. 2A, back spline receiver groove 248 can comprise a variety of shapes configured to receive a variety of spline nub shapes, such that inserting a spline nub into back spline receiver groove 248 couples baseboard element 200 to a spline. Incorporation of back spline receiver groove 248 into baseboard element 200 can save on production costs and weight due to reducing material used to manufacture baseboard element 200. In various embodiments, spline groove separator 247 extends between back spline receiver groove 248 and nose spline receiver groove 217.

Referring now to FIG. 2B, a side profile view of baseboard element 200 is shown. In some embodiments, top nose bend 214 can form top nose angle 218 between nose top section 211 and nose front section 213. In various embodiments, top nose angle 218 can be an approximately right angle. In the same or different embodiments, top nose angle 218 can be an acute angle or an obtuse angle. When top nose angle 218 is an approximately right angle, flooring material 202 can lay flush against nose front section 213, thus providing an approximately flat surface across nose top section 211 and flooring material 202. When top nose angle 218 is an obtuse angle, a channel can be formed with flooring material 202, which can be used as an aid for applying adhesive or sealant.

In further embodiments, nose bottom bend 215 can form bottom nose angle 219 between nose bottom section 212 and nose front section 213. In various embodiments, bottom nose angle 219 can be an approximately right angle. In the same or different embodiments, bottom nose angle 219 can be an acute angle or an obtuse angle. When bottom nose angle 219 is an approximately right angle, flooring material 202 can lay flush against nose front section 213, thus providing an approximately flat surface across nose top section 211 and flooring material 202. When bottom nose angle 219 is an acute angle, a channel can be formed with flooring material 202, which can be used as an aid for applying adhesive or sealant. In some embodiments, a height of nose front section 291 from nose top section 211 to nose bottom section 212 can be approximately 0.6266 inches (1.5916 centimeters), a height of baseboard element 293 from nose bottom section 212 to groove back edge 235 can be approximately 5.0 inches (12.7 centimeters), a thickness of groove back section 294 can be approximately 0.045 inches (0.1143 centimeters), a thickness of groove front section 295 can be approximately 0.045 inches (0.1143 centimeters), a width 297 of groove bend 232 from groove front section 231 to groove back section 233 can be approximately 0.130 inches (0.330 centimeters), and/or a height 296 from nose bottom section 212 to groove front edge 234 can be approximately 4.0 inches (10.16 centimeters). In different embodiments, each of these dimensions can be increased or decreased by up to one percent, five percent, ten percent, fifteen percent, twenty percent, or twenty-five percent. Height of nose front section 291 can be designed to match a height of flooring material 202. Width 297 of groove bend 232 can be designed to accommodate a width of a wall overlay material. Thickness of groove front section 295, a height of groove front section 231, and adjacent portions of baseboard element 200 can be designed to be strong enough to support the wall overlay material.

Figure 3A:
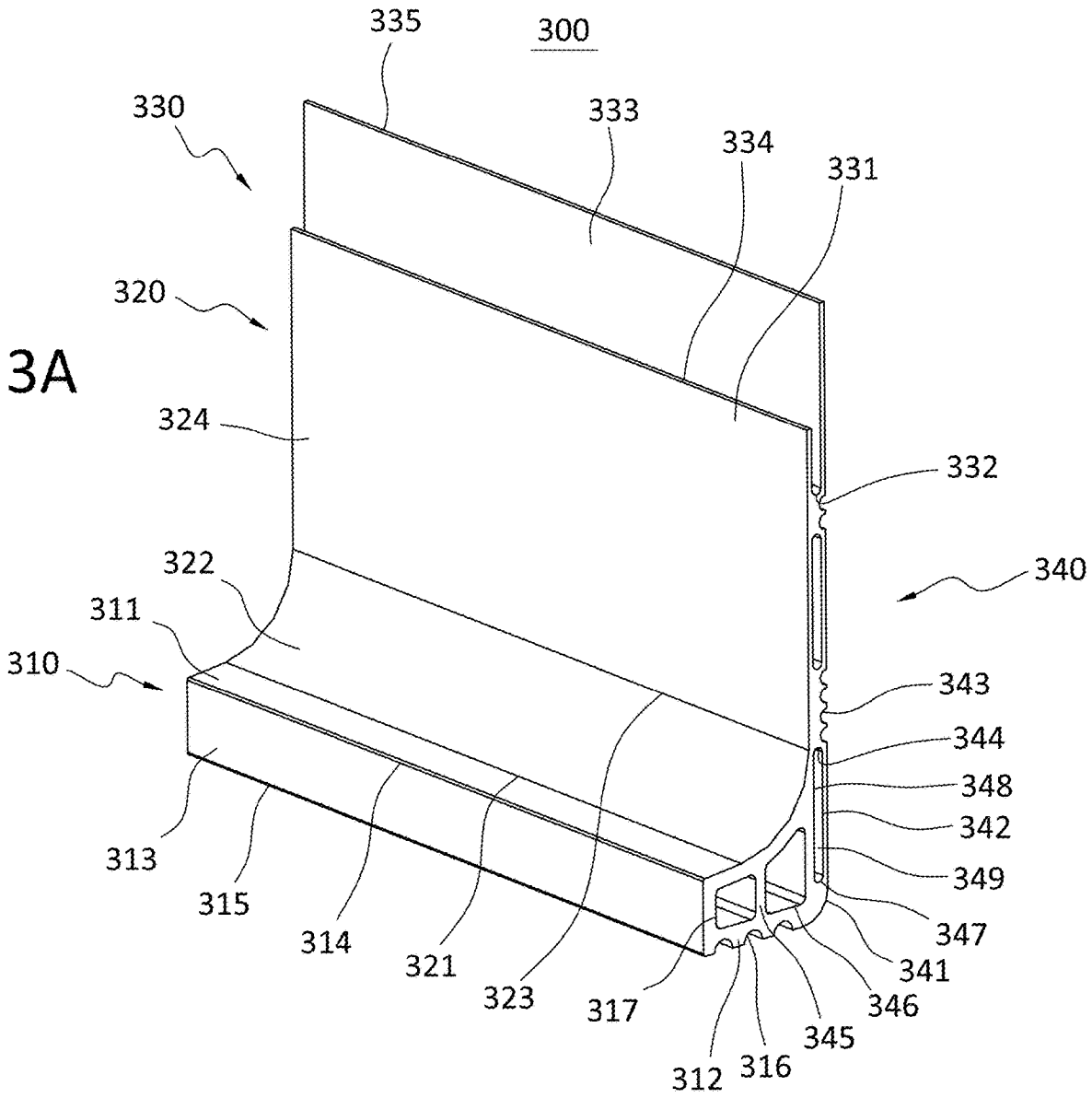

Turning to FIG. 3A, an exemplary embodiment of a baseboard element 300 is shown in an isometric view. In many embodiments, baseboard element 300 can comprise a single integrated piece. In many embodiments, baseboard element 300 and baseboard element 100, 200 (FIGS. 1A-2B) can be similar to each other. For example, baseboard element 300 can be longer than baseboard element 100, 200 (FIGS. 1A-2B), but otherwise can have the same general shape as baseboard element 100, 200 (FIGS. 1A-2B). In the same or different embodiments (not shown in FIG. 3A), baseboard element 300 and baseboard element 100, 200 (FIGS. 1A-2B) can be symmetrical with each other. In the same or different embodiments (also not shown in FIG. 3A), baseboard element 300 and baseboard element 100, 200 (FIGS. 1A-2B) can be identical with each other. In the same or different embodiments, baseboard element 300 can have the details shown in FIG. 3A and described in the subsequent paragraphs.

In some embodiments, baseboard element 300 can comprise a nose portion 310, a riser portion 320, a wall groove portion 330, and/or a spline receiver portion 340. In some embodiments, nose portion 310 can comprise a nose top section 311, a nose bottom section 312, and/or a nose front section 313. In the same or different embodiments, nose top section 311 can have a substantially planar shape. In further embodiments, nose top section 311 can extend approximately parallel to nose bottom section 312 and approximately perpendicular to nose front section 313.

Figure 3B:
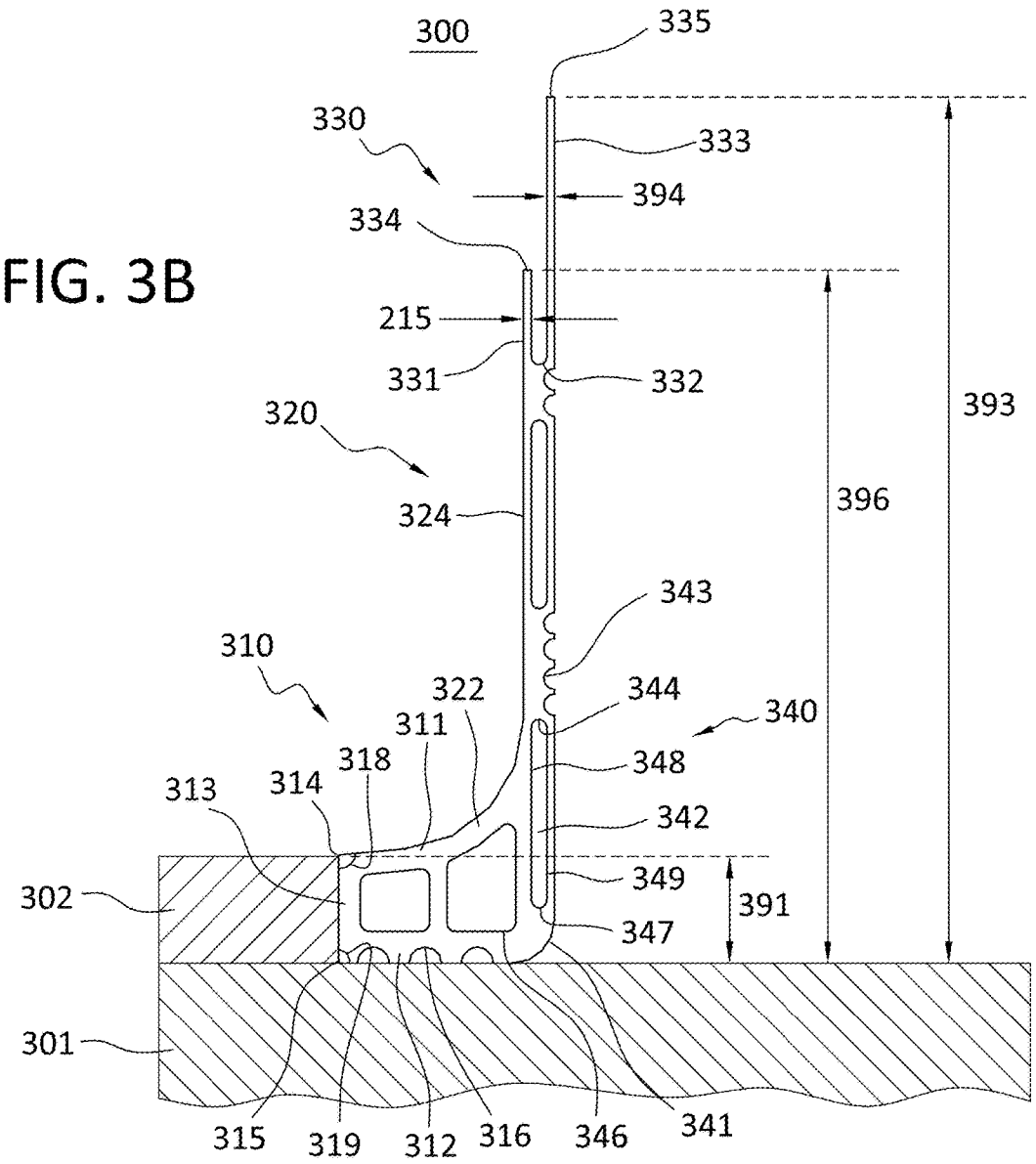

In some embodiments, nose front section 313 can have a substantially planar shape. In the same or different embodiments, nose front section 313 extends between nose top section 311 and nose bottom section 312. In the same or different embodiments, nose portion 310 can comprise top nose bend 314. In further embodiments, top nose bend 314 can extend between nose top section 311 and nose front section 313. In the same or different embodiments, nose portion 310 can comprise bottom nose bend 315. In further embodiments, bottom nose bend 315 can extend between nose bottom section 312 and nose front section 313. In the same or different embodiments, nose bottom section 312 can comprise one or more nose bottom grooves 316. In some embodiments, nose bottom grooves 316 can be configured to receive epoxy, glue, or sealant such that a baseboard element 300 is coupled to a ground surface 301 (FIG. 3B). In some embodiments, the coupling of baseboard element 300 to ground surface 301 (FIG. 3B) occurs in a way that is water tight and/or air tight.

In further embodiments, nose portion 310 further comprises a nose spline receiver groove 317. Nose spline receiver groove 317 can be a spline coupling portion. In some embodiments, the spline coupling portion can comprise one or more recesses or female portions, as described below, and in other embodiments (not shown in FIGS. 3A and 3B), the spline coupling portion can comprise one or more male portions. As shown in FIG. 3A, nose spline receiver groove 317 can comprise a variety of shapes configured to receive a variety of spline nub shapes, such that inserting a spline nub into nose spline receiver groove 317 couples baseboard element 300 to a spline. In various embodiments, nose spline receiver groove 317 can comprise a substantially rectangular shape, a substantially circular shape, a substantially triangular shape, and/or a substantially semi-circular shape. Incorporation of nose spline receiver groove 317 into baseboard element 300 can save on production costs and weight due to reducing material used to manufacture baseboard element 300.

In some embodiments, riser portion 320 can comprise riser bend bottom interface 321, riser bend 322, riser bend top interface 323, and/or riser section 324. In the same or different embodiments, riser bend bottom interface 321 can extend from nose top section 311. In further embodiments, riser bend 322 can extend from riser bend bottom interface 323. In the same or different embodiments, riser bend 322 can have a substantially arcuate shape, which allows for easy and thorough cleaning and/or disinfection because the lack of sharp corners and crevices prevents microorganisms from evading disinfectant. When riser bend 322 has a substantially arcuate shape, laminar airflow can also be enhanced because air streams do not encounter sharp corners. As an example, the substantially arcuate shape of riser bend 322 can be a concave shape or a convex shape. In some embodiments, riser bend top interface 323 can extend from riser bend 322. In the same or different embodiments, riser section 324 can extend from riser top interface 323. In various embodiments, riser section 324 has a substantially planar shape, can be parallel to nose front section 313, and/or be perpendicular to nose bottom section 312.

In the same or different embodiments, wall groove portion 330 can comprise a groove front section 331, a groove bend 332, a groove back section 333, a groove front edge 334, and/or a groove back edge 335. In some embodiments, groove front section 331 can extend from the riser section 324. As an example, groove front section 331 and riser section 324 can be coplanar with each other. In various embodiments, groove front section 331 has a substantially planar shape, can be parallel to nose front section 313, and/or be perpendicular to nose bottom section 312. In the same or different embodiments, groove front section 331 terminates at groove front edge 334. In various embodiments, groove front edge 334 can have a substantially planar shape or a substantially arcuate shape. In further embodiments, groove bend 332 can extend from groove front end 331. In various embodiments, groove bend 332 can have a substantially planar shape. In the same or different embodiments, groove bend 332 can form a 180 degree bend, such that groove back section 333 can be approximately parallel to groove front section 331. In various embodiments, groove back section 333 can extend from groove bend 332 and terminate at groove back edge 335. In further embodiments, groove back edge 335 can have a substantially planar shape or a substantially arcuate shape. Groove back section 333 can extend higher than groove front end 331 such that groove back edge 335 is higher than groove front edge 334.

In the same or different embodiments, spline receiver portion 340 can be a spline coupling portion. In some embodiments, the spline coupling portion can comprise one or more recesses or female portions, as described below, and in other embodiments (not shown in FIGS. 3A and 3B), the spline coupling portion can comprise one or more male portions. As shown in FIGS. 3A, spline receiver portion 340 can comprise spline receiver bend 341, spline receiver slots 342, and/or receiver back grooves 343.

In various embodiments, spline receiver bend 341 can extend from nose bottom section 312 and/or nose bottom grooves 316. In the same or different embodiments, spline receiver bend 341 can have a substantially arcuate or planar shape. In further embodiments, spline receiver bend 341 can form a right angle, acute angle, or obtuse angle.

In some embodiments, spline receiver slots 342 can be spline coupling portions. In some embodiments, the spline coupling portions can comprise one or more recesses or female portions, as described below, and in other embodiments (not shown in FIGS. 3A and 3B), the spline coupling portions can comprise one or more male portions. As shown in FIG. 3A, spline receiver slots 342 can be located proximate to spline receiver bend 341, proximate to groove bend 332, and/or proximate to riser section 324. In the same or different embodiments, each of spline receiver slots 342 can comprise a top bend 344, a bottom bend 347, a front side 348, and a back side 349. In some embodiments, top bend 344 can have a substantially planar shape or a substantially arcuate shape. In the same or different embodiments, bottom bend 347 can have a substantially planar shape or a substantially arcuate shape. In some embodiments, spline receiver slots 342 can be configured to receive spline plates such that a spline is coupled to baseboard element 300. In a different embodiment, the baseplate element can have only one split receiver slot.

In some embodiments, receiver back grooves 343 can be located proximate to spline receiver bend 341, proximate to groove bend 332, and/or proximate to riser section 324. In various embodiments, there can be a plurality of receiver back grooves 343. In various embodiments, receiver back grooves 343 can be configured to receive epoxy, glue, or sealant such that baseboard element 300 is coupled to a wall surface. In some embodiments, the coupling of baseboard element 300 to a wall surface occurs in a way that is water tight and/or air tight. In a different embodiment, the baseplate element can have only one receiver back groove.

In various embodiments, back spline receiver groove 346 can be a spline coupling portion. In some embodiments, the spline coupling portion can comprise one or more recesses or female portions, as described below, and in other embodiments (not shown in FIGS. 3A and 3B), the spline coupling portion can comprise one or more male portions. As shown in FIG. 3A, back spline receiver groove 346 can be proximate to spline receiver bend 341. In the same or different embodiments, back spline receiver groove 346 can comprise a variety of shapes configured to receive a variety of spline nub shapes such that inserting a spline nub into back spline receiver groove 346 couples baseboard element 300 to a spline. In various embodiments, spline groove separator 345 extends between back spline receiver groove 346 and nose spline receiver groove 317. Incorporation of back spline receiver groove 346 into baseboard element 300 can save on production costs and weight due to reducing material used to manufacture baseboard element 300.

Referring now to FIG. 3B, a side profile view of baseboard element 300 is shown. In some embodiments, top nose bend 314 can form top nose angle 318 between nose top section 311 and nose front section 313. In various embodiments, top nose angle 318 can be an approximately right angle. In the same or different embodiments, top nose angle 318 can be an acute angle or an obtuse angle. When top nose angle 318 is an approximately right angle, flooring material 302 can lay flush against nose front section 313, thus providing an approximately flat surface across nose top section 311 and flooring material 302. When top nose angle 318 is an obtuse angle, a channel can be formed with flooring material 302, which can be used as an aid for applying adhesive or sealant.

In further embodiments, nose bottom bend 315 can form bottom nose angle 319 between nose bottom section 312 and nose front section 313. In various embodiments, bottom nose angle 319 can be an approximately right angle. In the same or different embodiments, bottom nose angle 319 can be an acute angle or an obtuse angle. When bottom nose angle 319 is an approximately right angle, flooring material 302 can lay flush against nose front section 313, thus providing an approximately flat surface across nose top section 311 and flooring material 302. When bottom nose angle 319 is an acute angle, a channel can be formed with flooring material 302, which can be used as an aid for applying adhesive or sealant. In some embodiments, a height of nose front section 391 from nose top section 311 to nose bottom section 312 can be approximately 0.6266 inches (1.5916 centimeters), a length of nose bottom section 392 from nose front section 313 to spline receiver bend 341 can be approximately 1.25 inches (3.175 centimeters), a height of baseboard element 393 from nose bottom section 312 to groove back edge 335 can be approximately 5.0 inches (12.7 centimeters), a thickness of groove back section 394 can be approximately 0.045 inches (0.1143 centimeters), a thickness of groove front section 395 can be approximately 0.045 inches (0.1143 centimeters), a width 397 of groove bend 332 from groove front section 331 to groove back section 333 can be approximately 0.130 inches (0.330 centimeters), and/or a height 396 from nose bottom section 312 to groove front edge 334 can be approximately 4.0 inches (10.16 centimeters). In different embodiments, each of these dimensions can be increased or decreased by up to one percent, five percent, ten percent, fifteen percent, twenty percent, or twenty-five percent. Height of nose front section 391 can be designed to match a height of flooring material 302. Width 397 of groove bend 332 can be designed to accommodate a width of a wall overlay material. Thickness of groove front section 395, a height of groove front section 331, and adjacent portions of baseboard element 300 can be designed to be strong enough to support the wall overlay material.

Figure 4A:
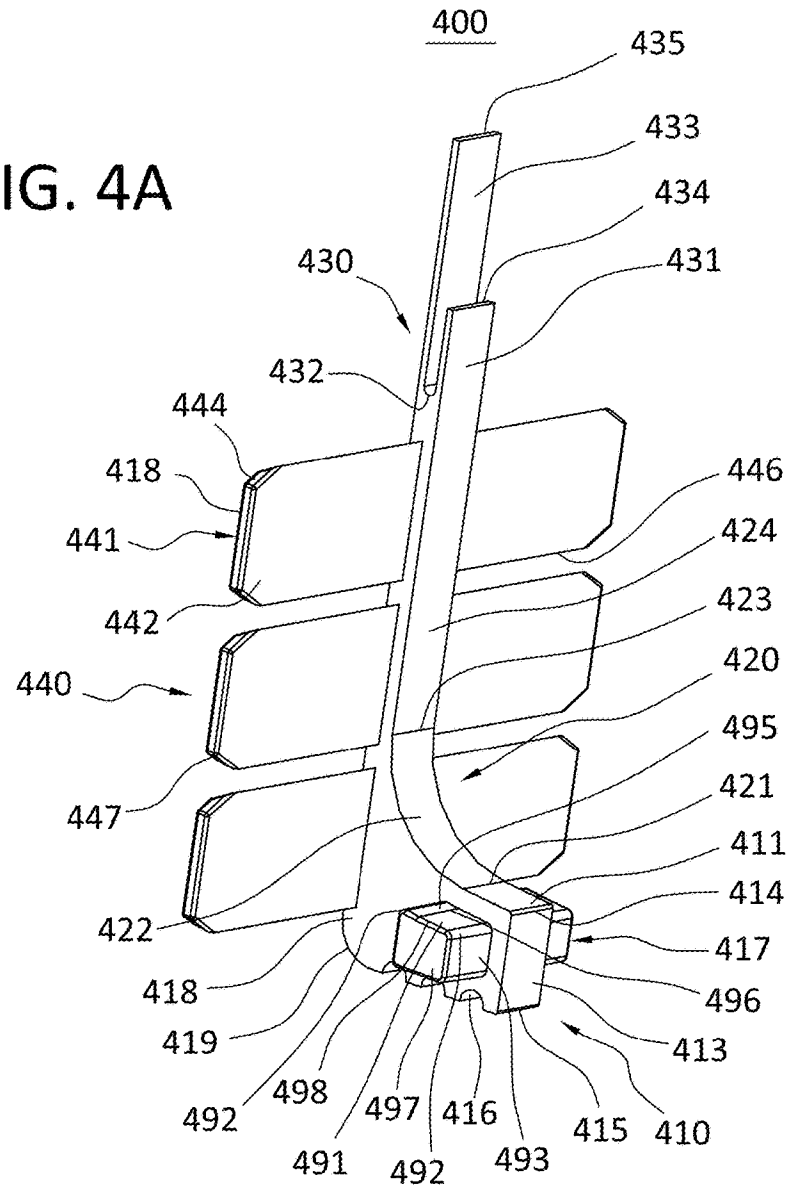
FIGS. 4A-15B representatively illustrate exemplary embodiments of baseboard splines.

Turning now to FIG. 4A, an exemplary embodiment of a spline 400 in a front isometric view is shown. In many embodiments, spline 400 can comprise a single, integrated piece. As an example, in embodiments where spline receiver portion 140 (FIGS. 1A and 1B) comprises one or more recesses or female portions, spline 400 can comprise one or more complementary male portions to couple with the one or more recesses or female portions. In other embodiments (not shown in FIGS. 4A-4C), when the spline receiver portion or spline coupling portion of the baseboard element comprises one or more male portions, the spline can comprise one or more complementary female portions to couple with the one or more male portions.

As shown in FIG. 4A, spline 400 can comprise a nose portion 410, a riser portion 420, a wall groove portion 430, and/or a spline portion 440. In some embodiments, nose portion 410 can further comprise a nose top section 411, a nose bottom section 412, and/or a nose front section 413. In the same or different embodiments, nose top section 411 can have a substantially planar shape. In the same or different embodiments, nose top section 411 can extend approximately parallel to nose bottom section 412 and approximately perpendicular to nose front section 413.

Figure 4B:
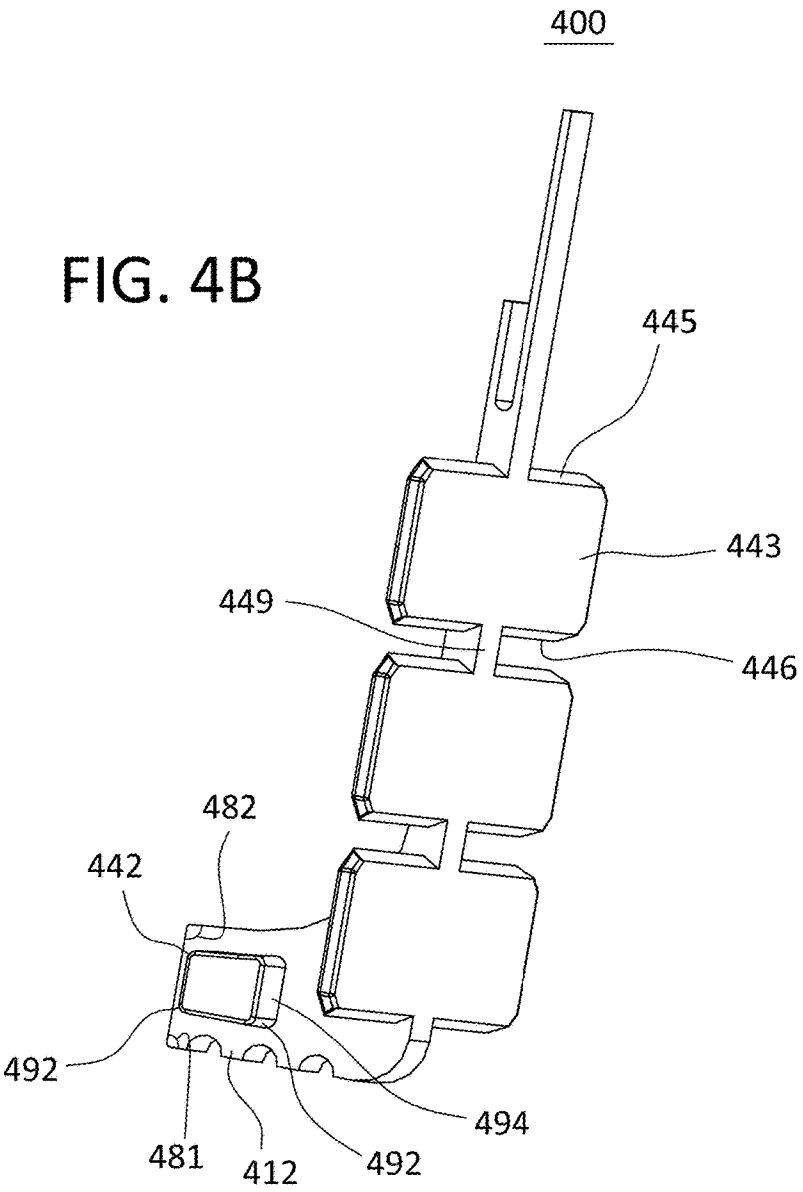
Figure 4C:
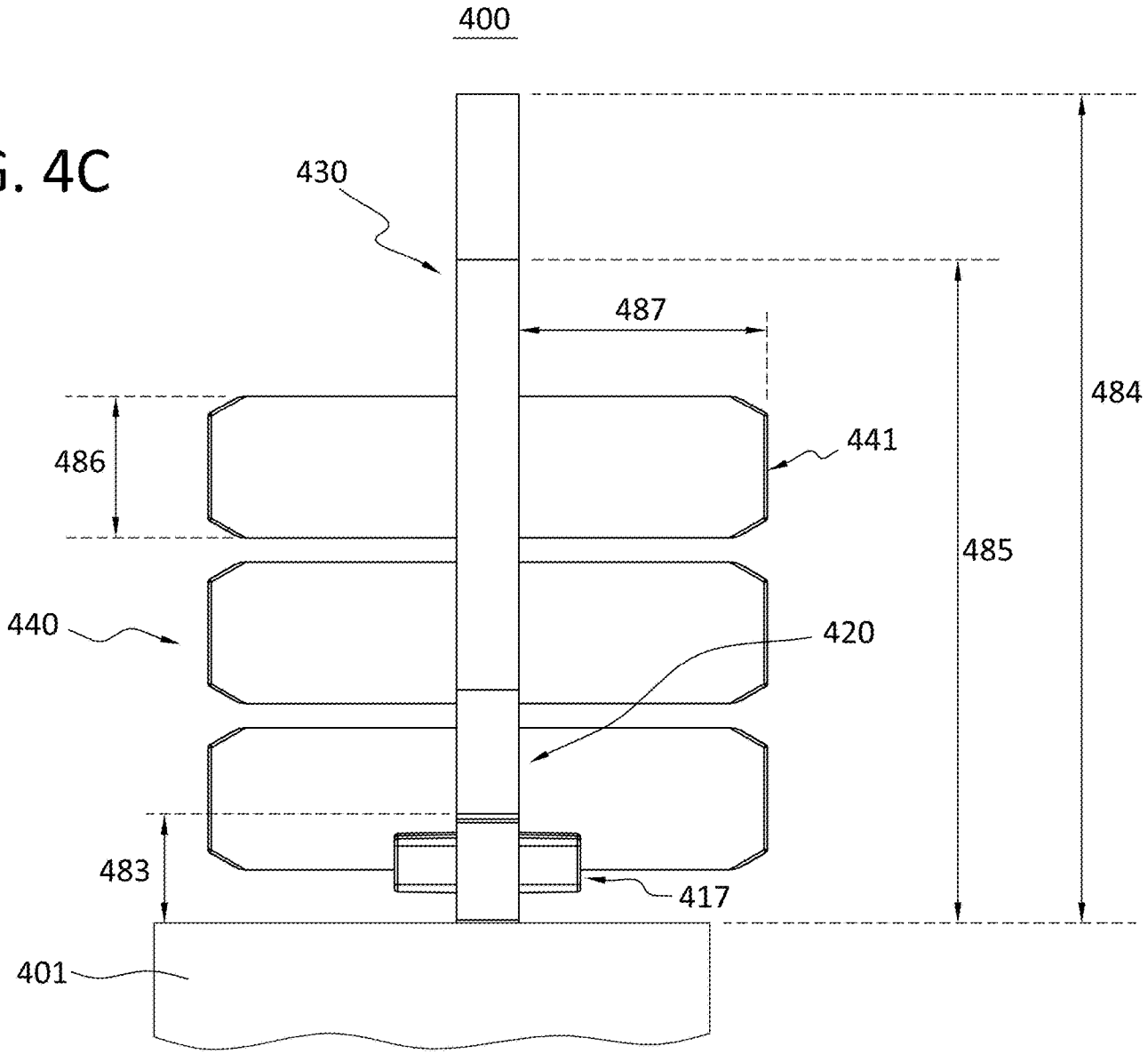

In some embodiments, nose front section 413 can have a substantially planar shape. In the same or different embodiments, nose front section 413 extends between nose top section 411 and nose bottom section 412. In the same or different embodiments, nose portion 410 can comprise top nose bend 414. In further embodiments, top nose bend 414 can extend between nose top section 411 and nose front section 413. In the same or different embodiments, nose portion 410 can comprise bottom nose bend 415. In further embodiments, bottom nose bend 415 can extend between nose bottom section 412 and nose front section 413. In the same or different embodiments, nose bottom section 412 can comprise one or more nose bottom grooves 416. In some embodiments, nose bottom grooves 416 can be configured to receive epoxy, glue, or sealant such that spline 400 is coupled to a ground surface 401 (FIG. 4C). In some embodiments, the coupling of spline 400 to a ground surface 401 (FIG. 4C) occurs in a way that is water tight and/or air tight. In further embodiments, nose portion 410 further comprises a spline nub 417 extending from a lateral side 418. As shown in FIG. 4A, nose portion 410 can include two spline nubs at opposite lateral sides of nose portion 410. In some embodiments, spline nub 417 can comprise a variety of shapes configured to be inserted into a variety of nose spline receiver grooves 117, 217, 317 (FIGS. 1A-3B) such that inserting or otherwise locating spline nub 417 in nose spline receiver grooves 117, 217, 317 (FIGS. 1A-3B) couples baseboard elements 100, 200, 300 (FIGS. 1A-3B) to spline 400. In various embodiments, spline nub 417 can comprise a substantially rectangular shape, a substantially circular shape, a substantially triangular shape, and/or a substantially semi-circular shape. In some embodiments, spline nub 417 can be proximate to back bend 418 such that it can be inserted into back spline receiver groove 148, 248, 346 (FIGS. 1A-3B). In the same or different embodiments, spline nub 417 can comprise a top spline nub surface 491, a plurality of spline nub bends 492, a front spline nub surface 493, a bottom spline nub surface (not shown), a back spline nub surface 494 (FIG. 4B), a spline nub riser section 495, a spline nub riser interface 496, a spline nub lateral surface 497, and/or a spline nub edge 498. In some embodiments, spline nub edge 498 can circumscribe spline nub lateral surface 497 and/or have a substantially arcuate or planar shape. When spline nub edge 498 has a substantially arcuate shape, it is easier to insert spline nub 417 into nose spline receiver grooves 117, 217, 317 (FIGS. 1A-3B). In the same or different embodiments, plurality of spline nub bends 492 can have a substantially arcuate or planar shape. When plurality of spline nub bends 492 has a substantially arcuate shape, it is easier to insert spline nub 417 into nose spline receiver grooves 117, 217, 317 (FIGS. 1A-3B). In some embodiments, spline nub riser section 495 extends between spline nub bend 492 and spline nub riser interface 496. In this way, spline nub riser section 495 prevents rotation of spline 400 when spline nub 417 is worn down from repeated insertions.

In some embodiments, riser portion 420 can comprise riser bend bottom interface 421, riser bend 422, riser bend top interface 423, and/or riser section 424. In the same or different embodiments, riser bend bottom interface 421 can extend from nose top section 411. In further embodiments, riser bend 422 can extend from riser bend bottom interface 423. In the same or different embodiments, riser bend 422 can have a substantially arcuate shape, which allows for easy and thorough cleaning and/or disinfection because the lack of sharp corners and crevices prevents microorganisms from evading disinfectant. When riser bend 422 has a substantially arcuate shape, laminar airflow can also be enhanced because air streams do not encounter sharp corners. As an example, the substantially arcuate shape of riser bend 422 can be a concave shape or a convex shape. In some embodiments, riser bend top interface 423 can extend from riser bend 422. In the same or different embodiments, riser section 424 can extend from riser top interface 423. In various embodiments, riser section 424 has a substantially planar shape, can be parallel to nose front section 413, and/or be perpendicular to nose bottom section 412.

In the same or different embodiments, wall groove portion 430 can comprise a groove front section 431, a groove bend 432, a groove back section 433, a groove front edge 434, and/or a groove back edge 435. In some embodiments, groove front section 431 can extend from the riser section 424. As an example, groove front section 431 and riser section 424 can be coplanar with each other. In various embodiments, groove front section 431 has a substantially planar shape, can be parallel to nose front section 413, and/or be perpendicular to nose bottom section 412. In the same or different embodiments, groove front section 431 terminates at groove front edge 434. In various embodiments, groove front edge 434 can have a substantially planar shape or a substantially arcuate shape. In further embodiments, groove bend 432 can extend from groove front end 431. In various embodiments, groove bend 432 can have a substantially planar or substantially arcuate shape. In the same or different embodiments, groove bend 432 can form a 180 degree bend, such that groove back section 433 can be approximately parallel to groove front section 431. In various embodiments, groove back section 433 can extend from groove bend 432 and terminate at groove back edge 435. In further embodiments, groove back edge 435 can have a substantially planar shape or a substantially arcuate shape.

In some embodiments, spline portion 440 can comprise a spline plate 441 extending out of lateral side 418. In various embodiments, there can be a plurality of spline plates extending from opposite lateral sides of spline 400, as shown in FIGS. 4A-4C. In the same or different embodiments, spline plate 441 can comprise a front spline plate surface 442 and/or a back spline plate surface 443 (FIG. 4B). In further embodiments, spline plate 441 can comprise a lateral spline edge 448, top corner spline edge 444, a top spline edge 445 (FIG. 4B), a bottom spline edge 446 (FIG. 4B), and a bottom corner spline edge 447. In various embodiments, lateral spline edge 448, top corner spline edge 444, top spline edge 445 (FIG. 4B), bottom spline edge 446 (FIG. 4B), and/or bottom corner spline edge 447 can have a substantially planar shape or a substantially arcuate shape. When lateral spline edge 448, top corner spline edge 444, top spline edge 445 (FIG. 4B), bottom spline edge 446 (FIG. 4B), and/or bottom corner spline edge 447 have a substantially arcuate shape, it is easier to insert spline plate 441 into receiver section 145 (FIGS. 1A & 1B) as buffeted by one or more of top receiver nub 149, middle receiver nubs 143, or bottom receiver nub 142.

Turning now to FIG. 4B, spline 400 is shown in a back isometric view. In various embodiments, back spline plate surface 443 can span across and be contiguous and co-planar with back spline surface 449. In some embodiments, top nose bend 414 can form top nose angle 482 between nose top section 411 and nose front section 413. In various embodiments, top nose angle 482 can be an approximately right angle. In the same or different embodiments, top nose angle 482 can be an acute angle or an obtuse angle. When top nose angle 482 is an approximately right angle, flooring material (not shown) can lay flush against nose front section 413, thus providing an approximately flat surface across nose top section 411 and flooring material (not shown). When top nose angle 482 is an acute angle, material costs are saved because nose bottom section 412 is smaller. When top nose angle 482 is an obtuse angle, a channel can be formed with flooring material (not shown), which can be used as an aid for applying adhesive or sealant. In some embodiments, nose bottom bend 415 can form bottom nose angle 481 between nose bottom section 412 and nose front section 413. In various embodiments, bottom nose angle 481 can be an approximately right angle. In the same or different embodiments, bottom nose angle 481 can be an acute angle or an obtuse angle. When bottom nose angle 481 is an approximately right angle, flooring material (not shown) can lay flush against nose front section 413, thus providing an approximately flat surface across nose top section 411 and flooring material (not shown). When bottom nose angle 481 is an acute angle, a channel can be formed with flooring material (not shown), which can be used as an aid for applying adhesive or sealant.

Turning now to FIG. 4C, a front view of spline 400 is shown. In some embodiments, a height of nose front section 483 from nose top section 411 to nose bottom section 412 can be approximately 0.6266 inches (1.5916 centimeters), a length of nose bottom section (not shown) from nose front section 413 to back nose bend 419 can be approximately 1.25 inches (3.175 centimeters), a height of spline 484 from nose bottom section 412 to groove back edge 435 can be approximately 5.0 inches (12.7 centimeters), a thickness (not shown in FIG. 4C) of groove back section 433 (FIG. 4A) can be approximately 0.045 inches (0.1143 centimeters), a thickness (not shown in FIG. 4C) of groove front section 431 can be approximately 0.045 inches (0.1143 centimeters), a height 485 from nose bottom section 412 to groove front edge 434 can be approximately 4.0 inches (10.16 centimeters), a width (not shown in FIG. 4C) of groove bend 132 (FIG. 4A) from groove front section 131 (FIG. 4A) to groove back section 133 (FIG. 4A) can be approximately 0.130 inches (0.330 centimeters), a height of spline plate 486 from top spline edge 445 (FIG. 4B) to bottom spline edge 446 (FIG. 4B) can be approximately 0.8539 inches (2.1689 centimeters), and/or a length of spline plate 487 from lateral side 418 (FIG. 4A) to lateral spline edge 448 (FIG. 4A) can be approximately 1.5 inches (3.81 centimeters).

Figure 5A:
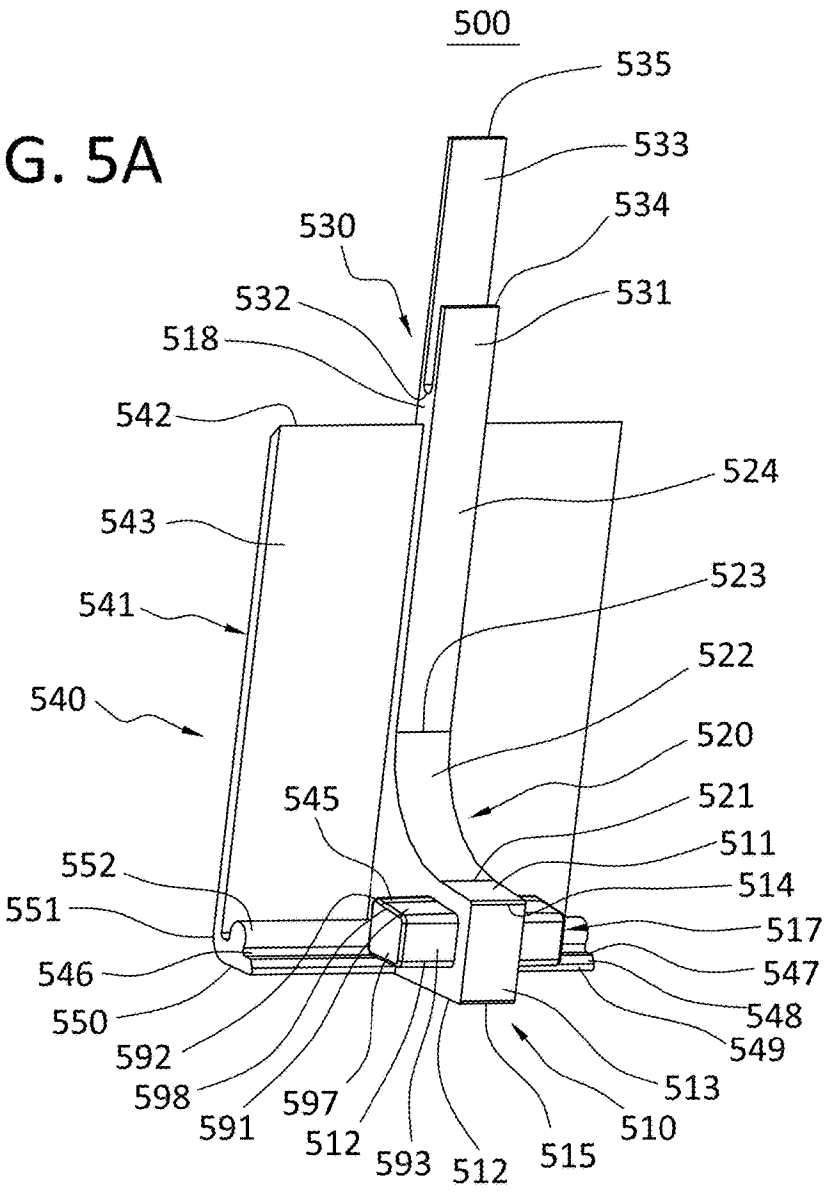

Turning now to FIG. 5A, an exemplary embodiment of a spline 500 in a front isometric view is shown. In many embodiments, spline 500 can comprise a single, integrated piece. As an example, in embodiments where spline receiver portion 240 (FIGS. 2A and 2B) comprises one or more recesses or female portions, spline 500 can comprise one or more complementary male portions to couple with the one or more recesses or female portions. In other embodiments (not shown in FIGS. 5A-5C), the spline receiver portion or spline coupling portion of the baseboard element comprises one or more male portions, the spline can comprise one or more complementary female portions to couple with the one or more male portions.

As shown in FIG. 5A, in some embodiments, spline 500 can comprise a nose portion 510, a riser portion 520, a wall groove portion 530, and/or a spline portion 540. In some embodiments, nose portion 510 can further comprise a nose top section 511, a nose bottom section 512, and/or a nose front section 513. In the same or different embodiments, nose top section 511 can have a substantially planar shape. In the same or different embodiments, nose top section 511 can extend approximately parallel to nose bottom section 512 and approximately perpendicular to nose front section 513.

Figure 5B:
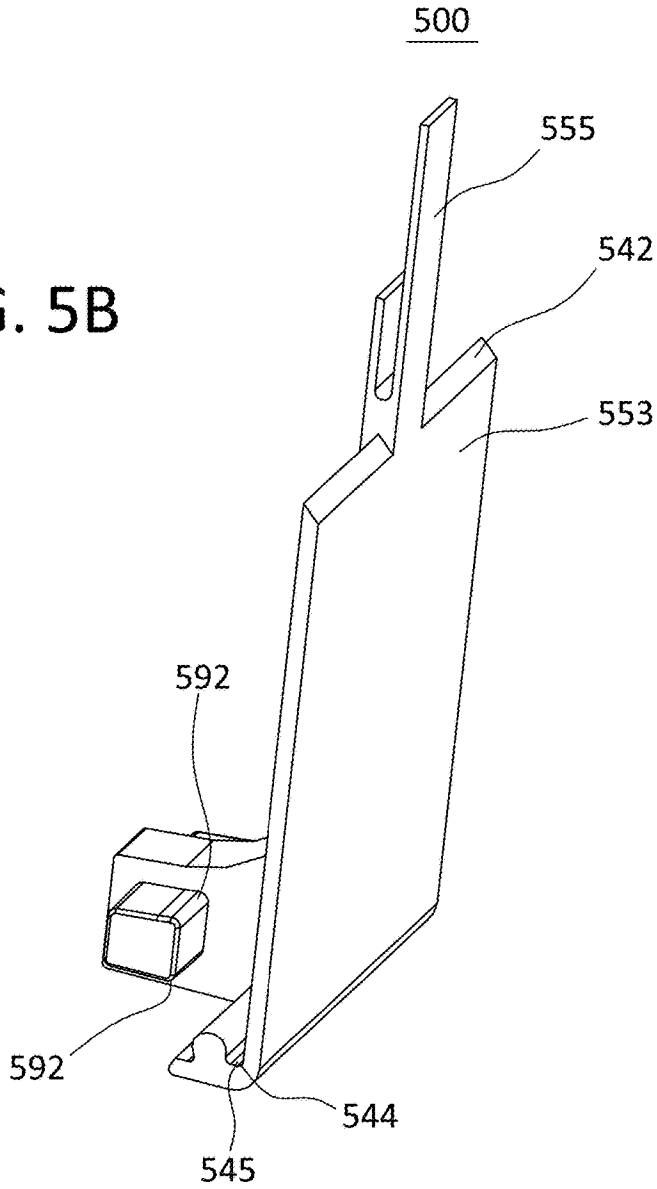
Figure 5C:
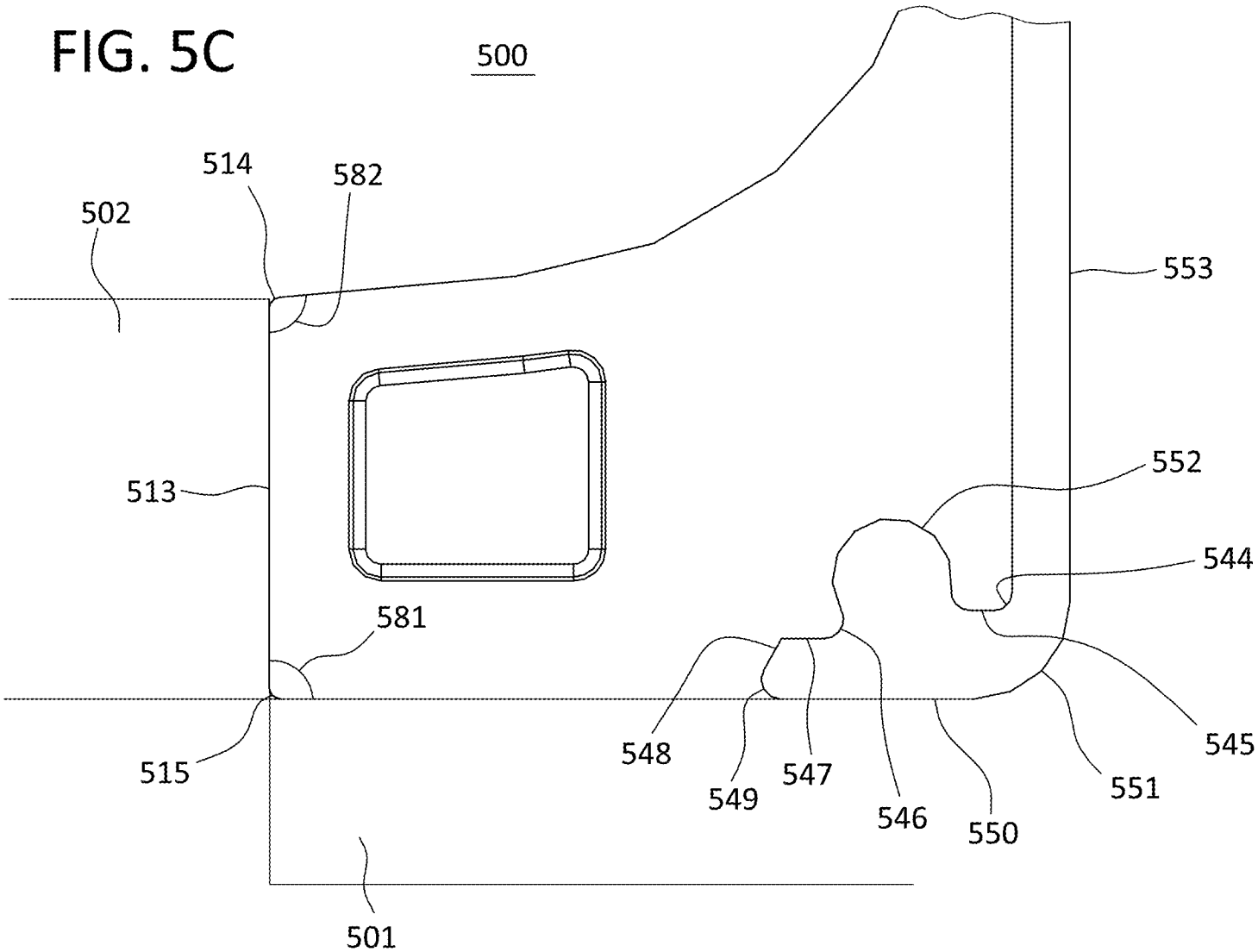

In some embodiments, nose front section 513 can have a substantially planar shape. In the same or different embodiments, nose front section 513 extends between nose top section 511 and nose bottom section 512. In the same or different embodiments, nose portion 510 can comprise top nose bend 514. In further embodiments, top nose bend 514 can extend between nose top section 511 and nose front section 513. In the same or different embodiments, nose portion 510 can comprise bottom nose bend 515. In further embodiments, bottom nose bend 515 can extend between nose bottom section 512 and nose front section 513. In the same or different embodiments, nose bottom section 512 can comprise one or more nose bottom grooves 516. In some embodiments, nose bottom grooves 516 can be configured to receive epoxy, glue, or sealant such that spline 500 is coupled to a ground surface 501 (FIG. 5C). In some embodiments, the coupling of spline 500 to a ground surface 501 (FIG. 5C) occurs in a way that is water tight and/or air tight. As shown in FIG. 5A, nose portion 510 can include two spline nubs at opposite lateral sides of nose portion 510. In some embodiments, spline nub 517 extends from a lateral side 518. In some embodiments, spline nub 517 can comprise a variety of shapes configured to be inserted into a variety of nose spline receiver grooves 117, 217, 317 (FIGS. 1A-3B) such that inserting or otherwise locating spline nub 517 into nose spline receiver grooves 117, 217, 317 (FIGS. 1A-3B) couples baseboard elements 100, 200, 300 (FIGS. 1A-3B) to spline 500. In various embodiments, spline nub 517 can comprise a substantially rectangular shape, a substantially circular shape, a substantially triangular shape, and/or a substantially semi-circular shape. In some embodiments, spline nub 517 can be proximate to back bend 551 such that it can be inserted into back spline receiver groove 148, 248, 346. In the same or different embodiments, spline nub 517 can comprise a top spline nub surface 591, a plurality of spline nub bends 592, a front spline nub surface 593, a bottom spline nub surface (not shown), a back spline nub surface 594 (FIG. 5B), a spline nub riser section 595, a spline nub riser interface 596, a spline nub lateral surface 597, and/or a spline nub edge 598. In some embodiments, spline nub edge 598 can circumscribe spline nub lateral surface 597 and/or have a substantially arcuate or planar shape. When spline nub edge 598 has a substantially arcuate shape, it is easier to insert spline nub 517 into nose spline receiver grooves 117, 217, 317 (FIGS. 1A-3B). In the same or different embodiments, plurality of spline nub bends 592 can have a substantially arcuate or planar shape. When plurality of spline nub bends 592 has a substantially arcuate shape, it is easier to insert spline nub 517 into nose spline receiver grooves 117, 217, 317 (FIGS. 1A-3B). In some embodiments, spline nub riser section 595 extends between spline nub bend 592 and spline nub riser interface 596. In this way, spline nub riser prevents rotation of spline 500 when spline nub 517 is worn down from repeated insertions.

In some embodiments, riser portion 520 can comprise riser bend bottom interface 521, riser bend 522, riser bend top interface 523, and/or riser section 524. In the same or different embodiments, riser bend bottom interface 521 can extend from nose top section 511. In further embodiments, riser bend 522 can extend from riser bend bottom interface 523. In the same or different embodiments, riser bend 522 can have a substantially arcuate shape, which allows for easy and thorough cleaning and/or disinfection because the lack of sharp corners and crevices prevents microorganisms from evading disinfectant. When riser bend 522 has a substantially arcuate shape, laminar airflow can also be enhanced because air streams do not encounter sharp corners. As an example, the substantially arcuate shape of riser bend 522 can be a concave shape or a convex shape. In some embodiments, riser bend top interface 523 can extend from riser bend 522. In the same or different embodiments, riser section 524 can extend from riser top interface 523. In various embodiments, riser section 524 has a substantially planar shape, can be parallel to nose top section 511, and/or be perpendicular to nose bottom section 512.

In the same or different embodiments, wall groove portion 530 can comprise a groove front section 531, a groove bend 532, a groove back section 533, a groove front edge 534, and/or a groove back edge 535. In some embodiments, groove front section 531 can extend from the riser section 524. As an example, groove front section 531 and riser section 524 can be coplanar with each other. In various embodiments, groove front section 531 has a substantially planar shape, can be parallel to nose front section 513, and/or be perpendicular to nose bottom section 512. In the same or different embodiments, groove front section 531 terminates at groove front edge 534. In various embodiments, groove front edge 534 can have a substantially planar shape or a substantially arcuate shape. In further embodiments, groove bend 532 can extend from groove front end 531. In various embodiments, groove bend 532 can have a substantially planar or substantially arcuate shape. In the same or different embodiments, groove bend 532 can form a 180 degree bend, such that groove back section 533 can be approximately parallel to groove front section 531. In various embodiments, groove back section 533 can extend from groove bend 532 and terminate at groove back edge 535. In further embodiments, groove back edge 535 can have a substantially planar shape or a substantially arcuate shape.

In some embodiments, spline portion 540 can comprise a spline wing 541 extending from lateral side 518. In various embodiments, there can be a single spline plate extending from each of the lateral sides of spline 500, as shown in FIGS. 5A-5C. In some embodiments, spline wing 541 can comprise a top edge 542. In various embodiments, top edge 542 can have a can have a substantially arcuate or planar shape. When top edge 542 has a substantially arcuate shape, it is easier to couple spline 500 with a baseboard element. In the same or different embodiments, front surface 543 can extend from top edge 542. In further embodiments, front bend 544 can extend from front surface 543. In various embodiments, front bend 544 can form an approximately right angle. In the same or different embodiments, front bend 544 can form an acute angle or an obtuse angle. In embodiments where front bend 544 forms a right angle, spline wing bottom surface 550 can lay flush against ground surface 501 (FIG. 5C) while back surface 553 (FIG. 5B) lays flush against a wall surface (not shown). In some embodiments, bend interface 545 (FIG. 5B) can extend between front bend 544 and back key 552. Thereby, the shape created by bend interface 544, front bend 545 (FIG. 5B), and back key 552 prevents a baseboard element from moving away from a wall surface (not shown), the spline 500, and/or a ground surface 501 (FIG. 5C). In various embodiments, back key 552 can comprise a substantially rectangular shape, a substantially circular shape, a substantially triangular shape, and/or a substantially semi-circular shape. In some embodiments, middle key bend 546 extends between back key 552 and front key 547. In various embodiments, front key 547 extends between key riser section 548 and key bend 546. In further embodiments, front key bend 549 extends between key riser section 548 and spline wing bottom surface 550. In further embodiments, back key bend 551 extends between spline wing bottom surface 550 and back surface 553 (FIG. 5B). In some embodiments, spline wing bottom surface 550 can comprise grooves (not shown), which can be configured to receive epoxy, glue, or sealant such that spline 500 is coupled to a ground surface 501 (FIG. 5C)

Turning now to FIG. 5C, a portion of spline 500 is shown in profile view. In various embodiments, back spline plate surface 553 can span across and be contiguous and co-planar with back spline surface 555 (FIG. 5B). In some embodiments, top nose bend 514 can form top nose angle 582 between nose top section 511 and nose front section 513. In various embodiments, top nose angle 582 can be an approximately right angle. In the same or different embodiments, top nose angle 582 can be an acute angle or an obtuse angle. When top nose angle 582 is an approximately right angle, flooring material 502 can lay flush against nose front section 513, thus providing an approximately flat surface across nose top section 511 and flooring material 502. When top nose angle 582 is an obtuse angle, a channel can be formed with flooring material 502, which can be used as an aid for applying adhesive or sealant. In some embodiments, nose bottom bend 515 can form bottom nose angle 581 between nose bottom section 512 and nose front section 513. In various embodiments, bottom nose angle 581 can be an approximately right angle. In the same or different embodiments, bottom nose angle 581 can be an acute angle or an obtuse angle. When bottom nose angle 581 is an approximately right angle, flooring material 502 can lay flush against nose front section 513, thus providing an approximately flat surface across nose top section 511 and flooring material 502. When bottom nose angle 581 is an acute angle, a channel can be formed with flooring material 502, which can be used as an aid for applying adhesive or sealant.

Figure 6A:
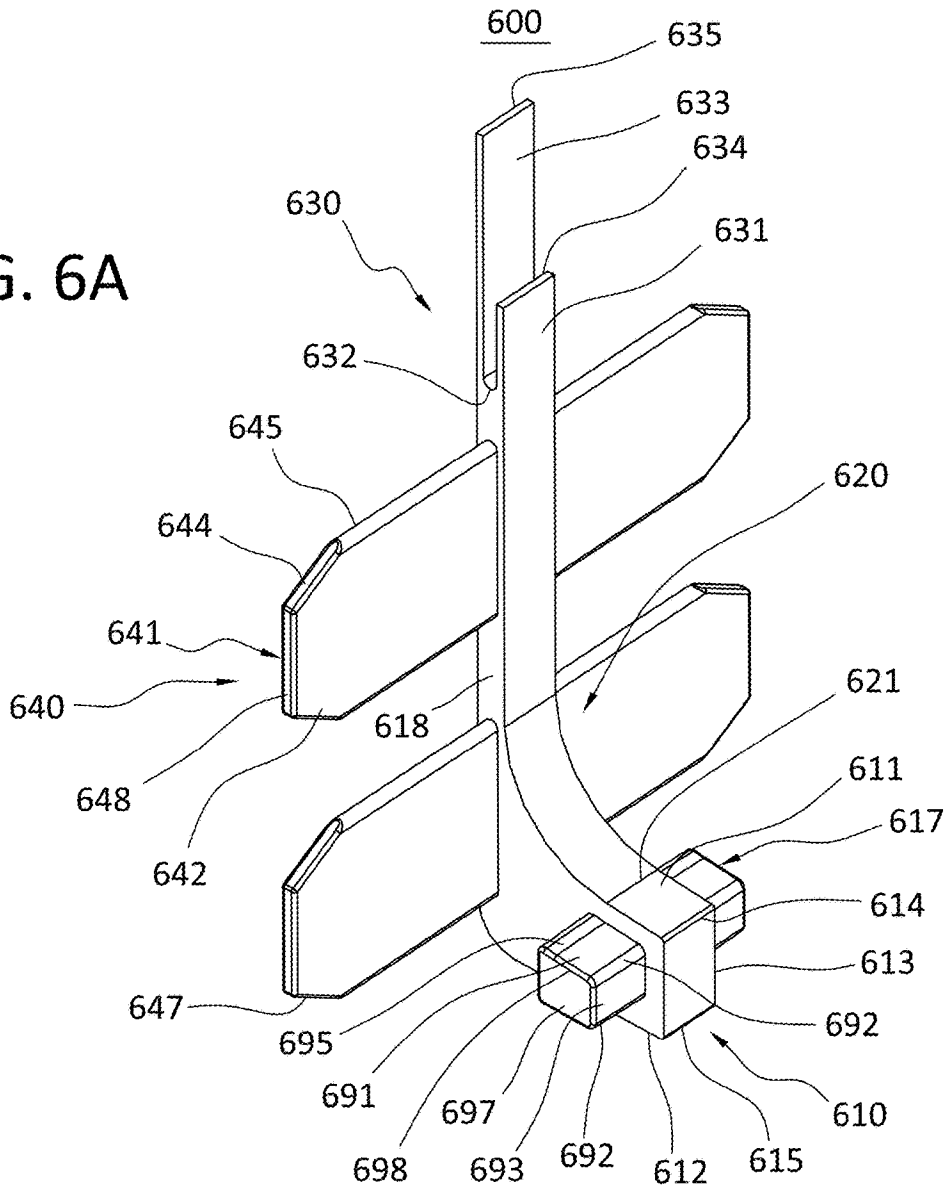

Turning now to FIG. 6A, an exemplary embodiment of a spline 600 in a front isometric view is shown. In many embodiments, spline 600 can comprise a single, integrated piece. As an example, in embodiments where spline receiver portion 340 (FIGS. 3A and 3B) comprises one or more recesses or female portions, spline 600 can comprise one or more complementary male portions to couple with the one or more recesses or female portions. In other embodiments (not shown in FIGS. 6A and 6B), the spline receiver portion or spline coupling portion of the baseboard element comprises one or more male portions, the spline can comprise one or more complementary female portions to couple with the one or more male portions.

In some embodiments, spline 600 can comprise a nose portion 610, a riser portion 620, a wall groove portion 630, and/or a spline portion 640. In some embodiments, nose portion 610 can further comprise a nose top section 611, a nose bottom section 612, and/or a nose front section 613. In the same or different embodiments, nose top section 611 can have a substantially planar shape. In the same or different embodiments, nose top section 611 can extend approximately parallel to nose bottom section 612 and approximately perpendicular to nose front section 613.

In some embodiments, nose front section 613 can have a substantially planar shape. In the same or different embodiments, nose front section 613 extends between nose top section 611 and nose bottom section 612. In the same or different embodiments, nose portion 610 can comprise top nose bend 614. In further embodiments, top nose bend 614 can extend between nose top section 611 and nose front section 613. In the same or different embodiments, nose portion 610 can comprise bottom nose bend 615. In further embodiments, bottom nose bend 615 can extend between nose bottom section 612 and nose front section 613. In the same or different embodiments, nose bottom section 612 can comprise nose bottom groove (not shown). In some embodiments, nose bottom groove (not shown) can be configured to receive epoxy, glue, or sealant such that spline 600 is coupled to a ground surface (see, e.g., ground surface 501 (FIG. 5C)). In some embodiments, the coupling of spline 600 to a ground surface (see, e.g., ground surface 501 (FIG. 5C)) occurs in a way that is water tight and/or air tight. In further embodiments, nose portion 610 further comprises a spline nub 617 extending from a lateral side 618. As shown in FIG. 6A, nose portion 610 can include two spline nubs at opposite lateral sides of nose portion 610. In some embodiments, spline nub 617 can comprise a variety of shapes configured to be inserted into a variety of nose spline receiver grooves 117, 217, 317 (FIGS. 1A-3B) such that inserting or otherwise locating spline nub 617 into nose spline receiver grooves 117, 217, 317 (FIGS. 1A-3B) couples baseboard elements 100, 200, 300 (FIGS. 1A-3B) to spline 600. In various embodiments, spline nub 617 can comprise a substantially rectangular shape, a substantially circular shape, a substantially triangular shape, and/or a substantially semi-circular shape. In some embodiments, spline nub 617 can be proximate to back bend 619 such that it can be inserted into back spline receiver groove 148, 248, 346. In the same or different embodiments, spline nub 617 can comprise a top spline nub surface 691, a plurality of spline nub bends 692, a front spline nub surface 693, a bottom spline nub surface (not shown), a back spline nub surface 694 (FIG. 6B), a spline nub riser section 695, a spline nub riser interface 696, a spline nub lateral surface 697, and/or a spline nub edge 698. In some embodiments, spline nub edge 698 can circumscribe spline nub lateral surface 697 and/or have a substantially arcuate or planar shape. When spline nub edge 698 has a substantially arcuate shape, it is easier to insert spline nub 617 into nose spline receiver grooves 117, 217, 317 (FIGS. 1A-3B). In the same or different embodiments, plurality of spline nub bends 692 can have a substantially arcuate or planar shape. When plurality of spline nub bends 592 has a substantially arcuate shape, it is easier to insert spline nub 617 into nose spline receiver grooves 117, 217, 317 (FIGS. 1A-3B). In some embodiments, spline nub riser section 695 extends between spline nub bend 692 and spline nub riser interface 696. In this way, spline nub riser prevents rotation of spline 600 when spline nub 617 is worn down from repeated insertions.

In some embodiments, riser portion 620 can comprise riser bend bottom interface 621, riser bend 622, riser bend top interface 623, and/or riser section 624. In the same or different embodiments, riser bend bottom interface 621 can extend from nose top section 611. In further embodiments, riser bend 622 can extend from riser bend bottom interface 623. In the same or different embodiments, riser bend 622 can have a substantially arcuate shape, which allows for easy and thorough cleaning and/or disinfection because the lack of sharp corners and crevices prevents microorganisms from evading disinfectant. When riser bend 622 has a substantially arcuate shape, laminar airflow can also be enhanced because air streams do not encounter sharp corners. As an example, the substantially arcuate shape of riser bend 622 can be a concave shape or a convex shape. In some embodiments, riser bend top interface 623 can extend from riser bend 622. In the same or different embodiments, riser section 624 can extend from riser top interface 623. In various embodiments, riser section 624 has a substantially planar shape, can be parallel to nose front section 613, and/or be perpendicular to nose bottom section 612.

In the same or different embodiments, wall groove portion 630 can comprise a groove front section 631, a groove bend 632, a groove back section 633, a groove front edge 634, and/or a groove back edge 635. In some embodiments, groove front section 631 can extend from the riser section 624. As an example, groove front section 631 and riser section 624 can be coplanar with each other. In various embodiments, groove front section 631 has a substantially planar shape, can be parallel to nose front section 613, and/or be perpendicular to nose bottom section 612. In the same or different embodiments, groove front section 631 terminates at groove front edge 634. In various embodiments, groove front edge 634 can have a substantially planar shape or a substantially arcuate shape. In further embodiments, groove bend 632 can extend from groove front end 631. In various embodiments, groove bend 632 can have a substantially planar or substantially arcuate shape. In the same or different embodiments, groove bend 632 can form a 180 degree bend, such that groove back section 633 can be approximately parallel to groove front section 631. In various embodiments, groove back section 633 can extend from groove bend 632 and terminate at groove back edge 635. In further embodiments, groove back edge 635 can have a substantially planar shape or a substantially arcuate shape.

Figure 6B:
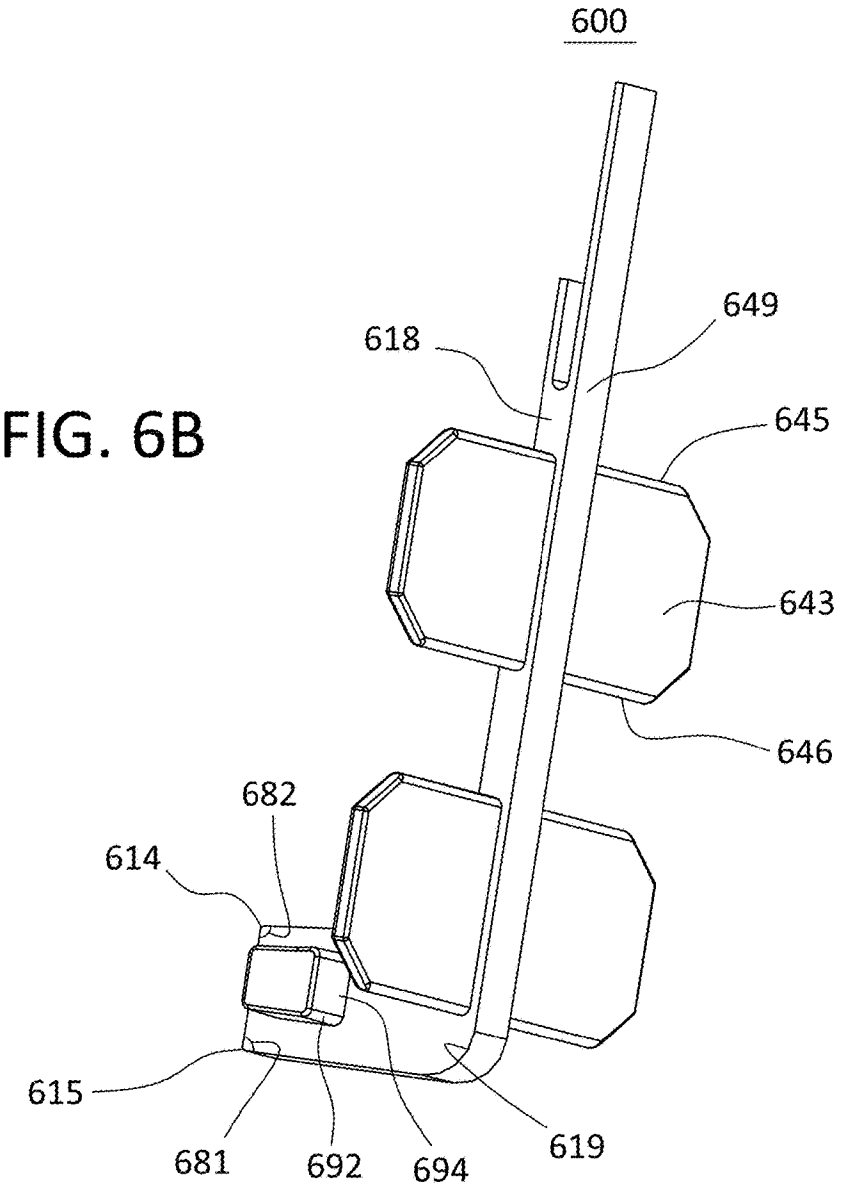

In some embodiments, spline portion 640 can comprise a spline plate 641 extending out of lateral side 618. In various embodiments, there can be a plurality of spline plates extending from opposite lateral sides of spline 600, as shown in FIGS. 6A and 6B. In various embodiments, there can be a plurality of spline plates 641 extending from opposite lateral sides of spline 600, as shown in FIGS. 6A and 6B. In the same or different embodiments, spline plate 641 can comprise a front spline plate surface 642 and/or a back spline plate surface 643 (FIG. 6B). In further embodiments, spline plate 641 can comprise a lateral spline edge 648, top corner spline edge 644, a top spline edge 645 (FIG. 6B), a bottom spline edge 646 (FIG. 6B), and a bottom corner spline edge 647. In various embodiments, lateral spline edge 648, top corner spline edge 644, top spline edge 645 (FIG. 6B), bottom spline edge 646 (FIG. 6B), and/or bottom corner spline edge 647 can have a substantially planar shape or a substantially arcuate shape. When lateral spline edge 648, top corner spline edge 644, top spline edge 645 (FIG. 6B), bottom spline edge 646 (FIG. 6B), and/or bottom corner spline edge 647 have a substantially arcuate shape, it is easier to insert spline plate 641 into a receiver groove.

Turning now to FIG. 6B, spline 600 is shown in a back isometric view. In various embodiments, back spline plate surface 643 can extend to lateral surface 618, and thus allow back spline surface 649 to rest against a wall surface (not shown) when in use. In some embodiments, top nose bend 614 can form top nose angle 682 between nose top section 611 and nose front section 613. In various embodiments, top nose angle 682 can be an approximately right angle. In the same or different embodiments, top nose angle 682 can be an acute angle or an obtuse angle. When top nose angle 682 is an approximately right angle, flooring material (not shown) can lay flush against nose front section 613, thus providing an approximately flat surface across nose top section 611 and flooring material (not shown). When top nose angle 682 is an acute angle, material costs are saved because nose bottom section 612 is smaller. When top nose angle 682 is an obtuse angle, a channel can be formed with flooring material (not shown), which can be used as an aid for applying adhesive or sealant. In some embodiments, nose bottom bend 615 can form bottom nose angle 681 between nose bottom section 612 and nose front section 613. In various embodiments, bottom nose angle 681 can be an approximately right angle. In the same or different embodiments, bottom nose angle 681 can be an acute angle or an obtuse angle. When bottom nose angle 681 is an approximately right angle, flooring material (not shown) can lay flush against nose front section 613, thus providing an approximately flat surface across nose top section 611 and flooring material (not shown). When bottom nose angle 681 is an acute angle, a channel can be formed with flooring material (not shown), which can be used as an aid for applying adhesive or sealant. When bottom nose angle 681 is an obtuse angle, material costs are saved because nose bottom section 612 is smaller.

Figure 7:
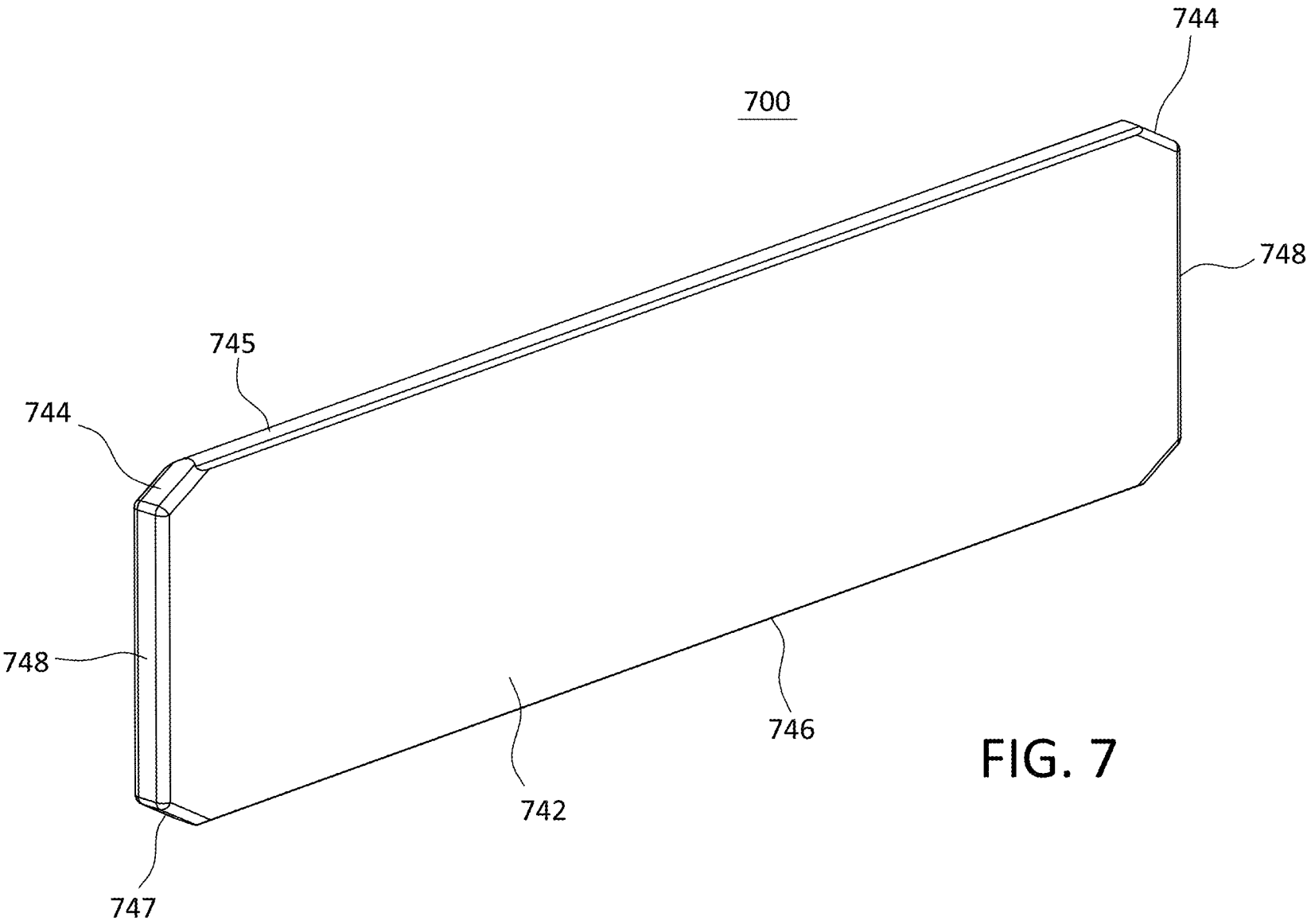

Turning now to FIG. 7, an exemplary embodiment of a spline 700 is shown in an isometric view. In many embodiments, spline 700 can comprise a single, integrated piece. As an example, in embodiments where spline receiver portion 140, 340 (FIGS. 1A, 1B, 3A, and 3B) comprises one or more recesses or female portions, spline 700 can comprise one or more complementary male portions to couple with the one or more recesses or female portions. In other embodiments (not shown in FIG. 7), the spline receiver portion or spline coupling portion comprises one or more male portions, the spline can comprise one or more complementary female portions to couple with the one or more male portions.

As shown in FIG. 7, in some embodiments, spline 700 comprises a front spline plate surface 742 and/or a back spline plate surface (not shown). In further embodiments, spline 700 can comprise a lateral spline edge 748, top corner spline edge 744, a top spline edge 745, a bottom spline edge 746, and a bottom corner spline edge 747. In various embodiments, lateral spline edge 748, top corner spline edge 744, top spline edge 745, bottom spline edge 746, and/or bottom corner spline edge 747 can have a substantially planar shape or a substantially arcuate shape. When lateral spline edge 748, top corner spline edge 744, top spline edge 745, bottom spline edge 746, and/or bottom corner spline edge 747 have a substantially arcuate shape, it is easier to insert spline 700 into a receiver groove. In various embodiments, when spline 700 is used to couple two baseboard elements or crown molding elements in an assembly, it can be hidden from view.

Figure 8A:
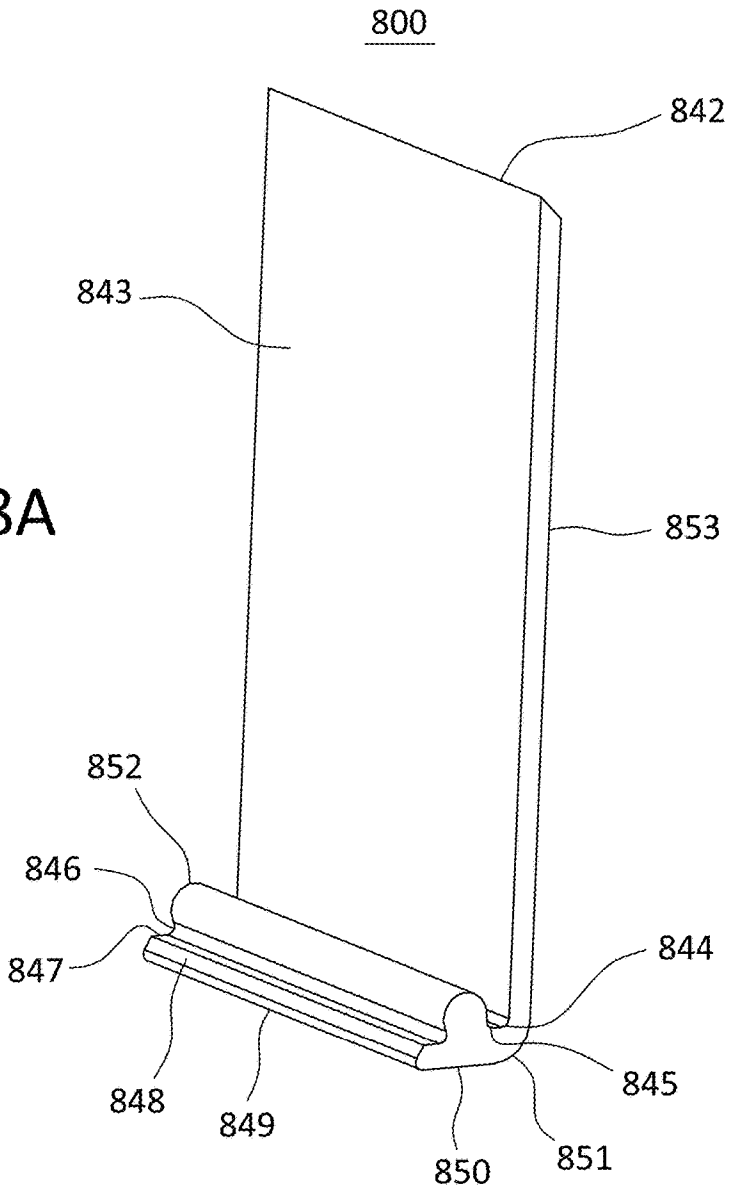

Turning now to FIG. 8A, an exemplary embodiment of a spline 800 is shown in an isometric view. In many embodiments, spline 800 can comprise a single, integrated piece. As an example, in embodiments where spline receiver portion 240 (FIGS. 2A and 2B) comprises one or more recesses or female portions, spline 800 can comprise one or more complementary male portions to couple with the one or more recesses or female portions. In other embodiments (not shown in FIGS. 8A and 8B), the spline receiver portion or spline coupling portion of the baseboard element comprises one or more male portions, the spline can comprise one or more complementary female portions to couple with the one or more male portions.

Figure 8B:
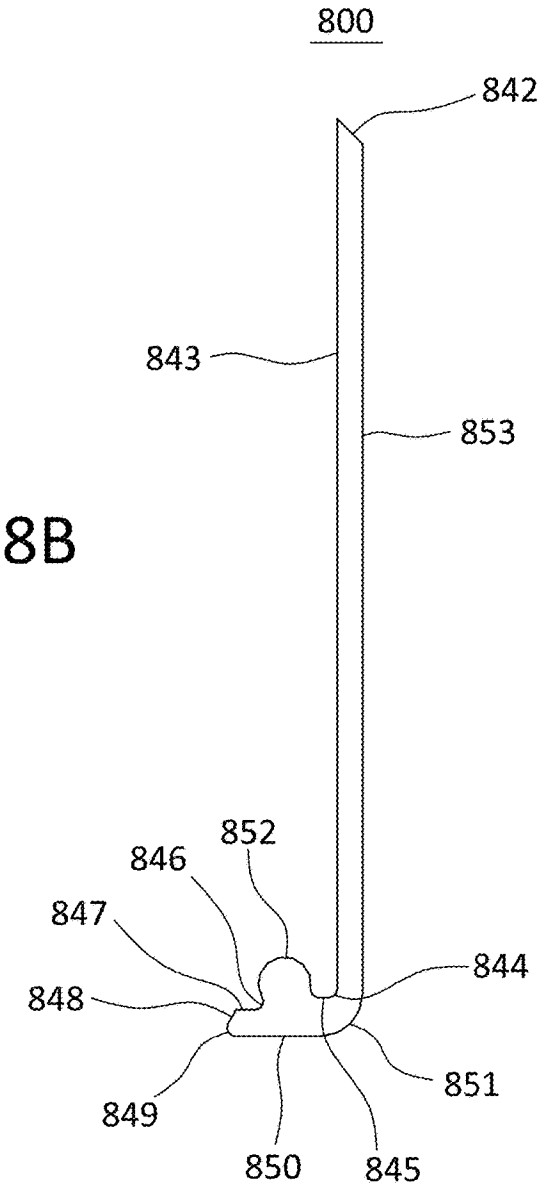

As shown in FIG. 8A, in some embodiments, spline 800 can comprise a top edge 842. In various embodiments, top edge 842 can have a can have a substantially arcuate or planar shape. When top edge 842 has a substantially arcuate shape, it is easier to couple spline 800 with baseboard element 200 (FIGS. 2A and 2B). In the same or different embodiments, front surface 843 can extend from top edge 842. In further embodiments, front bend 844 can extend from front surface 843. In various embodiments, front bend 844 can form an approximately right angle. In the same or different embodiments, front bend 844 can form an acute angle or an obtuse angle. In embodiments where front bend 844 forms a right angle, spline wing bottom surface 850 can lay flush against ground surface ground surface (not shown) while back surface 853 lays flush against a wall surface (not shown). In some embodiments, bend interface 845 can extend between front bend 844 and back key 852. Thereby, the shape created by bend interface 844, front bend 845, and back key 852 prevents baseboard element 200 (FIGS. 2A and 2B) from moving away from a wall surface (not shown), the spline 800, and/or a ground surface (not shown). In various embodiments, back key 852 can comprise a substantially rectangular shape, a substantially circular shape, a substantially triangular shape, and/or a substantially semicircular shape. In some embodiments, middle key bend 846 extends between back key 852 and front key 847. In various embodiments, front key 847 extends between key riser section 848 and key bend 846. In further embodiments, front key bend 849 extends between key riser section 848 and spline wing bottom surface 850. In further embodiments, back key bend 851 extends between spline wing bottom surface 850 and back surface 853 (FIG. 8B). In some embodiments, spline wing bottom surface 850 can comprise grooves (not shown), which can be configured to receive epoxy, glue, or sealant such that spline 800 is coupled to a ground surface (not shown).

Figure 9A:
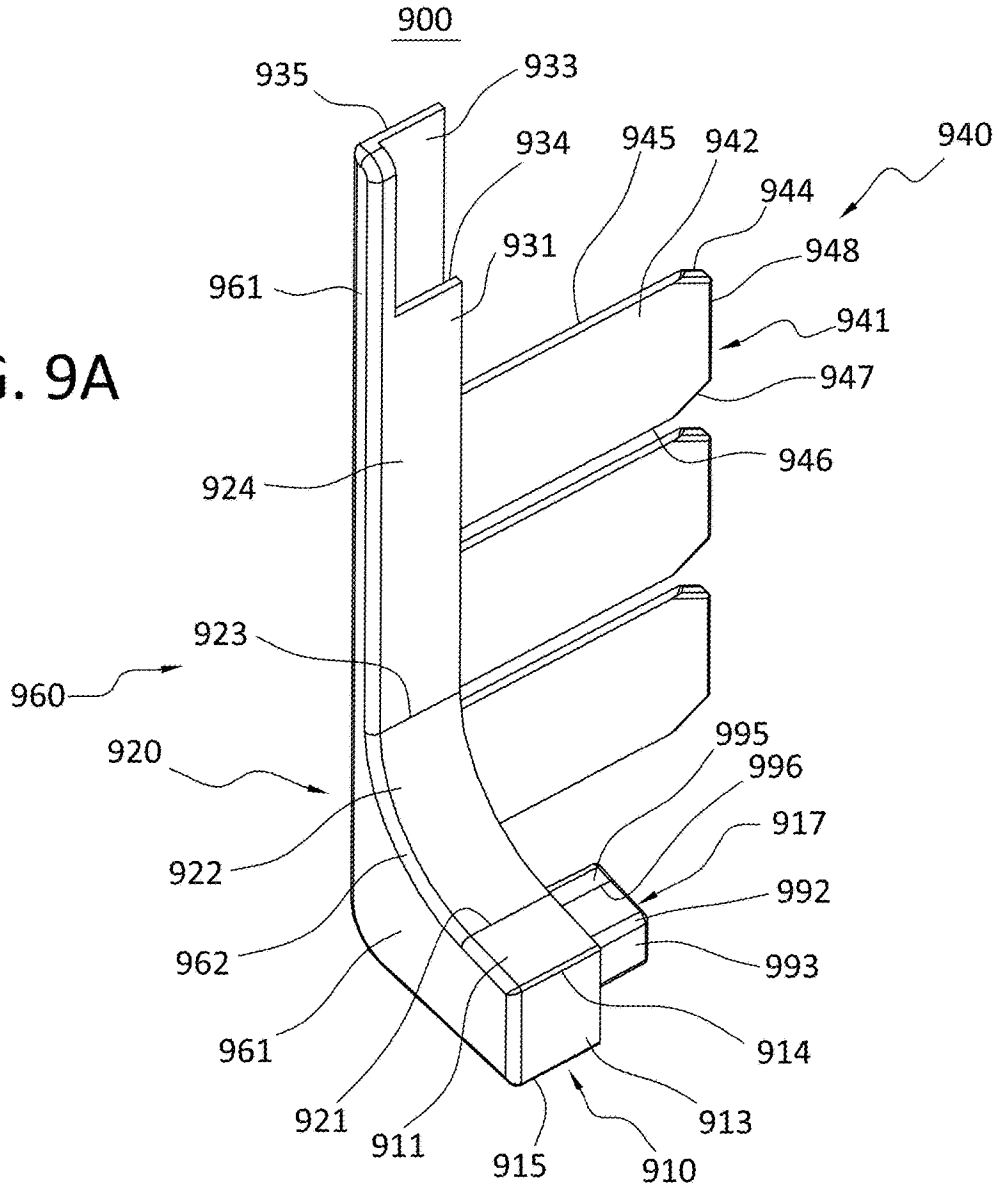

Turning now to FIG. 9A, an exemplary embodiment of a spline 900 is shown in an isometric view. In many embodiments, spline 900 can comprise a single, integrated piece. As an example, in embodiments where spline receiver portion 140 (FIGS. 1A and 1B) comprises one or more recesses or female portions, spline 900 can comprise one or more complementary male portions to couple with the one or more recesses or female portions. In other embodiments (not shown in FIGS. 9A and 9B), the spline receiver portion or spline coupling portion of the baseboard element comprises one or more male portions, the spline can comprise one or more complementary female portions to couple with the one or more male portions.

As shown in FIG. 9A, in some embodiments, spline 900 can comprise a nose portion 910, a riser portion 920, a wall groove portion 930, spline portion 940, and/or a cap portion 960. In some embodiments, nose portion 910 can further comprise a nose top section 911, a nose bottom section 912 (FIG. 9B), and/or a nose front section 913. In the same or different embodiments, nose top section 911 can have a substantially planar shape. In the same or different embodiments, nose top section 911 can extend approximately parallel to nose bottom section 912 (FIG. 9B) and approximately perpendicular to nose front section 913.

Figure 9B:
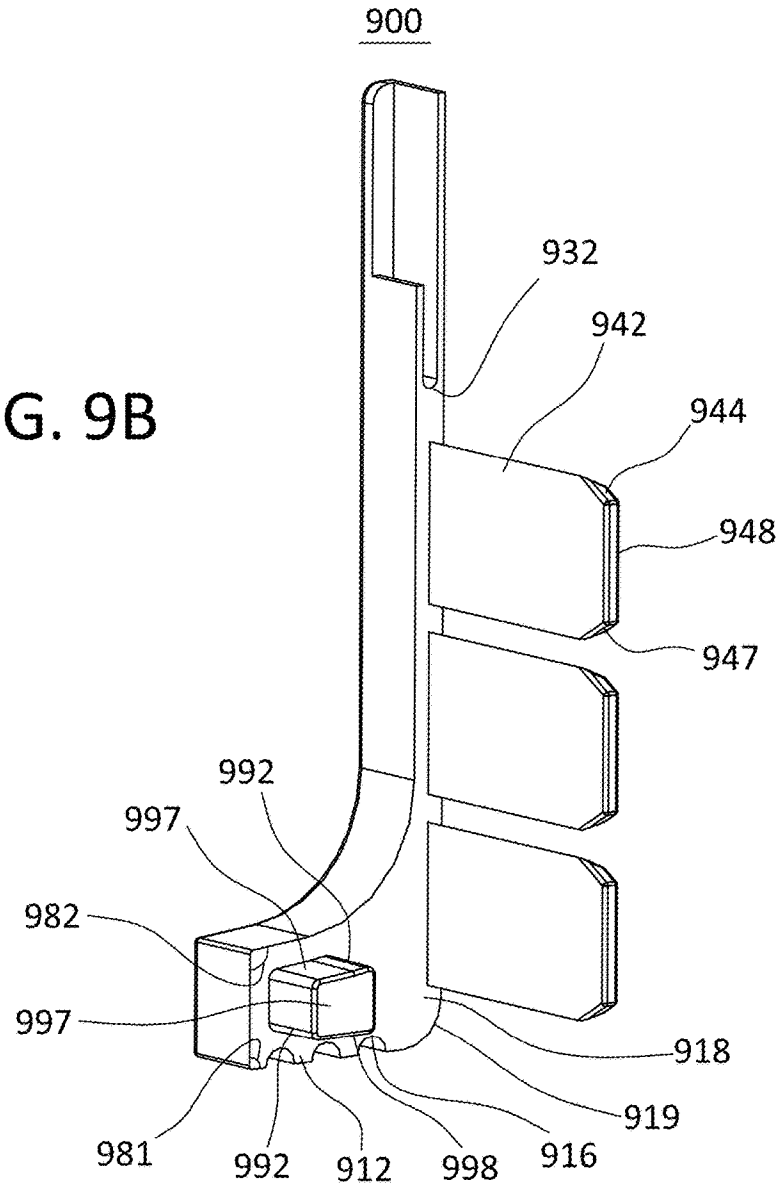

In some embodiments, nose front section 913 can have a substantially planar shape. In the same or different embodiments, nose front section 913 extends between nose top section 911 and nose bottom section 912 (FIG. 9B). In the same or different embodiments, nose portion 910 can comprise top nose bend 914. In further embodiments, top nose bend 914 can extend between nose top section 911 and nose front section 913. In the same or different embodiments, nose portion 910 can comprise bottom nose bend 915. In further embodiments, bottom nose bend 915 can extend between nose bottom section 912 and nose front section 913. In the same or different embodiments, nose bottom section 912 (FIG. 9B) can comprise one or more nose bottom grooves 916 (FIG. 9B). In some embodiments, nose bottom grooves 916 (FIG. 9B) can be configured to receive epoxy, glue, or sealant such that spline 900 is coupled to a ground surface (not shown). In some embodiments, the coupling of spline 900 to a ground surface (not shown) occurs in a way that is water tight and/or air tight. In the same or different embodiments, nose bottom groove 916 (FIG. 9B) terminates at or before it reaches cap lateral surface 961. In further embodiments, nose portion 910 further comprises a spline nub 917 extending from a lateral side 918. In some embodiments, spline nub 917 can comprise a variety of shapes configured to be inserted into a variety of nose spline receiver grooves 117, 217, 317 (FIGS. 1A-3B) such that inserting or otherwise locating spline nub 917 into nose spline receiver grooves 117, 217, 317 (FIGS. 1A-3B) couples baseboard elements 100, 200, 300 (FIGS. 1A-3B) to spline 900. In various embodiments, spline nub 917 can comprise a substantially rectangular shape, a substantially circular shape, a substantially triangular shape, and/or a substantially semi-circular shape. In some embodiments, spline nub 917 can be proximate to back bend 919 such that it can be inserted into back spline receiver groove 148, 248, 346. In the same or different embodiments, spline nub 917 can comprise a top spline nub surface 991, a plurality of spline nub bends 992, a front spline nub surface 993, a bottom spline nub surface (not shown), a back spline nub surface (not shown), a spline nub riser section 995, a spline nub riser interface 996, a spline nub lateral surface 997, and/or a spline nub edge 998 (FIG. 9B). In some embodiments, spline nub edge 998 (FIG. 9B) can circumscribe spline nub lateral surface 997 (FIG. 9B) and/or have a substantially arcuate or planar shape. When spline nub edge 998 (FIG. 9B) has a substantially arcuate shape, it is easier to insert spline nub 917 into nose spline receiver grooves 117, 217, 317 (FIGS. 1A-3B). In the same or different embodiments, plurality of spline nub bends 992 can have a substantially arcuate or planar shape. When plurality of spline nub bends 992 has a substantially arcuate shape, it is easier to insert spline nub 917 into nose spline receiver grooves 117, 217, 317 (FIGS. 1A-3B). In some embodiments, spline nub riser section 995 extends between spline nub bend 992 and spline nub riser interface 996. In this way, spline nub riser prevents rotation of spline 900 when spline nub 917 is worn down from repeated insertions.

In some embodiments, riser portion 920 can comprise riser bend bottom interface 921, riser bend 922, riser bend top interface 923, and/or riser section 924. In the same or different embodiments, riser bend bottom interface 921 can extend from nose top section 911. In further embodiments, riser bend 922 can extend from riser bend bottom interface 923. In the same or different embodiments, riser bend 922 can have a substantially arcuate shape, which allows for easy and thorough cleaning and/or disinfection because the lack of sharp corners and crevices prevents microorganisms from evading disinfectant. When riser bend 922 has a substantially arcuate shape, laminar airflow can also be enhanced because air streams do not encounter sharp corners. As an example, the substantially arcuate shape of riser bend 922 can be a concave shape or a convex shape. In some embodiments, riser bend top interface 923 can extend from riser bend 922. In the same or different embodiments, riser section 924 can extend from riser top interface 923. In various embodiments, riser section 924 has a substantially planar shape, can be parallel to nose front section 913, and/or be perpendicular to nose bottom section 912.

In the same or different embodiments, wall groove portion 930 can comprise a groove front section 931, a groove bend 932 (FIG. 9B), a groove back section 933, a groove front edge 934, and/or a groove back edge 935. In some embodiments, groove front section 931 can extend from the riser section 924. As an example, groove front section 931 and riser section 924 can be coplanar with each other. In various embodiments, groove front section 931 has a substantially planar shape, can be parallel to nose front section 913, and/or be perpendicular to nose bottom section 912. In the same or different embodiments, groove front section 931 terminates at groove front edge 934. In various embodiments, groove front edge 934 can have a substantially planar shape or a substantially arcuate shape. In further embodiments, groove bend 932 (FIG. 9B) can extend from groove front end 931. In various embodiments, groove bend 932 (FIG. 9B) can have a substantially planar or substantially arcuate shape. In the same or different embodiments, groove bend 932 (FIG. 9B) can form a 180 degree bend, such that groove back section 933 can be approximately parallel to groove front section 931. In various embodiments, groove back section 933 can extend from groove bend 932 (FIG. 9B) and terminate at groove back edge 935. In further embodiments, groove back edge 935 can have a substantially planar shape or a substantially arcuate shape.

In some embodiments, spline portion 940 can comprise a spline plate 941 extending out of lateral side 918. In various embodiments, there can be a plurality of spline plates 941 extending from only one of the lateral sides of spline 900, as shown in FIGS. 9A and 9B. In the same or different embodiments, spline plate 941 can comprise a front spline plate surface 942 and/or a back spline plate surface (not shown). In further embodiments, spline plate 941 can comprise a lateral spline edge 948, top corner spline edge 944, a top spline edge 945, a bottom spline edge 946, and a bottom corner spline edge 947. In various embodiments, lateral spline edge 948, top corner spline edge 944, top spline edge 445, bottom spline edge 946, and/or bottom corner spline edge 947 can have a substantially planar shape or a substantially arcuate shape. When lateral spline edge 948, top corner spline edge 944, top spline edge 945, bottom spline edge 946, and/or bottom corner spline edge 947 have a substantially arcuate shape, it is easier to insert spline plate 941 into receiver section 145 as buffeted by one or more of top receiver nub 149, middle receiver nubs 132, or bottom receiver nub 142. In the same or different embodiments, spline portion 940 can have a back spline plate surface (not shown), which can span across and be contiguous and co-planar with back spline surface (not shown. In further embodiments, back spline plate surface (not shown) can extend to lateral surface 918, and thus allow back spline surface (not shown) to rest against a wall surface (not shown) when in use. In further embodiments, spline portion 940 can comprise a spline wing extending from lateral side 918, such as a spline wing described in FIGS. 5A, 5B, and/or 5C.

Turning now to FIG. 9B, spline 900 is shown in another isometric view. In some embodiments, top nose bend 914 can form top nose angle 982 between nose top section 911 and nose front section 913. In various embodiments, top nose angle 982 can be an approximately right angle. In the same or different embodiments, top nose angle 982 can be an acute angle or an obtuse angle. When top nose angle 982 is an approximately right angle, flooring material (not shown) can lay flush against nose front section 913, thus providing an approximately flat surface across nose top section 911 and flooring material (not shown). When top nose angle 982 is an acute angle, material costs are saved because nose bottom section 912 is smaller. When top nose angle 982 is an obtuse angle, a channel can be formed with flooring material (not shown), which can be used as an aid for applying adhesive or sealant. In some embodiments, nose bottom bend 915 can form bottom nose angle 981 between nose bottom section 912 and nose front section 913. In various embodiments, bottom nose angle 981 can be an approximately right angle. In the same or different embodiments, bottom nose angle 981 can be an acute angle or an obtuse angle. When bottom nose angle 981 is an approximately right angle, flooring material (not shown) can lay flush against nose front section 913, thus providing an approximately flat surface across nose top section 911 and flooring material (not shown). When bottom nose angle 981 is an acute angle, a channel can be formed with flooring material (not shown), which can be used as an aid for applying adhesive or sealant.

Returning to FIG. 9A, in various embodiments, cap portion 960 can comprise cap lateral surface 961 and/or cap edge 962. In some embodiments, cap edge 962 circumscribes cap lateral surface 961 and extends from nose top section 911, nose front section 913, top nose bend 914, bottom nose bend 915, nose bottom section 912 (FIG. 9B), back bend 919 (FIG. 9B), riser bend 922, riser bend top interface 923, riser section 924, groove front section 931, groove back section 933, groove front edge 934, and/or groove back edge 935. In further embodiments, cap edge 962 has a substantially planar shape. In the same or different embodiments, cap edge 962 can have a substantially arcuate shape, which allows for easy and thorough cleaning and/or disinfection because the lack of sharp corners and crevices prevents microorganisms from evading disinfectant. When cap edge 962 has a substantially arcuate shape, laminar airflow can also be enhanced because air streams do not encounter sharp corners. As an example, the substantially arcuate shape of cap edge 962 can be a concave shape or a convex shape.

Figure 10A:
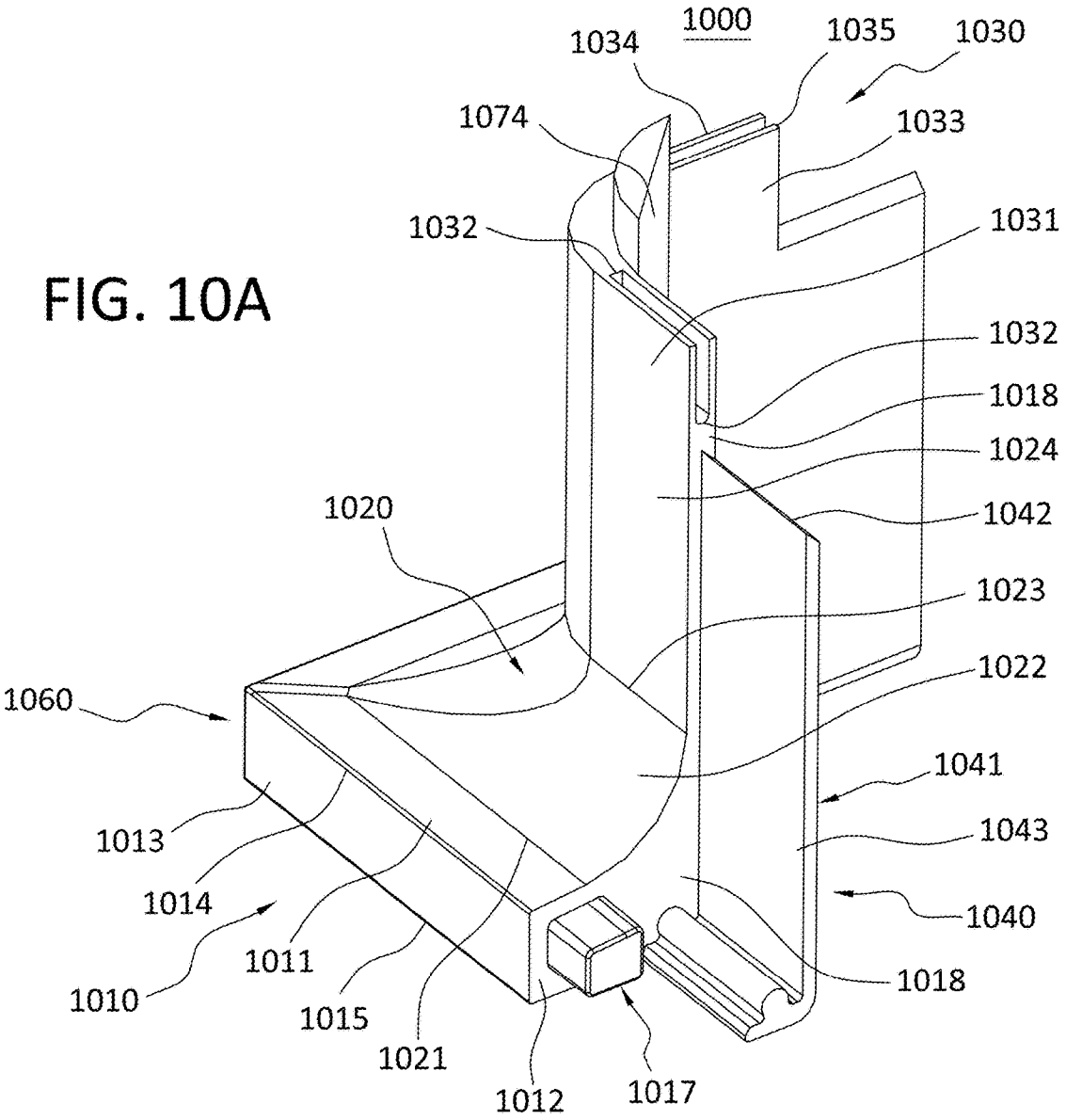

Turning now to FIG. 10A, an exemplary embodiment of spline 1000 is shown in an isometric view. In many embodiments, spline 1000 can comprise a single, integrated piece. As an example, in embodiments where spline receiver portion 240 (FIGS. 2A and 2B) comprises one or more recesses or female portions, spline 1000 can comprise one or more complementary male portions to couple with the one or more recesses or female portions. In other embodiments (not shown in FIGS. 10A-10C), the spline receiver portion or spline coupling portion of the baseboard element comprises one or more male portions, the spline can comprise one or more complementary female portions to couple with the one or more male portions.

As shown in FIG. 10A, spline 1000 can comprise a nose portion 1010, a riser portion 1020, a wall groove portion 1030, spline portion 1040, and a corner portion 1060. In some embodiments, nose portion 1010 can further comprise a nose top section 1011, a nose bottom section 1012, and/or a nose front section 1013. In the same or different embodiments, nose top section 1011 can have a substantially planar shape. In the same or different embodiments, nose top section 1011 can extend approximately parallel to nose bottom section 1012 and approximately perpendicular to nose front section 1013.

Figure 10B:
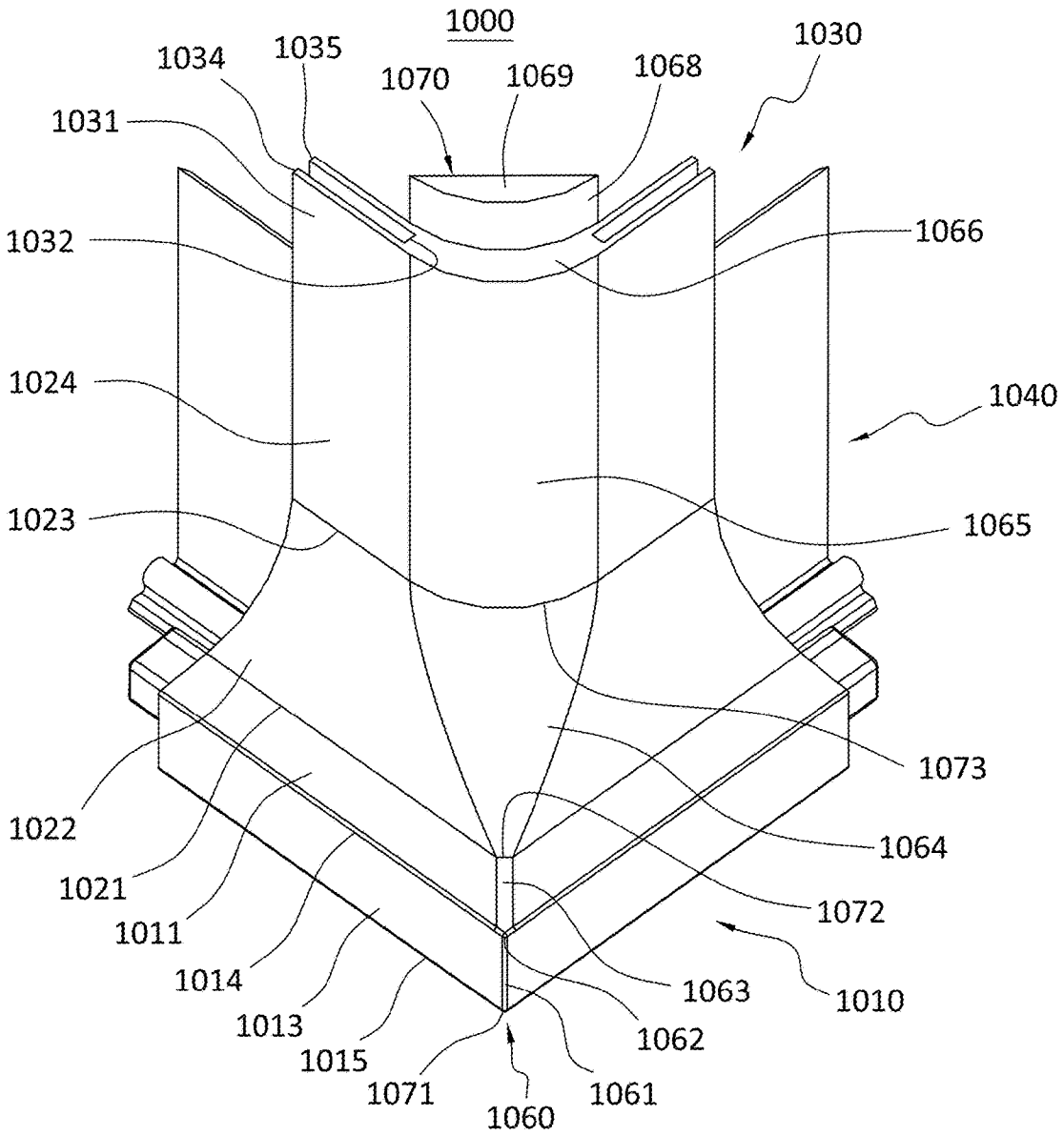
Figure 10C:
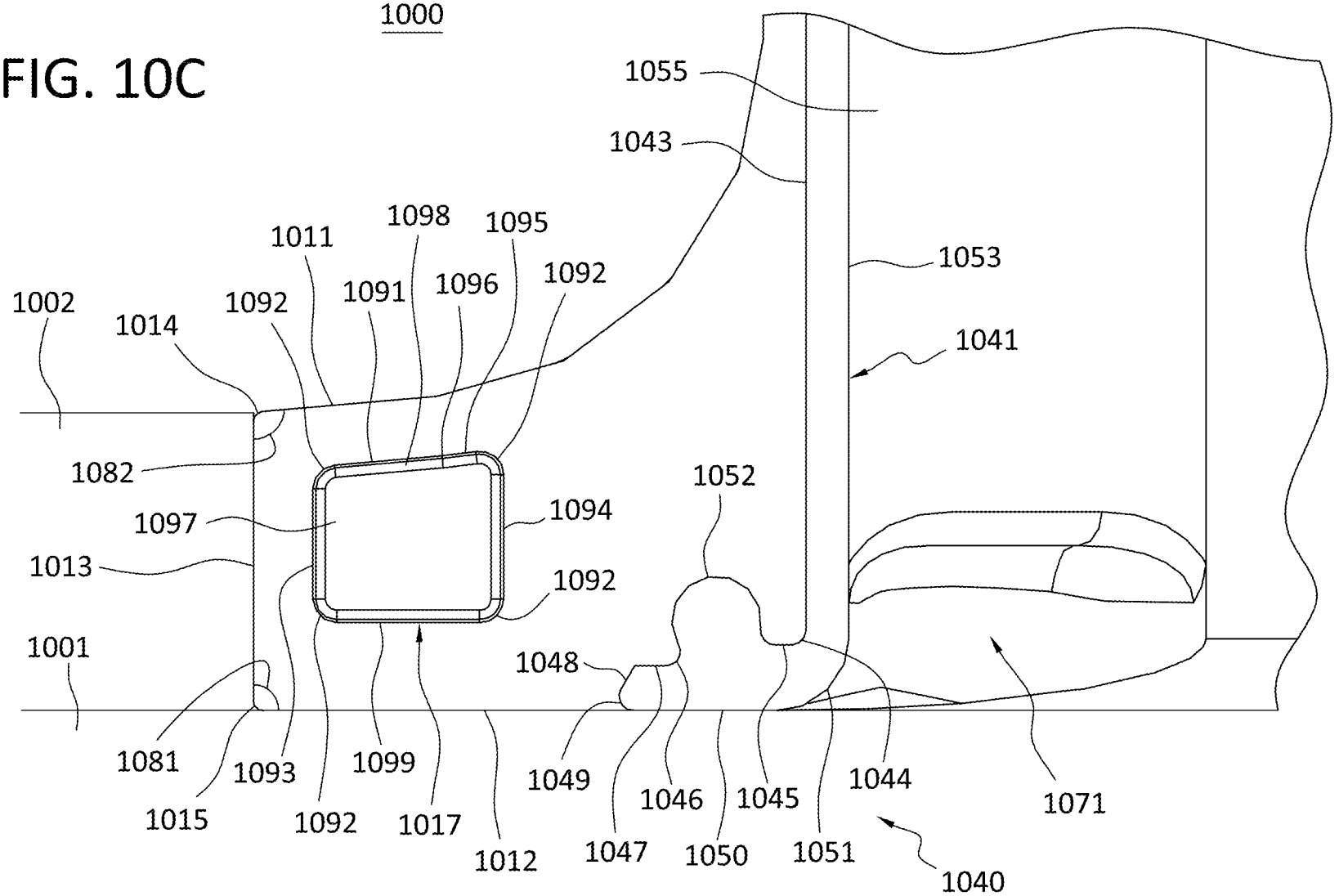

In some embodiments, nose front section 1013 can have a substantially planar shape. In the same or different embodiments, nose front section 1013 extends between nose top section 1011 and nose bottom section 1012. In the same or different embodiments, nose portion 1010 can comprise top nose bend 1014. In further embodiments, top nose bend 1014 can extend between nose top section 1011 and nose front section 1013. In the same or different embodiments, nose portion 1010 can comprise bottom nose bend 1015. In further embodiments, bottom nose bend 1015 can extend between nose bottom section 1012 and nose front section 1013. In the same or different embodiments, nose bottom section 1012 can comprise nose bottom groove (not shown). In some embodiments, nose bottom groove (not shown) can be configured to receive epoxy, glue, or sealant such that spline 1000 is coupled to a ground surface 1001 (FIG. 10C). In some embodiments, the coupling of spline 1000 to a ground surface 1001 (FIG. 10C) occurs in a way that is water tight and/or air tight.

Turning now to FIG. 10C, in further embodiments, nose portion 1010 further comprises a spline nub 1017 extending from a lateral side 1018 (FIG. 10A). As shown in FIG. 10A, nose portion 1010 can include two spline nubs at opposite lateral sides of nose portion 1010. In some embodiments, spline nub 1017 can comprise a variety of shapes configured to be inserted into a variety of nose spline receiver grooves 117, 217, 317 (FIGS. 1A-3B) such that inserting or otherwise locating spline nub 1017 into nose spline receiver grooves 117, 217, 317 (FIGS. 1A-3B) couples baseboard elements 100, 200, 300 (FIGS. 1A-3B) to spline 1000. In various embodiments, spline nub 1017 can comprise a substantially rectangular shape, a substantially circular shape, a substantially triangular shape, and/or a substantially semi-circular shape. In some embodiments, spline nub 1017 can be proximate to back key bend 1051 such that it can be inserted into back spline receiver groove 148, 248, 346 (FIGS. 1A-3B). In the same or different embodiments, spline nub 1017 can comprise a top spline nub surface 1091, a plurality of spline nub bends 1092, a front spline nub surface 1093, a bottom spline nub surface 1099, a back spline nub surface 1094, a spline nub riser section 1095, a spline nub riser interface 1096, a spline nub lateral surface 1097, and/or a spline nub edge 1098. In some embodiments, spline nub edge 1098 can circumscribe spline nub lateral surface 1097 and/or have a substantially arcuate or planar shape. When spline nub edge 1098 has a substantially arcuate shape, it is easier to insert spline nub 1017 into nose spline receiver grooves 117, 217, 317 (FIGS. 1A-3B). In the same or different embodiments, plurality of spline nub bends 1092 can have a substantially arcuate or planar shape. When plurality of spline nub bends 1092 has a substantially arcuate shape, it is easier to insert spline nub 1017 into nose spline receiver grooves 117, 217, 317 (FIGS. 1A-3B). In some embodiments, spline nub riser section 1095 extends between spline nub bend 1092 and spline nub riser interface 1096. In this way, spline nub riser prevents rotation of spline 1000 when spline nub 1017 is worn down from repeated insertions.

Returning to FIG. 10A, in some embodiments, riser portion 1020 can comprise riser bend bottom interface 1021, riser bend 1022, riser bend top interface 1023, and/or riser section 1024. In the same or different embodiments, riser bend bottom interface 1021 can extend from nose top section 1011. In further embodiments, riser bend 1022 can extend from riser bend bottom interface 1023. In the same or different embodiments, riser bend 1022 can have a substantially arcuate shape, which allows for easy and thorough cleaning and/or disinfection because the lack of sharp corners and crevices prevents microorganisms from evading disinfectant. When riser bend 1022 has a substantially arcuate shape, laminar airflow can also be enhanced because air streams do not encounter sharp corners. As an example, the substantially arcuate shape of riser bend 1022 can be a concave shape or a convex shape. In some embodiments, riser bend top interface 1023 can extend from riser bend 1022. In the same or different embodiments, riser section 1024 can extend from riser top interface 1023. In various embodiments, riser section 1024 has a substantially planar shape, can be parallel to nose front section 1013, and/or be perpendicular to nose bottom section 1012.

In the same or different embodiments, wall groove portion 1030 can comprise a groove front section 1031, a groove bend 1032, a groove back section 1033, a groove front edge 1034, and/or a groove back edge 1035. In some embodiments, groove front section 1031 can extend from the riser section 1024. As an example, groove front section 1031 and riser section 1024 can be coplanar with each other. In various embodiments, groove front section 1031 has a substantially planar shape, can be parallel to nose front section 1013, and/or be perpendicular to nose bottom section 1012. In the same or different embodiments, groove front section 1031 terminates at groove front edge 1034. In various embodiments, groove front edge 1034 can have a substantially planar shape or a substantially arcuate shape. In further embodiments, groove bend 1032 can extend from groove front end 1031. In various embodiments, groove bend 1032 can have a substantially planar or substantially arcuate shape. In the same or different embodiments, groove bend 1032 can form a 180 degree bend, such that groove back section 1033 can be approximately parallel to groove front section 1031. In various embodiments, groove back section 1033 can extend from groove bend 1032 and terminate at groove back edge 1035. In further embodiments, groove back edge 1035 can have a substantially planar shape or a substantially arcuate shape.

Returning to FIG. 10C, in some embodiments, spline portion 1040 can comprise a spline wing 1041 extending from lateral side 1018 (FIG. 10A). In various embodiments, there can be a single spline plate extending from each of the lateral sides of spline 1000, as shown in FIGS. 10A-10C. In some embodiments, spline wing 1041 can comprise a top edge 1042 (FIG. 10A). In various embodiments, top edge 1042 (FIG. 10A) can have a can have a substantially arcuate or planar shape. When top edge 1042 (FIG. 10A) has a substantially arcuate shape, it is easier to couple spline 1000 with a baseboard element. In the same or different embodiments, front surface 1043 can extend from top edge 1042 (FIG. 10A). In further embodiments, front bend 1044 can extend from front surface 1043. In various embodiments, front bend 1044 can form an approximately right angle. In the same or different embodiments, front bend 1044 can form an acute angle or an obtuse angle. In embodiments where front bend 1044 forms a right angle, spline wing bottom surface 1050 can lay flush against ground surface 1001 while back surface 1053 lays against a wall surface (not shown). In some embodiments, bend interface 1045 can extend between front bend 1044 and back key 1052. Thereby, the shape created by bend interface 1044, front bend 1045, and back key 1052 prevents a baseboard element from moving away from a wall surface (not shown), the spline 1000, and/or a ground surface 1001. In various embodiments, back key 1052 can comprise a substantially rectangular shape, a substantially circular shape, a substantially triangular shape, and/or a substantially semi-circular shape. In some embodiments, middle key bend 1046 extends between back key 1052 and front key 1047. In various embodiments, front key 1047 extends between key riser section 1048 and key bend 1046. In further embodiments, front key bend 1049 extends between key riser section 1048 and spline wing bottom surface 1050. In further embodiments, back key bend 1051 extends between spline wing bottom surface 1050 and back surface 1053. In some embodiments, spline wing bottom surface 1050 can comprise grooves (not shown), which can be configured to receive epoxy, glue, or sealant such that spline 1000 is coupled to a ground surface 1001. In some embodiments, the coupling of spline 1000 to a ground surface 1001 occurs in a way that is water tight and/or air tight.

In various embodiments, back spline plate surface 1053 can span across and be contiguous and co-planar with back corner surface 1055. In some embodiments, top nose bend 1014 can form top nose angle 1082 between nose top section 1011 and nose front section 1013. In various embodiments, top nose angle 1082 can be an approximately right angle. In the same or different embodiments, top nose angle 1082 can be an acute angle or an obtuse angle. When top nose angle 1082 is an approximately right angle, flooring material 1002 can lay flush against nose front section 1013, thus providing an approximately flat surface across nose top section 1011 and flooring material 1002. When top nose angle 1082 is an acute angle, material costs are saved because nose bottom section 1012 is smaller. When top nose angle 1082 is an obtuse angle, a channel can be formed with flooring material 1002, which can be used as an aid for applying adhesive or sealant. In some embodiments, nose bottom bend 1015 can form bottom nose angle 1081 between nose bottom section 1012 and nose front section 1013. In various embodiments, bottom nose angle 1081 can be an approximately right angle. In the same or different embodiments, bottom nose angle 1081 can be an acute angle or an obtuse angle. When bottom nose angle 1081 is an approximately right angle, flooring material 1002 can lay flush against nose front section 1013, thus providing an approximately flat surface across nose top section 1011 and flooring material 1002. When bottom nose angle 1081 is an acute angle, a channel can be formed with flooring material 1002, which can be used as an aid for applying adhesive or sealant. When bottom nose angle 1081 is an obtuse angle, material costs are saved because nose bottom section 1012 is smaller.

Turning now to FIG. 10B, a frontal view of spline 1000 is shown. In some embodiments, corner portion 1060 can comprise corner bottom nose bend 1071, corner nose front section 1061, corner top nose bend 1062, corner nose top section 1063, corner riser bend bottom interface 1072, corner riser bend 1064, corner riser bend bottom interface 1073, corner riser section 1065, corner top surface 1066, and/or corner nub 1070. In some embodiments, corner portion 1060 forms a right angle of an exterior corner. In the same or different embodiments, corner portion 1060 forms an acute angle of an exterior corner. In still other embodiments, corner portion 1060 forms an obtuse angle of an exterior corner.

In further embodiments, corner bottom nose bend 1071 extends between a plurality of bottom nose bends 1015. In the same or different embodiments, corner bottom nose bend 1071 can have a substantially planar shape. In some embodiments, corner bottom nose bend 1071 can have an arcuate shape, which allows for easy and thorough cleaning and/or disinfection because the lack of sharp corners and crevices prevents microorganisms from evading disinfectant. When corner bottom nose bend 1071 has a substantially arcuate shape, laminar airflow can also be enhanced because air streams do not encounter sharp corners. As an example, the substantially arcuate shape of corner bottom nose bend 1071 can be a concave shape or a convex shape.

In further embodiments, corner nose front section 1061 extends between a plurality of nose front sections 1013. In the same or different embodiments, corner nose front section 1061 can have a substantially planar shape. In some embodiments, corner nose front section 1061 can have an arcuate shape, which allows for easy and thorough cleaning and/or disinfection because the lack of sharp corners and crevices prevents microorganisms from evading disinfectant. When corner nose front section 1061 has a substantially arcuate shape, laminar airflow can also be enhanced because air streams do not encounter sharp corners. As an example, the substantially arcuate shape of corner nose front section 1061 can be a concave shape or a convex shape.

In further embodiments, corner top nose bend 1062 extends between a plurality of top nose bends 1014. In the same or different embodiments, corner top nose bend 1062 can have a substantially planar shape. In some embodiments, corner top nose bend 1062 can have an arcuate shape, which allows for easy and thorough cleaning and/or disinfection because the lack of sharp corners and crevices prevents microorganisms from evading disinfectant. When corner top nose bend 1062 has a substantially arcuate shape, laminar airflow can also be enhanced because air streams do not encounter sharp corners. As an example, the substantially arcuate shape of corner top nose bend 1062 can be a concave shape or a convex shape. In further embodiments, corner nose top section 1063 extends between a plurality of nose top sections 1011. In the same or different embodiments, corner nose top section 1063 can have a substantially planar shape.

In further embodiments, corner riser bend bottom interface 1072 extends between a plurality of riser bend bottom interfaces 1021. In the same or different embodiments, corner riser bend bottom interface 1072 can have a substantially planar shape. In some embodiments, corner riser bend bottom interface 1072 can have an arcuate shape, which allows for easy and thorough cleaning and/or disinfection because the lack of sharp corners and crevices prevents microorganisms from evading disinfectant. When corner riser bend bottom interface 1072 has a substantially arcuate shape, laminar airflow can also be enhanced because air streams do not encounter sharp corners. As an example, the substantially arcuate shape of corner riser bend bottom interface 1072 can be a concave shape or a convex shape.

In further embodiments, corner riser bend 1064 extends between a plurality of riser bends 1022. In the same or different embodiments, corner riser bend 1064 can have a substantially planar shape. In some embodiments, corner riser bend 1064 can have an arcuate shape, which allows for easy and thorough cleaning and/or disinfection because the lack of sharp corners and crevices prevents microorganisms from evading disinfectant. When corner riser bend 1064 has a substantially arcuate shape, laminar airflow can also be enhanced because air streams do not encounter sharp corners. As an example, the substantially arcuate shape of corner riser bend 1064 can be a concave shape or a convex shape.

In further embodiments, corner riser bend bottom interface 1073 extends between a plurality of riser bend bottom interfaces 1023. In the same or different embodiments, corner riser bend bottom interface 1073 can have a substantially planar shape. In some embodiments, corner riser bend bottom interface 1073 can have an arcuate shape, which allows for easy and thorough cleaning and/or disinfection because the lack of sharp corners and crevices prevents microorganisms from evading disinfectant. When corner riser bend bottom interface 1073 has a substantially arcuate shape, laminar airflow can also be enhanced because air streams do not encounter sharp corners. As an example, the substantially arcuate shape of corner riser bend bottom interface 1073 can be a concave shape or a convex shape.

In further embodiments, corner riser section 1065 extends between a plurality of riser sections 1024 and/or groove bends 1032. In the same or different embodiments, corner riser section 1065 can have a substantially planar shape. In some embodiments, corner riser section 1065 can have an arcuate shape, which allows for easy and thorough cleaning and/or disinfection because the lack of sharp corners and crevices prevents microorganisms from evading disinfectant. When corner riser section 1065 has a substantially arcuate shape, laminar airflow can also be enhanced because air streams do not encounter sharp corners. As an example, the substantially arcuate shape of corner riser section 1065 can be a concave shape or a convex shape. In some embodiments, corner top surface 1066 extends between a plurality of groove bends 1032.

In some embodiments, corner nub 1070 extends out of top surface 1066. In the same or different embodiments, corner nub 1070 comprises corner nub front surface 1068, corner nub top surface 1069, and corner nub back surface 1074 (FIG. 10A). In some embodiments, corner nub 1070 can comprise a variety of shapes configured to be inserted into a variety of nub receiver grooves, such that inserting or otherwise locating corner nub 1070 into nub receiver grooves couples a wall corner element to spline 1000 while a wall corner element remains substantially immobile. In various embodiments, corner nub 1070 can comprise a substantially rectangular shape, a substantially circular shape, a substantially triangular shape, and/or a substantially semi-circular shape.

Figure 11A:
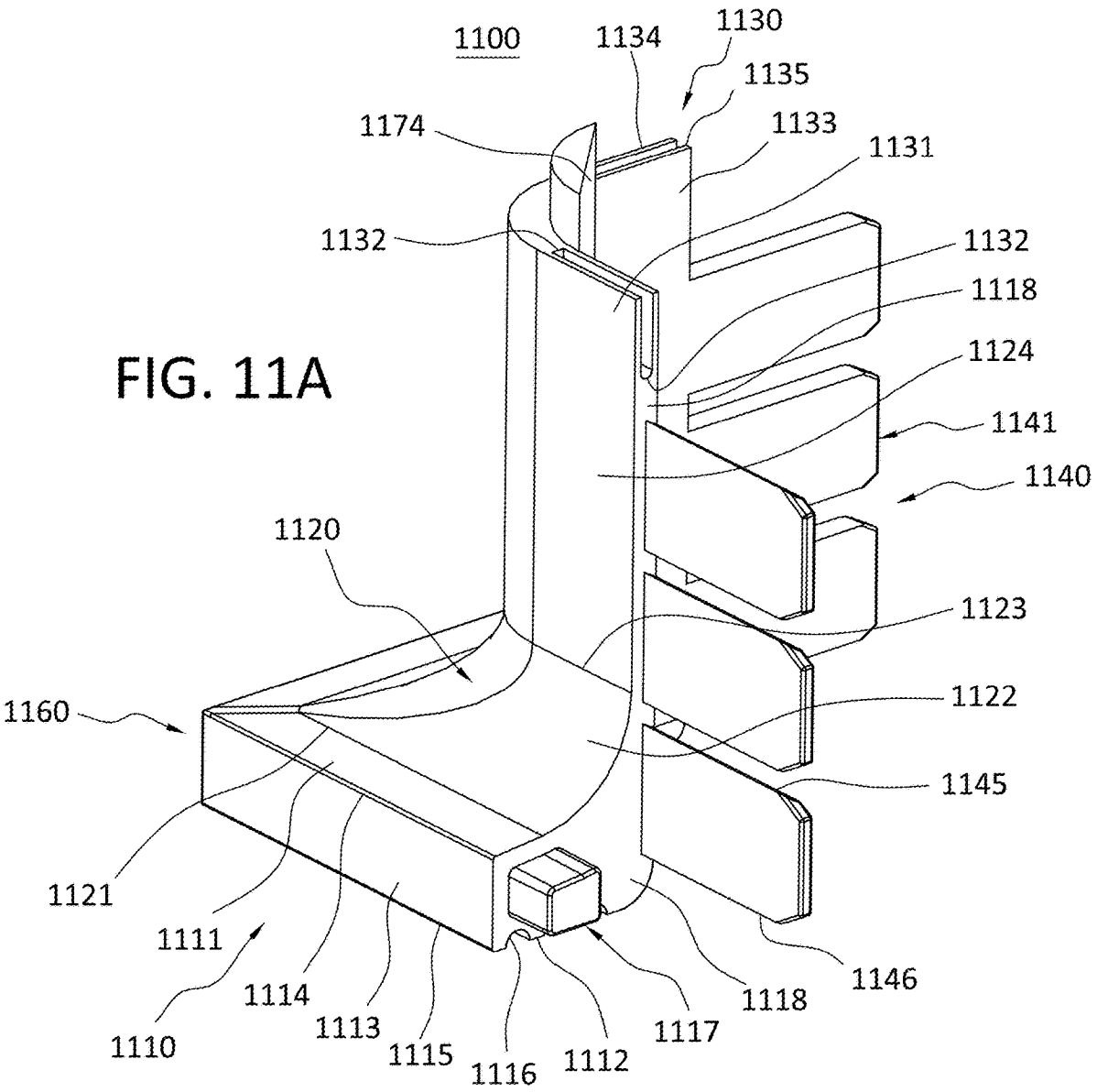

Turning now to FIG. 11A, an exemplary embodiment of spline 1100 is shown in an isometric view. In many embodiments, spline 1100 can comprise a single, integrated piece. As an example, in embodiments where spline receiver portion 140 (FIGS. 1A and 1B) comprises one or more recesses or female portions, spline 1100 can comprise one or more complementary male portions to couple with the one or more recesses or female portions. In other embodiments (not shown in FIGS. 11A-11C), the spline receiver portion or spline coupling portion of the baseboard element comprises one or more male portions, the spline can comprise one or more complementary female portions to couple with the one or more male portions.

As shown in FIG. 11A, spline 1100 can comprise a nose portion 1110, a riser portion 1120, a wall groove portion 1130, spline portion 1140, and a corner portion 1160. In some embodiments, nose portion 1110 can further comprise a nose top section 1111, a nose bottom section 1112, and/or a nose front section 1113. In the same or different embodiments, nose top section 1111 can have a substantially planar shape. In the same or different embodiments, nose top section 1111 can extend approximately parallel to nose bottom section 1112 and approximately perpendicular to nose front section 1113.

Figure 11B:
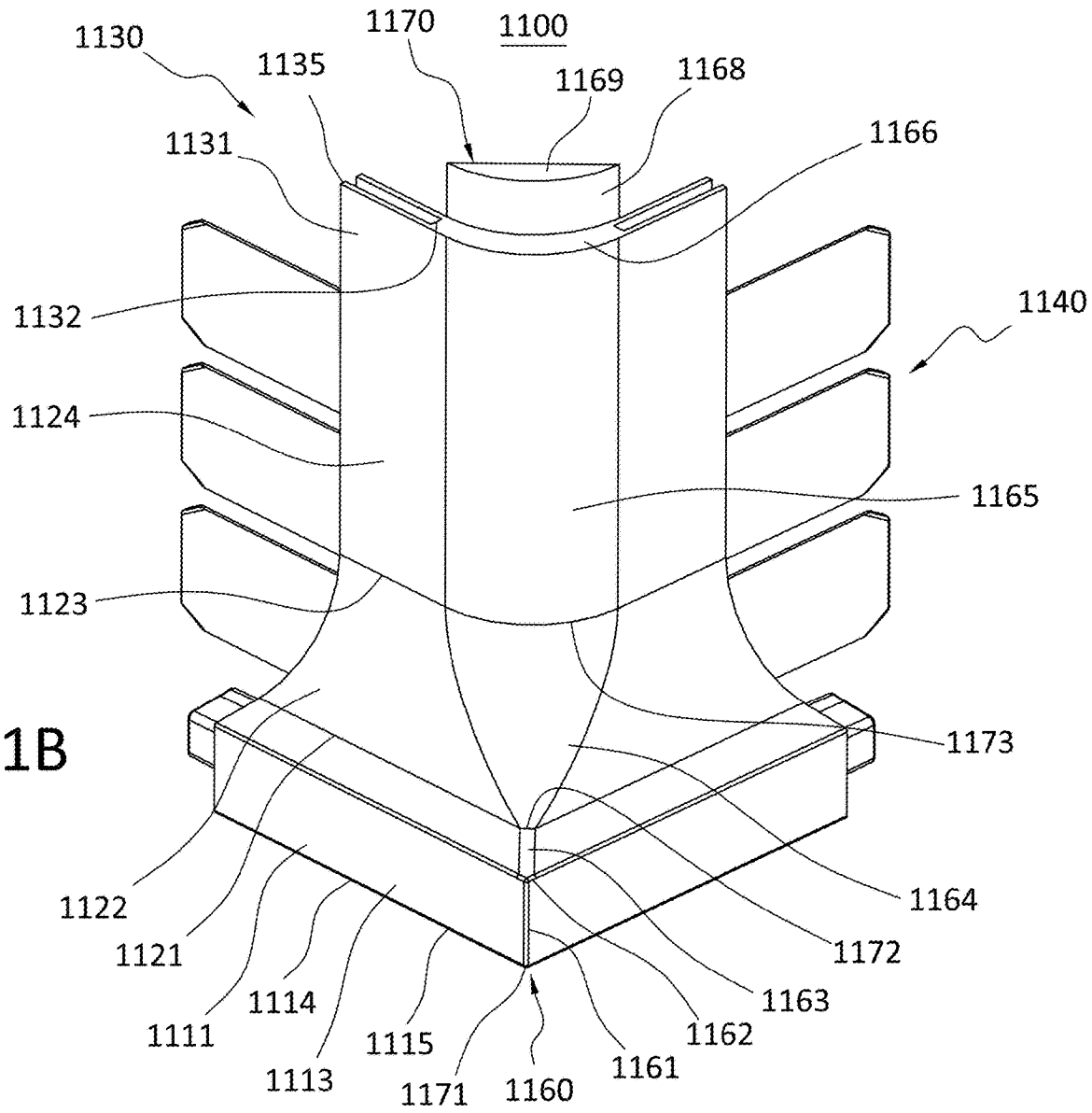
Figure 11C:
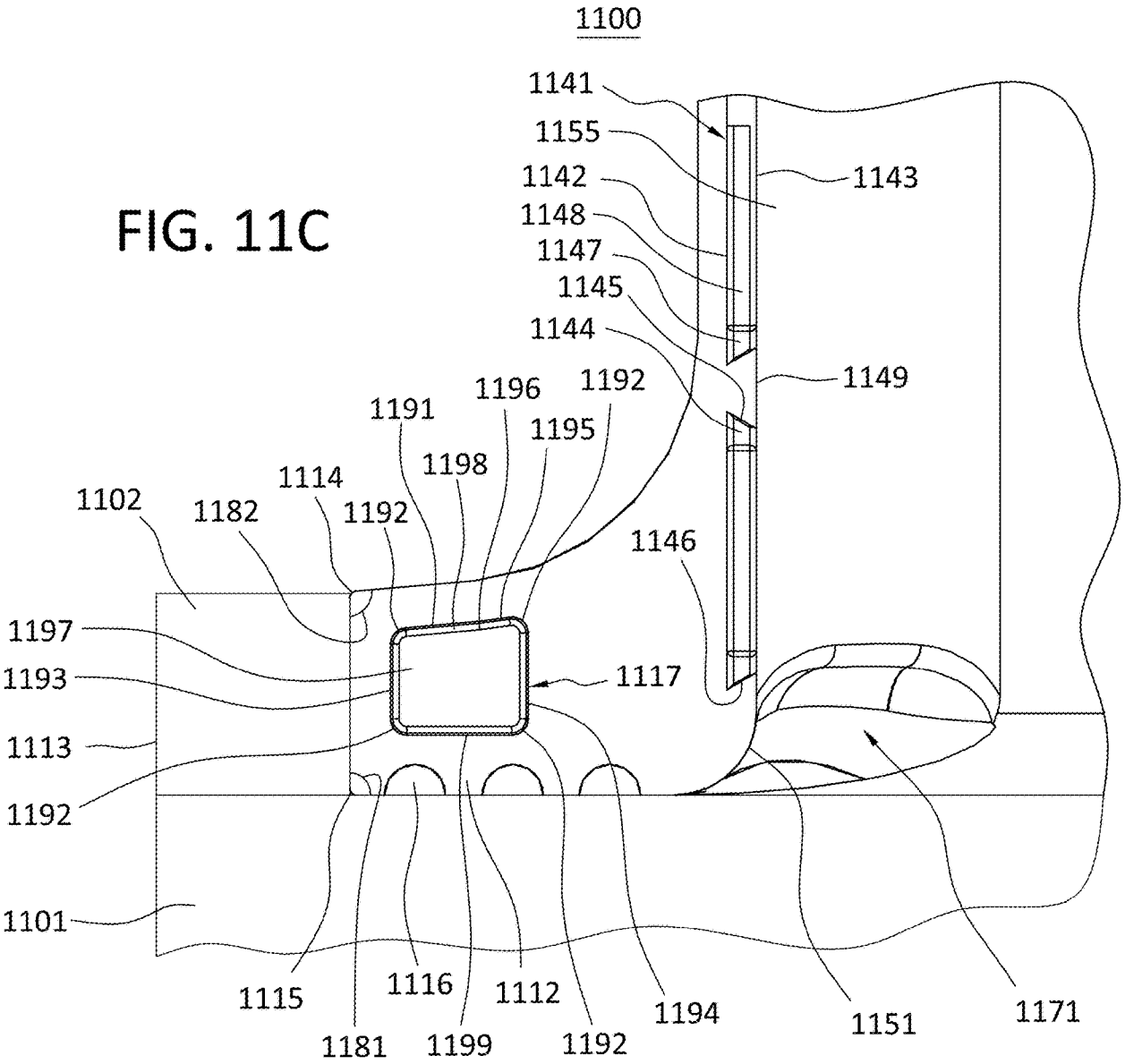

In some embodiments, nose front section 1113 can have a substantially planar shape. In the same or different embodiments, nose front section 1113 extends between nose top section 1111 and nose bottom section 1112. In the same or different embodiments, nose portion 1110 can comprise top nose bend 1114. In further embodiments, top nose bend 1114 can extend between nose top section 1111 and nose front section 1113. In the same or different embodiments, nose portion 1110 can comprise bottom nose bend 1115. In further embodiments, bottom nose bend 1115 can extend between nose bottom section 1112 and nose front section 1113. In the same or different embodiments, nose bottom section 1112 can comprise nose bottom groove (not shown). In some embodiments, nose bottom groove 1116 can be configured to receive epoxy, glue, or sealant such that spline 1100 is coupled to a ground surface 1101 (FIG. 11C). In some embodiments, the coupling of spline 1100 to a ground surface 1101 (FIG. 11C) occurs in a way that is water tight and/or air tight. As shown in FIG. 11A, nose portion 1110 can include two spline nubs at opposite lateral sides of nose portion 1110.

Turning now to FIG. 11C, in further embodiments, nose portion 1110 further comprises a spline nub 1117 extending from a lateral side 1118 (FIG. 11A). In some embodiments, spline nub 1117 can comprise a variety of shapes configured to be inserted into a variety of nose spline receiver grooves 117, 217, 317 (FIGS. 1A-3B) such that inserting or otherwise locating spline nub 1117 into nose spline receiver grooves 117, 217, 317 (FIGS. 1A-3B) couples baseboard elements 100, 200, 300 (FIGS. 1A-3B) to spline 1100. In various embodiments, spline nub 1117 can comprise a substantially rectangular shape, a substantially circular shape, a substantially triangular shape, and/or a substantially semi-circular shape. In some embodiments, spline nub 1117 can be proximate to back bend 1151 such that it can be inserted into back spline receiver groove 148, 248, 346. In the same or different embodiments, spline nub 1117 can comprise a top spline nub surface 1191, a plurality of spline nub bends 1192, a front spline nub surface 1193, a bottom spline nub surface 1199, a back spline nub surface 1194, a spline nub riser section 1195, a spline nub riser interface 1196, a spline nub lateral surface 1197, and/or a spline nub edge 1198. In some embodiments, spline nub edge 1198 can circumscribe spline nub lateral surface 1197 and/or have a substantially arcuate or planar shape. When spline nub edge 1198 has a substantially arcuate shape, it is easier to insert spline nub 1117 into nose spline receiver grooves 117, 217, 317 (FIGS. 1A-3B). In the same or different embodiments, plurality of spline nub bends 1192 can have a substantially arcuate or planar shape. When plurality of spline nub bends 1192 has a substantially arcuate shape, it is easier to insert spline nub 1117 into nose spline receiver grooves 117, 217, 317 (FIGS. 1A-3B). In some embodiments, spline nub riser section 1195 extends between spline nub bend 1192 and spline nub riser interface 1196. In this way, spline nub riser prevents rotation of spline 1100 when spline nub 1117 is worn down from repeated insertions.

Returning to FIG. 11A, in some embodiments, riser portion 1120 can comprise riser bend bottom interface 1121, riser bend 1122, riser bend top interface 1123, and/or riser section 1124. In the same or different embodiments, riser bend bottom interface 1121 can extend from nose top section 1111. In further embodiments, riser bend 1122 can extend from riser bend bottom interface 1123. In the same or different embodiments, riser bend 1122 can have a substantially arcuate shape, which allows for easy and thorough cleaning and/or disinfection because the lack of sharp corners and crevices prevents microorganisms from evading disinfectant. When riser bend 1122 has a substantially arcuate shape, laminar airflow can also be enhanced because air streams do not encounter sharp corners. As an example, the substantially arcuate shape of riser bend 1122 can be a concave shape or a convex shape. In some embodiments, riser bend top interface 1123 can extend from riser bend 1122. In the same or different embodiments, riser section 1124 can extend from riser top interface 1123. In various embodiments, riser section 1124 has a substantially planar shape, can be parallel to nose front section 1113, and/or be perpendicular to nose bottom section 1112.

In the same or different embodiments, wall groove portion 1130 can comprise a groove front section 1131, a groove bend 1132, a groove back section 1133, a groove front edge 1134, and/or a groove back edge 1135. In some embodiments, groove front section 1131 can extend from the riser section 1124. As an example, groove front section 1131 and riser section 1124 can be coplanar with each other. In various embodiments, groove front section 1131 has a substantially planar shape, can be parallel to nose front section 1113, and/or be perpendicular to nose bottom section 1112. In the same or different embodiments, groove front section 1131 terminates at groove front edge 1134. In various embodiments, groove front edge 1134 can have a substantially planar shape or a substantially arcuate shape. In further embodiments, groove bend 1132 can extend from groove front end 1131. In various embodiments, groove bend 1132 can have a substantially planar or substantially arcuate shape. In the same or different embodiments, groove bend 1132 can form a 180 degree bend, such that groove back section 1133 can be approximately parallel to groove front section 1131. In various embodiments, groove back section 1133 can extend from groove bend 1132 and terminate at groove back edge 1135. In further embodiments, groove back edge 1135 can have a substantially planar shape or a substantially arcuate shape.

Returning to FIG. 11C, spline portion 1140 can comprise a spline plate 1141 extending out of lateral side 1118. In various embodiments, there can be a plurality of spline plates 1141 extending from opposite lateral sides of spline 1100, as shown in FIGS. 11A-11C. In the same or different embodiments, spline plate 1141 can comprise a front spline plate surface 1142 and/or a back spline plate surface 1143. In further embodiments, spline plate 1141 can comprise a lateral spline edge 1148, top corner spline edge 1144, a top spline edge 1145, a bottom spline edge 1146, and a bottom corner spline edge 1147. In various embodiments, lateral spline edge 1148, top corner spline edge 1144, top spline edge 1145, bottom spline edge 1146, and/or bottom corner spline edge 1147 can have a substantially planar shape or a substantially arcuate shape. When lateral spline edge 1148, top corner spline edge 1144, top spline edge 1145, bottom spline edge 1146, and/or bottom corner spline edge 1147 have a substantially arcuate shape, it is easier to insert spline plate 1141 into receiver section 145 as buffeted by top receiver nub 146 and bottom receiver nub 142.

In various embodiments, back spline plate surface 1143 can span across and be contiguous and co-planar with back spline surface 1149. In some embodiments, top nose bend 1114 can form top nose angle 1182 between nose top section 1111 and nose front section 1113. In various embodiments, top nose angle 1182 can be an approximately right angle. In the same or different embodiments, top nose angle 1182 can be an acute angle or an obtuse angle. When top nose angle 1182 is an approximately right angle, flooring material (not shown) can lay flush against nose front section 1113, thus providing an approximately flat surface across nose top section 1111 and flooring material (not shown). When top nose angle 1182 is an acute angle, material costs are saved because nose bottom section 1112 is smaller. When top nose angle 1182 is an obtuse angle, a channel can be formed with flooring material (not shown), which can be used as an aid for applying adhesive or sealant. In some embodiments, nose bottom bend 1115 can form bottom nose angle 1181 between nose bottom section 1112 and nose front section 1113. In various embodiments, bottom nose angle 1181 can be an approximately right angle. In the same or different embodiments, bottom nose angle 1181 can be an acute angle or an obtuse angle. When bottom nose angle 1181 is an approximately right angle, flooring material (not shown) can lay flush against nose front section 1113, thus providing an approximately flat surface across nose top section 1111 and flooring material (not shown). When bottom nose angle 1181 is an acute angle, a channel can be formed with flooring material (not shown), which can be used as an aid for applying adhesive or sealant. When bottom nose angle 1181 is an obtuse angle, material costs are saved because nose bottom section 1112 is smaller.

Turning now to FIG. 11B, a frontal view of spline 1100 is shown. In some embodiments, corner portion 1160 can comprise corner bottom nose bend 1171, corner nose front section 1161, corner top nose bend 1162, corner nose top section 1163, corner riser bend bottom interface 1172, corner riser bend 1164, corner riser bend bottom interface 1173, corner riser section 1165, corner top surface 1166, and/or corner nub 1170. In some embodiments, corner portion 1160 forms a right angle of an exterior corner. In the same or different embodiments, corner portion 1160 forms an acute angle of an exterior corner. In still other embodiments, corner portion 1160 forms an obtuse angle of an exterior corner.

In further embodiments, corner bottom nose bend 1171 extends between a plurality of bottom nose bends 1115. In the same or different embodiments, corner bottom nose bend 1171 can have a substantially planar shape. In some embodiments, corner bottom nose bend 1171 can have an arcuate shape, which allows for easy and thorough cleaning and/or disinfection because the lack of sharp corners and crevices prevents microorganisms from evading disinfectant. When corner bottom nose bend 1171 has a substantially arcuate shape, laminar airflow can also be enhanced because air streams do not encounter sharp corners. As an example, the substantially arcuate shape of corner bottom nose bend 1171 can be a concave shape or a convex shape. In further embodiments, corner nose front section 1161 extends between a plurality of nose front sections 1113. In the same or different embodiments, corner nose front section 1161 can have a substantially planar shape. In some embodiments, corner nose front section 1161 can have an arcuate shape, which allows for easy and thorough cleaning and/or disinfection because the lack of sharp corners and crevices prevents microorganisms from evading disinfectant. When corner nose front section 1161 has a substantially arcuate shape, laminar airflow can also be enhanced because air streams do not encounter sharp corners. As an example, the substantially arcuate shape of corner nose front section 1161 can be a concave shape or a convex shape. In further embodiments, corner top nose bend 1162 extends between a plurality of top nose bends 1114. In the same or different embodiments, corner top nose bend 1162 can have a substantially planar shape. In some embodiments, corner top nose bend 1162 can have an arcuate shape, which allows for easy and thorough cleaning and/or disinfection because the lack of sharp corners and crevices prevents microorganisms from evading disinfectant. When corner top nose bend 1162 has a substantially arcuate shape, laminar airflow can also be enhanced because air streams do not encounter sharp corners. As an example, the substantially arcuate shape of corner top nose bend 1162 can be a concave shape or a convex shape. In further embodiments, corner nose top section 1163 extends between a plurality of nose top sections 1111. In the same or different embodiments, corner nose top section 1163 can have a substantially planar shape.

In further embodiments, corner riser bend bottom interface 1172 extends between a plurality of riser bend bottom interfaces 1121. In the same or different embodiments, corner riser bend bottom interface 1172 can have a substantially planar shape. In some embodiments, corner riser bend bottom interface 1172 can have an arcuate shape, which allows for easy and thorough cleaning and/or disinfection because the lack of sharp corners and crevices prevents microorganisms from evading disinfectant. When corner riser bend bottom interface 1172 has a substantially arcuate shape, laminar airflow can also be enhanced because air streams do not encounter sharp corners. As an example, the substantially arcuate shape of corner riser bend bottom interface 1172 can be a concave shape or a convex shape. In further embodiments, corner riser bend 1164 extends between a plurality of riser bends 1164. In the same or different embodiments, corner riser bend 1164 can have a substantially planar shape. In some embodiments, corner riser bend 1164 can have an arcuate shape, which allows for easy and thorough cleaning and/or disinfection because the lack of sharp corners and crevices prevents microorganisms from evading disinfectant. When corner riser bend 1164 has a substantially arcuate shape, laminar airflow can also be enhanced because air streams do not encounter sharp corners. As an example, the substantially arcuate shape of corner riser bend 1164 can be a concave shape or a convex shape. In further embodiments, corner riser bend bottom interface 1173 extends between a plurality of riser bend bottom interfaces 1123. In the same or different embodiments, corner riser bend bottom interface 1173 can have a substantially planar shape. In some embodiments, corner riser bend bottom interface 1173 can have an arcuate shape, which allows for easy and thorough cleaning and/or disinfection because the lack of sharp corners and crevices prevents microorganisms from evading disinfectant. When corner riser bend bottom interface 1173 has a substantially arcuate shape, laminar airflow can also be enhanced because air streams do not encounter sharp corners. As an example, the substantially arcuate shape of corner riser bend bottom interface 1173 can be a concave shape or a convex shape. In further embodiments, corner riser section 1165 extends between a plurality of riser sections 1124 and/or groove bends 1132. In the same or different embodiments, corner riser section 1165 can have a substantially planar shape. In some embodiments, corner riser section 1165 can have an arcuate shape, which allows for easy and thorough cleaning and/or disinfection because the lack of sharp corners and crevices prevents microorganisms from evading disinfectant. When corner riser section 1165 has a substantially arcuate shape, laminar airflow can also be enhanced because air streams do not encounter sharp corners. As an example, the substantially arcuate shape of corner riser section 1165 can be a concave shape or a convex shape. In some embodiments, corner top surface 1166 extends between a plurality of groove bends 1132.

In some embodiments, corner nub 1170 extends out of top surface 1166. In the same or different embodiments, corner nub 1170 comprises corner nub front surface 1168, corner nub top surface 1169, and corner nub back surface 1174. In some embodiments, corner nub 1170 can comprise a variety of shapes configured to be inserted into a variety of nub receiver grooves, such that inserting or otherwise locating corner nub 1170 into nub receiver grooves couples a wall corner element to spline 1100 while a wall corner element remains substantially immobile. In various embodiments, corner nub 1170 can comprise a substantially rectangular shape, a substantially circular shape, a substantially triangular shape, and/or a substantially semi-circular shape.

Figure 12A:
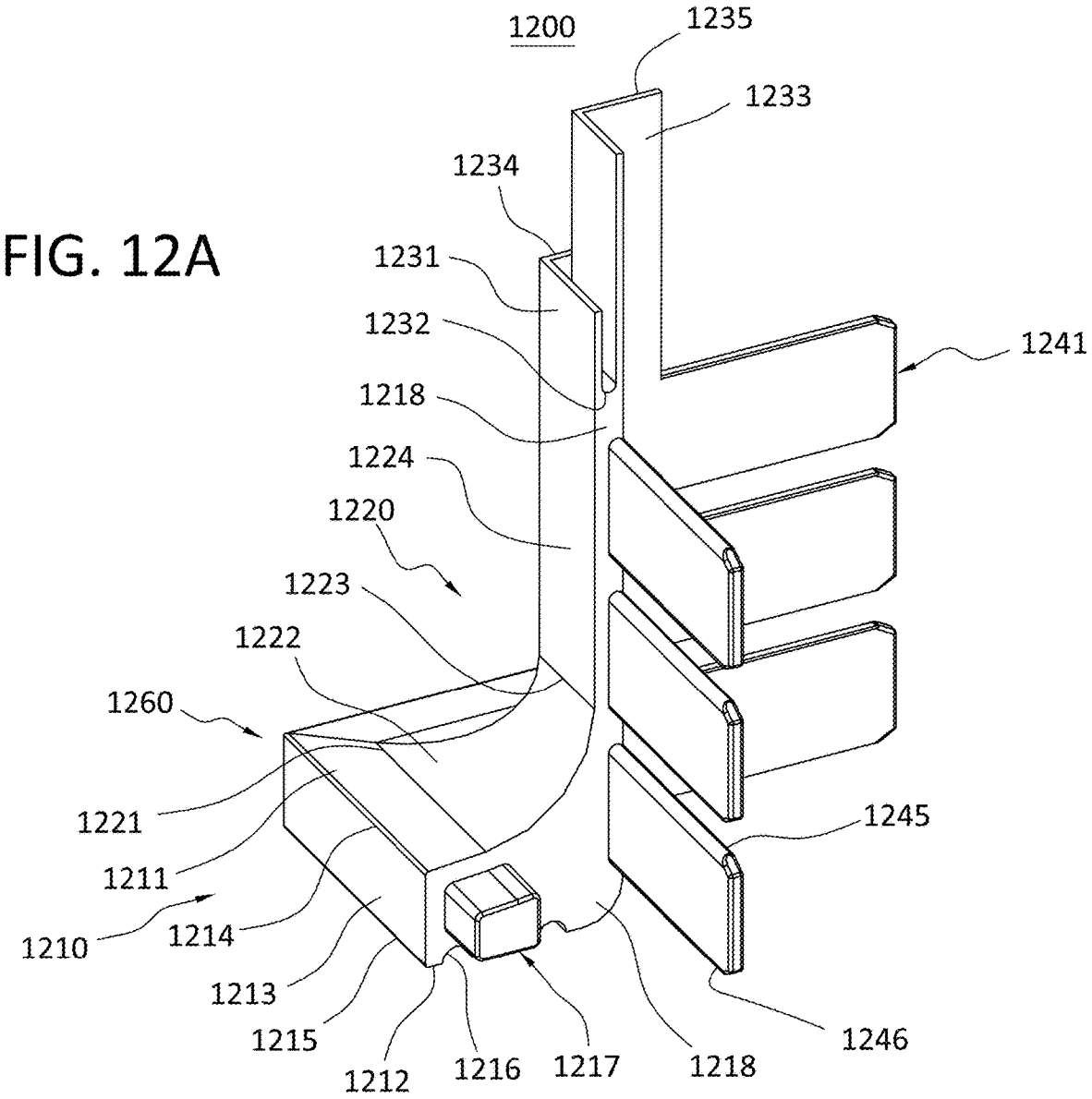

Turning now to FIG. 12A, an exemplary embodiment of spline 1200 is shown in an isometric view. In many embodiments, spline 1200 can comprise a single, integrated piece. As an example, in embodiments where spline receiver portion 140 (FIGS. 1A and 1B) comprises one or more recesses or female portions, spline 1200 can comprise one or more complementary male portions to couple with the one or more recesses or female portions. In other embodiments (not shown in FIGS. 12A-12C), the spline receiver portion or spline coupling portion of the baseboard element comprises one or more male portions, the spline can comprise one or more complementary female portions to couple with the one or more male portions.

As shown in FIG. 12A, spline 1200 can comprise a nose portion 1210, a riser portion 1220, a wall groove portion 1230, spline portion 1240, and a corner portion 1260. In some embodiments, nose portion 1210 can further comprise a nose top section 1211, a nose bottom section 1212, and/or a nose front section 1213. In the same or different embodiments, nose top section 1211 can have a substantially planar shape. In the same or different embodiments, nose top section 1211 can extend approximately parallel to nose bottom section 1212 and approximately perpendicular to nose front section 1213.

Figure 12B:
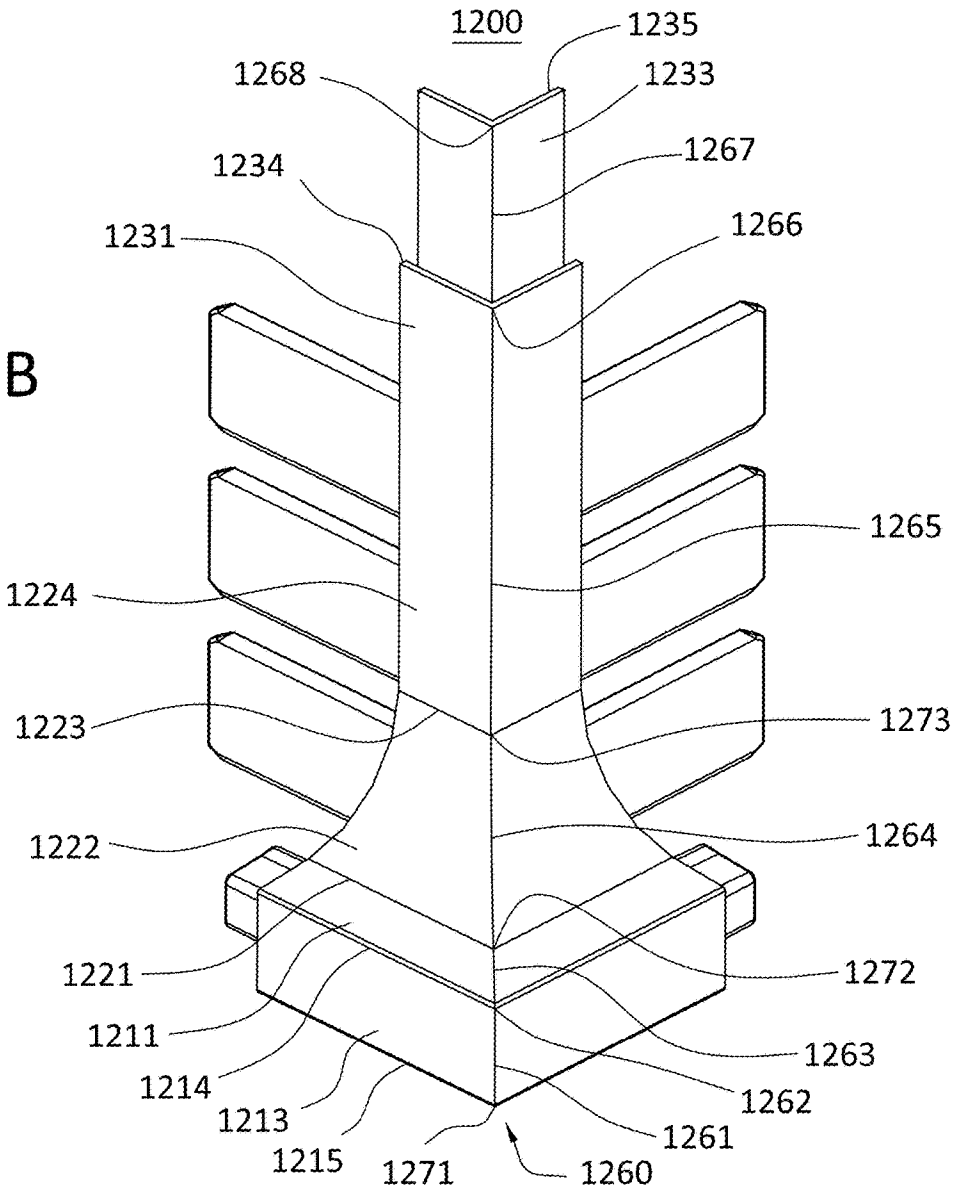
Figure 12C:
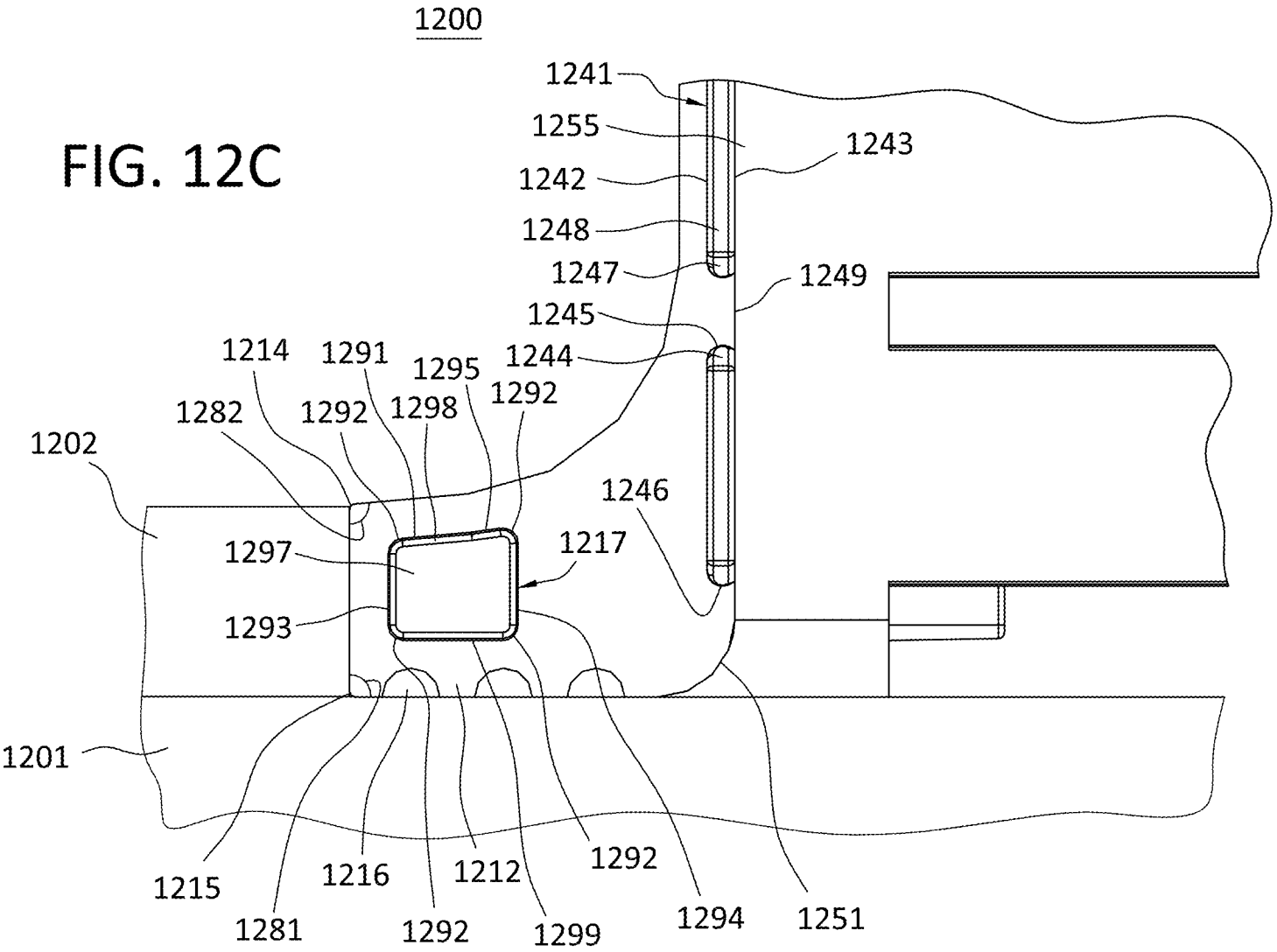

In some embodiments, nose front section 1213 can have a substantially planar shape. In the same or different embodiments, nose front section 1213 extends between nose top section 1211 and nose bottom section 1212. In the same or different embodiments, nose portion 1210 can comprise top nose bend 1214. In further embodiments, top nose bend 1214 can extend between nose top section 1211 and nose front section 1213. In the same or different embodiments, nose portion 1210 can comprise bottom nose bend 1215. In further embodiments, bottom nose bend 1215 can extend between nose bottom section 1212 and nose front section 1213. In the same or different embodiments, nose bottom section 1212 can comprise nose bottom groove (not shown). In some embodiments, nose bottom groove 1216 can be configured to receive epoxy, glue, or sealant such that spline 1200 is coupled to a ground surface 1201 (FIG. 12C). In some embodiments, the coupling of spline 1200 to a ground surface 1201 (FIG. 12C) occurs in a way that is water tight and/or air tight.

Turning now to FIG. 12C, in further embodiments, nose portion 1210 further comprises a spline nub 1217 extending from a lateral side 1218 (FIG. 12A). As shown in FIG. 12A, nose portion 1210 can include two spline nubs at opposite lateral sides of nose portion 1210. In some embodiments, spline nub 1217 can comprise a variety of shapes configured to be inserted into a variety of nose spline receiver grooves 127, 217, 317, such that inserting or otherwise locating spline nub 1217 into nose spline receiver grooves 127, 217, 317 couples baseboard elements 100, 200, 300 to spline 1200. In various embodiments, spline nub 1217 can comprise a substantially rectangular shape, a substantially circular shape, a substantially triangular shape, and/or a substantially semi-circular shape. In some embodiments, spline nub 1217 can be proximate to back bend 1251 such that it can be inserted into back spline receiver groove 148, 248, 346. In the same or different embodiments, spline nub 1217 can comprise a top spline nub surface 1291, a plurality of spline nub bends 1292, a front spline nub surface 1293, a bottom spline nub surface 1299, a back spline nub surface 1294, a spline nub riser section 1295, a spline nub riser interface 1296, a spline nub lateral surface 1297, and/or a spline nub edge 1298. In some embodiments, spline nub edge 1298 can circumscribe spline nub lateral surface 1297 and/or have a substantially arcuate or planar shape. When spline nub edge 1298 has a substantially arcuate shape, it is easier to insert spline nub 1217 into nose spline receiver grooves 127, 217, 317. In the same or different embodiments, plurality of spline nub bends 1292 can have a substantially arcuate or planar shape. When plurality of spline nub bends 1292 has a substantially arcuate shape, it is easier to insert spline nub 1217 into nose spline receiver grooves 127, 217, 317. In some embodiments, spline nub riser section 1295 extends between spline nub bend 1292 and spline nub riser interface 1296. In this way, spline nub riser prevents rotation of spline 1200 when spline nub 1217 is worn down from repeated insertions.

Returning to FIG. 12A, in some embodiments, riser portion 1220 can comprise riser bend bottom interface 1221, riser bend 1222, riser bend top interface 1223, and/or riser section 1224. In the same or different embodiments, riser bend bottom interface 1221 can extend from nose top section 1211. In further embodiments, riser bend 1222 can extend from riser bend bottom interface 1223. In the same or different embodiments, riser bend 1222 can have a substantially arcuate shape, which allows for easy and thorough cleaning and/or disinfection because the lack of sharp corners and crevices prevents microorganisms from evading disinfectant. When riser bend 1222 has a substantially arcuate shape, laminar airflow can also be enhanced because air streams do not encounter sharp corners. As an example, the substantially arcuate shape of riser bend 1222 can be a concave shape or a convex shape. In some embodiments, riser bend top interface 1223 can extend from riser bend 1222. In the same or different embodiments, riser section 1224 can extend from riser top interface 1223. In various embodiments, riser section 1224 has a substantially planar shape, can be parallel to nose front section 1213, and/or be perpendicular to nose bottom section 1212.

In the same or different embodiments, wall groove portion 1230 can comprise a groove front section 1231, a groove bend 1232, a groove back section 1233, a groove front edge 1234, and/or a groove back edge 1235. In some embodiments, groove front section 1231 can extend from the riser section 1224. As an example, groove front section 1231 and riser section 1224 can be coplanar with each other. In various embodiments, groove front section 1231 has a substantially planar shape, can be parallel to nose front section 1213, and/or be perpendicular to nose bottom section 1212. In the same or different embodiments, groove front section 1231 terminates at groove front edge 1234. In various embodiments, groove front edge 1234 can have a substantially planar shape or a substantially arcuate shape. In further embodiments, groove bend 1232 can extend from groove front end 1231. In various embodiments, groove bend 1232 can have a substantially planar or substantially arcuate shape. In the same or different embodiments, groove bend 1232 can form a 180 degree bend, such that groove back section 1233 can be approximately parallel to groove front section 1231. In various embodiments, groove back section 1233 can extend from groove bend 1232 and terminate at groove back edge 1235. In further embodiments, groove back edge 1235 can have a substantially planar shape or a substantially arcuate shape.

Returning to FIG. 12C, spline portion 1240 can comprise a spline plate 1241 extending out of lateral side 1218. In various embodiments, there can be a plurality of spline plates 1241 extending from opposite lateral sides of spline 1200, as shown in FIGS. 12A-12C. In the same or different embodiments, spline plate 1241 can comprise a front spline plate surface 1242 and/or a back spline plate surface 1243. In further embodiments, spline plate 1241 can comprise a lateral spline edge 1248, top corner spline edge 1244, a top spline edge 1245, a bottom spline edge 1246, and a bottom corner spline edge 1247. In various embodiments, lateral spline edge 1248, top corner spline edge 1244, top spline edge 1245, bottom spline edge 1246, and/or bottom corner spline edge 1247 can have a substantially planar shape or a substantially arcuate shape. When lateral spline edge 1248, top corner spline edge 1244, top spline edge 1245, bottom spline edge 1246, and/or bottom corner spline edge 1247 have a substantially arcuate shape, it is easier to insert spline plate 1241 into receiver section 145 as buffeted by top receiver nub 146 and bottom receiver nub 142.

In various embodiments, back spline plate surface 1243 can span across and be contiguous and co-planar with back spline surface 1249. In some embodiments, top nose bend 1214 can form top nose angle 1282 between nose top section 1211 and nose front section 1213. In various embodiments, top nose angle 1282 can be an approximately right angle. In the same or different embodiments, top nose angle 1282 can be an acute angle or an obtuse angle. When top nose angle 1282 is an approximately right angle, flooring material (not shown) can lay flush against nose front section 1213, thus providing an approximately flat surface across nose top section 1211 and flooring material (not shown). When top nose angle 1282 is an acute angle, material costs are saved because nose bottom section 1212 is smaller. When top nose angle 1282 is an obtuse angle, a channel can be formed with flooring material (not shown), which can be used as an aid for applying adhesive or sealant. In some embodiments, nose bottom bend 1215 can form bottom nose angle 1281 between nose bottom section 1212 and nose front section 1213. In various embodiments, bottom nose angle 1281 can be an approximately right angle. In the same or different embodiments, bottom nose angle 1281 can be an acute angle or an obtuse angle. When bottom nose angle 1281 is an approximately right angle, flooring material (not shown) can lay flush against nose front section 1213, thus providing an approximately flat surface across nose top section 1211 and flooring material (not shown). When bottom nose angle 1281 is an acute angle, a channel can be formed with flooring material (not shown), which can be used as an aid for applying adhesive or sealant. When bottom nose angle 1281 is an obtuse angle, material costs are saved because nose bottom section 1212 is smaller.

Turning now to FIG. 12B, a frontal view of spline 1200 is shown. In some embodiments, corner portion 1260 can comprise corner bottom nose bend 1271, corner nose front interface 1261, corner top nose bend 1262, corner nose top interface 1263, corner riser bend bottom interface 1272, corner riser bend 1264, corner riser bend bottom interface 1273, corner riser interface 1265, corner top bend 1266, corner groove back section interface 1267, and/or corner groove back section bend 1268. In some embodiments, corner portion 1260 forms a right angle of an exterior corner. In the same or different embodiments, corner portion 1260 forms an acute angle of an exterior corner. In still other embodiments, corner portion 1260 forms an obtuse angle of an exterior corner.

In further embodiments, corner bottom nose bend 1271 extends between a plurality of bottom nose bends 1215. In the same or different embodiments, corner bottom nose bend 1271 can have a substantially planar shape. In some embodiments, corner bottom nose bend 1271 can have an arcuate shape, which allows for easy and thorough cleaning and/or disinfection because the lack of sharp corners and crevices prevents microorganisms from evading disinfectant. When corner bottom nose bend 1271 has a substantially arcuate shape, laminar airflow can also be enhanced because air streams do not encounter sharp corners. As an example, the substantially arcuate shape of bottom nose bend 1271 can be a concave shape or a convex shape. In further embodiments, corner nose front interface 1261 extends between a plurality of nose front sections 1213. In the same or different embodiments, corner nose front interface 1261 can have a substantially planar shape. In some embodiments, corner nose front interface 1261 can have an arcuate shape, which allows for easy and thorough cleaning and/or disinfection because the lack of sharp corners and crevices prevents microorganisms from evading disinfectant. When corner nose front interface 1261 has a substantially arcuate shape, laminar airflow can also be enhanced because air streams do not encounter sharp corners. As an example, the substantially arcuate shape of corner nose front interface 1261 can be a concave shape or a convex shape. In further embodiments, corner top nose bend 1262 extends between a plurality of top nose bends 1214. In the same or different embodiments, corner top nose bend 1262 can have a substantially planar shape. In some embodiments, corner top nose bend 1262 can have an arcuate shape, which allows for easy and thorough cleaning and/or disinfection because the lack of sharp corners and crevices prevents microorganisms from evading disinfectant. When corner top nose bend 1262 has a substantially arcuate shape, laminar airflow can also be enhanced because air streams do not encounter sharp corners. As an example, the substantially arcuate shape of corner top nose bend 1262 can be a concave shape or a convex shape. In further embodiments, corner nose top interface 1263 extends between a plurality of nose top sections 1211. In the same or different embodiments, corner nose top interface 1263 can have a substantially planar shape.

In further embodiments, corner riser bend bottom interface 1272 extends between a plurality of riser bend bottom interfaces 1221. In the same or different embodiments, corner riser bend bottom interface 1272 can have a substantially planar shape. In some embodiments, corner riser bend bottom interface 1272 can have an arcuate shape, which allows for easy and thorough cleaning and/or disinfection because the lack of sharp corners and crevices prevents microorganisms from evading disinfectant. When corner riser bend bottom interface 1272 has a substantially arcuate shape, laminar airflow can also be enhanced because air streams do not encounter sharp corners. As an example, the substantially arcuate shape of corner riser bend bottom interface 1272 can be a concave shape or a convex shape. In further embodiments, corner riser bend 1264 extends between a plurality of riser bends 1264. In the same or different embodiments, corner riser bend 1264 can have a substantially planar shape. In some embodiments, corner riser bend 1264 can have an arcuate shape, which allows for easy and thorough cleaning and/or disinfection because the lack of sharp corners and crevices prevents microorganisms from evading disinfectant. When corner riser bend 1264 has a substantially arcuate shape, laminar airflow can also be enhanced because air streams do not encounter sharp corners. As an example, the substantially arcuate shape of corner riser bend 1264 can be a concave shape or a convex shape. In further embodiments, corner riser bend bottom interface 1273 extends between a plurality of riser bend bottom interfaces 1223. In the same or different embodiments, corner riser bend bottom interface 1273 can have a substantially planar shape. In some embodiments, corner riser bend bottom interface 1273 can have an arcuate shape, which allows for easy and thorough cleaning and/or disinfection because the lack of sharp corners and crevices prevents microorganisms from evading disinfectant. When corner riser bend bottom interface 1273 has a substantially arcuate shape, laminar airflow can also be enhanced because air streams do not encounter sharp corners. As an example, the substantially arcuate shape of corner riser bend bottom interface 1273 can be a concave shape or a convex shape. In further embodiments, corner riser interface 1265 extends between a plurality of riser sections 1224 and/or groove front sections 1231. In the same or different embodiments, corner riser interface 1265 can have a substantially planar shape. In some embodiments, corner riser interface 1265 can have an arcuate shape, which allows for easy and thorough cleaning and/or disinfection because the lack of sharp corners and crevices prevents microorganisms from evading disinfectant. When corner riser interface 1265 has a substantially arcuate shape, laminar airflow can also be enhanced because air streams do not encounter sharp corners. As an example, the substantially arcuate shape of corner riser interface 1265 can be a concave shape or a convex shape. In some embodiments, corner top bend 1266 extends between a plurality of groove front edges 1234. In further embodiments, corner groove back section interface 1267 extends between a plurality of groove back sections 1233. In the same or different embodiments, corner groove back section interface 1267 can have a substantially planar shape. In some embodiments, corner groove back section interface 1267 can have an arcuate shape, which allows for easy and thorough cleaning and/or disinfection because the lack of sharp corners and crevices prevents microorganisms from evading disinfectant. When corner groove back section interface 1267 has a substantially arcuate shape, laminar airflow can also be enhanced because air streams do not encounter sharp corners. As an example, the substantially arcuate shape of corner groove back section interface 1267 can be a concave shape or a convex shape. In further embodiments, corner groove back section bend 1268 extends between a plurality of groove back sections 1233. In the same or different embodiments, corner groove back section bend 1268 can have a substantially planar shape. In some embodiments, corner groove back section bend 1268 can have an arcuate shape, which allows for easy and thorough cleaning and/or disinfection because the lack of sharp corners and crevices prevents microorganisms from evading disinfectant. When corner groove back section bend 1268 has a substantially arcuate shape, laminar airflow can also be enhanced because air streams do not encounter sharp corners. As an example, the substantially arcuate shape of corner groove back section bend 1268 can be a concave shape or a convex shape.

Figure 13A:
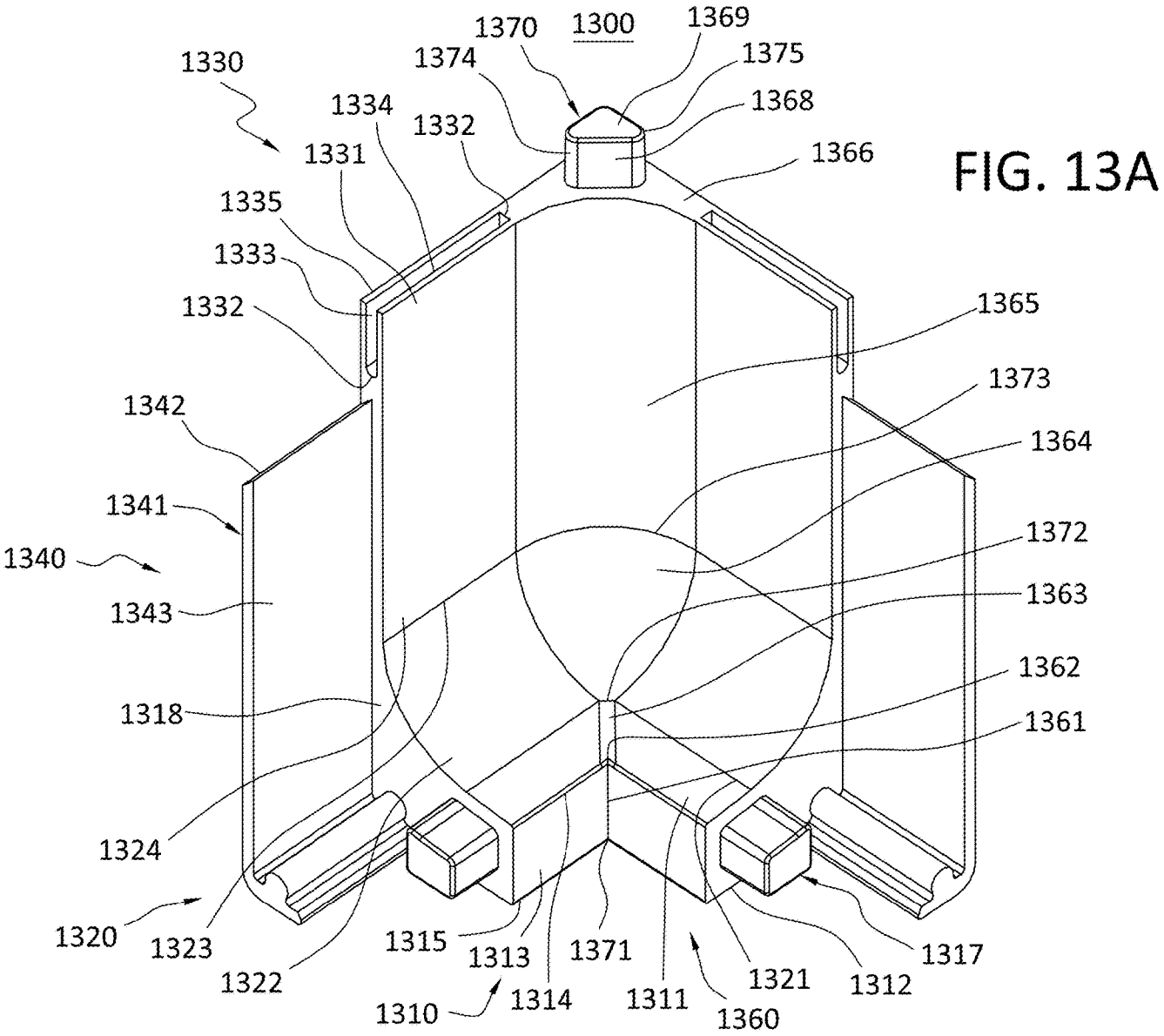

Turning now to FIG. 13A, an exemplary embodiment of spline 1300 is shown in a frontal view. In many embodiments, spline 1300 can comprise a single, integrated piece. As an example, in embodiments where spline receiver portion 240 (FIGS. 2A and 2B) comprises one or more recesses or female portions, spline 1300 can comprise one or more complementary male portions to couple with the one or more recesses or female portions. In other embodiments (not shown in FIGS. 13A-13B), the spline receiver portion or spline coupling portion of the baseboard element comprises one or more male portions, the spline can comprise one or more complementary female portions to couple with the one or more male portions.

As shown in FIG. 13A, spline 1300 can comprise a nose portion 1310, a riser portion 1320, a wall groove portion 1330, spline portion 1340, and a corner portion 1360. In some embodiments, nose portion 1310 can further comprise a nose top section 1311, a nose bottom section 1312, and/or a nose front section 1313. In the same or different embodiments, nose top section 1311 can have a substantially planar shape. In the same or different embodiments, nose top section 1311 can extend approximately parallel to nose bottom section 1312 and approximately perpendicular to nose front section 1313.

In some embodiments, nose front section 1313 can have a substantially planar shape. In the same or different embodiments, nose front section 1313 extends between nose top section 1311 and nose bottom section 1312. In the same or different embodiments, nose portion 1310 can comprise top nose bend 1314. In further embodiments, top nose bend 1314 can extend between nose top section 1311 and nose front section 1313. In the same or different embodiments, nose portion 1310 can comprise bottom nose bend 1315. In further embodiments, bottom nose bend 1315 can extend between nose bottom section 1312 and nose front section 1313. In the same or different embodiments, nose bottom section 1312 can comprise nose bottom groove (not shown). In some embodiments, nose bottom groove (not shown) can be configured to receive epoxy, glue, or sealant such that spline 1300 is coupled to a ground surface 1301 (FIG. 13C). In some embodiments, the coupling of spline 1300 to a ground surface 1301 (FIG. 13C) occurs in a way that is water tight and/or air tight.

Figure 13B:
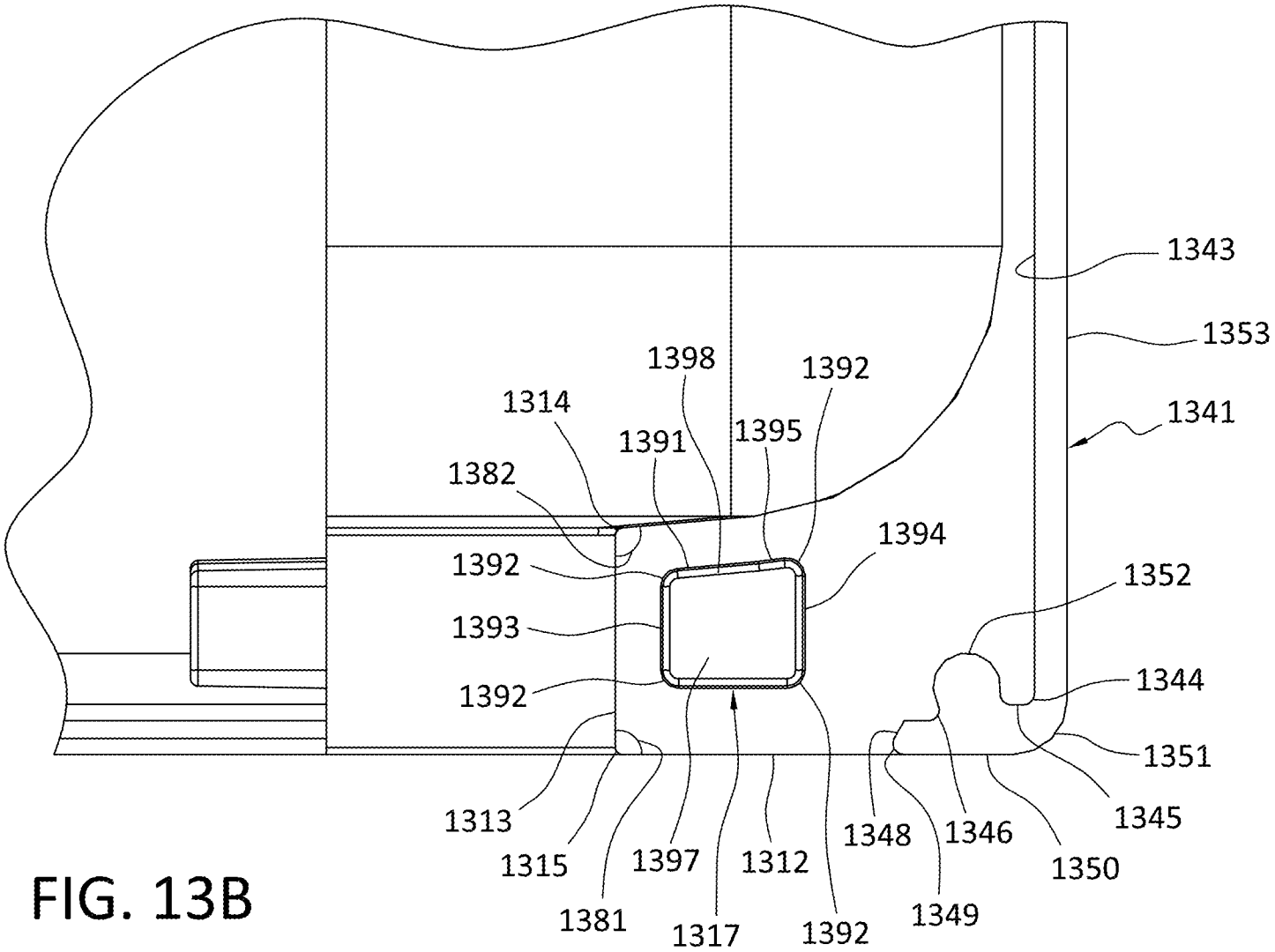

Turning now to FIG. 13B, in further embodiments, nose portion 1310 further comprises a spline nub 1317 extending from a lateral side 1318 (FIG. 13A). As shown in FIG. 13A, nose portion 1310 can include two spline nubs 1317 at opposite lateral sides of nose portion 1310. In some embodiments, spline nub 1317 can comprise a variety of shapes configured to be inserted into a variety of nose spline receiver grooves 117, 217, 317 (FIGS. 1A-3B) such that inserting or otherwise locating spline nub 1317 into nose spline receiver grooves 117, 217, 317 (FIGS. 1A-3B) couples baseboard elements 100, 200, 300 (FIGS. 1A-3B) to spline 1300. In various embodiments, spline nub 1317 can comprise a substantially rectangular shape, a substantially circular shape, a substantially triangular shape, and/or a substantially semi-circular shape. In some embodiments, spline nub 1317 can be proximate to back key bend 1351 such that it can be inserted into back spline receiver groove 148, 248, 346. In the same or different embodiments, spline nub 1317 can comprise a top spline nub surface 1391, a plurality of spline nub bends 1392, a front spline nub surface 1393, a bottom spline nub surface 1399, a back spline nub surface 1394, a spline nub riser section 1395, a spline nub riser interface 1396, a spline nub lateral surface 1397, and/or a spline nub edge 1398. In some embodiments, spline nub edge 1398 can circumscribe spline nub lateral surface 1397 and/or have a substantially arcuate or planar shape. When spline nub edge 1398 has a substantially arcuate shape, it is easier to insert spline nub 1317 into nose spline receiver grooves 117, 217, 317 (FIGS. 1A-3B). In the same or different embodiments, plurality of spline nub bends 1392 can have a substantially arcuate or planar shape. When plurality of spline nub bends 1392 has a substantially arcuate shape, it is easier to insert spline nub 1317 into nose spline receiver grooves 117, 217, 317 (FIGS. 1A-3B). In some embodiments, spline nub riser section 1395 extends between spline nub bend 1392 and spline nub riser interface 1396. In this way, spline nub riser prevents rotation of spline 1300 when spline nub 1317 is worn down from repeated insertions.

Returning to FIG. 13A, in some embodiments, riser portion 1320 can comprise riser bend bottom interface 1321, riser bend 1322, riser bend top interface 1323, and/or riser section 1324. In the same or different embodiments, riser bend bottom interface 1321 can extend from nose top section 1311. In further embodiments, riser bend 1322 can extend from riser bend bottom interface 1321. In the same or different embodiments, riser bend 1322 can have a substantially arcuate shape, which allows for easy and thorough cleaning and/or disinfection because the lack of sharp corners and crevices prevents microorganisms from evading disinfectant. When riser bend 1322 has a substantially arcuate shape, laminar airflow can also be enhanced because air streams do not encounter sharp corners. As an example, the substantially arcuate shape of riser bend 1322 can be a concave shape or a convex shape. In some embodiments, riser bend top interface 1323 can extend from riser bend 1322. In the same or different embodiments, riser section 1324 can extend from riser top interface 1323. In various embodiments, riser section 1324 has a substantially planar shape, can be parallel to nose front section 1313, and/or be perpendicular to nose bottom section 1312.

In the same or different embodiments, wall groove portion 1330 can comprise a groove front section 1331, a groove bend 1332, a groove back section 1333, a groove front edge 1334, and/or a groove back edge 1335. In some embodiments, groove front section 1331 can extend from the riser section 1324. As an example, groove front section 1331 and riser section 1324 can be coplanar with each other. In various embodiments, groove front section 1331 has a substantially planar shape, can be parallel to nose front section 1313, and/or be perpendicular to nose bottom section 1312. In the same or different embodiments, groove front section 1331 terminates at groove front edge 1334. In various embodiments, groove front edge 1334 can have a substantially planar shape or a substantially arcuate shape. In further embodiments, groove bend 1332 can extend from groove front end 1331. In various embodiments, groove bend 1332 can have a substantially planar or substantially arcuate shape. In the same or different embodiments, groove bend 1332 can form a 180 degree bend, such that groove back section 1333 can be approximately parallel to groove front section 1331. In various embodiments, groove back section 1333 can extend from groove bend 1332 and terminate at groove back edge 1335. In further embodiments, groove back edge 1335 can have a substantially planar shape or a substantially arcuate shape.

Returning to FIG. 13B, in some embodiments, spline portion 1340 can comprise a spline wing 1341 extending from lateral side 1318 (FIG. 13A). In various embodiments, there can be a single spline plate extending from each of the lateral sides of spline 1300, as shown in FIGS. 13A and 13B. In some embodiments, spline wing 1341 can comprise a top edge 1342 (FIG. 13A). In various embodiments, top edge 1342 (FIG. 13A) can have a can have a substantially arcuate or planar shape. When top edge 1342 (FIG. 13A) has a substantially arcuate shape, it is easier to couple spline 1300 with a baseboard element. In the same or different embodiments, front surface 1343 can extend from top edge 1342 (FIG. 13A). In further embodiments, front bend 1344 can extend from front surface 1343. In various embodiments, front bend 1344 can form an approximately right angle. In the same or different embodiments, front bend 1344 can form an acute angle or an obtuse angle. In embodiments where front bend 1344 forms a right angle, spline wing bottom surface 1350 can lay flush against ground surface 1301 while back surface 1353 (FIG. 13B) lays against a wall surface (not shown). In some embodiments, bend interface 1345 can extend between front bend 1344 and back key 1352. Thereby, the shape created by bend interface 1344, front bend 1345, and back key 1352 prevents a baseboard element from moving away from a wall surface (not shown), the spline 1300, and/or a ground surface 1301. In various embodiments, back key 1352 can comprise a substantially rectangular shape, a substantially circular shape, a substantially triangular shape, and/or a substantially semi-circular shape. In some embodiments, middle key bend 1346 extends between back key 1352 and front key 1347. In various embodiments, front key 1347 extends between key riser section 1348 and key bend 1346. In further embodiments, front key bend 1349 extends between key riser section 1348 and spline wing bottom surface 1350. In further embodiments, back key bend 1351 extends between spline wing bottom surface 1350 and back surface 1353. In some embodiments, spline wing bottom surface 1350 can comprise grooves (not shown), which can be configured to receive epoxy, glue, or sealant such that spline 1300 is coupled to a ground surface 1301. In some embodiments, the coupling of spline 1300 to a ground surface 1301 occurs in a way that is water tight and/or air tight.

In various embodiments, back spline plate surface 1353 can span across and be contiguous and co-planar with back corner surface (not shown). In some embodiments, top nose bend 1314 can form top nose angle 1382 between nose top section 1311 and nose front section 1313. In various embodiments, top nose angle 1382 can be an approximately right angle. In the same or different embodiments, top nose angle 1382 can be an acute angle or an obtuse angle. When top nose angle 1382 is an approximately right angle, flooring material 1302 can lay flush against nose front section 1313, thus providing an approximately flat surface across nose top section 1311 and flooring material 1302. When top nose angle 1382 is an acute angle, material costs are saved because nose bottom section 1312 is smaller. When top nose angle 1382 is an obtuse angle, a channel can be formed with flooring material 1302, which can be used as an aid for applying adhesive or sealant. In some embodiments, nose bottom bend 1315 can form bottom nose angle 1381 between nose bottom section 1312 and nose front section 1313. In various embodiments, bottom nose angle 1381 can be an approximately right angle. In the same or different embodiments, bottom nose angle 1381 can be an acute angle or an obtuse angle. When bottom nose angle 1381 is an approximately right angle, flooring material 1302 can lay flush against nose front section 1313, thus providing an approximately flat surface across nose top section 1311 and flooring material 1302. When bottom nose angle 1381 is an acute angle, a channel can be formed with flooring material 1302, which can be used as an aid for applying adhesive or sealant. When bottom nose angle 1381 is an obtuse angle, material costs are saved because nose bottom section 1312 is smaller.

Returning to FIG. 13A, in some embodiments, corner portion 1360 can comprise corner bottom nose bend 1371, corner nose front section 1361, corner top nose bend 1362, corner nose top section 1363, corner riser bend bottom interface 1372, corner riser bend 1364, corner riser bend bottom interface 1373, corner riser section 1365, corner top surface 1366, and/or corner nub 1370. In some embodiments, corner portion 1360 forms a right angle of an interior corner. In the same or different embodiments, corner portion 1360 forms an acute angle of an interior corner. In still other embodiments, corner portion 1360 forms an obtuse angle of an interior corner.

In further embodiments, corner bottom nose bend 1371 extends between a plurality of bottom nose bends 1315. In the same or different embodiments, corner bottom nose bend 1371 can have a substantially planar shape. In some embodiments, corner bottom nose bend 1371 can have an arcuate shape, which allows for easy and thorough cleaning and/or disinfection because the lack of sharp corners and crevices prevents microorganisms from evading disinfectant. When corner bottom nose bend 1371 has a substantially arcuate shape, laminar airflow can also be enhanced because air streams do not encounter sharp corners. As an example, the substantially arcuate shape of corner bottom nose bend 1371 can be a concave shape or a convex shape. In further embodiments, corner nose front section 1361 extends between a plurality of nose front sections 1313. In the same or different embodiments, corner nose front section 1361 can have a substantially planar shape. In some embodiments, corner nose front section 1361 can have an arcuate shape, which allows for easy and thorough cleaning and/or disinfection because the lack of sharp corners and crevices prevents microorganisms from evading disinfectant. When corner nose front section 1361 has a substantially arcuate shape, laminar airflow can also be enhanced because air streams do not encounter sharp corners. As an example, the substantially arcuate shape of corner nose front section 1361 can be a concave shape or a convex shape. In further embodiments, corner top nose bend 1362 extends between a plurality of top nose bends 1314. In the same or different embodiments, corner top nose bend 1362 can have a substantially planar shape. In some embodiments, corner top nose bend 1362 can have an arcuate shape, which allows for easy and thorough cleaning and/or disinfection because the lack of sharp corners and crevices prevents microorganisms from evading disinfectant. When corner top nose bend 1362 has a substantially arcuate shape, laminar airflow can also be enhanced because air streams do not encounter sharp corners. As an example, the substantially arcuate shape of corner top nose bend 1362 can be a concave shape or a convex shape. In further embodiments, corner nose top section 1363 extends between a plurality of nose top sections 1311. In the same or different embodiments, corner nose top section 1363 can have a substantially planar shape.

In further embodiments, corner riser bend bottom interface 1372 extends between a plurality of riser bend bottom interfaces 1321. In the same or different embodiments, corner riser bend bottom interface 1372 can have a substantially planar shape. In some embodiments, corner riser bend bottom interface 1372 can have an arcuate shape, which allows for easy and thorough cleaning and/or disinfection because the lack of sharp corners and crevices prevents microorganisms from evading disinfectant. When corner riser bend bottom interface 1372 has a substantially arcuate shape, laminar airflow can also be enhanced because air streams do not encounter sharp corners. As an example, the substantially arcuate shape of corner riser bend bottom interface 1372 can be a concave shape or a convex shape. In further embodiments, corner riser bend 1364 extends between a plurality of riser bends 1364. In the same or different embodiments, corner riser bend 1364 can have a substantially planar shape. In some embodiments, corner riser bend 1364 can have an arcuate shape, which allows for easy and thorough cleaning and/or disinfection because the lack of sharp corners and crevices prevents microorganisms from evading disinfectant. When corner riser bend 1364 has a substantially arcuate shape, laminar airflow can also be enhanced because air streams do not encounter sharp corners. As an example, the substantially arcuate shape of corner riser bend 1364 can be a concave shape or a convex shape. In further embodiments, corner riser bend bottom interface 1373 extends between a plurality of riser bend top interfaces 1323. In the same or different embodiments, corner riser bend bottom interface 1373 can have a substantially planar shape. In some embodiments, corner riser bend bottom interface 1373 can have an arcuate shape, which allows for easy and thorough cleaning and/or disinfection because the lack of sharp corners and crevices prevents microorganisms from evading disinfectant. When corner riser bend bottom interface 1373 has a substantially arcuate shape, laminar airflow can also be enhanced because air streams do not encounter sharp corners. As an example, the substantially arcuate shape of corner riser bend bottom interface 1373 can be a concave shape or a convex shape. In further embodiments, corner riser section 1365 extends between a plurality of riser sections 1324 and/or groove bends 1332. In the same or different embodiments, corner riser section 1365 can have a substantially planar shape. In some embodiments, corner riser section 1365 can have an arcuate shape, which allows for easy and thorough cleaning and/or disinfection because the lack of sharp corners and crevices prevents microorganisms from evading disinfectant. When corner riser section 1365 has a substantially arcuate shape, laminar airflow can also be enhanced because air streams do not encounter sharp corners. As an example, the substantially arcuate shape of corner riser section 1365 can be a concave shape or a convex shape. In some embodiments, corner top surface 1366 extends between a plurality of groove bends 1332.

In some embodiments, corner nub 1370 extends out of top surface 1366. In the same or different embodiments, corner nub 1370 comprises a plurality of corner nub surfaces 1368, corner nub top surface 1369, and/or a plurality of corner nub bends 1374. In some embodiments, corner nub edge 1375 can circumscribe corner nub top surface 1369 and/or have a substantially arcuate or planar shape. When corner nub edge 1375 has a substantially arcuate shape, it is easier to insert corner nub 1370 into nub receiver grooves. In some embodiments, corner nub 1370 can comprise a variety of shapes configured to be inserted into a variety of nub receiver grooves, such that inserting or otherwise locating corner nub 1370 into nub receiver grooves couples a wall corner element to spline 1300 while a wall corner element remains substantially immobile. In various embodiments, corner nub 1370 can comprise a substantially rectangular shape, a substantially circular shape, a substantially triangular shape, and/or a substantially semi-circular shape.

Figure 14A:
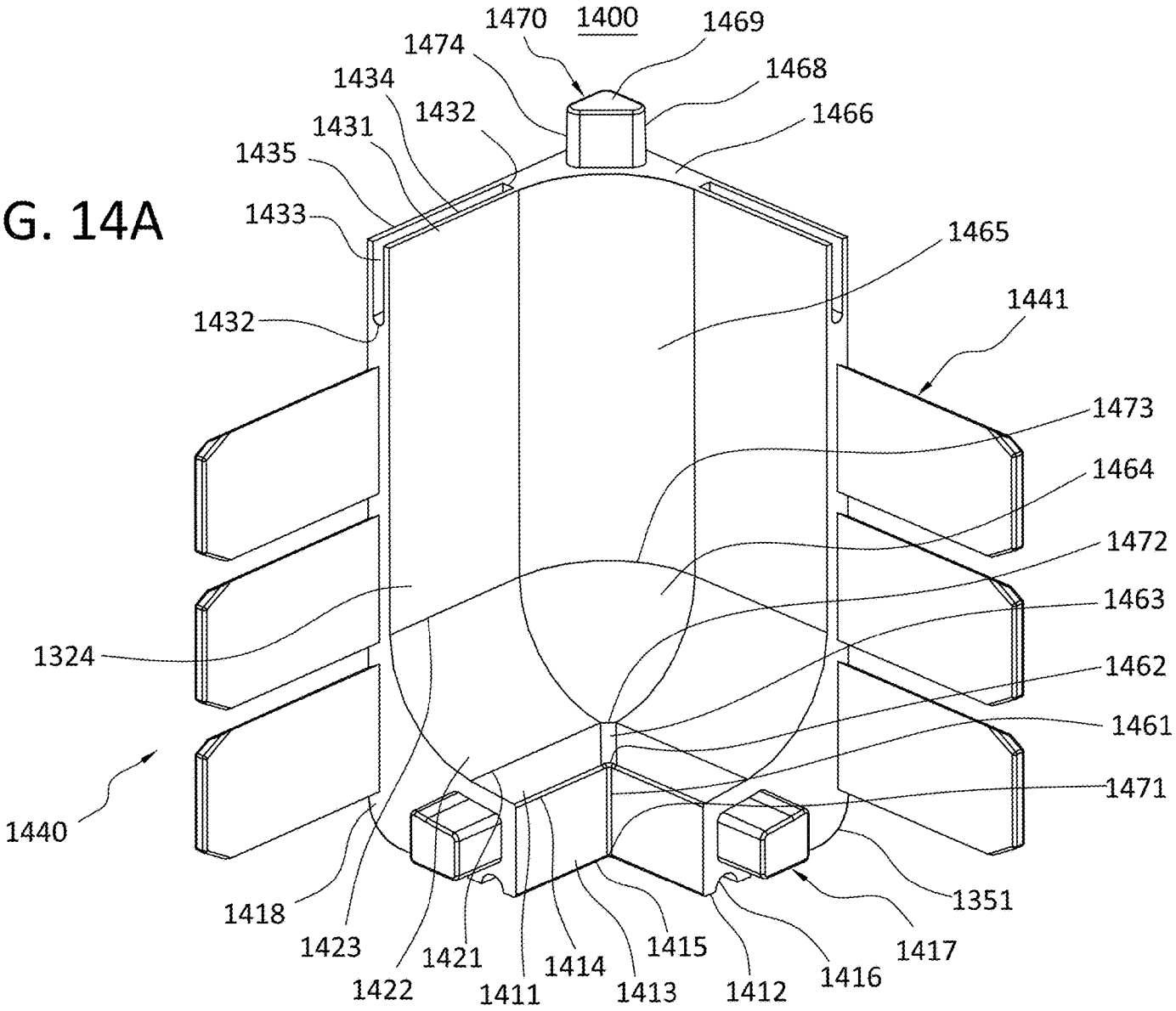

Turning now to FIG. 14A, an exemplary embodiment of spline 1400 is shown in a frontal view. In many embodiments, spline 1400 can comprise a single, integrated piece. As an example, in embodiments where spline receiver portion 240 (FIGS. 2A and 2B) comprises one or more recesses or female portions, spline 1400 can comprise one or more complementary male portions to couple with the one or more recesses or female portions. In other embodiments (not shown in FIGS. 14A and 14B), the spline receiver portion or spline coupling portion of the baseboard element comprises one or more male portions, the spline can comprise one or more complementary female portions to couple with the one or more male portions.

As shown in FIG. 14A, spline 1400 can comprise a nose portion 1410, a riser portion 1420, a wall groove portion 1430, spline portion 1440, and a corner portion 1460. In some embodiments, nose portion 1410 can further comprise a nose top section 1411, a nose bottom section 1412, and/or a nose front section 1413. In the same or different embodiments, nose top section 1411 can have a substantially planar shape. In the same or different embodiments, nose top section 1411 can extend approximately parallel to nose bottom section 1412 and approximately perpendicular to nose front section 1413.

In some embodiments, nose front section 1413 can have a substantially planar shape. In the same or different embodiments, nose front section 1413 extends between nose top section 1411 and nose bottom section 1412. In the same or different embodiments, nose portion 1410 can comprise top nose bend 1414. In further embodiments, top nose bend 1414 can extend between nose top section 1411 and nose front section 1413. In the same or different embodiments, nose portion 1410 can comprise bottom nose bend 1415. In further embodiments, bottom nose bend 1415 can extend between nose bottom section 1412 and nose front section 1413. In the same or different embodiments, nose bottom section 1412 can comprise nose bottom groove (not shown). In some embodiments, nose bottom groove (not shown) can be configured to receive epoxy, glue, or sealant such that spline 1400 is coupled to a ground surface 1401 (FIG. 14C). In some embodiments, the coupling of spline 1400 to a ground surface 1401 (FIG. 14C) occurs in a way that is water tight and/or air tight.

Figure 14B:
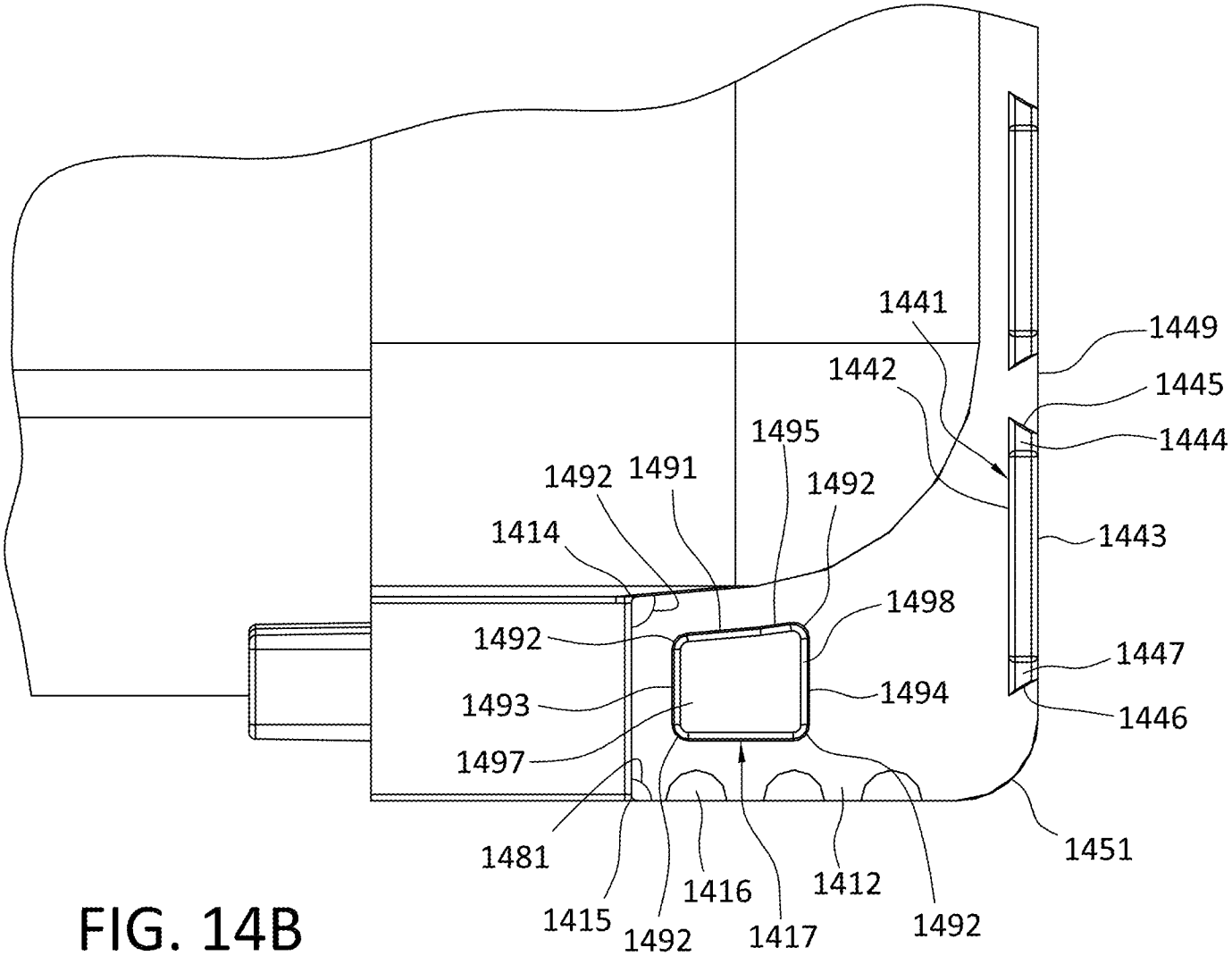

Turning now to FIG. 14B, in further embodiments, nose portion 1410 further comprises a spline nub 1417 extending from a lateral side 1418 (FIG. 14A). As shown in FIG. 14A, nose portion 1410 can include two spline nubs 1417 at opposite lateral sides of nose portion 1410. In some embodiments, spline nub 1417 can comprise a variety of shapes configured to be inserted into a variety of nose spline receiver grooves 117, 217, 317 (FIGS. 1A-3B) such that inserting or otherwise locating spline nub 1417 into nose spline receiver grooves 117, 217, 317 (FIGS. 1A-3B) couples baseboard elements 100, 200, 300 (FIGS. 1A-3B) to spline 1400. In various embodiments, spline nub 1417 can comprise a substantially rectangular shape, a substantially circular shape, a substantially triangular shape, and/or a substantially semi-circular shape. In some embodiments, spline nub 1417 can be proximate to back key bend 1451 such that it can be inserted into back spline receiver groove 148, 248, 346 (FIGS. 1A-3B). In the same or different embodiments, spline nub 1417 can comprise a top spline nub surface 1491, a plurality of spline nub bends 1492, a front spline nub surface 1493, a bottom spline nub surface 1499, a back spline nub surface 1494, a spline nub riser section 1495, a spline nub riser interface 1496, a spline nub lateral surface 1497, and/or a spline nub edge 1498. In some embodiments, spline nub edge 1498 can circumscribe spline nub lateral surface 1497 and/or have a substantially arcuate or planar shape. When spline nub edge 1498 has a substantially arcuate shape, it is easier to insert spline nub 1417 into nose spline receiver grooves 117, 217, 317 (FIGS. 1A-3B). In the same or different embodiments, plurality of spline nub bends 1492 can have a substantially arcuate or planar shape. When plurality of spline nub bends 1492 has a substantially arcuate shape, it is easier to insert spline nub 1417 into nose spline receiver grooves 117, 217, 317 (FIGS. 1A-3B). In some embodiments, spline nub riser section 1495 extends between spline nub bend 1492 and spline nub riser interface 1496. In this way, spline nub riser prevents rotation of spline 1400 when spline nub 1417 is worn down from repeated insertions.

Returning to FIG. 14A, in some embodiments, riser portion 1420 can comprise riser bend bottom interface 1421, riser bend 1422, riser bend top interface 1423, and/or riser section 1424. In the same or different embodiments, riser bend bottom interface 1421 can extend from nose top section 1411. In further embodiments, riser bend 1422 can extend from riser bend bottom interface 1423. In the same or different embodiments, riser bend 1422 can have a substantially arcuate shape, which allows for easy and thorough cleaning and/or disinfection because the lack of sharp corners and crevices prevents microorganisms from evading disinfectant. When riser bend 1422 has a substantially arcuate shape, laminar airflow can also be enhanced because air streams do not encounter sharp corners. As an example, the substantially arcuate shape of riser bend 1422 can be a concave shape or a convex shape. In some embodiments, riser bend top interface 1423 can extend from riser bend 1422. In the same or different embodiments, riser section 1424 can extend from riser top interface 1423. In various embodiments, riser section 1424 has a substantially planar shape, can be parallel to nose front section 1413, and/or be perpendicular to nose bottom section 1412.

In the same or different embodiments, wall groove portion 1430 can comprise a groove front section 1431, a groove bend 1432, a groove back section 1433, a groove front edge 1434, and/or a groove back edge 1435. In some embodiments, groove front section 1431 can extend from the riser section 1424. As an example, groove front section 1431 and riser section 1424 can be coplanar with each other. In various embodiments, groove front section 1431 has a substantially planar shape, can be parallel to nose front section 1413, and/or be perpendicular to nose bottom section 1412. In the same or different embodiments, groove front section 1431 terminates at groove front edge 1434. In various embodiments, groove front edge 1434 can have a substantially planar shape or a substantially arcuate shape. In further embodiments, groove bend 1432 can extend from groove front end 1431. In various embodiments, groove bend 1432 can have a substantially planar or substantially arcuate shape. In the same or different embodiments, groove bend 1432 can form a 180 degree bend, such that groove back section 1433 can be approximately parallel to groove front section 1431. In various embodiments, groove back section 1433 can extend from groove bend 1432 and terminate at groove back edge 1435. In further embodiments, groove back edge 1435 can have a substantially planar shape or a substantially arcuate shape.

Returning to FIG. 14B, spline portion 1440 can comprise a spline plate 1441 extending out of lateral side 1418. In various embodiments, there can be a plurality of spline plates 1441 extending from opposite lateral sides of spline 1400, as shown in FIGS. 14A and 14B. In the same or different embodiments, spline plate 1441 can comprise a front spline plate surface 1442 and/or a back spline plate surface 1443. In further embodiments, spline plate 1441 can comprise a lateral spline edge 1448, top corner spline edge 1444, a top spline edge 1445, a bottom spline edge 1446, and a bottom corner spline edge 1447. In various embodiments, lateral spline edge 1448, top corner spline edge 1444, top spline edge 1445, bottom spline edge 1446, and/or bottom corner spline edge 1447 can have a substantially planar shape or a substantially arcuate shape. When lateral spline edge 1448, top corner spline edge 1444, top spline edge 1445, bottom spline edge 1446, and/or bottom corner spline edge 1447 have a substantially arcuate shape, it is easier to insert spline plate 1441 into receiver section 145 as buffeted by top receiver nub 146 and bottom receiver nub 142.

In various embodiments, back spline plate surface 1443 can span across and be contiguous and co-planar with back spline surface 1449. In some embodiments, top nose bend 1414 can form top nose angle 1482 between nose top section 1411 and nose front section 1413. In various embodiments, top nose angle 1482 can be an approximately right angle. In the same or different embodiments, top nose angle 1482 can be an acute angle or an obtuse angle. When top nose angle 1482 is an approximately right angle, flooring material (not shown) can lay flush against nose front section 1413, thus providing an approximately flat surface across nose top section 1411 and flooring material (not shown). When top nose angle 1482 is an acute angle, material costs are saved because nose bottom section 1412 is smaller. When top nose angle 1482 is an obtuse angle, a channel can be formed with flooring material (not shown), which can be used as an aid for applying adhesive or sealant. In some embodiments, nose bottom bend 1415 can form bottom nose angle 1481 between nose bottom section 1412 and nose front section 1413. In various embodiments, bottom nose angle 1481 can be an approximately right angle. In the same or different embodiments, bottom nose angle 1481 can be an acute angle or an obtuse angle. When bottom nose angle 1481 is an approximately right angle, flooring material (not shown) can lay flush against nose front section 1413, thus providing an approximately flat surface across nose top section 1411 and flooring material (not shown). When bottom nose angle 1481 is an acute angle, a channel can be formed with flooring material (not shown), which can be used as an aid for applying adhesive or sealant. When bottom nose angle 1481 is an obtuse angle, material costs are saved because nose bottom section 1412 is smaller.

Returning to FIG. 14A, in some embodiments, corner portion 1460 can comprise corner bottom nose bend 1471, corner nose front section 1461, corner top nose bend 1462, corner nose top section 1463, corner riser bend bottom interface 1472, corner riser bend 1464, corner riser bend bottom interface 1473, corner riser section 1465, corner top surface 1466, and/or corner nub 1470. In some embodiments, corner portion 1460 forms a right angle of an interior corner. In the same or different embodiments, corner portion 1460 forms an acute angle of an interior corner. In still other embodiments, corner portion 1460 forms an obtuse angle of an interior corner.

In further embodiments, corner bottom nose bend 1471 extends between a plurality of bottom nose bends 1415. In the same or different embodiments, corner bottom nose bend 1471 can have a substantially planar shape. In some embodiments, corner bottom nose bend 1471 can have an arcuate shape, which allows for easy and thorough cleaning and/or disinfection because the lack of sharp corners and crevices prevents microorganisms from evading disinfectant. When corner bottom nose bend 1471 has a substantially arcuate shape, laminar airflow can also be enhanced because air streams do not encounter sharp corners. As an example, the substantially arcuate shape of corner bottom nose bend 1471 can be a concave shape or a convex shape. In further embodiments, corner nose front section 1461 extends between a plurality of nose front sections 1413. In the same or different embodiments, corner nose front section 1461 can have a substantially planar shape. In some embodiments, corner nose front section 1461 can have an arcuate shape, which allows for easy and thorough cleaning and/or disinfection because the lack of sharp corners and crevices prevents microorganisms from evading disinfectant. When corner nose front section 1461 has a substantially arcuate shape, laminar airflow can also be enhanced because air streams do not encounter sharp corners. As an example, the substantially arcuate shape of corner nose front section 1461 can be a concave shape or a convex shape. In further embodiments, corner top nose bend 1462 extends between a plurality of top nose bends 1414. In the same or different embodiments, corner top nose bend 1462 can have a substantially planar shape. In some embodiments, corner top nose bend 1462 can have an arcuate shape, which allows for easy and thorough cleaning and/or disinfection because the lack of sharp corners and crevices prevents microorganisms from evading disinfectant. When corner top nose bend 1462 has a substantially arcuate shape, laminar airflow can also be enhanced because air streams do not encounter sharp corners. As an example, the substantially arcuate shape of corner top nose bend 1462 can be a concave shape or a convex shape. In further embodiments, corner nose top section 1463 extends between a plurality of nose top sections 1411. In the same or different embodiments, corner nose top section 1463 can have a substantially planar shape.

In further embodiments, corner riser bend bottom interface 1472 extends between a plurality of riser bend bottom interfaces 1421. In the same or different embodiments, corner riser bend bottom interface 1472 can have a substantially planar shape. In some embodiments, corner riser bend bottom interface 1472 can have an arcuate shape, which allows for easy and thorough cleaning and/or disinfection because the lack of sharp corners and crevices prevents microorganisms from evading disinfectant. When corner riser bend bottom interface 1472 has a substantially arcuate shape, laminar airflow can also be enhanced because air streams do not encounter sharp corners. As an example, the substantially arcuate shape of corner riser bend bottom interface 1472 can be a concave shape or a convex shape. In further embodiments, corner riser bend 1464 extends between a plurality of riser bends 1464. In the same or different embodiments, corner riser bend 1464 can have a substantially planar shape. In some embodiments, corner riser bend 1464 can have an arcuate shape, which allows for easy and thorough cleaning and/or disinfection because the lack of sharp corners and crevices prevents microorganisms from evading disinfectant. When corner riser bend 1464 has a substantially arcuate shape, laminar airflow can also be enhanced because air streams do not encounter sharp corners. As an example, the substantially arcuate shape of corner riser bend 1464 can be a concave shape or a convex shape. In further embodiments, corner riser bend bottom interface 1473 extends between a plurality of riser bend bottom interfaces 1423. In the same or different embodiments, corner riser bend bottom interface 1473 can have a substantially planar shape. In some embodiments, corner riser bend bottom interface 1473 can have an arcuate shape, which allows for easy and thorough cleaning and/or disinfection because the lack of sharp corners and crevices prevents microorganisms from evading disinfectant. When corner riser bend bottom interface 1473 has a substantially arcuate shape, laminar airflow can also be enhanced because air streams do not encounter sharp corners. As an example, the substantially arcuate shape of corner riser bend bottom interface 1473 can be a concave shape or a convex shape. In further embodiments, corner riser section 1465 extends between a plurality of riser sections 1424 and/or groove bends 1432. In the same or different embodiments, corner riser section 1465 can have a substantially planar shape. In some embodiments, corner riser section 1465 can have an arcuate shape, which allows for easy and thorough cleaning and/or disinfection because the lack of sharp corners and crevices prevents microorganisms from evading disinfectant. When corner riser section 1465 has a substantially arcuate shape, laminar airflow can also be enhanced because air streams do not encounter sharp corners. As an example, the substantially arcuate shape of corner riser section 1465 can be a concave shape or a convex shape. In some embodiments, corner top surface 1466 extends between a plurality of groove bends 1432.

In some embodiments, corner nub 1470 extends out of top surface 1466. In the same or different embodiments, corner nub 1470 comprises a plurality of corner nub surfaces 1468, corner nub top surface 1469, and/or a plurality of corner nub bends 1474. In some embodiments, corner nub edge 1475 can circumscribe corner nub top surface 1469 and/or have a substantially arcuate or planar shape. When corner nub edge 1475 has a substantially arcuate shape, it is easier to insert corner nub 1470 into nub receiver grooves. In some embodiments, corner nub 1470 can comprise a variety of shapes configured to be inserted into a variety of nub receiver grooves, such that inserting or otherwise locating corner nub 1470 into nub receiver grooves couples a wall corner element to spline 1400 while a wall corner element remains substantially immobile. In various embodiments, corner nub 1470 can comprise a substantially rectangular shape, a substantially circular shape, a substantially triangular shape, and/or a substantially semi-circular shape.

Figure 15A:
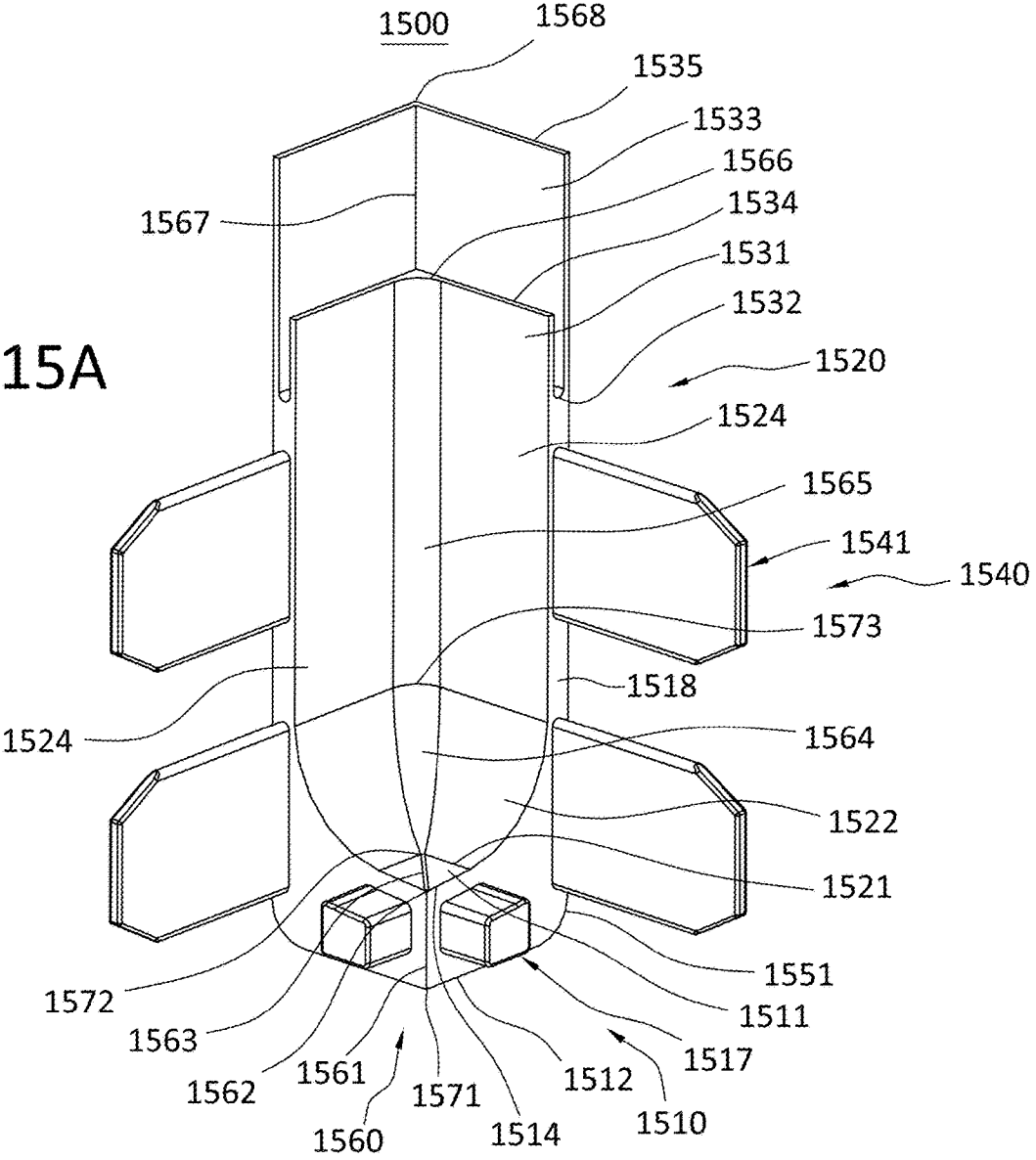

Turning now to FIG. 15A, an exemplary embodiment of spline 1500 is shown in an isometric view. In many embodiments, spline 1500 can comprise a single, integrated piece. As an example, in embodiments where spline receiver portion 340 (FIGS. 3A and 3B) comprises one or more recesses or female portions, spline 1500 can comprise one or more complementary male portions to couple with the one or more recesses or female portions. In other embodiments (not shown in FIGS. 15A and 15B), the spline receiver portion or spline coupling portion of the baseboard element comprises one or more male portions, the spline can comprise one or more complementary female portions to couple with the one or more male portions.

As shown in FIG. 15A, spline 1500 can comprise a nose portion 1510, a riser portion 1520, a wall groove portion 1530, spline portion 1540, and a corner portion 1560. In some embodiments, nose portion 1510 can further comprise a nose top section 1511 and/or a nose bottom section 1512. In the same or different embodiments, nose top section 1511 can have a substantially planar shape. In the same or different embodiments, nose top section 1511 can extend approximately parallel to nose bottom section 1512.

In the same or different embodiments, nose portion 1510 can comprise top nose bend 1514. In further embodiments, top nose bend 1514 can extend between nose top section 1511 and lateral surface 1518. In the same or different embodiments, nose bottom section 1512 can comprise nose bottom groove (not shown). In some embodiments, nose bottom groove (not shown) can be configured to receive epoxy, glue, or sealant such that spline 1500 is coupled to a ground surface 1501 (not shown). In some embodiments, the coupling of spline 1500 to a ground surface 1501 (not shown) occurs in a way that is water tight and/or air tight.

Figure 15B:
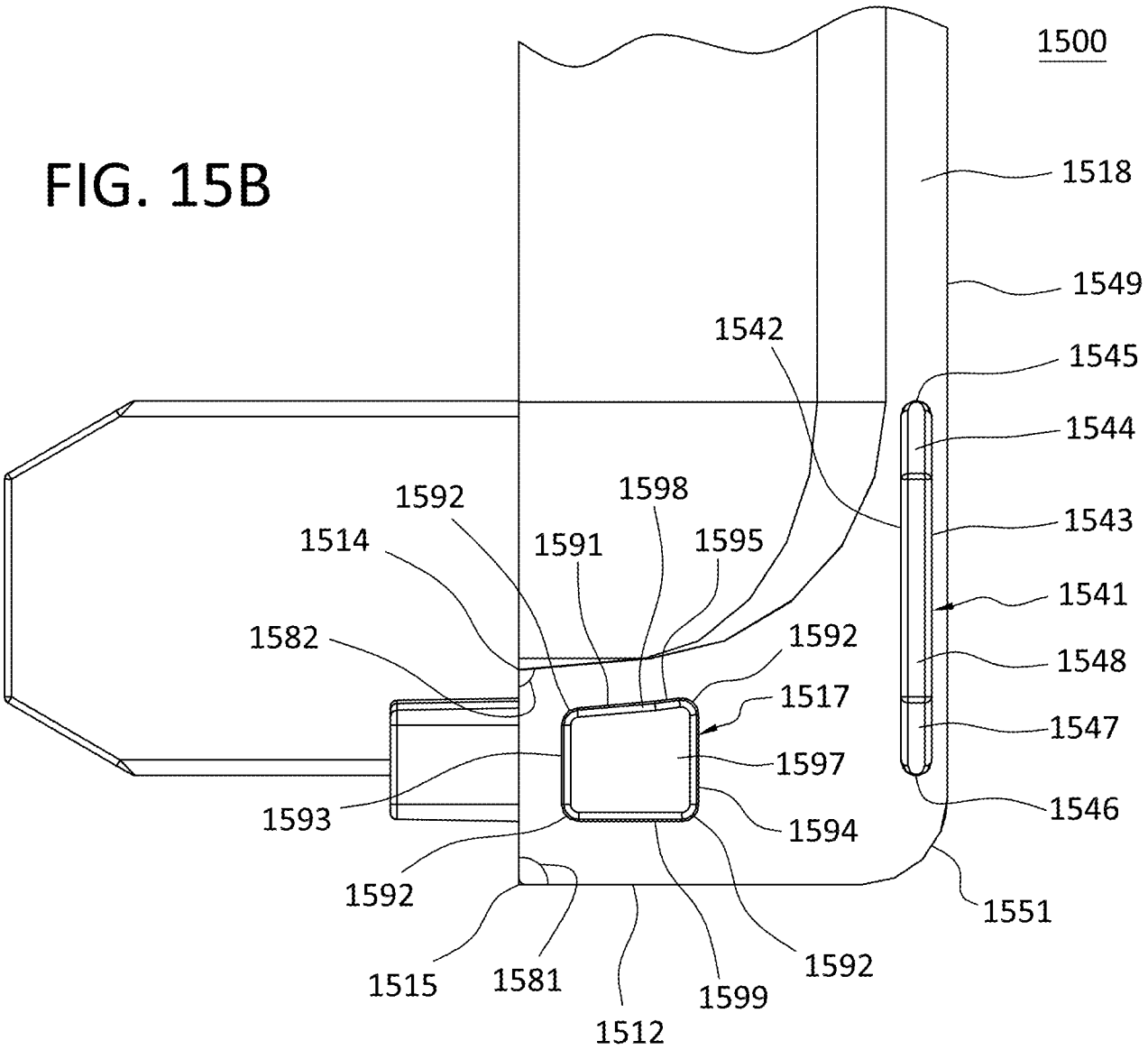

Turning now to FIG. 15B, in further embodiments, nose portion 1510 further comprises a spline nub 1517 extending from a lateral side 1518 (FIG. 15A). As shown in FIG. 15A, nose portion 1510 can include two spline nubs 1517 at opposite lateral sides of nose portion 1510. In some embodiments, spline nub 1517 can comprise a variety of shapes configured to be inserted into a variety of nose spline receiver grooves 157, 217, 317, such that inserting or otherwise locating spline nub 1517 into nose spline receiver grooves 157, 217, 317 couples baseboard elements 100, 200, 300 to spline 1500. In various embodiments, spline nub 1517 can comprise a substantially rectangular shape, a substantially circular shape, a substantially triangular shape, and/or a substantially semi-circular shape. In some embodiments, spline nub 1517 can be proximate to back bend 1551 such that it can be inserted into back spline receiver groove 148, 248, 346. In the same or different embodiments, spline nub 1517 can comprise a top spline nub surface 1591, a plurality of spline nub bends 1592, a front spline nub surface 1593, a bottom spline nub surface 1599, a back spline nub surface 1594, a spline nub riser section 1595, a spline nub riser interface 1596, a spline nub lateral surface 1597, and/or a spline nub edge 1598. In some embodiments, spline nub edge 1598 can circumscribe spline nub lateral surface 1597 and/or have a substantially arcuate or planar shape. When spline nub edge 1598 has a substantially arcuate shape, it is easier to insert spline nub 1517 into nose spline receiver grooves 157, 217, 317. In the same or different embodiments, plurality of spline nub bends 1592 can have a substantially arcuate or planar shape. When plurality of spline nub bends 1592 has a substantially arcuate shape, it is easier to insert spline nub 1517 into nose spline receiver grooves 157, 217, 317. In some embodiments, spline nub riser section 1595 extends between spline nub bend 1592 and spline nub riser interface 1596. In this way, spline nub riser prevents rotation of spline 1500 when spline nub 1517 is worn down from repeated insertions.

Returning to FIG. 15A, in some embodiments, riser portion 1520 can comprise riser bend bottom interface 1521, riser bend 1522, riser bend top interface 1523, and/or riser section 1524. In the same or different embodiments, riser bend bottom interface 1521 can extend from nose top section 1511. In further embodiments, riser bend 1522 can extend from riser bend bottom interface 1523. In the same or different embodiments, riser bend 1522 can have a substantially arcuate shape, which allows for easy and thorough cleaning and/or disinfection because the lack of sharp corners and crevices prevents microorganisms from evading disinfectant. When riser bend 1522 has a substantially arcuate shape, laminar airflow can also be enhanced because air streams do not encounter sharp corners. As an example, the substantially arcuate shape of riser bend 1522 can be a concave shape or a convex shape. In some embodiments, riser bend top interface 1523 can extend from riser bend 1522. In the same or different embodiments, riser section 1524 can extend from riser top interface 1523. In various embodiments, riser section 1524 has a substantially planar shape, can be parallel to nose front section 1513, and/or be perpendicular to nose bottom section 1512.

In the same or different embodiments, wall groove portion 1530 can comprise a groove front section 1531, a groove bend 1532, a groove back section 1533, a groove front edge 1534, and/or a groove back edge 1535. In some embodiments, groove front section 1531 can extend from the riser section 1524. As an example, groove front section 1531 and riser section 1524 can be coplanar with each other. In various embodiments, groove front section 1531 has a substantially planar shape, can be parallel to nose front section 1513, and/or be perpendicular to nose bottom section 1512. In the same or different embodiments, groove front section 1531 terminates at groove front edge 1534. In various embodiments, groove front edge 1534 can have a substantially planar shape or a substantially arcuate shape. In further embodiments, groove bend 1532 can extend from groove front end 1531. In various embodiments, groove bend 1532 can have a substantially planar or substantially arcuate shape. In the same or different embodiments, groove bend 1532 can form a 180 degree bend, such that groove back section 1533 can be approximately parallel to groove front section 1531. In various embodiments, groove back section 1533 can extend from groove bend 1532 and terminate at groove back edge 1535. In further embodiments, groove back edge 1535 can have a substantially planar shape or a substantially arcuate shape.

Returning to FIG. 15B, spline portion 1540 can comprise a spline plate 1541 extending out of lateral side 1518. In various embodiments, there can be a plurality of spline plates 1541 extending from opposite lateral sides of spline 1500, as shown in FIGS. 15A and 15B. In the same or different embodiments, spline plate 1541 can comprise a front spline plate surface 1542 and/or a back spline plate surface 1543. In further embodiments, spline plate 1541 can comprise a lateral spline edge 1548, top corner spline edge 1544, a top spline edge 1545, a bottom spline edge 1546, and a bottom corner spline edge 1547. In various embodiments, lateral spline edge 1548, top corner spline edge 1544, top spline edge 1545, bottom spline edge 1546, and/or bottom corner spline edge 1547 can have a substantially planar shape or a substantially arcuate shape. When lateral spline edge 1548, top corner spline edge 1544, top spline edge 1545, bottom spline edge 1546, and/or bottom corner spline edge 1547 have a substantially arcuate shape, it is easier to insert spline plate 1541 into receiver section 145 as buffeted by top receiver nub 146 and bottom receiver nub 142.

In various embodiments, back spline plate surface 1543 can extend from lateral surface 1518. In some embodiments, top nose bend 1514 can form top nose angle 1582 between nose top section 1511 and nose front section 1513. In various embodiments, top nose angle 1582 can be an approximately right angle. In the same or different embodiments, top nose angle 1582 can be an acute angle or an obtuse angle. When top nose angle 1582 is an approximately right angle, flooring material (not shown) can lay flush against nose front section 1513, thus providing an approximately flat surface across nose top section 1511 and flooring material (not shown). When top nose angle 1582 is an acute angle, material costs are saved because nose bottom section 1512 is smaller. When top nose angle 1582 is an obtuse angle, a channel can be formed with flooring material (not shown), which can be used as an aid for applying adhesive or sealant. In some embodiments, nose bottom bend 1515 can form bottom nose angle 1581 between nose bottom section 1512 and nose front section 1513. In various embodiments, bottom nose angle 1581 can be an approximately right angle. In the same or different embodiments, bottom nose angle 1581 can be an acute angle or an obtuse angle. When bottom nose angle 1581 is an approximately right angle, flooring material (not shown) can lay flush against nose front section 1513, thus providing an approximately flat surface across nose top section 1511 and flooring material (not shown). When bottom nose angle 1581 is an acute angle, a channel can be formed with flooring material (not shown), which can be used as an aid for applying adhesive or sealant. When bottom nose angle 1581 is an obtuse angle, material costs are saved because nose bottom section 1512 is smaller.

Returning to FIG. 15A, in some embodiments, corner portion 1560 can comprise corner bottom nose bend 1571, corner nose front interface 1561, corner top nose bend 1562, corner nose top interface 1563, corner riser bend bottom interface 1572, corner riser bend 1564, corner riser bend bottom interface 1573, corner riser interface 1565, corner top bend 1566, corner groove back section interface 1567, and/or corner groove back section bend 1568. In some embodiments, corner portion 1560 forms a right angle of an interior corner. In the same or different embodiments, corner portion 1560 forms an acute angle of an interior corner. In still other embodiments, corner portion 1560 forms an obtuse angle of an interior corner.

In further embodiments, corner bottom nose bend 1571 extends between a plurality of bottom nose bends 1515. In the same or different embodiments, corner bottom nose bend 1571 can have a substantially planar shape. In some embodiments, corner bottom nose bend 1571 can have an arcuate shape. In further embodiments, corner nose front interface 1561 extends between a plurality of nose front sections 1513. In the same or different embodiments, corner nose front interface 1561 can have a substantially planar shape. In some embodiments, corner nose front interface 1561 can have a substantially arcuate shape. In further embodiments, corner top nose bend 1562 extends between a plurality of top nose bends 1514. In the same or different embodiments, corner top nose bend 1562 can have a substantially planar shape. In some embodiments, corner top nose bend 1562 can have an arcuate shape. In further embodiments, corner nose top interface 1563 extends between a plurality of nose top sections 1511. In the same or different embodiments, corner nose top interface 1563 can have a substantially planar shape.

In further embodiments, corner riser bend bottom interface 1572 extends between a plurality of riser bend bottom interfaces 1521. In the same or different embodiments, corner riser bend bottom interface 1572 can have a substantially planar shape. In some embodiments, corner riser bend bottom interface 1572 can have an arcuate shape, which allows for easy and thorough cleaning and/or disinfection because the lack of sharp corners and crevices prevents microorganisms from evading disinfectant. When corner riser bend bottom interface 1572 has a substantially arcuate shape, laminar airflow can also be enhanced because air streams do not encounter sharp corners. As an example, the substantially arcuate shape of corner riser bend bottom interface 1572 can be a concave shape or a convex shape. In further embodiments, corner riser bend 1564 extends between a plurality of riser bends 1564. In the same or different embodiments, corner riser bend 1564 can have a substantially planar shape. In some embodiments, corner riser bend 1564 can have an arcuate shape, which allows for easy and thorough cleaning and/or disinfection because the lack of sharp corners and crevices prevents microorganisms from evading disinfectant. When corner riser bend 1564 has a substantially arcuate shape, laminar airflow can also be enhanced because air streams do not encounter sharp corners. As an example, the substantially arcuate shape of corner riser bend 1564 can be a concave shape or a convex shape. In further embodiments, corner riser bend bottom interface 1573 extends between a plurality of riser bend bottom interfaces 1523. In the same or different embodiments, corner riser bend bottom interface 1573 can have a substantially planar shape. In some embodiments, corner riser bend bottom interface 1573 can have an arcuate shape, which allows for easy and thorough cleaning and/or disinfection because the lack of sharp corners and crevices prevents microorganisms from evading disinfectant. When corner riser bend bottom interface 1573 has a substantially arcuate shape, laminar airflow can also be enhanced because air streams do not encounter sharp corners. As an example, the substantially arcuate shape of corner riser bend bottom interface 1573 can be a concave shape or a convex shape. In further embodiments, corner riser interface 1565 extends between a plurality of riser sections 1524 and/or groove front sections 1531. In the same or different embodiments, corner riser interface 1565 can have a substantially planar shape. In some embodiments, corner riser interface 1565 can have an arcuate shape, which allows for easy and thorough cleaning and/or disinfection because the lack of sharp corners and crevices prevents microorganisms from evading disinfectant. When corner riser interface 1565 has a substantially arcuate shape, laminar airflow can also be enhanced because air streams do not encounter sharp corners. As an example, the substantially arcuate shape of corner riser interface 1565 can be a concave shape or a convex shape. In some embodiments, corner top bend 1566 extends between a plurality of groove front edges 1534. In further embodiments, corner groove back section interface 1567 extends between a plurality of groove back sections 1533. In the same or different embodiments, corner groove back section interface 1567 can have a substantially planar shape. In some embodiments, corner groove back section interface 1567 can have an arcuate shape. In further embodiments, corner groove back section bend 1568 extends between a plurality of groove back sections 1533. In the same or different embodiments, corner groove back section bend 1568 can have a substantially planar shape. In some embodiments, corner groove back section bend 1568 can have an arcuate shape.

Figure 16A:
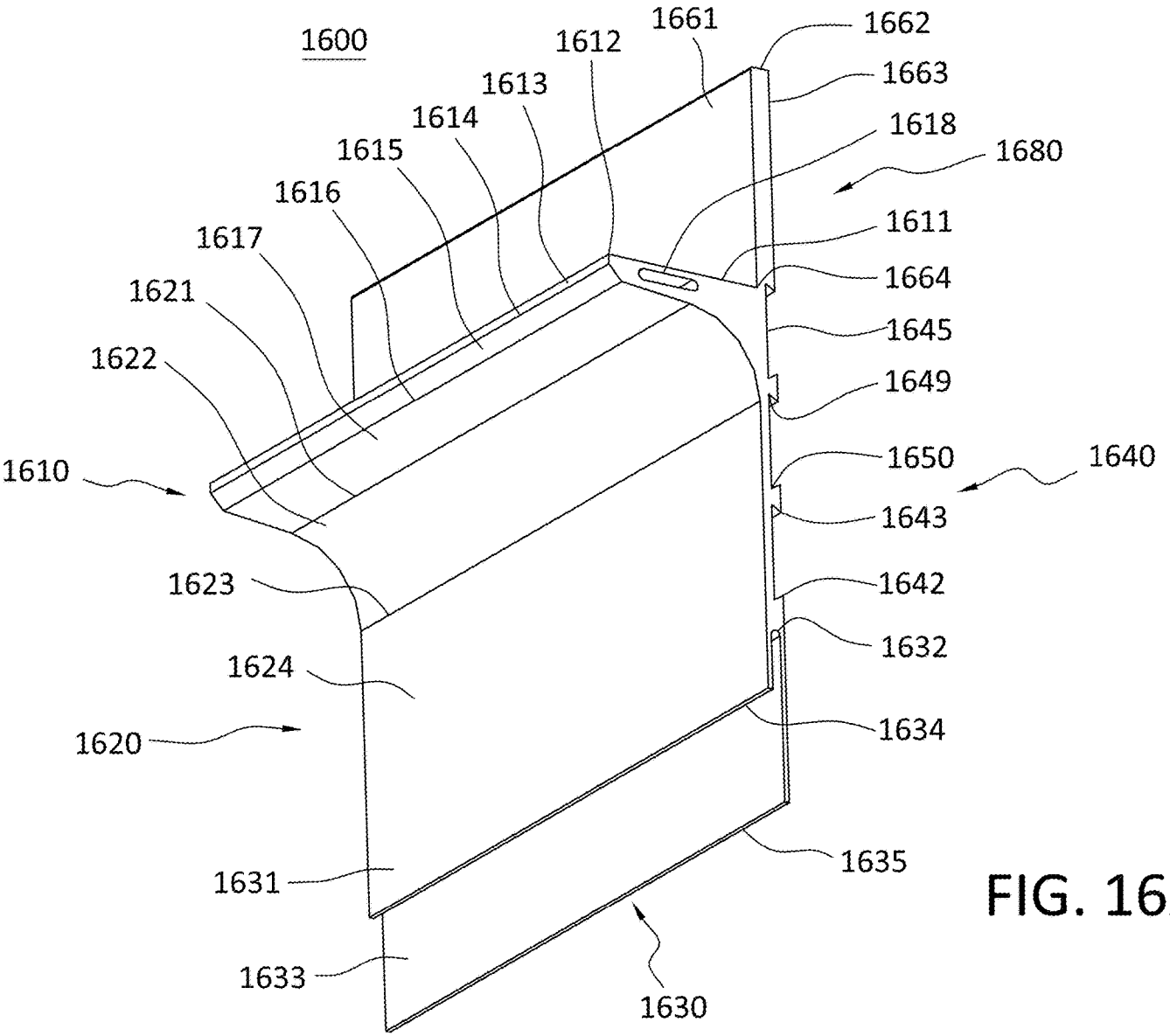
FIGS. 16A-17B representatively illustrate exemplary embodiments of crown elements.
Figure 16B:
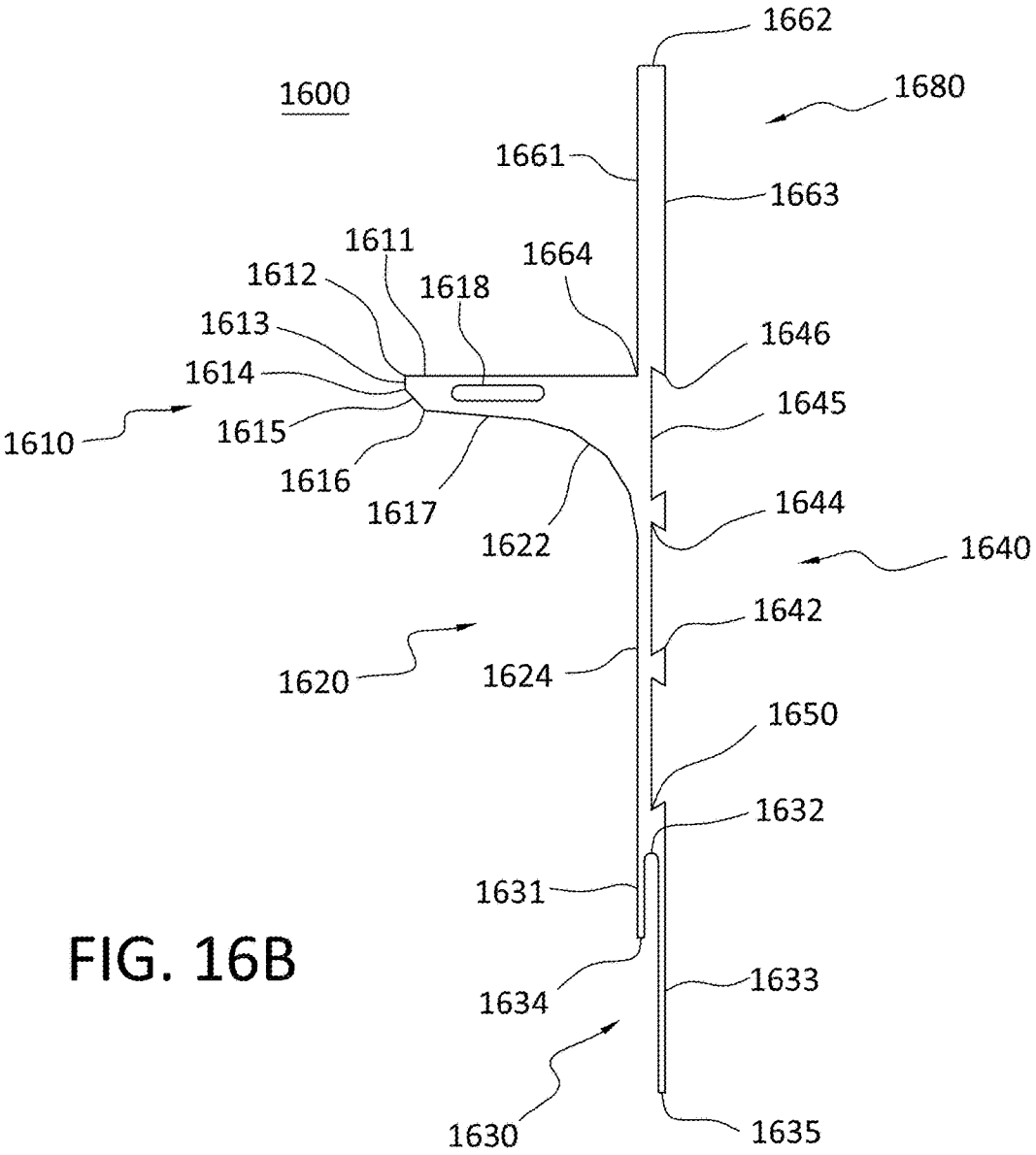

Turning now to FIGS. 16A and 16B, an exemplary embodiment of a crown element 1600 is shown in a front isometric view. In many embodiments, crown element 1600 can comprise a single, integrated piece.

In some embodiments, crown element 1600 can comprise nose portion 1610, riser portion 1620, groove portion 1630, spline receiver portion 1640, and/or ceiling portion 1680. In some embodiments, nose portion 1610 can further comprise a nose top section 1611, a nose top bend 1612, nose front section 1613, nose front bend 1614, nose riser section 1615, nose riser bend 1616, nose bottom section 1617, and/or nose nub receiver groove 1618. In the same or different embodiments, nose top section 1611 can have a substantially planar shape. In various embodiments, nose top section 1611 is configured to couple to a ceiling surface (not shown). In some embodiments, nose top section 1611 can comprise nose top grooves (not shown). In some embodiments, nose top grooves (not shown) can be configured to receive epoxy, glue, or sealant such that a crown element 1600 is coupled to a ceiling surface (not shown). In some embodiments, the coupling of crown element 1600 to ceiling surface (not shown) occurs in a way that is water tight and/or air tight. In the same or different embodiments, nose top section 1611 can extend approximately parallel to nose bottom section 1617 and approximately perpendicular to nose front section 1613. In various embodiments, nose top bend 1612 extends between nose top section 1611 and nose front section 1613.

In various embodiments, nose front section extends approximately parallel to back ceiling section 1663 and/or perpendicular to nose top section 1611. In some embodiments, nose front section 1613 can have a substantially planar shape. In various embodiments, nose front section 1613 can have a substantially arcuate shape, which allows for easy and thorough cleaning and/or disinfection because the lack of sharp corners and crevices prevents microorganisms from evading disinfectant. When nose front section 1613 has a substantially arcuate shape, laminar airflow can also be enhanced because air streams do not encounter sharp corners. As an example, the substantially arcuate shape of nose front section 1613 can be a concave shape or a convex shape. In the same or different embodiments, nose front bend 1614 extends between nose front section 1613 and nose riser section 1615. In some embodiments, nose front bend 1614 can have a substantially planar shape. In the same or different embodiments, nose front bend 1614 can have a substantially arcuate shape, which allows for easy and thorough cleaning and/or disinfection because the lack of sharp corners and crevices prevents microorganisms from evading disinfectant. When nose front bend 1614 has a substantially arcuate shape, laminar airflow can also be enhanced because air streams do not encounter sharp corners. As an example, the substantially arcuate shape of nose front bend 1614 can be a concave shape or a convex shape.

In the same or different embodiments, nose riser section 1615 can have a substantially planar shape. In various embodiments, nose riser section 1615 can have a substantially arcuate shape, which allows for easy and thorough cleaning and/or disinfection because the lack of sharp corners and crevices prevents microorganisms from evading disinfectant. When nose riser section 1615 has a substantially arcuate shape, laminar airflow can also be enhanced because air streams do not encounter sharp corners. As an example, the substantially arcuate shape of nose riser section 1615 can be a concave shape or a convex shape. In the same or different embodiments, nose riser section 1615 can form an obtuse angle with nose front section 1613. In some embodiments, nose riser section 1615 can form an acute angle with nose front section 1613. In various embodiments, nose riser section 1615 can form an approximately right angle with nose front section 1613. In further embodiments, nose riser section 1615 can be co-planar with nose front section 1613.

In some embodiments, nose riser bend 1616 extends between nose riser section 1615 and nose bottom section 1617. In some embodiments, nose riser bend 1616 can have a substantially planar shape. In the same or different embodiments, nose riser bend 1616 can have a substantially arcuate shape, which allows for easy and thorough cleaning and/or disinfection because the lack of sharp corners and crevices prevents microorganisms from evading disinfectant. When nose riser bend 1616 has a substantially arcuate shape, laminar airflow can also be enhanced because air streams do not encounter sharp corners.

In the same or various embodiments, nose bottom section 1617 can be substantially parallel to nose top section 1611. In various embodiments, nose bottom section 1617 can have a substantially planar shape. In some embodiments, nose bottom section 1617 can have a substantially arcuate shape, which allows for easy and thorough cleaning and/or disinfection because the lack of sharp corners and crevices prevents microorganisms from evading disinfectant. When nose bottom section 1617 has a substantially arcuate shape, laminar airflow can also be enhanced because air streams do not encounter sharp corners. As an example, the substantially arcuate shape of nose bottom section 1617 can be a concave shape or a convex shape.

In further embodiments, nose portion 1610 further comprises nose nub receiver groove 1618. Nose nub receiver groove 1618 can be a spline coupling portion. In some embodiments, the spline coupling portion can comprise one or more recesses or female portions, as described below, and in other embodiments (not shown in FIGS. 16A and 16B), the spline coupling portion can comprise one or more male portions. As shown in FIGS. 16A and 16B, nose nub receiver groove 1618 can comprise a variety of shapes configured to receive a variety of spline nub shapes, such that inserting a spline nub into nose nub receiver groove 1618 couples crown element 1600 to a spline. Incorporation of nose nub receiver groove 1618 into crown element 1600 can save on production costs and weight due to reducing material used to manufacture crown element 1600. In various embodiments, nose nub receiver groove 1618 can comprise a substantially rectangular shape, a substantially circular shape, a substantially triangular shape, a substantially ovoid shape, a substantially oval shape, and/or a substantially semi-circular shape.

In some embodiments, riser portion 1620 can comprise riser bend bottom interface 1621, riser bend 1622, riser bend top interface 1623, and/or riser section 1624. In the same or different embodiments, riser bend bottom interface 1621 can extend from nose top section 1611. In the same or different embodiments, riser bend 1622 can extend from riser bend bottom interface 1623. In the same or different embodiments, riser bend 1622 can have a substantially arcuate shape, which allows for easy and thorough cleaning and/or disinfection because the lack of sharp corners and crevices prevents microorganisms from evading disinfectant. When riser bend 1622 has a substantially arcuate shape, laminar airflow can also be enhanced because air streams do not encounter sharp corners. As an example, the substantially arcuate shape of riser bend 1622 can be a concave shape or a convex shape. In some embodiments, riser bend top interface 1623 can extend from riser bend 1622. In the same or different embodiments, riser section 1624 can extend from riser top interface 1623. In various embodiments, riser section 1624 has a substantially planar shape, can be parallel to nose front section 1613, and/or be perpendicular to nose bottom section 1617.

In the same or different embodiments, wall groove portion 1630 can comprise a groove front section 1631, a groove bend 1632, a groove back section 1633, a groove front edge 1634, and/or a groove back edge 1635. In some embodiments, groove front section 1631 can extend from riser section 1624. As an example, groove front section 1631 and riser section 1624 can be coplanar with each other. In various embodiments, groove front section 1631 has a substantially planar shape, can be parallel to nose front section 1613, and/or be perpendicular to nose bottom section 1617. In the same or different embodiments, groove front section 1631 terminates at groove front edge 1634. In various embodiments, groove front edge 1634 can have a substantially planar shape or a substantially arcuate shape. In further embodiments, groove bend 1632 can extend from groove front end 1631. In various embodiments, groove bend 1632 can have a substantially planar or substantially arcuate shape. In the same or different embodiments, groove bend 1632 can form a 180 degree bend, such that groove back section 1633 can be approximately parallel to groove front section 1631. In various embodiments, groove back section 1633 can extend from groove bend 1632 and terminate at groove back edge 1635. In further embodiments, groove back edge 1635 can have a substantially planar shape or a substantially arcuate shape.

In the same or different embodiments, spline receiver portion 1640 can be a spline coupling portion. In some embodiments, the spline coupling portion can comprise one or more recesses or female portions, as described below, and in other embodiments (not shown in FIGS. 16A and 16B), the spline coupling portion can comprise one or more male portions. As shown in FIGS. 16A and 16B, spline receiver portion 1640 can comprise bottom receiver nub 1642, top receiver nub 1643, receiver back groove (not shown), and/or receiver section 1645. In some embodiments, bottom receiver nub 1642 can extend from a back surface of riser section 1624. In the same or different embodiments, bottom receiver nub 1642 does not extend from spline receiver bend 1641, but instead extends from top receiver nub 1646. In embodiments where bottom receiver nub 1642 extends from top receiver nub 1646, receiver back groove (not shown) can be formed. In the same or different embodiments, receiver back groove (not shown) can extend between groove back section 1633 and bottom receiver nub 1642. In further embodiments, receiver back groove (not shown) can be configured to receive epoxy, glue, or sealant such that a crown element 1600 is coupled to a wall surface (not shown). In some embodiments, the coupling of crown element 1600 to wall surface (not shown) occurs in a way that is water tight and/or air tight. In some embodiments, receiver section 1645 extends between top receiver nub 1646 and bottom receiver nub 1642. In various embodiments, top receiver nub bend 1649 extends between top receiver nub 1646 and receiver section 1645. In some embodiments, top receiver nub bend 1649 can have a substantially arcuate or substantially planar shape. When top receiver nub bend 1649 has an arcuate shape, coupling of crown element 1600 to a spline can be easier. In various embodiments, bottom receiver nub bend 1650 extends between bottom receiver nub 1642 and receiver section 1645. In some embodiments, bottom receiver nub bend 1650 can have a substantially arcuate or substantially planar shape. When bottom receiver nub bend 1650 has an arcuate shape, coupling of crown element 1600 to a spline can be easier, but manufacturing costs may be increased. In the same or different embodiments, a spline plate can be configured to be inserted along receiver section 1645 such that it is held in place by top receiver nub 1646 and bottom receiver nub 1642.

In some embodiments, ceiling portion 1680 can comprise bottom ceiling bend 1664, front ceiling section 1661, top ceiling section 1662, and/or back ceiling section 1663. In the same or different embodiments, bottom ceiling bend 1664 can have a planar shape. In various embodiments, bottom ceiling bend 1664 can have a substantially arcuate shape. In other embodiments, bottom ceiling bend 1664 can have a substantially planar shape. As an example, the substantially arcuate shape of bottom ceiling bend 1664 can be a concave shape or a convex shape. In the same or different embodiments, bottom ceiling bend 1664 extends between nose top section 1611 and front ceiling section 1661. In some embodiments, front ceiling section 1661 is approximately perpendicular with nose top section 1611. In other embodiments, front ceiling section 1661 creates an acute angle with nose top section 1611. In further embodiments, front ceiling section 1661 creates an obtuse angle with nose top section 1611. In the same or different embodiments, front ceiling section 1661 is configured to be flush with a side of a ceiling surface (not shown). In some embodiments, top ceiling section 1622 extends between front ceiling section 1661 and back ceiling section 1633. In the same or different embodiments, back ceiling section 1633 is approximately parallel with front ceiling section 1661 and approximately perpendicular with nose top section 1611. In various embodiments, top receiver nub 1646 extends from back ceiling section 1633.

Figure 17A:
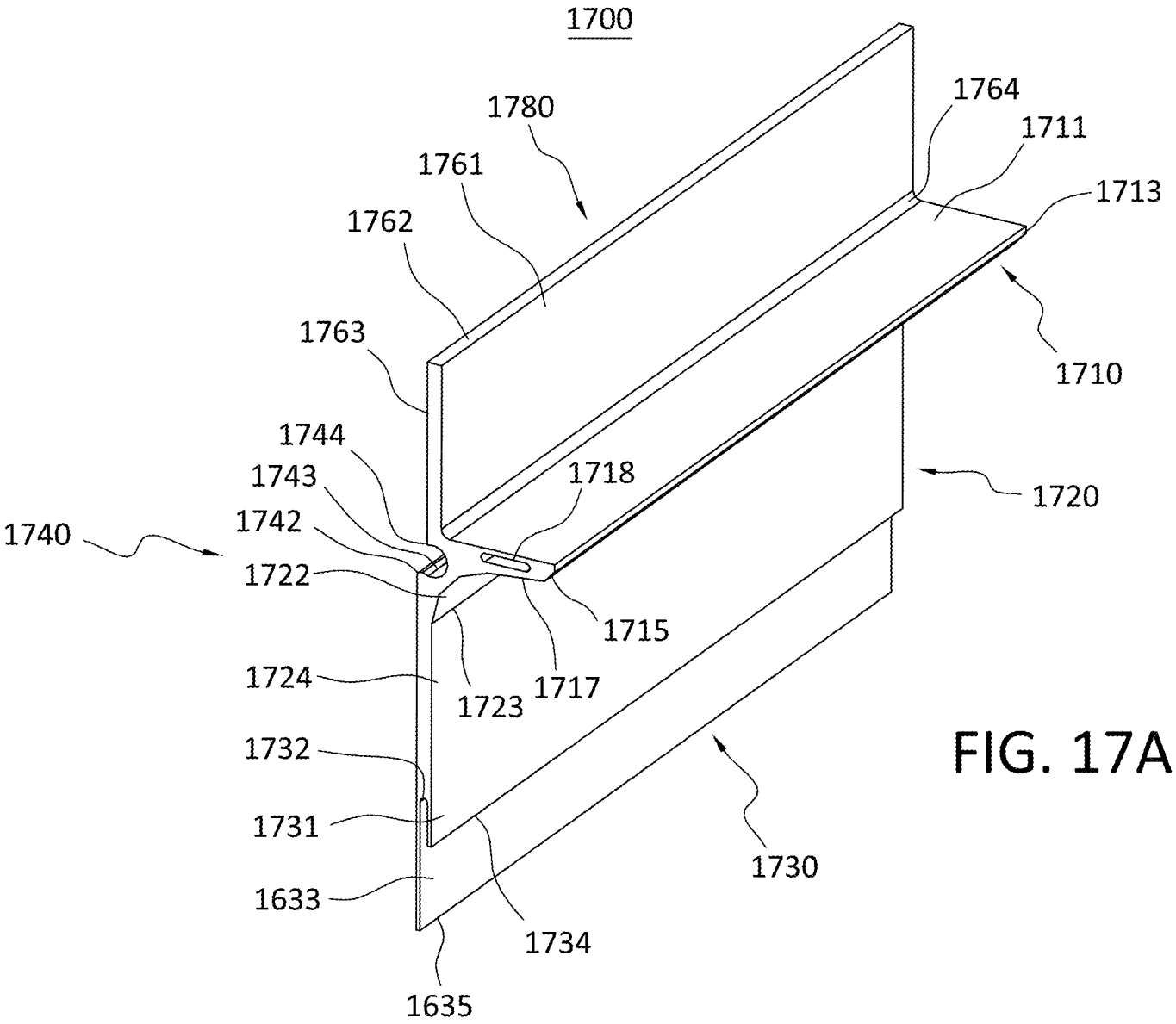
Figure 17B:
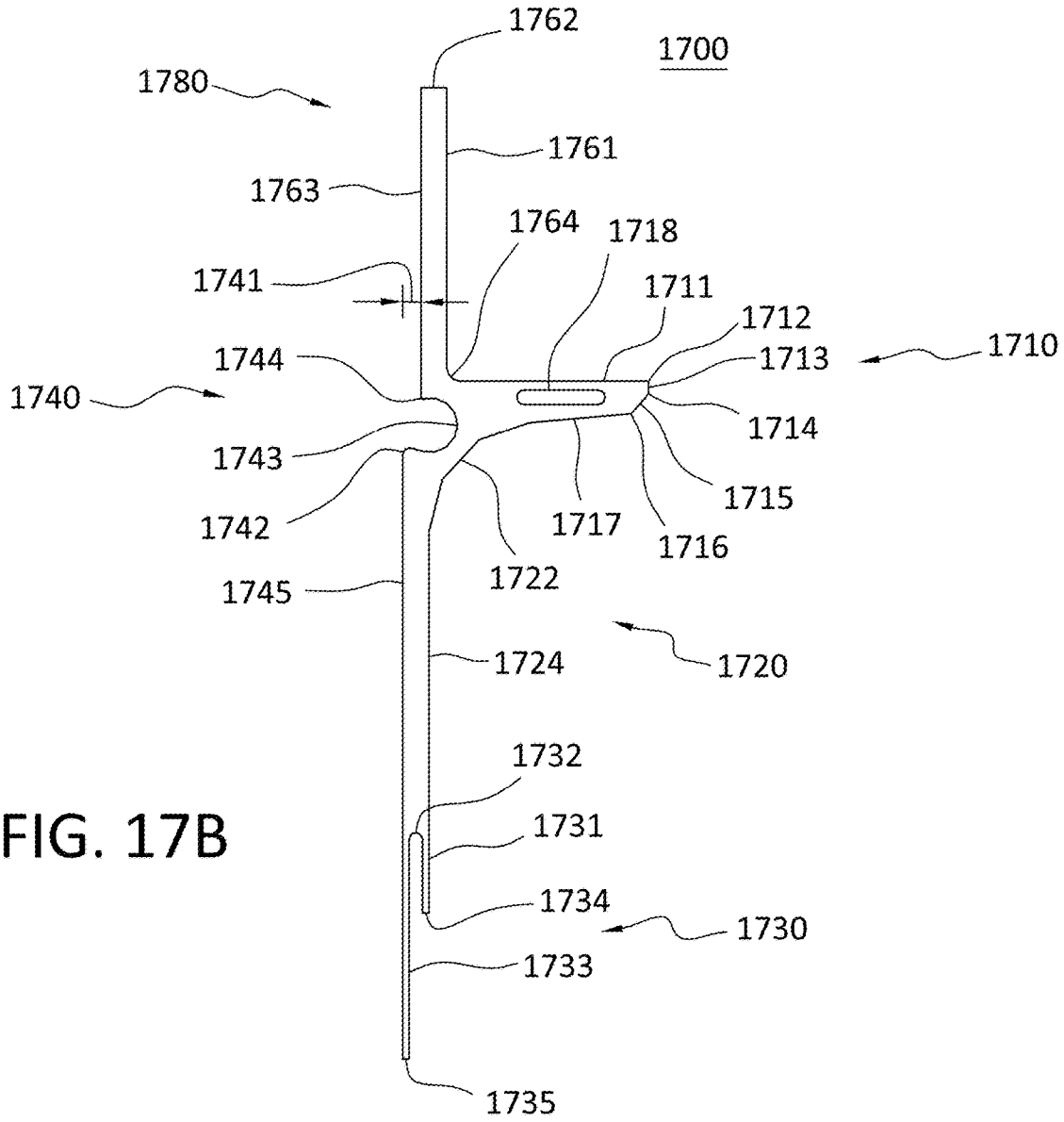

Turning now to FIGS. 17A and 17B, an exemplary embodiment of a crown element 1700 is shown in a front isometric view. In many embodiments, crown element 1700 can comprise a single, integrated piece.

In some embodiments, crown element 1700 can comprise nose portion 1710, riser portion 1720, groove portion 1730, spline receiver portion 1740, and/or ceiling portion 1780. In some embodiments, nose portion 1710 can further comprise a nose top section 1711, a nose top bend 1712, nose front section 1713, nose front bend 1714, nose riser section 1715, nose riser bend 1716, nose bottom section 1717, and/or nose nub receiver groove 1718. In the same or different embodiments, nose top section 1711 can have a substantially planar shape. In various embodiments, nose top section 1711 is configured to couple to a ceiling surface (not shown). In some embodiments, nose top section 1711 can comprise nose top grooves (not shown). In some embodiments, nose top grooves (not shown) can be configured to receive epoxy, glue, or sealant such that a crown element 1700 is coupled to a ceiling surface (not shown). In some embodiments, the coupling of crown element 1700 to ceiling surface (not shown) occurs in a way that is water tight and/or air tight. In the same or different embodiments, nose top section 1711 can extend approximately parallel to nose bottom section 1717 and approximately perpendicular to nose front section 1713. In various embodiments, nose top bend 1712 extends between nose top section 1711 and nose front section 1713.

In various embodiments, nose front section extends approximately parallel to back ceiling section 1763 and/or perpendicular to nose top section 1711. In some embodiments, nose front section 1713 can have a substantially planar shape. In various embodiments, nose front section 1713 can have a substantially arcuate shape, which allows for easy and thorough cleaning and/or disinfection because the lack of sharp corners and crevices prevents microorganisms from evading disinfectant. When nose front section 1713 has a substantially arcuate shape, laminar airflow can also be enhanced because air streams do not encounter sharp corners. As an example, the substantially arcuate shape of nose front section 1713 can be a concave shape or a convex shape. In the same or different embodiments, nose front bend 1714 extends between nose front section 1713 and nose riser section 1715. In some embodiments, nose front bend 1714 can have a substantially planar shape. In the same or different embodiments, nose front bend 1714 can have a substantially arcuate shape, which allows for easy and thorough cleaning and/or disinfection because the lack of sharp corners and crevices prevents microorganisms from evading disinfectant. When nose front bend 1714 has a substantially arcuate shape, laminar airflow can also be enhanced because air streams do not encounter sharp corners. As an example, the substantially arcuate shape of nose front bend 1714 can be a concave shape or a convex shape.

In the same or different embodiments, nose riser section 1715 can have a substantially planar shape. In various embodiments, nose riser section 1715 can have a substantially arcuate shape, which allows for easy and thorough cleaning and/or disinfection because the lack of sharp corners and crevices prevents microorganisms from evading disinfectant. When nose riser section 1715 has a substantially arcuate shape, laminar airflow can also be enhanced because air streams do not encounter sharp corners. As an example, the substantially arcuate shape of nose riser section 1715 can be a concave shape or a convex shape. In the same or different embodiments, nose riser section 1715 can form an obtuse angle with nose front section 1713. In some embodiments, nose riser section 1715 can form an acute angle with nose front section 1713. In various embodiments, nose riser section 1715 can form an approximately right angle with nose front section 1713. In further embodiments, nose riser section 1715 can be co-planar with nose front section 1713.

In some embodiments, nose riser bend 1716 extends between nose riser section 1715 and nose bottom section 1717. In some embodiments, nose riser bend 1716 can have a substantially planar shape. In the same or different embodiments, nose riser bend 1716 can have a substantially arcuate shape, which allows for easy and thorough cleaning and/or disinfection because the lack of sharp corners and crevices prevents microorganisms from evading disinfectant. When nose riser bend 1716 has a substantially arcuate shape, laminar airflow can also be enhanced because air streams do not encounter sharp corners.

In the same or various embodiments, nose bottom section 1717 can be substantially parallel to nose top section 1711. In various embodiments, nose bottom section 1717 can have a substantially planar shape. In some embodiments, nose bottom section 1717 can have a substantially arcuate shape, which allows for easy and thorough cleaning and/or disinfection because the lack of sharp corners and crevices prevents microorganisms from evading disinfectant. When nose bottom section 1717 has a substantially arcuate shape, laminar airflow can also be enhanced because air streams do not encounter sharp corners. As an example, the substantially arcuate shape of nose bottom section 1717 can be a concave shape or a convex shape.

In some embodiments, nose portion 1710 further comprises nose nub receiver groove 1718. Nose nub receiver groove 1718 can be a spline coupling portion. In some embodiments, the spline coupling portion can comprise one or more recesses or female portions, as described below, and in other embodiments (not shown in FIGS. 17A and 17B), the spline coupling portion can comprise one or more male portions. As shown in FIGS. 17A and 17B, nose nub receiver groove 1718 can comprise a variety of shapes configured to receive a variety of spline nub shapes, such that inserting a spline nub into nose nub receiver groove 1718 couples crown element 1700 to a spline. Incorporation of nose nub receiver groove 1718 into crown element 1700 can save on production costs and weight due to reducing material used to manufacture crown element 1700. In various embodiments, nose nub receiver groove 1718 can comprise a substantially rectangular shape, a substantially circular shape, a substantially triangular shape, a substantially ovoid shape, a substantially oval shape, and/or a substantially semi-circular shape.

In some embodiments, riser portion 1720 can comprise riser bend bottom interface 1721, riser bend 1722, riser bend top interface 1723, and/or riser section 1724. In the same or different embodiments, riser bend bottom interface 1721 can extend from nose top section 1711. In the same or different embodiments, riser bend 1722 can extend from riser bend bottom interface 1723. In the same or different embodiments, riser bend 1722 can have a substantially arcuate shape, which allows for easy and thorough cleaning and/or disinfection because the lack of sharp corners and crevices prevents microorganisms from evading disinfectant. When riser bend 1722 has a substantially arcuate shape, laminar airflow can also be enhanced because air streams do not encounter sharp corners. As an example, the substantially arcuate shape of riser bend 1722 can be a concave shape or a convex shape. In some embodiments, riser bend top interface 1723 can extend from riser bend 1722. In the same or different embodiments, riser section 1724 can extend from riser top interface 1723. In various embodiments, riser section 1724 has a substantially planar shape, can be parallel to nose front section 1713, and/or be perpendicular to nose bottom section 1717.

In the same or different embodiments, wall groove portion 1730 can comprise a groove front section 1731, a groove bend 1732, a groove back section 1733, a groove front edge 1734, and/or a groove back edge 1735. In some embodiments, groove front section 1731 can extend from riser section 1724. As an example, groove front section 1731 and riser section 1724 can be coplanar with each other. In various embodiments, groove front section 1731 has a substantially planar shape, can be parallel to nose front section 1713, and/or be perpendicular to nose bottom section 1717. In the same or different embodiments, groove front section 1731 terminates at groove front edge 1734. In various embodiments, groove front edge 1734 can have a substantially planar shape or a substantially arcuate shape. In further embodiments, groove bend 1732 can extend from groove front end 1731. In various embodiments, groove bend 1732 can have a substantially planar or substantially arcuate shape. In the same or different embodiments, groove bend 1732 can form a 180 degree bend, such that groove back section 1733 can be approximately parallel to groove front section 1731. In various embodiments, groove back section 1733 can extend from groove bend 1732 and terminate at groove back edge 1735. In further embodiments, groove back edge 1735 can have a substantially planar shape or a substantially arcuate shape.

In the same or different embodiments, spline receiver portion 1740 can be a spline coupling portion. In some embodiments, the spline coupling portion can comprise one or more recesses or female portions, as described below, and in other embodiments (not shown in FIGS. 17A and 17B), the spline coupling portion can comprise one or more male portions. As shown in FIGS. 17A and 17B, spline receiver portion 1740 can comprise top receiver bend 1744, receiver groove 1743, bottom receiver bend 1442, riser section back surface 1745, and/or receiver notch 1741. In some embodiments, top receiver bend 1744 can extend between back ceiling section 1763 and receiver groove 1743. In various embodiments, top receiver bend 1744 can have a substantially planar shape. In various embodiments, top receiver bend 1744 can have a substantially arcuate shape. In the same or different embodiments, receiver groove 1743 can have a substantially arcuate, substantially circular, substantially planar, substantially triangular, or substantially rectangular shape. In the same or different embodiments, receiver groove 1743 can be configured to receive a male portion of a spline in order to aid in the coupling of crown element 1700 to a spline. In some embodiments, bottom receiver bend 1742 can extend from a back surface of riser section 1724 and receiver groove 1743. In various embodiments, bottom receiver bend 1742 can have a substantially planar shape. In various embodiments, bottom receiver bend 1742 can have a substantially arcuate shape. In various embodiments, receiver notch 1741 is offset from riser section back surface 1745 such that when a spline couples to crown element 1700, its back side lays flush with riser section back surface 1745.

In some embodiments, ceiling portion 1780 can comprise bottom ceiling bend 1764, front ceiling section 1761, top ceiling section 1762, and/or back ceiling section 1763. In the same or different embodiments, bottom ceiling bend 1764 can have a planar shape. In various embodiments, bottom ceiling bend 1764 can have a substantially arcuate shape. In other embodiments, bottom ceiling bend 1764 can have a substantially planar shape. As an example, the substantially arcuate shape of bottom ceiling bend 1764 can be a concave shape or a convex shape. In the same or different embodiments, bottom ceiling bend 1764 extends between nose top section 1711 and front ceiling section 1761. In some embodiments, front ceiling section 1761 is approximately perpendicular with nose top section 1711. In other embodiments, front ceiling section 1761 creates an acute angle with nose top section 1711. In further embodiments, front ceiling section 1761 creates an obtuse angle with nose top section 1711. In the same or different embodiments, front ceiling section 1761 is configured to be flush with a side of a ceiling surface (not shown). In some embodiments, top ceiling section 1722 extends between front ceiling section 1761 and back ceiling section 1733. In the same or different embodiments, back ceiling section 1733 is approximately parallel with front ceiling section 1761 and approximately perpendicular with nose top section 1711.

Figure 18A:
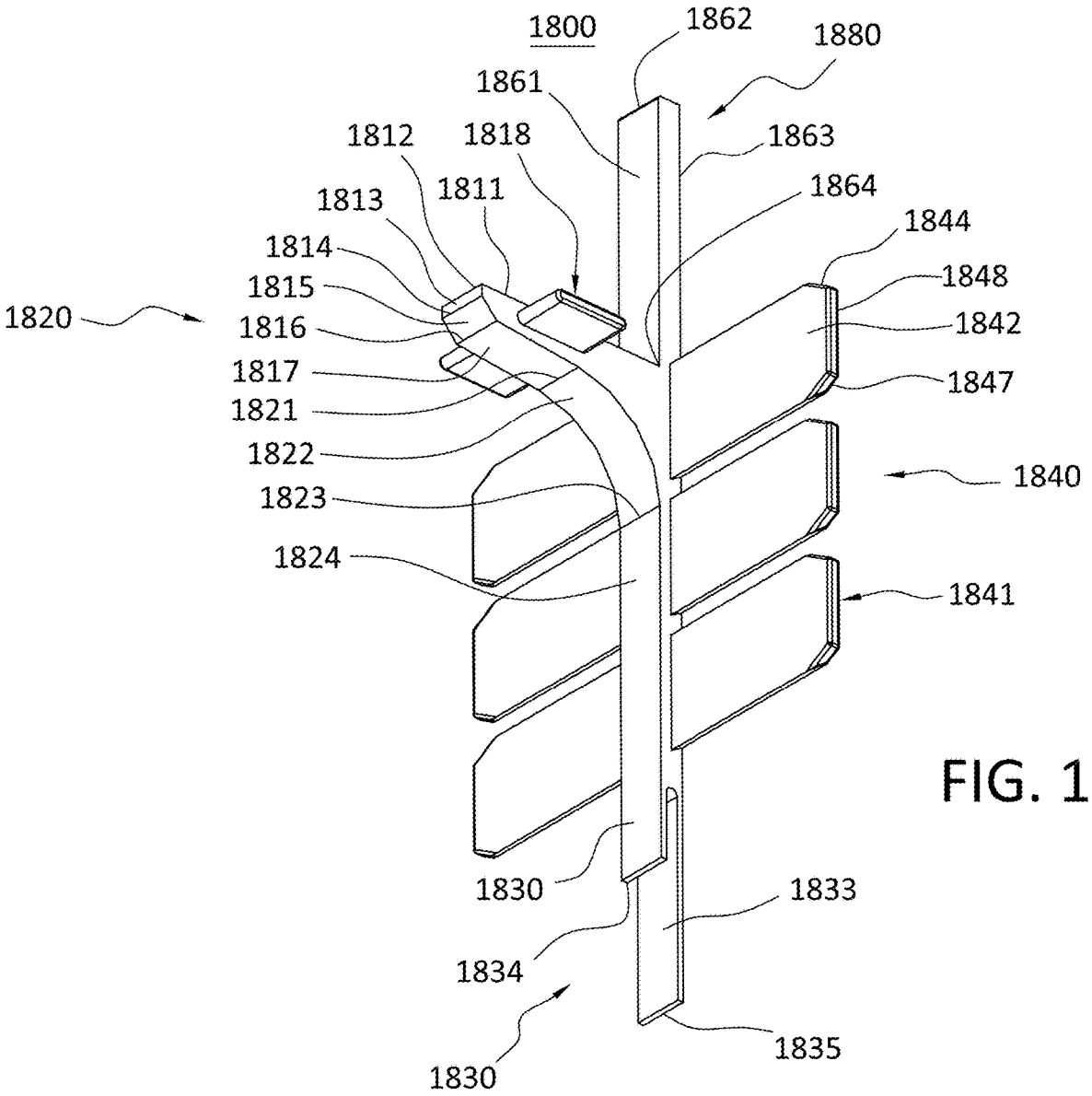
FIGS. 18A-20B representatively illustrate exemplary embodiments of splines.
Figure 18B:
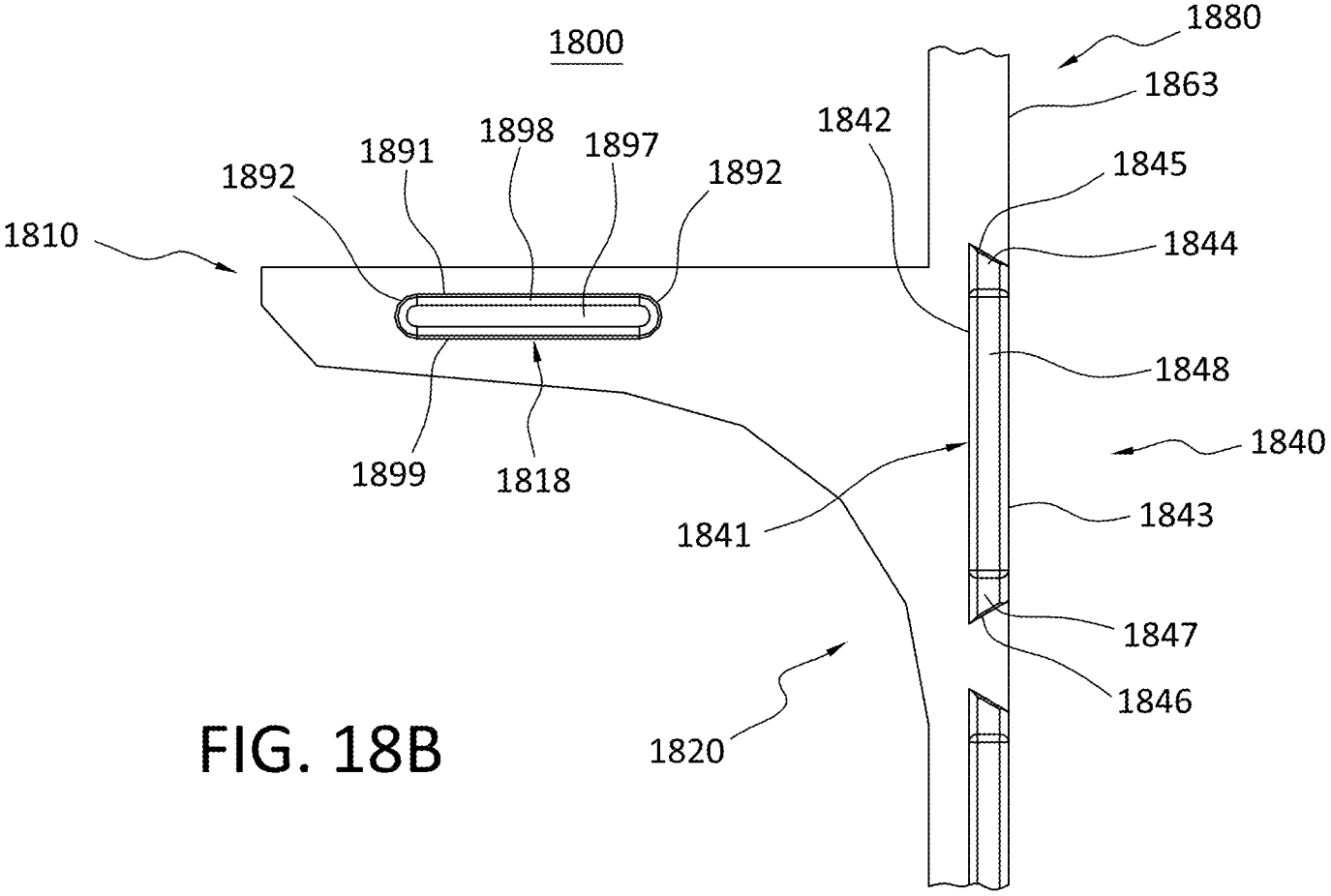

Turning now to FIGS. 18A and 18B, an exemplary embodiment of a spline 1800 is shown in a front isometric view. In many embodiments, spline 1800 can comprise a single, integrated piece. As an example, in embodiments where spline receiver portion 1640 (FIGS. 16A and 16B) comprises one or more recesses or female portions, spline 1800 can comprise one or more complementary male portions to couple with the one or more recesses or female portions. In other embodiments (not shown in FIGS. 18A and 18B), the spline receiver portion or spline coupling portion of the crown element comprises one or more male portions, the spline can comprise one or more complementary female portions to couple with the one or more male portions.

In some embodiments, spline 1800 can comprise nose portion 1810, riser portion 1820, groove portion 1830, spline portion 1840, and/or ceiling portion 1880. In some embodiments, nose portion 1810 can further comprise a nose top section 1811, a nose top bend 1812, nose front section 1813, nose front bend 1814, nose riser section 1815, nose riser bend 1816, nose bottom section 1817, and/or nose nub receiver groove 1818. In the same or different embodiments, nose top section 1811 can have a substantially planar shape. In various embodiments, nose top section is configured to couple to a ceiling surface (not shown). In some embodiments, nose top section 1811 can comprise nose top grooves (not shown). In some embodiments, nose top grooves (not shown) can be configured to receive epoxy, glue, or sealant such that a spline 1800 is coupled to a ceiling surface (not shown). In some embodiments, the coupling of spline 1800 to ceiling surface (not shown) occurs in a way that is water tight and/or air tight. In the same or different embodiments, nose top section 1811 can extend approximately parallel to nose bottom section 1817 and approximately perpendicular to nose front section 1813. In various embodiments, nose top bend 182 extends between nose top section 1811 and nose front section 1813.

In various embodiments, nose front section extends approximately parallel to back ceiling section 1863 and/or perpendicular to nose top section 1811. In some embodiments, nose front section 1813 can have a substantially planar shape. In various embodiments, nose front section 1813 can have a substantially arcuate shape, which allows for easy and thorough cleaning and/or disinfection because the lack of sharp corners and crevices prevents microorganisms from evading disinfectant. When nose front section 1813 has a substantially arcuate shape, laminar airflow can also be enhanced because air streams do not encounter sharp corners. As an example, the substantially arcuate shape of nose front section 1813 can be a concave shape or a convex shape. In the same or different embodiments, nose front bend 1814 extends between nose front section 1813 and nose riser section 1815. In some embodiments, nose front bend 1814 can have a substantially planar shape. In the same or different embodiments, nose front bend 1814 can have a substantially arcuate shape, which allows for easy and thorough cleaning and/or disinfection because the lack of sharp corners and crevices prevents microorganisms from evading disinfectant. When nose front bend 1814 has a substantially arcuate shape, laminar airflow can also be enhanced because air streams do not encounter sharp corners. As an example, the substantially arcuate shape of nose front bend 1814 can be a concave shape or a convex shape.

In the same or different embodiments, nose riser section 1815 can have a substantially planar shape. In various embodiments, nose riser section 1815 can have a substantially arcuate shape, which allows for easy and thorough cleaning and/or disinfection because the lack of sharp corners and crevices prevents microorganisms from evading disinfectant. When nose riser section 1815 has a substantially arcuate shape, laminar airflow can also be enhanced because air streams do not encounter sharp corners. As an example, the substantially arcuate shape of nose riser section 1815 can be a concave shape or a convex shape. In the same or different embodiments, nose riser section 1815 can form an obtuse angle with nose front section 1813. In some embodiments, nose riser section 1815 can form an acute angle with nose front section 1813. In various embodiments, nose riser section 1815 can form an approximately right angle with nose front section 1813. In further embodiments, nose riser section 1815 can be co-planar with nose front section 1813.

In some embodiments, nose riser bend 1816 extends between nose riser section 1815 and nose bottom section 1817. In some embodiments, nose riser bend 1816 can have a substantially planar shape. In the same or different embodiments, nose riser bend 1816 can have a substantially arcuate shape, which allows for easy and thorough cleaning and/or disinfection because the lack of sharp corners and crevices prevents microorganisms from evading disinfectant. When nose riser bend 1816 has a substantially arcuate shape, laminar airflow can also be enhanced because air streams do not encounter sharp corners.

In the same or various embodiments, nose bottom section 1817 can be substantially parallel to nose top section 1811. In various embodiments, nose bottom section 1817 can have a substantially planar shape. In some embodiments, nose bottom section 1817 can have a substantially arcuate shape, which allows for easy and thorough cleaning and/or disinfection because the lack of sharp corners and crevices prevents microorganisms from evading disinfectant. When nose bottom section 1817 has a substantially arcuate shape, laminar airflow can also be enhanced because air streams do not encounter sharp corners. As an example, the substantially arcuate shape of nose bottom section 1817 can be a concave shape or a convex shape.

In further embodiments, nose portion 1810 further comprises a spline nub 1818 extending from a lateral side of spline 1800. As shown in FIG. 18A, nose portion 1810 can include two spline nubs 1818 at opposite lateral sides of nose portion 1810. In some embodiments, spline nub 1818 can comprise a variety of shapes configured to be inserted into a variety of spline receiver grooves such that inserting or otherwise locating spline nub 1817 in a spline receiver groove couples a crown element to spline 1800. In various embodiments, spline nub 1818 can comprise a substantially rectangular shape, a substantially circular shape, a substantially triangular shape, a substantially ovoid shape, a substantially oval shape, and/or a substantially semi-circular shape. In the same or different embodiments, spline nub 1818 can comprise a top spline nub surface 1891, a plurality of spline nub bends 1892, a spline nub lateral surface 1897, and/or a spline nub edge 1898. In some embodiments, spline nub edge 1898 can circumscribe spline nub lateral surface 1897 and/or have a substantially arcuate or planar shape. When spline nub edge 1898 has a substantially arcuate shape, it is easier to insert spline nub 1818 into nose spline receiver grooves. In the same or different embodiments, plurality of spline nub bends 1892 can have a substantially arcuate or planar shape. When plurality of spline nub bends 1892 has a substantially arcuate shape, it is easier to insert spline nub 1818 into spline receiver grooves.

In some embodiments, riser portion 1820 can comprise riser bend bottom interface 1821, riser bend 1822, riser bend top interface 1823, and/or riser section 1824. In the same or different embodiments, riser bend bottom interface 1821 can extend from nose top section 1811. In the same or different embodiments, riser bend 1822 can extend from riser bend bottom interface 1823. In the same or different embodiments, riser bend 1822 can have a substantially arcuate shape, which allows for easy and thorough cleaning and/or disinfection because the lack of sharp corners and crevices prevents microorganisms from evading disinfectant. When riser bend 1822 has a substantially arcuate shape, laminar airflow can also be enhanced because air streams do not encounter sharp corners. As an example, the substantially arcuate shape of riser bend 1822 can be a concave shape or a convex shape. In some embodiments, riser bend top interface 1823 can extend from riser bend 1822. In the same or different embodiments, riser section 1824 can extend from riser top interface 1823. In various embodiments, riser section 1824 has a substantially planar shape, can be parallel to nose front section 1813, and/or be perpendicular to nose bottom section 1817.

In the same or different embodiments, wall groove portion 1830 can comprise a groove front section 1831, a groove bend 1832, a groove back section 1833, a groove front edge 1834, and/or a groove back edge 1835. In some embodiments, groove front section 1831 can extend from riser section 1824. As an example, groove front section 1831 and riser section 1824 can be coplanar with each other. In various embodiments, groove front section 1831 has a substantially planar shape, can be parallel to nose front section 1813, and/or be perpendicular to nose bottom section 1817. In the same or different embodiments, groove front section 1831 terminates at groove front edge 1834. In various embodiments, groove front edge 1834 can have a substantially planar shape or a substantially arcuate shape.

In further embodiments, groove bend 1832 can extend from groove front end 1831. In various embodiments, groove bend 1832 can have a substantially planar or substantially arcuate shape. In the same or different embodiments, groove bend 1832 can form a 180 degree bend, such that groove back section 1833 can be approximately parallel to groove front section 1831. In various embodiments, groove back section 1833 can extend from groove bend 1832 and terminate at groove back edge 1835. In further embodiments, groove back edge 1835 can have a substantially planar shape or a substantially arcuate shape.

In some embodiments, spline plate portion 1840 can comprise a spline plate 1841 extending out of lateral side 1818. In various embodiments, there can be a plurality of spline plates 1841 extending from opposite lateral sides of spline 1800, as shown in FIGS. 18A and 18B. In the same or different embodiments, spline plate 1841 can comprise a front spline plate surface 1842 and/or a back spline plate surface 1843. In further embodiments, spline plate 1841 can comprise a lateral spline edge 1848, top corner spline edge 1844, a top spline edge 1845, a bottom spline edge 1846, and a bottom corner spline edge 1847. In various embodiments, lateral spline edge 1848, top corner spline edge 1844, top spline edge 1845, bottom spline edge 1846, and/or bottom corner spline edge 1847 can have a substantially planar shape or a substantially arcuate shape. When lateral spline edge 1848, top corner spline edge 1844, top spline edge 1845, bottom spline edge 1846, and/or bottom corner spline edge 1847 have a substantially arcuate shape, it is easier to insert spline plate 1841 into receiver section 1645 as buffeted by top receiver nub 1646 and bottom receiver nub 1642. In various embodiments, back spline plate surface 1843 can span across and be contiguous and co-planar with back a spline surface.

In some embodiments, ceiling portion 1880 can comprise bottom ceiling bend 1864, front ceiling section 1861, top ceiling section 1862, and/or back ceiling section 1863. In the same or different embodiments, bottom ceiling bend 1864 can have a planar shape. In various embodiments, bottom ceiling bend 1864 can have a substantially arcuate shape. In other embodiments, bottom ceiling bend 1864 can have a substantially planar shape. As an example, the substantially arcuate shape of bottom ceiling bend 1864 can be a concave shape or a convex shape. In the same or different embodiments, bottom ceiling bend 1864 extends between nose top section 1811 and front ceiling section 1861. In some embodiments, front ceiling section 1861 is approximately perpendicular with nose top section 1811. In other embodiments, front ceiling section 1861 creates an acute angle with nose top section 1811. In further embodiments, front ceiling section 1861 creates an obtuse angle with nose top section 1811. In the same or different embodiments, front ceiling section 1861 is configured to be flush with a side of a ceiling surface (not shown). In some embodiments, top ceiling section 1822 extends between front ceiling section 1861 and back ceiling section 1833. In the same or different embodiments, back ceiling section 1833 is approximately parallel with front ceiling section 1861 and approximately perpendicular with nose top section 1811.

Figure 19A:
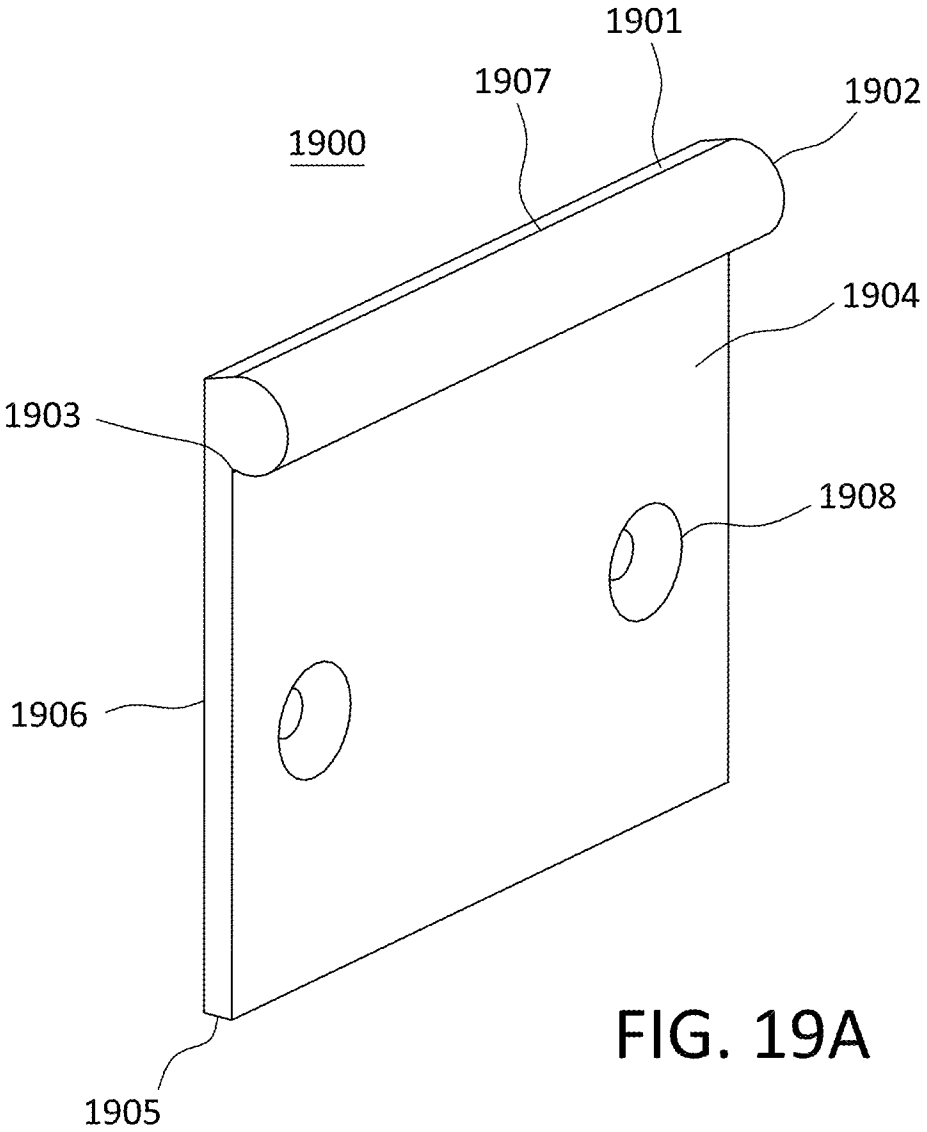
Figure 19B:
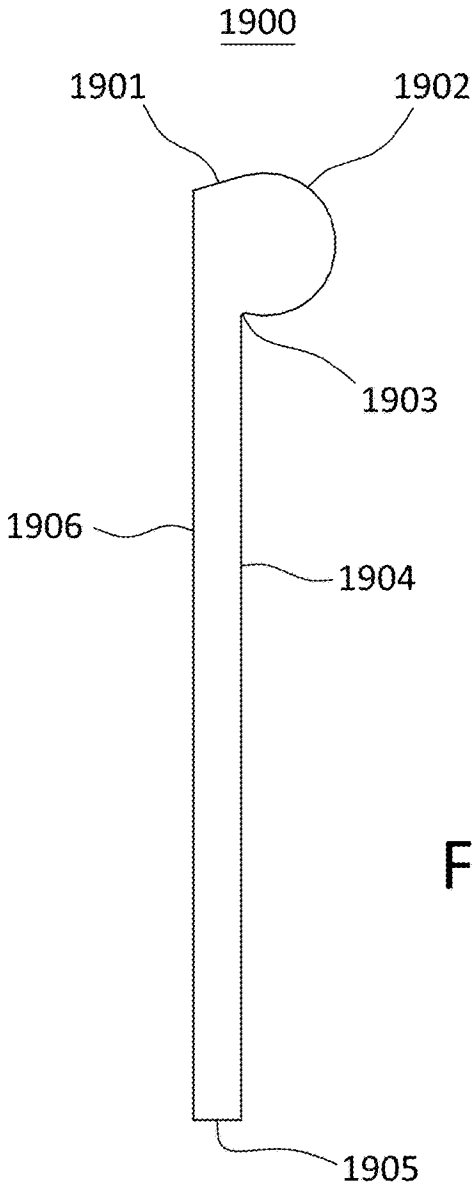

Turning now to FIGS. 19A and 19B, an exemplary embodiment of spline 1900 is shown. In some embodiments, spline 1900 can comprise spline riser 1901, spline riser interface 1907, spline nub 1902, spline nub bend 1903, front surface 1905, back surface 1906, bottom surface 1905, and/or fastener notch 1908. In various embodiments, spline riser 1901 can have a substantially planar shape. In some embodiments, spline riser 1901 can have a substantially arcuate shape. In the same or different embodiments, spline riser 1901 can be approximately parallel with spline bottom surface 1906 and/or approximately perpendicular with spline back surface 1906. In various embodiments, spline riser interface 1907 extends between spline riser 1901 and spline nub 1902. In various embodiments, spline riser interface 1907 can have a substantially planar shape. In some embodiments, spline riser interface 1907 can have a substantially arcuate shape. In various embodiments, spline nub 1902 can comprise a substantially rectangular shape, a substantially circular shape, a substantially triangular shape, a substantially ovoid shape, a substantially oval shape, and/or a substantially semi-circular shape. In the same or different embodiments, spline nub 1902 can be configured to be inserted into a spline receiver groove such that spline 1900 is thus coupled to a crown element. In some embodiments, spline nub bend 1903 extends between spline nub 1902 and front surface 1905. In various embodiments, spline nub bend 1903 can have a substantially planar shape. In some embodiments, spline nub bend 1903 can have a substantially arcuate shape. In various embodiments, front surface 1905 can have a substantially planar shape. In some embodiments, front surface 1905 can have a substantially arcuate shape. In the same or different embodiments, front surface 1905 can be approximately parallel with back surface 1906 and/or approximately perpendicular with spline bottom surface 1905. In various embodiments, back surface 1906 can have a substantially planar shape. In some embodiments, back surface 1906 can have a substantially arcuate shape. In the same or different embodiments, back surface 1906 can be approximately parallel with front surface 1905 and/or approximately perpendicular with spline bottom surface 1905. In various embodiments, back surface 1906 lays flush against a wall surface when coupled to the wall surface using a fastener inserted through fastener notch 1908.

Figure 20A:
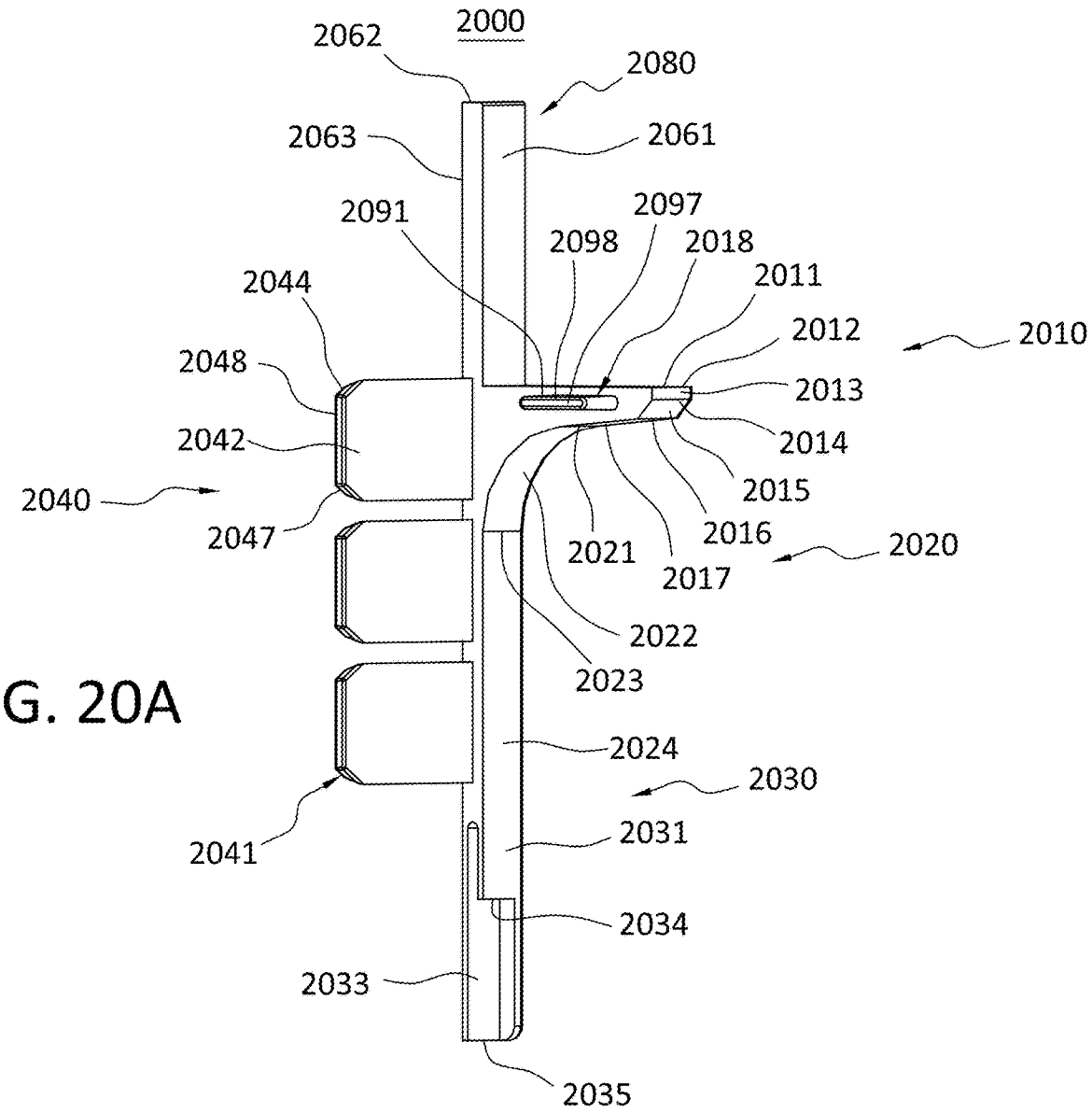
Figure 20B:
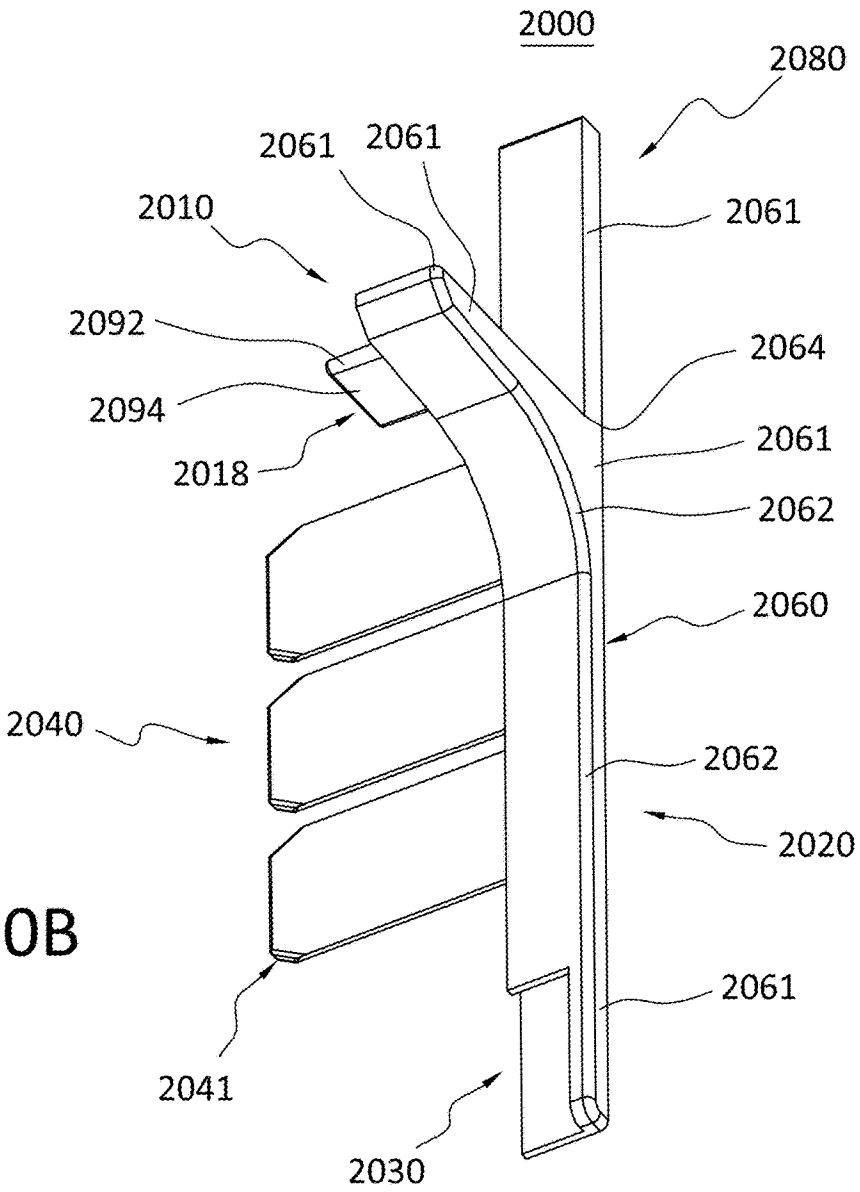

Turning now to FIGS. 20A and 20B, an exemplary embodiment of a spline 2000 is shown in a front isometric view. In many embodiments, spline 2000 can comprise a single, integrated piece. As an example, in embodiments where spline receiver portion 1640 (FIGS. 16A and 16B) comprises one or more recesses or female portions, spline 2000 can comprise one or more complementary male portions to couple with the one or more recesses or female portions. In other embodiments (not shown in FIGS. 20A and 20B), the spline receiver portion or spline coupling portion of the crown element comprises one or more male portions, the spline can comprise one or more complementary female portions to couple with the one or more male portions.

In some embodiments, spline 2000 can comprise nose portion 2010, riser portion 2020, groove portion 2030, spline portion 2040, cap portion 2060 and/or ceiling portion 2080. In some embodiments, nose portion 2010 can further comprise a nose top section 2011, a nose top bend 2012, nose front section 2013, nose front bend 2014, nose riser section 2015, nose riser bend 2016, nose bottom section 2017, and/or spline nub 2018. In the same or different embodiments, nose top section 2011 can have a substantially planar shape. In various embodiments, nose top section is configured to couple to a ceiling surface (not shown). In some embodiments, nose top section 2011 can comprise nose top grooves (not shown). In some embodiments, nose top grooves (not shown) can be configured to receive epoxy, glue, or sealant such that a spline 2000 is coupled to a ceiling surface (not shown). In some embodiments, the coupling of spline 2000 to ceiling surface (not shown) occurs in a way that is water tight and/or air tight. In the same or different embodiments, nose top section 2011 can extend approximately parallel to nose bottom section 2017 and approximately perpendicular to nose front section 2013. In various embodiments, nose top bend 2012 extends between nose top section 2011 and nose front section 2013.

In various embodiments, nose front section extends approximately parallel to back ceiling section 2063 and/or perpendicular to nose top section 2011. In some embodiments, nose front section 2013 can have a substantially planar shape. In various embodiments, nose front section 2013 can have a substantially arcuate shape, which allows for easy and thorough cleaning and/or disinfection because the lack of sharp corners and crevices prevents microorganisms from evading disinfectant. When nose front section 2013 has a substantially arcuate shape, laminar airflow can also be enhanced because air streams do not encounter sharp corners. As an example, the substantially arcuate shape of nose front section 2013 can be a concave shape or a convex shape. In the same or different embodiments, nose front bend 2014 extends between nose front section 2013 and nose riser section 2015. In some embodiments, nose front bend 2014 can have a substantially planar shape. In the same or different embodiments, nose front bend 2014 can have a substantially arcuate shape, which allows for easy and thorough cleaning and/or disinfection because the lack of sharp corners and crevices prevents microorganisms from evading disinfectant. When nose front bend 2014 has a substantially arcuate shape, laminar airflow can also be enhanced because air streams do not encounter sharp corners. As an example, the substantially arcuate shape of nose front bend 2014 can be a concave shape or a convex shape.

In the same or different embodiments, nose riser section 2015 can have a substantially planar shape. In various embodiments, nose riser section 2015 can have a substantially arcuate shape, which allows for easy and thorough cleaning and/or disinfection because the lack of sharp corners and crevices prevents microorganisms from evading disinfectant. When nose riser section 2015 has a substantially arcuate shape, laminar airflow can also be enhanced because air streams do not encounter sharp corners. As an example, the substantially arcuate shape of nose riser section 2015 can be a concave shape or a convex shape. In the same or different embodiments, nose riser section 2015 can form an obtuse angle with nose front section 2013. In some embodiments, nose riser section 2015 can form an acute angle with nose front section 2013. In various embodiments, nose riser section 2015 can form an approximately right angle with nose front section 2013. In further embodiments, nose riser section 2015 can be co-planar with nose front section 2013.

In some embodiments, nose riser bend 2016 extends between nose riser section 2015 and nose bottom section 2017. In some embodiments, nose riser bend 2016 can have a substantially planar shape. In the same or different embodiments, nose riser bend 2016 can have a substantially arcuate shape, which allows for easy and thorough cleaning and/or disinfection because the lack of sharp corners and crevices prevents microorganisms from evading disinfectant. When nose riser bend 2016 has a substantially arcuate shape, laminar airflow can also be enhanced because air streams do not encounter sharp corners.

In the same or various embodiments, nose bottom section 2017 can be substantially parallel to nose top section 2011. In various embodiments, nose bottom section 2017 can have a substantially planar shape. In some embodiments, nose bottom section 2017 can have a substantially arcuate shape, which allows for easy and thorough cleaning and/or disinfection because the lack of sharp corners and crevices prevents microorganisms from evading disinfectant. When nose bottom section 2017 has a substantially arcuate shape, laminar airflow can also be enhanced because air streams do not encounter sharp corners. As an example, the substantially arcuate shape of nose bottom section 2017 can be a concave shape or a convex shape.

In further embodiments, nose portion 2010 further comprises a spline nub 2018 extending from a lateral side of spline 2000. In some embodiments, spline nub 2018 can comprise a variety of shapes configured to be inserted into a variety of spline receiver grooves such that inserting or otherwise locating spline nub 2018 in a spline receiver groove couples a crown element to spline 2000. In various embodiments, spline nub 2018 can comprise a substantially rectangular shape, a substantially circular shape, a substantially triangular shape, a substantially ovoid shape, a substantially oval shape, and/or a substantially semi-circular shape. In the same or different embodiments, spline nub 2018 can comprise a top spline nub surface 2091, a plurality of spline nub bends 2092, a spline nub lateral surface 2097, and/or a spline nub edge 2098. In some embodiments, spline nub edge 2098 can circumscribe spline nub lateral surface 2097 and/or have a substantially arcuate or planar shape. When spline nub edge 2098 has a substantially arcuate shape, it is easier to insert spline nub 2018 into nose spline receiver grooves. In the same or different embodiments, plurality of spline nub bends 2092 can have a substantially arcuate or planar shape. When plurality of spline nub bends 2092 has a substantially arcuate shape, it is easier to insert spline nub 2018 into spline receiver grooves.

In some embodiments, riser portion 2020 can comprise riser bend bottom interface 2021, riser bend 2022, riser bend top interface 2023, and/or riser section 2024. In the same or different embodiments, riser bend bottom interface 2021 can extend from nose top section 2011. In the same or different embodiments, riser bend 2022 can extend from riser bend bottom interface 2023. In the same or different embodiments, riser bend 2022 can have a substantially arcuate shape, which allows for easy and thorough cleaning and/or disinfection because the lack of sharp corners and crevices prevents microorganisms from evading disinfectant. When riser bend 2022 has a substantially arcuate shape, laminar airflow can also be enhanced because air streams do not encounter sharp corners. As an example, the substantially arcuate shape of riser bend 2022 can be a concave shape or a convex shape. In some embodiments, riser bend top interface 2023 can extend from riser bend 2022. In the same or different embodiments, riser section 2024 can extend from riser top interface 2023. In various embodiments, riser section 2024 has a substantially planar shape, can be parallel to nose front section 2013, and/or be perpendicular to nose bottom section 2017.

In the same or different embodiments, wall groove portion 2030 can comprise a groove front section 2031, a groove bend 2032, a groove back section 2033, a groove front edge 2034, and/or a groove back edge 2035. In some embodiments, groove front section 2031 can extend from riser section 2024. As an example, groove front section 2031 and riser section 2024 can be coplanar with each other. In various embodiments, groove front section 2031 has a substantially planar shape, can be parallel to nose front section 2013, and/or be perpendicular to nose bottom section 2012. In the same or different embodiments, groove front section 2031 terminates at groove front edge 2034. In various embodiments, groove front edge 2034 can have a substantially planar shape or a substantially arcuate shape.

In further embodiments, groove bend 2032 can extend from groove front end 2031. In various embodiments, groove bend 2032 can have a substantially planar or substantially arcuate shape. In the same or different embodiments, groove bend 2032 can form a 180 degree bend, such that groove back section 2033 can be approximately parallel to groove front section 2031. In various embodiments, groove back section 2033 can extend from groove bend 2032 and terminate at groove back edge 2035. In further embodiments, groove back edge 2035 can have a substantially planar shape or a substantially arcuate shape.

In some embodiments, spline plate portion 2040 can comprise a spline plate 2041 extending out of lateral side 2018. In various embodiments, there can be a plurality of spline plates 2041 extending from opposite lateral sides of spline 2000, as shown in FIGS. 20A and 20B. In the same or different embodiments, spline plate 2041 can comprise a front spline plate surface 2042 and/or a back spline plate surface 2043. In further embodiments, spline plate 2041 can comprise a lateral spline edge 2048, top corner spline edge 2044, a top spline edge 2045, a bottom spline edge 2046, and a bottom corner spline edge 2047. In various embodiments, lateral spline edge 2048, top corner spline edge 2044, top spline edge 2045, bottom spline edge 2046, and/or bottom corner spline edge 2047 can have a substantially planar shape or a substantially arcuate shape. When lateral spline edge 2048, top corner spline edge 2044, top spline edge 2045, bottom spline edge 2046, and/or bottom corner spline edge 2047 have a substantially arcuate shape, it is easier to insert spline plate 2041 into receiver section 1645 as buffeted by top receiver nub 1646 and bottom receiver nub 1642. In various embodiments, back spline plate surface 2043 can span across and be contiguous and co-planar with back a spline surface.

In some embodiments, ceiling portion 2080 can comprise bottom ceiling bend 2064, front ceiling section 2061, top ceiling section 2062, and/or back ceiling section 2063. In the same or different embodiments, bottom ceiling bend 2064 can have a planar shape. In various embodiments, bottom ceiling bend 2064 can have a substantially arcuate shape. In other embodiments, bottom ceiling bend 2064 can have a substantially planar shape. As an example, the substantially arcuate shape of bottom ceiling bend 2064 can be a concave shape or a convex shape. In the same or different embodiments, bottom ceiling bend 2064 extends between nose top section 2011 and front ceiling section 2061. In some embodiments, front ceiling section 2061 is approximately perpendicular with nose top section 2011. In other embodiments, front ceiling section 2061 creates an acute angle with nose top section 2011. In further embodiments, front ceiling section 2061 creates an obtuse angle with nose top section 2011. In the same or different embodiments, front ceiling section 2061 is configured to be flush with a side of a ceiling surface (not shown). In some embodiments, top ceiling section 2022 extends between front ceiling section 2061 and back ceiling section 2033. In the same or different embodiments, back ceiling section 2033 is approximately parallel with front ceiling section 2061 and approximately perpendicular with nose top section 2011.

Turning now to FIG. 20B, cap portion 2060 can be seen. In various embodiments, cap portion 2060 can comprise cap lateral surface 2061 and/or cap edge 2062. In some embodiments, cap edge 2062 circumscribes nose top bend 2012, nose front section 2013, nose front bend 2014, nose riser section 2015, nose riser bend 2016, nose bottom section 2017, cap lateral surface 2061 and extends from riser bend 2022, riser bend top interface 2023, riser section 2024, groove front section 2031, groove back section 2033, groove front edge 2034, and/or groove back edge 2035. In further embodiments, cap edge 2062 has a substantially planar shape. In the same or different embodiments, cap edge 2062 can have a substantially arcuate shape, which allows for easy and thorough cleaning and/or disinfection because the lack of sharp corners and crevices prevents microorganisms from evading disinfectant. When cap edge 2062 has a substantially arcuate shape, laminar airflow can also be enhanced because air streams do not encounter sharp corners. As an example, the substantially arcuate shape of cap edge 2062 can be a concave shape or a convex shape.

Figure 21A:
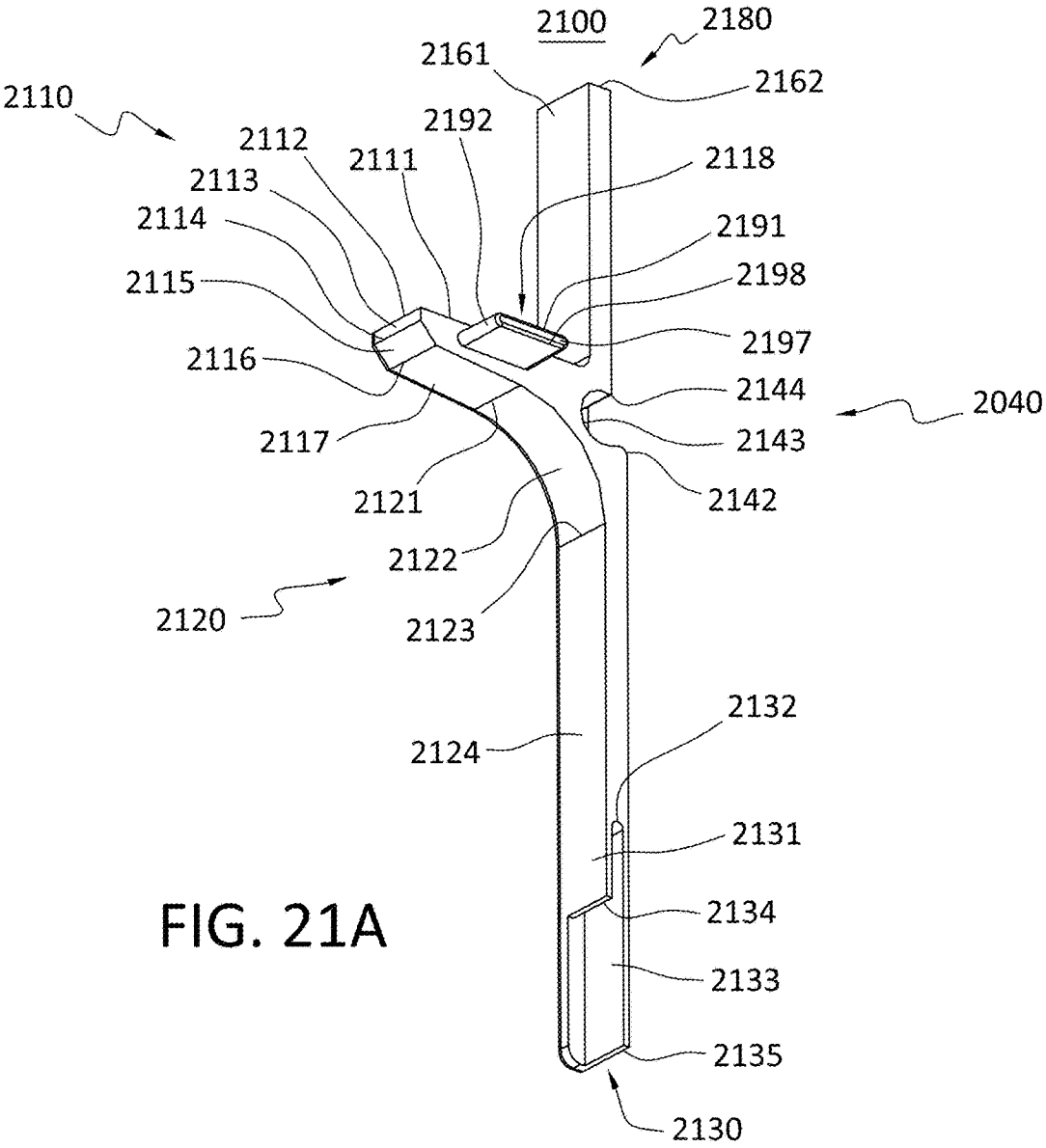
FIGS. 21A-21C representatively illustrate an exemplary embodiment of a crown element.
Figure 21B:
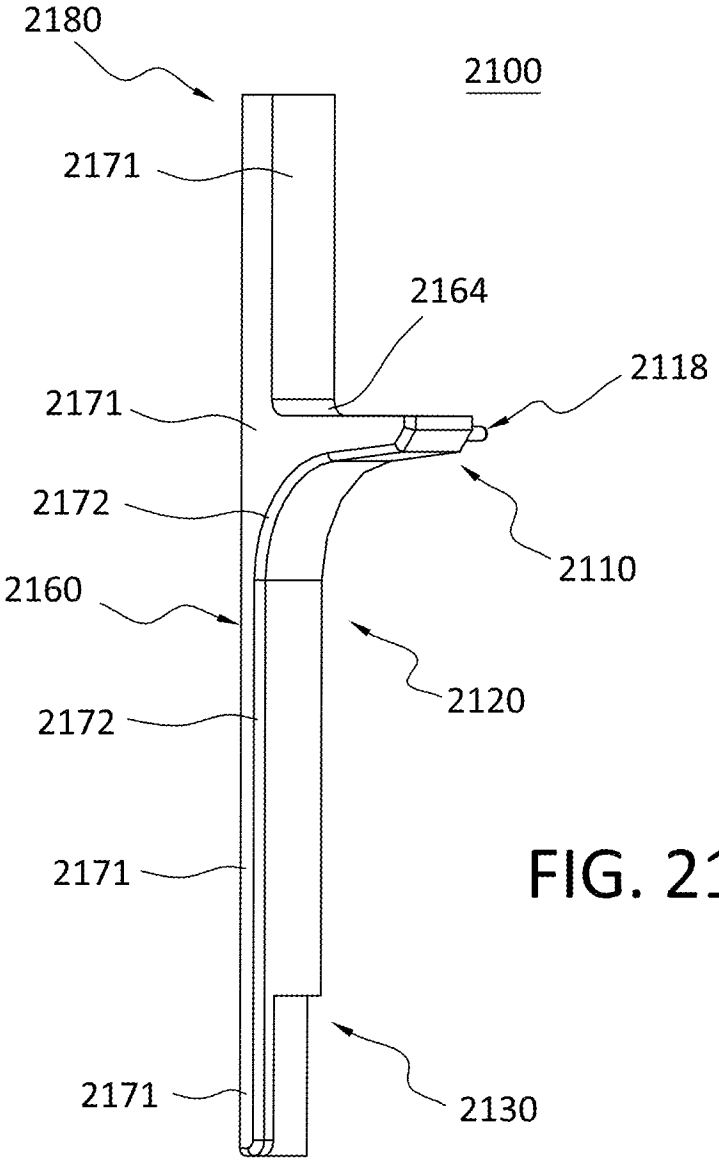
Figure 21C:
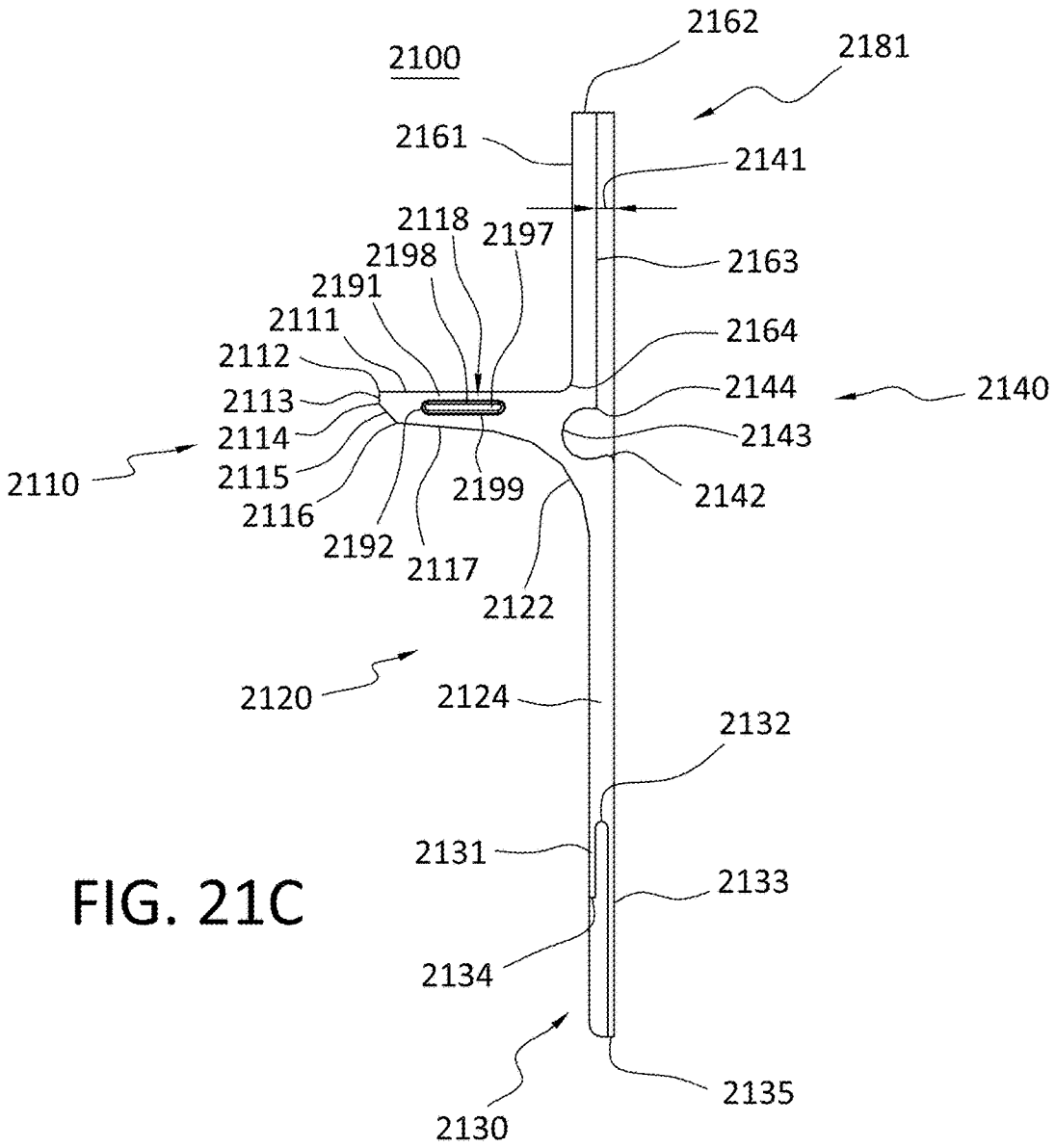

Turning now to FIGS. 21A, 21B, and 21C, an exemplary embodiment of a crown element 2100 is shown in a front isometric view. In many embodiments, crown element 2100 can comprise a single, integrated piece.

In some embodiments, crown element 2100 can comprise nose portion 2110, riser portion 2120, groove portion 2130, spline receiver portion 2140, and/or ceiling portion 2180. In some embodiments, nose portion 2110 can further comprise a nose top section 2111, a nose top bend 2112, nose front section 2113, nose front bend 2114, nose riser section 2115, nose riser bend 2116, nose bottom section 2117, and/or spline nub 2118. In the same or different embodiments, nose top section 2111 can have a substantially planar shape. In various embodiments, nose top section is configured to couple to a ceiling surface (not shown). In some embodiments, nose top section 2111 can comprise nose top grooves (not shown). In some embodiments, nose top grooves (not shown) can be configured to receive epoxy, glue, or sealant such that a crown element 2100 is coupled to a ceiling surface (not shown). In some embodiments, the coupling of crown element 2100 to ceiling surface (not shown) occurs in a way that is water tight and/or air tight. In the same or different embodiments, nose top section 2111 can extend approximately parallel to nose bottom section 2117 and approximately perpendicular to nose front section 2113. In various embodiments, nose top bend 212 extends between nose top section 2111 and nose front section 2113.

In various embodiments, nose front section extends approximately parallel to back ceiling section 2163 and/or perpendicular to nose top section 2111. In some embodiments, nose front section 2113 can have a substantially planar shape. In various embodiments, nose front section 2113 can have a substantially arcuate shape, which allows for easy and thorough cleaning and/or disinfection because the lack of sharp corners and crevices prevents microorganisms from evading disinfectant. When nose front section 2113 has a substantially arcuate shape, laminar airflow can also be enhanced because air streams do not encounter sharp corners. As an example, the substantially arcuate shape of nose front section 2113 can be a concave shape or a convex shape. In the same or different embodiments, nose front bend 2114 extends between nose front section 2113 and nose riser section 2115. In some embodiments, nose front bend 2114 can have a substantially planar shape. In the same or different embodiments, nose front bend 2114 can have a substantially arcuate shape, which allows for easy and thorough cleaning and/or disinfection because the lack of sharp corners and crevices prevents microorganisms from evading disinfectant. When nose front bend 2114 has a substantially arcuate shape, laminar airflow can also be enhanced because air streams do not encounter sharp corners. As an example, the substantially arcuate shape of nose front bend 2114 can be a concave shape or a convex shape.

In the same or different embodiments, nose riser section 2115 can have a substantially planar shape. In various embodiments, nose riser section 2115 can have a substantially arcuate shape, which allows for easy and thorough cleaning and/or disinfection because the lack of sharp corners and crevices prevents microorganisms from evading disinfectant. When nose riser section 2115 has a substantially arcuate shape, laminar airflow can also be enhanced because air streams do not encounter sharp corners. As an example, the substantially arcuate shape of nose riser section 2115 can be a concave shape or a convex shape. In the same or different embodiments, nose riser section 2115 can form an obtuse angle with nose front section 2113. In some embodiments, nose riser section 2115 can form an acute angle with nose front section 2113. In various embodiments, nose riser section 2115 can form an approximately right angle with nose front section 2113. In further embodiments, nose riser section 2115 can be co-planar with nose front section 2113.

In some embodiments, nose riser bend 2116 extends between nose riser section 2115 and nose bottom section 2117. In some embodiments, nose riser bend 2116 can have a substantially planar shape. In the same or different embodiments, nose riser bend 2116 can have a substantially arcuate shape, which allows for easy and thorough cleaning and/or disinfection because the lack of sharp corners and crevices prevents microorganisms from evading disinfectant. When nose riser bend 2116 has a substantially arcuate shape, laminar airflow can also be enhanced because air streams do not encounter sharp corners.

In the same or various embodiments, nose bottom section 2117 can be substantially parallel to nose top section 2111. In various embodiments, nose bottom section 2117 can have a substantially planar shape. In some embodiments, nose bottom section 2117 can have a substantially arcuate shape, which allows for easy and thorough cleaning and/or disinfection because the lack of sharp corners and crevices prevents microorganisms from evading disinfectant. When nose bottom section 2117 has a substantially arcuate shape, laminar airflow can also be enhanced because air streams do not encounter sharp corners. As an example, the substantially arcuate shape of nose bottom section 2117 can be a concave shape or a convex shape.

In further embodiments, nose portion 2110 further comprises a spline nub 2118 extending from a lateral side of spline 2100. In some embodiments, spline nub 2118 can comprise a variety of shapes configured to be inserted into a variety of spline receiver grooves such that inserting or otherwise locating spline nub 2117 in a spline receiver groove couples a crown element to spline 2100. In various embodiments, spline nub 2118 can comprise a substantially rectangular shape, a substantially circular shape, a substantially triangular shape, a substantially ovoid shape, a substantially oval shape, and/or a substantially semi-circular shape. In the same or different embodiments, spline nub 2118 can comprise a top spline nub surface 2191, a plurality of spline nub bends 2192, a spline nub lateral surface 2197, and/or a spline nub edge 2198. In some embodiments, spline nub edge 2198 can circumscribe spline nub lateral surface 2197 and/or have a substantially arcuate or planar shape. When spline nub edge 2198 has a substantially arcuate shape, it is easier to insert spline nub 2118 into nose spline receiver grooves. In the same or different embodiments, plurality of spline nub bends 2192 can have a substantially arcuate or planar shape. When plurality of spline nub bends 2192 has a substantially arcuate shape, it is easier to insert spline nub 2118 into spline receiver grooves.

In some embodiments, riser portion 2120 can comprise riser bend bottom interface 2121, riser bend 2122, riser bend top interface 2123, and/or riser section 2124. In the same or different embodiments, riser bend bottom interface 2121 can extend from nose top section 2111. In the same or different embodiments, riser bend 2122 can extend from riser bend bottom interface 2123. In the same or different embodiments, riser bend 2122 can have a substantially arcuate shape, which allows for easy and thorough cleaning and/or disinfection because the lack of sharp corners and crevices prevents microorganisms from evading disinfectant. When riser bend 2122 has a substantially arcuate shape, laminar airflow can also be enhanced because air streams do not encounter sharp corners. As an example, the substantially arcuate shape of riser bend 2122 can be a concave shape or a convex shape. In some embodiments, riser bend top interface 2123 can extend from riser bend 2122. In the same or different embodiments, riser section 2124 can extend from riser top interface 2123. In various embodiments, riser section 2124 has a substantially planar shape, can be parallel to nose front section 2113, and/or be perpendicular to nose bottom section 2117.

In the same or different embodiments, wall groove portion 2130 can comprise a groove front section 2131, a groove bend 2132, a groove back section 2133, a groove front edge 2134, and/or a groove back edge 2135. In some embodiments, groove front section 2131 can extend from riser section 2124. As an example, groove front section 2131 and riser section 2124 can be coplanar with each other. In various embodiments, groove front section 2131 has a substantially planar shape, can be parallel to nose front section 2113, and/or be perpendicular to nose bottom section 2117. In the same or different embodiments, groove front section 2131 terminates at groove front edge 2134. In various embodiments, groove front edge 2134 can have a substantially planar shape or a substantially arcuate shape. In further embodiments, groove bend 2132 can extend from groove front end 2131. In various embodiments, groove bend 2132 can have a substantially planar or substantially arcuate shape. In the same or different embodiments, groove bend 2132 can form a 180 degree bend, such that groove back section 2133 can be approximately parallel to groove front section 2131. In various embodiments, groove back section 2133 can extend from groove bend 2132 and terminate at groove back edge 2135. In further embodiments, groove back edge 2135 can have a substantially planar shape or a substantially arcuate shape.

In the same or different embodiments, spline receiver portion 2140 can be a spline coupling portion. In some embodiments, the spline coupling portion can comprise one or more recesses or female portions, as described below, and in other embodiments (not shown in FIGS. 21A, 21B, and 21C), the spline coupling portion can comprise one or more male portions. As shown in FIGS. 21A, 21B, and 21C, spline receiver portion 2140 can comprise top receiver bend 2144, receiver groove 2143, bottom receiver bend 2142, riser section back surface 2145, and/or receiver notch 2141. In some embodiments, top receiver bend 2144 can extend between back ceiling section 2163 and receiver groove 2143. In various embodiments, top receiver bend 2144 can have a substantially planar shape. In various embodiments, top receiver bend 2144 can have a substantially arcuate shape. In the same or different embodiments, receiver groove 2143 can have a substantially arcuate, substantially circular, substantially planar, substantially triangular, or substantially rectangular shape. In the same or different embodiments, receiver groove 2143 can be configured to receive a male portion of a spline in order to aid in the coupling of crown element 2100 to a spline. In some embodiments, bottom receiver bend 2142 can extend from a back surface of riser section 2124 and receiver groove 2143. In various embodiments, bottom receiver bend 2142 can have a substantially planar shape. In various embodiments, bottom receiver bend 2142 can have a substantially arcuate shape. In various embodiments, receiver notch 2141 is offset from riser section back surface 2145 such that when a spline couples to crown element 2100, its back side lays flush with riser section back surface 2145.

In some embodiments, ceiling portion 2180 can comprise bottom ceiling bend 2164, front ceiling section 2161, top ceiling section 2162, and/or back ceiling section 2163. In the same or different embodiments, bottom ceiling bend 2164 can have a planar shape. In various embodiments, bottom ceiling bend 2164 can have a substantially arcuate shape. In other embodiments, bottom ceiling bend 2164 can have a substantially planar shape. As an example, the substantially arcuate shape of bottom ceiling bend 2164 can be a concave shape or a convex shape. In the same or different embodiments, bottom ceiling bend 2164 extends between nose top section 2111 and front ceiling section 2161. In some embodiments, front ceiling section 2161 is approximately perpendicular with nose top section 2111. In other embodiments, front ceiling section 2161 creates an acute angle with nose top section 2111. In further embodiments, front ceiling section 2161 creates an obtuse angle with nose top section 2111. In the same or different embodiments, front ceiling section 2161 is configured to be flush with a side of a ceiling surface (not shown). In some embodiments, top ceiling section 2122 extends between front ceiling section 2161 and back ceiling section 2133. In the same or different embodiments, back ceiling section 2133 is approximately parallel with front ceiling section 2161 and approximately perpendicular with nose top section 2111.

Turning now to FIG. 21B, cap portion 2160 can be seen. In various embodiments, cap portion 2160 can comprise cap lateral surface 2161 and/or cap edge 2162. In some embodiments, cap edge 2162 circumscribes nose top bend 2112, nose front section 2113, nose front bend 2114, nose riser section 2115, nose riser bend 2116, nose bottom section 2117, cap lateral surface 2161 and extends from riser bend 2122, riser bend top interface 2123, riser section 2124, groove front section 2131, groove back section 2133, groove front edge 2134, and/or groove back edge 2135. In further embodiments, cap edge 2162 has a substantially planar shape. In the same or different embodiments, cap edge 2162 can have a substantially arcuate shape, which allows for easy and thorough cleaning and/or disinfection because the lack of sharp corners and crevices prevents microorganisms from evading disinfectant. When cap edge 2162 has a substantially arcuate shape, laminar airflow can also be enhanced because air streams do not encounter sharp corners. As an example, the substantially arcuate shape of cap edge 2162 can be a concave shape or a convex shape.

Figure 22A:
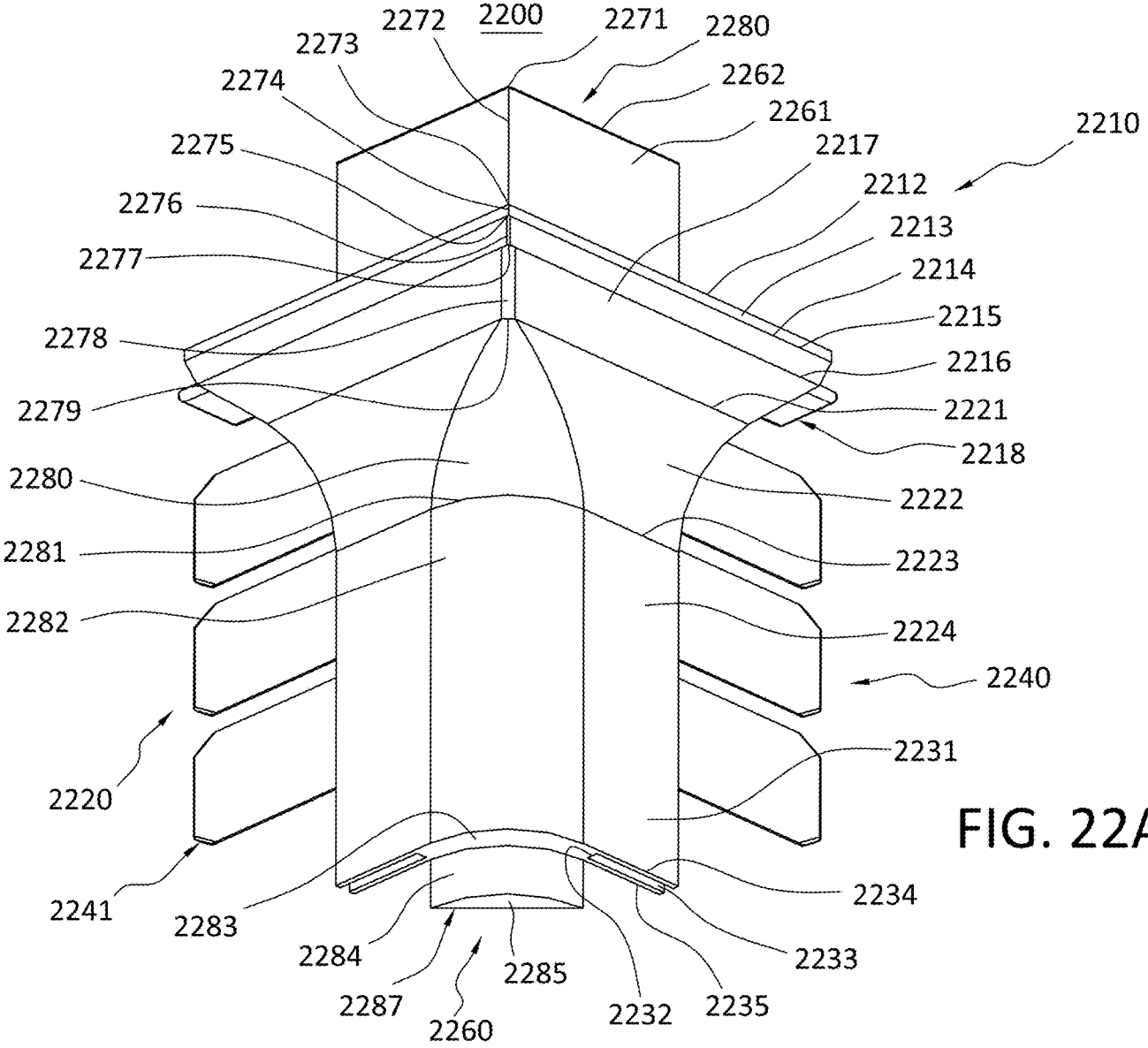
FIGS. 22A and 22B representatively illustrate an exemplary embodiment of a spline.
Figure 22B:
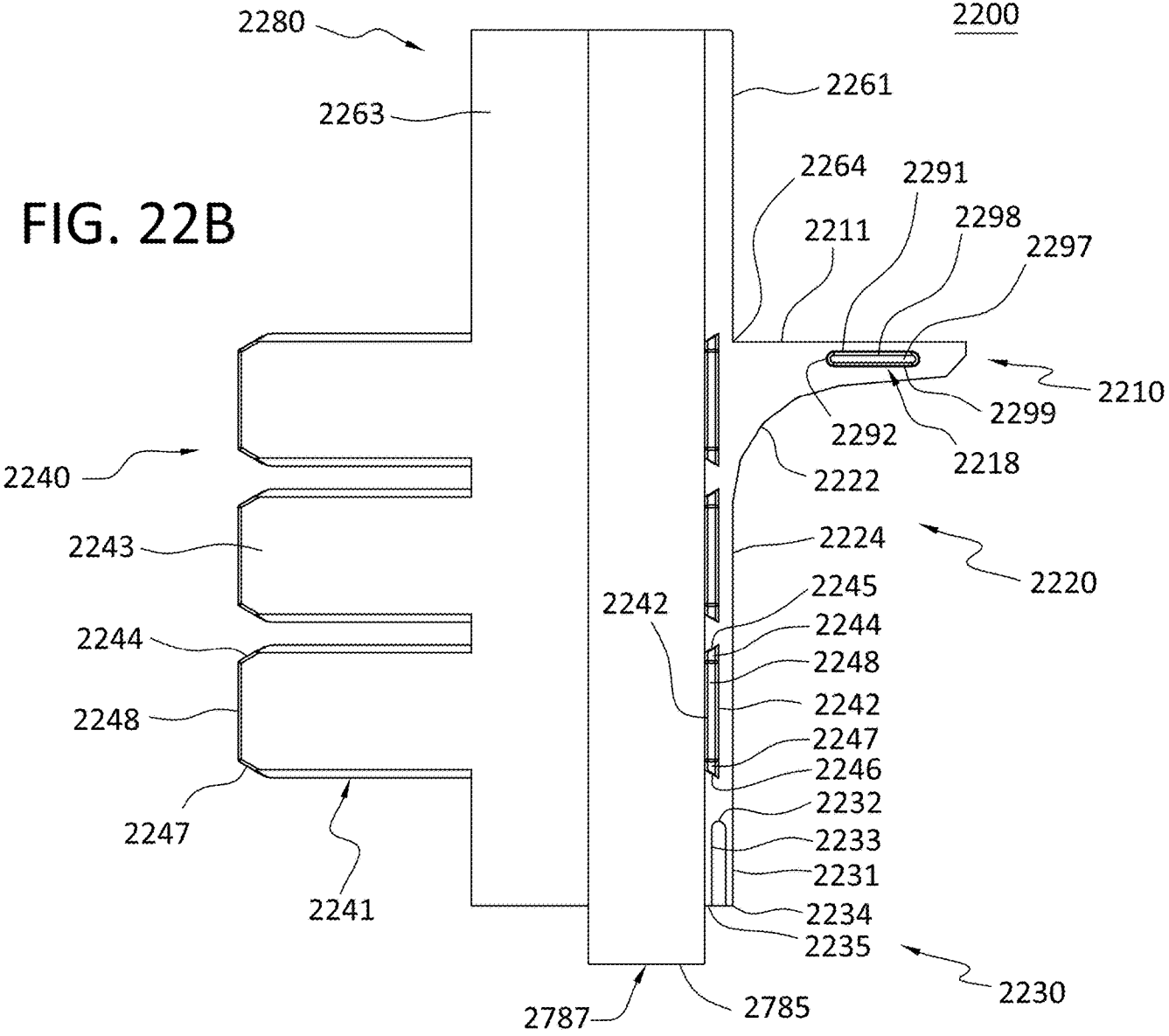

Turning now to FIGS. 22A and 22B, an exemplary embodiment of a spline 2200 is shown in a front isometric view. In many embodiments, spline 2200 can comprise a single, integrated piece. As an example, in embodiments where spline receiver portion 1640 (FIGS. 16A and 16B) comprises one or more recesses or female portions, spline 2200 can comprise one or more complementary male portions to couple with the one or more recesses or female portions. In other embodiments (not shown in FIGS. 22A and 22B), the spline receiver portion or spline coupling portion of the crown element comprises one or more male portions, the spline can comprise one or more complementary female portions to couple with the one or more male portions.

In some embodiments, spline 2200 can comprise nose portion 2210, riser portion 2220, groove portion 2230, spline portion 2240, corner portion 2260, and/or ceiling portion 2280. In some embodiments, nose portion 2210 can further comprise a nose top section 2211, a nose top bend 2212, nose front section 2213, nose front bend 2214, nose riser section 2215, nose riser bend 2216, nose bottom section 2217, and/or nose nub receiver groove 2218. In the same or different embodiments, nose top section 2211 can have a substantially planar shape. In various embodiments, nose top section is configured to couple to a ceiling surface (not shown). In some embodiments, nose top section 2211 can comprise nose top grooves (not shown). In some embodiments, nose top grooves (not shown) can be configured to receive epoxy, glue, or sealant such that a spline 2200 is coupled to a ceiling surface (not shown). In some embodiments, the coupling of spline 2200 to ceiling surface (not shown) occurs in a way that is water tight and/or air tight. In the same or different embodiments, nose top section 2211 can extend approximately parallel to nose bottom section 2217 and approximately perpendicular to nose front section 2213. In various embodiments, nose top bend 2222 extends between nose top section 2211 and nose front section 2213.

In various embodiments, nose front section extends approximately parallel to back ceiling section 2263 and/or perpendicular to nose top section 2211. In some embodiments, nose front section 2213 can have a substantially planar shape. In various embodiments, nose front section 2213 can have a substantially arcuate shape, which allows for easy and thorough cleaning and/or disinfection because the lack of sharp corners and crevices prevents microorganisms from evading disinfectant. When nose front section 2213 has a substantially arcuate shape, laminar airflow can also be enhanced because air streams do not encounter sharp corners. As an example, the substantially arcuate shape of nose front section 2213 can be a concave shape or a convex shape. In the same or different embodiments, nose front bend 2214 extends between nose front section 2213 and nose riser section 2215. In some embodiments, nose front bend 2214 can have a substantially planar shape. In the same or different embodiments, nose front bend 2214 can have a substantially arcuate shape, which allows for easy and thorough cleaning and/or disinfection because the lack of sharp corners and crevices prevents microorganisms from evading disinfectant. When nose front bend 2214 has a substantially arcuate shape, laminar airflow can also be enhanced because air streams do not encounter sharp corners. As an example, the substantially arcuate shape of nose front bend 2214 can be a concave shape or a convex shape.

In the same or different embodiments, nose riser section 2215 can have a substantially planar shape. In various embodiments, nose riser section 2215 can have a substantially arcuate shape, which allows for easy and thorough cleaning and/or disinfection because the lack of sharp corners and crevices prevents microorganisms from evading disinfectant. When nose riser section 2215 has a substantially arcuate shape, laminar airflow can also be enhanced because air streams do not encounter sharp corners. As an example, the substantially arcuate shape of nose riser section 2215 can be a concave shape or a convex shape. In the same or different embodiments, nose riser section 2215 can form an obtuse angle with nose front section 2213. In some embodiments, nose riser section 2215 can form an acute angle with nose front section 2213. In various embodiments, nose riser section 2215 can form an approximately right angle with nose front section 2213. In further embodiments, nose riser section 2215 can be co-planar with nose front section 2213.

In some embodiments, nose riser bend 2216 extends between nose riser section 2215 and nose bottom section 2217. In some embodiments, nose riser bend 2216 can have a substantially planar shape. In the same or different embodiments, nose riser bend 2216 can have a substantially arcuate shape, which allows for easy and thorough cleaning and/or disinfection because the lack of sharp corners and crevices prevents microorganisms from evading disinfectant. When nose riser bend 2216 has a substantially arcuate shape, laminar airflow can also be enhanced because air streams do not encounter sharp corners.

In the same or various embodiments, nose bottom section 2217 can be substantially parallel to nose top section 2211. In various embodiments, nose bottom section 2217 can have a substantially planar shape. In some embodiments, nose bottom section 2217 can have a substantially arcuate shape, which allows for easy and thorough cleaning and/or disinfection because the lack of sharp corners and crevices prevents microorganisms from evading disinfectant. When nose bottom section 2217 has a substantially arcuate shape, laminar airflow can also be enhanced because air streams do not encounter sharp corners. As an example, the substantially arcuate shape of nose bottom section 2217 can be a concave shape or a convex shape.

In further embodiments, nose portion 2210 further comprises a spline nub 2218 extending from a lateral side of spline 2200. As shown in FIG. 22A, nose portion 2210 can include two spline nubs 2218 at opposite lateral sides of nose portion 2210. In some embodiments, spline nub 2218 can comprise a variety of shapes configured to be inserted into a variety of spline receiver grooves such that inserting or otherwise locating spline nub 2217 in a spline receiver groove couples a crown element to spline 2200. In various embodiments, spline nub 2218 can comprise a substantially rectangular shape, a substantially circular shape, a substantially triangular shape, a substantially ovoid shape, a substantially oval shape, and/or a substantially semi-circular shape. In the same or different embodiments, spline nub 2218 can comprise a top spline nub surface 2291, a plurality of spline nub bends 2292, a spline nub lateral surface 2297, and/or a spline nub edge 2298. In some embodiments, spline nub edge 2298 can circumscribe spline nub lateral surface 2297 and/or have a substantially arcuate or planar shape. When spline nub edge 2298 has a substantially arcuate shape, it is easier to insert spline nub 2218 into nose spline receiver grooves. In the same or different embodiments, plurality of spline nub bends 2292 can have a substantially arcuate or planar shape. When plurality of spline nub bends 2292 has a substantially arcuate shape, it is easier to insert spline nub 2218 into spline receiver grooves.

In some embodiments, riser portion 2220 can comprise riser bend bottom interface 2221, riser bend 2222, riser bend top interface 2223, and/or riser section 2224. In the same or different embodiments, riser bend bottom interface 2221 can extend from nose top section 2211. In the same or different embodiments, riser bend 2222 can extend from riser bend top interface 2223. In the same or different embodiments, riser bend 2222 can have a substantially arcuate shape, which allows for easy and thorough cleaning and/or disinfection because the lack of sharp corners and crevices prevents microorganisms from evading disinfectant. When riser bend 2222 has a substantially arcuate shape, laminar airflow can also be enhanced because air streams do not encounter sharp corners. As an example, the substantially arcuate shape of riser bend 2222 can be a concave shape or a convex shape. In some embodiments, riser bend top interface 2223 can extend from riser bend 2222. In the same or different embodiments, riser section 2224 can extend from riser bend top interface 2223. In various embodiments, riser section 2224 has a substantially planar shape, can be parallel to nose front section 2213, and/or be perpendicular to nose bottom section 2217.

In the same or different embodiments, wall groove portion 2230 can comprise a groove front section 2231, a groove bend 2232, a groove back section 2233, a groove front edge 2234, and/or a groove back edge 2235. In some embodiments, groove front section 2231 can extend from riser section 2224. As an example, groove front section 2231 and riser section 2224 can be coplanar with each other. In various embodiments, groove front section 2231 has a substantially planar shape, can be parallel to nose front section 2213, and/or be perpendicular to nose bottom section 2217. In the same or different embodiments, groove front section 2231 terminates at groove front edge 2234. In various embodiments, groove front edge 2234 can have a substantially planar shape or a substantially arcuate shape. In further embodiments, groove bend 2232 can extend from groove front end 2231. In various embodiments, groove bend 2232 can have a substantially planar or substantially arcuate shape. In the same or different embodiments, groove bend 2232 can form a 180 degree bend, such that groove back section 2233 can be approximately parallel to groove front section 2231. In various embodiments, groove back section 2233 can extend from groove bend 2232 and terminate at groove back edge 2235. In further embodiments, groove back edge 2235 can have a substantially planar shape or a substantially arcuate shape.

In some embodiments, spline plate portion 2240 can comprise a spline plate 2241 extending out of lateral side 2218. In various embodiments, there can be a plurality of spline plates 2241 extending from opposite lateral sides of spline 2200, as shown in FIGS. 22A and 22B. In the same or different embodiments, spline plate 2241 can comprise a front spline plate surface 2242 and/or a back spline plate surface 2243. In further embodiments, spline plate 2241 can comprise a lateral spline edge 2248, top corner spline edge 2244, a top spline edge 2245, a bottom spline edge 2246, and a bottom corner spline edge 2247. In various embodiments, lateral spline edge 2248, top corner spline edge 2244, top spline edge 2245, bottom spline edge 2246, and/or bottom corner spline edge 2247 can have a substantially planar shape or a substantially arcuate shape. When lateral spline edge 2248, top corner spline edge 2244, top spline edge 2245, bottom spline edge 2246, and/or bottom corner spline edge 2247 have a substantially arcuate shape, it is easier to insert spline plate 2241 into receiver section 1645 as buffeted by top receiver nub 1646 and bottom receiver nub 1642. In various embodiments, back spline plate surface 2243 can span across and be contiguous and co-planar with back a spline surface.

In some embodiments, ceiling portion 2280 can comprise bottom ceiling bend 2264, front ceiling section 2261, top ceiling section 2262, and/or back ceiling section 2263. In the same or different embodiments, bottom ceiling bend 2264 can have a planar shape. In various embodiments, bottom ceiling bend 2264 can have a substantially arcuate shape. In other embodiments, bottom ceiling bend 2264 can have a substantially planar shape. As an example, the substantially arcuate shape of bottom ceiling bend 2264 can be a concave shape or a convex shape. In the same or different embodiments, bottom ceiling bend 2264 extends between nose top section 2211 and front ceiling section 2261. In some embodiments, front ceiling section 2261 is approximately perpendicular with nose top section 2211. In other embodiments, front ceiling section 2261 creates an acute angle with nose top section 2211. In further embodiments, front ceiling section 2261 creates an obtuse angle with nose top section 2211. In the same or different embodiments, front ceiling section 2261 is configured to be flush with a side of a ceiling surface (not shown). In some embodiments, top ceiling section 2222 extends between front ceiling section 2261 and back ceiling section 2233. In the same or different embodiments, back ceiling section 2233 is approximately parallel with front ceiling section 2261 and approximately perpendicular with nose top section 2211.

In some embodiments, corner portion 2260 can comprise corner top ceiling section 2271, corner front ceiling section 2272, corner nose top bend 2273, corner nose front section 2274, corner nose front bend 2275, corner nose riser section 2276, corner nose riser bend 2277, corner nose bottom section 2278, corner riser bend bottom interface 2279, corner riser bend 2280, corner riser bend top interface 2281, corner riser section 2282, corner top surface 2283, and/or corner nub 2287. In some embodiments, corner portion 2260 forms a right angle of an exterior corner. In the same or different embodiments, corner portion 2260 forms an acute angle of an exterior corner. In still other embodiments, corner portion 2260 forms an obtuse angle of an exterior corner.

In further embodiments, corner top ceiling section 2271 extends between a plurality of top ceiling sections 2262. In the same or different embodiments, corner top ceiling section 2271 can have a substantially planar shape. In some embodiments, corner bottom nose bend 2271 can have an arcuate shape, which allows for easy and thorough cleaning and/or disinfection because the lack of sharp corners and crevices prevents microorganisms from evading disinfectant. When corner top ceiling section 2271 has a substantially arcuate shape, laminar airflow can also be enhanced because air streams do not encounter sharp corners. As an example, the substantially arcuate shape of corner top ceiling section 2271 can be a concave shape or a convex shape.

In further embodiments, corner front ceiling section 2272 extends between a plurality of front ceiling sections 2261. In the same or different embodiments, corner front ceiling section 2272 can have a substantially planar shape. In some embodiments, corner front ceiling section 2272 can have an arcuate shape, which allows for easy and thorough cleaning and/or disinfection because the lack of sharp corners and crevices prevents microorganisms from evading disinfectant. When corner front ceiling section 2272 has a substantially arcuate shape, laminar airflow can also be enhanced because air streams do not encounter sharp corners. As an example, the substantially arcuate shape of corner front ceiling section 2272 can be a concave shape or a convex shape.

In further embodiments, corner nose top bend 2273 extends between a plurality of nose top bend 2212. In the same or different embodiments, corner nose top bend 2273 can have a substantially planar shape. In some embodiments, corner nose top bend 2273 can have an arcuate shape, which allows for easy and thorough cleaning and/or disinfection because the lack of sharp corners and crevices prevents microorganisms from evading disinfectant. When corner nose top bend 2273 has a substantially arcuate shape, laminar airflow can also be enhanced because air streams do not encounter sharp corners. As an example, the substantially arcuate shape of corner nose top bend 2273 can be a concave shape or a convex shape.

In further embodiments, corner nose front section 2274 extends between a plurality of nose front sections 2213. In the same or different embodiments, corner nose front section 2274 can have a substantially planar shape. In some embodiments, corner nose front section 2274 can have an arcuate shape, which allows for easy and thorough cleaning and/or disinfection because the lack of sharp corners and crevices prevents microorganisms from evading disinfectant. When corner nose front section 2274 has a substantially arcuate shape, laminar airflow can also be enhanced because air streams do not encounter sharp corners. As an example, the substantially arcuate shape of corner nose front section 2274 can be a concave shape or a convex shape.

In further embodiments, corner nose front bend 2275 extends between a plurality of corner nose front bends 2214. In the same or different embodiments, corner nose front bend 2275 can have a substantially planar shape. In some embodiments, corner nose front bend 2275 can have an arcuate shape, which allows for easy and thorough cleaning and/or disinfection because the lack of sharp corners and crevices prevents microorganisms from evading disinfectant. When corner nose front bend 2275 has a substantially arcuate shape, laminar airflow can also be enhanced because air streams do not encounter sharp corners. As an example, the substantially arcuate shape of corner nose front bend 2275 can be a concave shape or a convex shape.

In further embodiments, corner nose riser section 2276 extends between a plurality of nose riser sections 2215. In the same or different embodiments, corner nose riser section 2276 can have a substantially planar shape. In some embodiments, corner nose riser section 2276 can have an arcuate shape, which allows for easy and thorough cleaning and/or disinfection because the lack of sharp corners and crevices prevents microorganisms from evading disinfectant. When corner nose riser section 2276 has a substantially arcuate shape, laminar airflow can also be enhanced because air streams do not encounter sharp corners. As an example, the substantially arcuate shape of corner nose riser section 2276 can be a concave shape or a convex shape.

In further embodiments, corner nose riser bend 2277 extends between a plurality of nose riser bend 2217. In the same or different embodiments, corner nose riser bend 2277 can have a substantially planar shape. In some embodiments, corner nose riser bend 2277 can have an arcuate shape, which allows for easy and thorough cleaning and/or disinfection because the lack of sharp corners and crevices prevents microorganisms from evading disinfectant. When corner nose riser bend 2277 has a substantially arcuate shape, laminar airflow can also be enhanced because air streams do not encounter sharp corners. As an example, the substantially arcuate shape of corner nose riser bend 2277 can be a concave shape or a convex shape.

In further embodiments, corner nose bottom section 2278 extends between a plurality of nose bottom sections 2217. In the same or different embodiments, corner nose bottom section 2278 can have a substantially planar shape. In some embodiments, corner nose bottom section 2278 can have an arcuate shape, which allows for easy and thorough cleaning and/or disinfection because the lack of sharp corners and crevices prevents microorganisms from evading disinfectant. When corner nose bottom section 2278 has a substantially arcuate shape, laminar airflow can also be enhanced because air streams do not encounter sharp corners. As an example, the substantially arcuate shape of corner nose bottom section 2278 can be a concave shape or a convex shape.

In further embodiments, corner riser bend bottom interface 2279 extends between a plurality of riser bend bottom interfaces 2221. In the same or different embodiments, corner riser bend bottom interface 2279 can have a substantially planar shape. In some embodiments, corner riser bend bottom interface 2279 can have an arcuate shape, which allows for easy and thorough cleaning and/or disinfection because the lack of sharp corners and crevices prevents microorganisms from evading disinfectant. When corner riser bend bottom interface 2279 has a substantially arcuate shape, laminar airflow can also be enhanced because air streams do not encounter sharp corners. As an example, the substantially arcuate shape of corner nose bottom section 2278 can be a concave shape or a convex shape.

In further embodiments, corner riser bend 2280 extends between a plurality of riser bends 2222. In the same or different embodiments, corner riser bend 2280 can have a substantially planar shape. In some embodiments corner riser bend 2280 can have an arcuate shape, which allows for easy and thorough cleaning and/or disinfection because the lack of sharp corners and crevices prevents microorganisms from evading disinfectant. When corner riser bend 2280 has a substantially arcuate shape, laminar airflow can also be enhanced because air streams do not encounter sharp corners. As an example, the substantially arcuate shape of corner riser bend 2280 can be a concave shape or a convex shape.

In further embodiments, corner riser bend top interface 2281 extends between a plurality of riser bend top interface 2223. In the same or different embodiments, corner riser bend top interface 2281 can have a substantially planar shape. In some embodiments corner riser bend top interface 2281 can have an arcuate shape, which allows for easy and thorough cleaning and/or disinfection because the lack of sharp corners and crevices prevents microorganisms from evading disinfectant. When corner riser bend top interface 2281 has a substantially arcuate shape, laminar airflow can also be enhanced because air streams do not encounter sharp corners. As an example, the substantially arcuate shape of corner riser bend top interface 2281 can be a concave shape or a convex shape.

In further embodiments, corner riser section 2282 extends between a plurality of riser bend top interface 2223. In the same or different embodiments, corner riser section 2282 can have a substantially planar shape. In some embodiments corner riser section 2282 can have an arcuate shape, which allows for easy and thorough cleaning and/or disinfection because the lack of sharp corners and crevices prevents microorganisms from evading disinfectant. When corner riser section 2282 has a substantially arcuate shape, laminar airflow can also be enhanced because air streams do not encounter sharp corners. As an example, the substantially arcuate shape of corner riser section 2282 can be a concave shape or a convex shape.

In further embodiments, corner top surface 2283 extends between a plurality of groove bends 2232, groove front edge 2234, and/or a groove back edge 2235. In the same or different embodiments, corner top surface 2283 can have a substantially planar shape, such that it lays flush with a top surface of a wall corner element when a wall corner element is coupled to spline 2200.

In some embodiments, corner nub 2287 extends out of corner top surface 2283. In the same or different embodiments, corner nub 2287 comprises corner nub front surface 2284, corner nub top surface 2285, and corner nub back surface (not shown). In some embodiments, corner nub 2287 can comprise a variety of shapes configured to be inserted into a variety of nub receiver grooves, such that inserting or otherwise locating corner nub 2287 into nub receiver grooves couples a wall corner element to spline 2200 while a wall corner element remains substantially immobile. In various embodiments, corner nub 2287 can comprise a substantially rectangular shape, a substantially circular shape, a substantially triangular shape, a substantially ovoid shape, a substantially oval shape, and/or a substantially semi-circular shape.

Figure 23A:
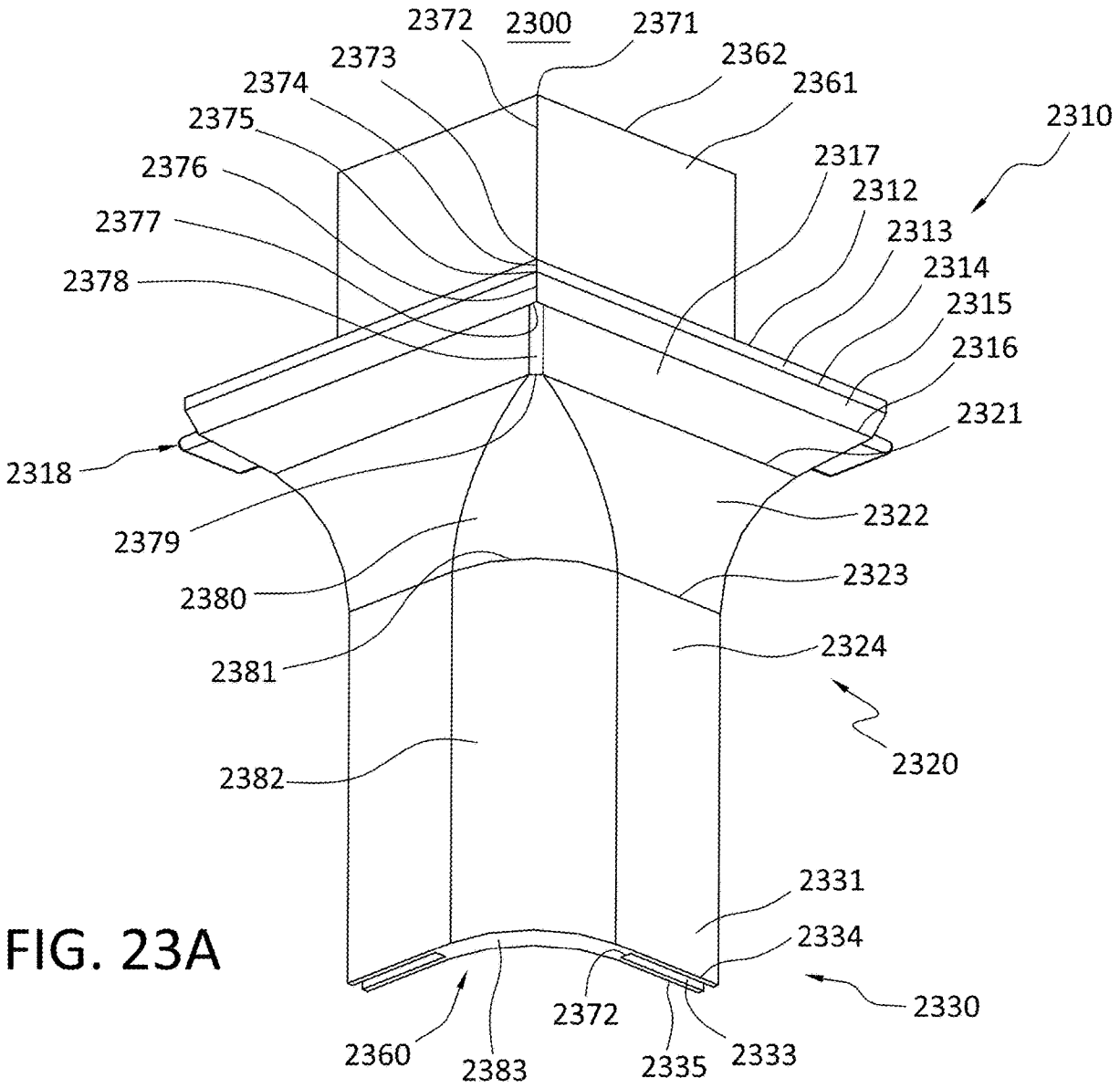
FIGS. 23A-23C representatively illustrate an exemplary embodiment of a crown element.
Figure 23B:
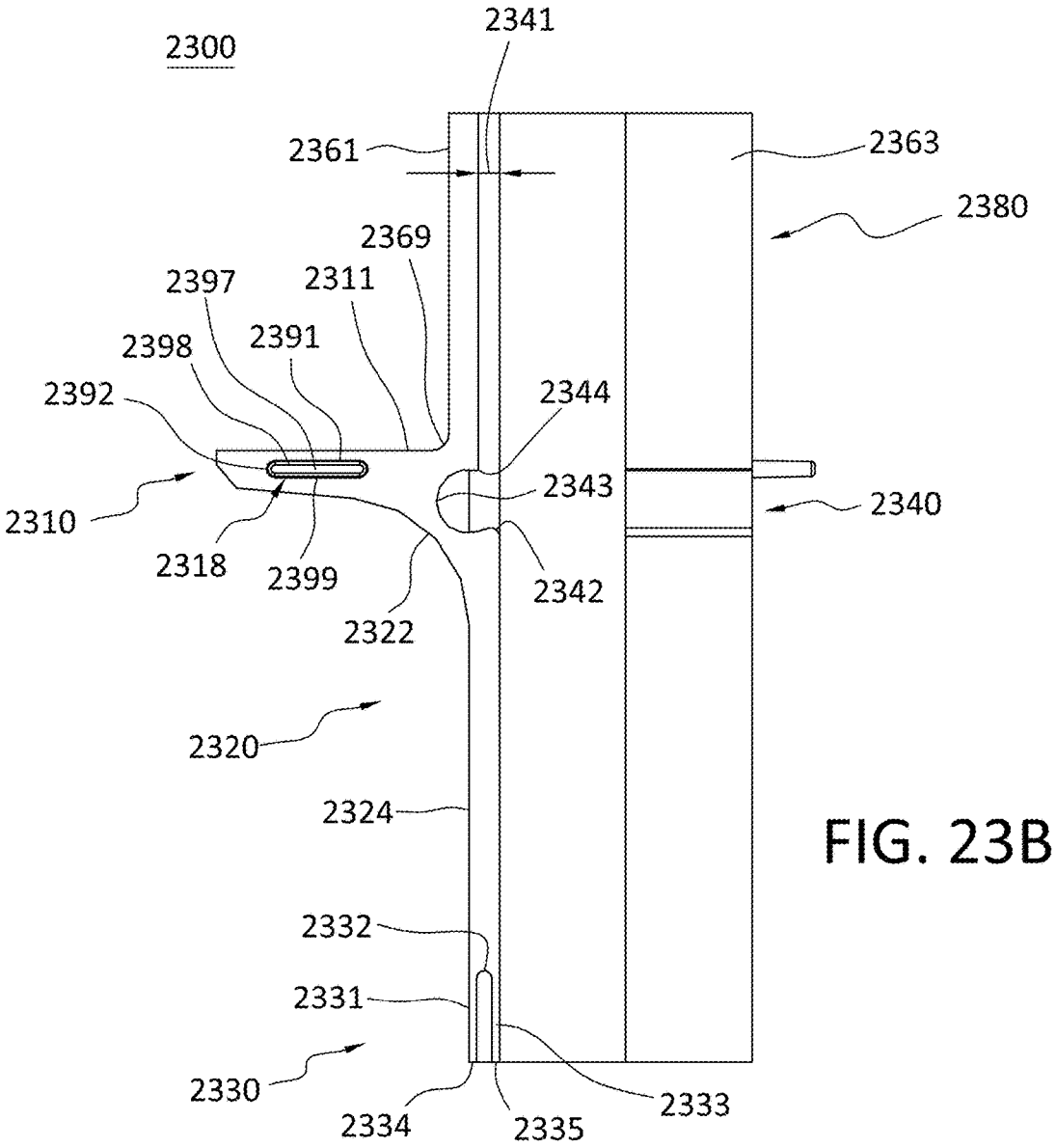
Figure 23C:
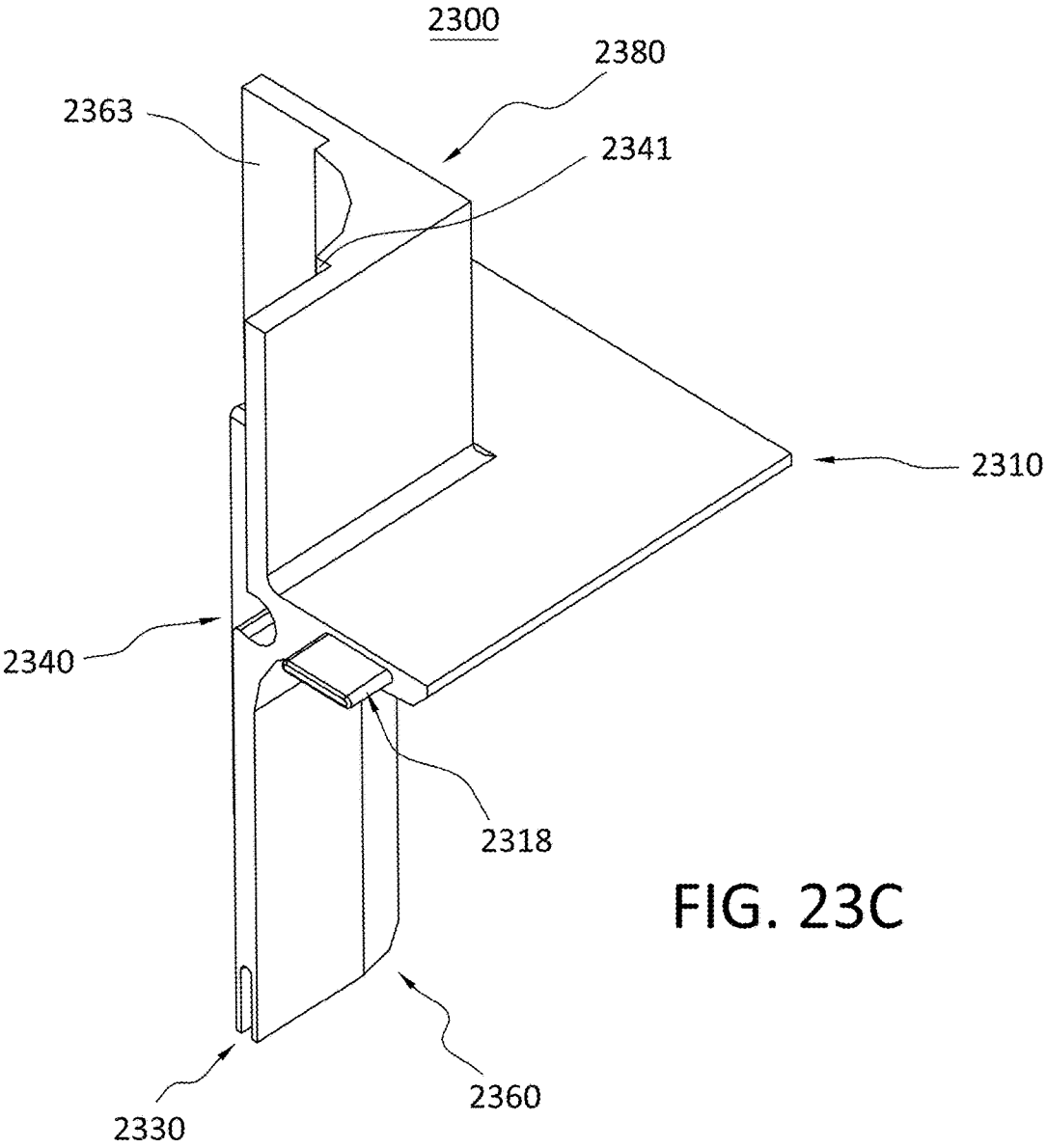

Turning now to FIGS. 23A, 23B, and 23C, an exemplary embodiment of a crown element 2300 is shown in a front isometric view. In many embodiments, crown element 2300 can comprise a single, integrated piece. As an example, in embodiments where spline receiver portion 1640 (FIGS. 16A and 16B) comprises one or more recesses or female portions, crown element 2300 can comprise one or more complementary male portions to couple with the one or more recesses or female portions. In other embodiments (not shown in FIGS. 23A, 23B, and 23C), the spline receiver portion or spline coupling portion of the crown element comprises one or more male portions, the spline can comprise one or more complementary female portions to couple with the one or more male portions.

In some embodiments, crown element 2300 can comprise nose portion 2310, riser portion 2320, groove portion 2330, spline receiver portion 2340, corner portion 2360, and/or ceiling portion 2380. In some embodiments, nose portion 2310 can further comprise a nose top section 2311, a nose top bend 2312, nose front section 2313, nose front bend 2314, nose riser section 2315, nose riser bend 2316, nose bottom section 2317, and/or a spline nub 2318. In the same or different embodiments, nose top section 2311 can have a substantially planar shape. In various embodiments, nose top section is configured to couple to a ceiling surface (not shown). In some embodiments, nose top section 2311 can comprise nose top grooves (not shown). In some embodiments, nose top grooves (not shown) can be configured to receive epoxy, glue, or sealant such that a crown element 2300 is coupled to a ceiling surface (not shown). In some embodiments, the coupling of crown element 2300 to ceiling surface (not shown) occurs in a way that is water tight and/or air tight. In the same or different embodiments, nose top section 2311 can extend approximately parallel to nose bottom section 2317 and approximately perpendicular to nose front section 2313. In various embodiments, nose top bend 2312 extends between nose top section 2311 and nose front section 2313.

In various embodiments, nose front section extends approximately parallel to back ceiling section 2363 and/or perpendicular to nose top section 2311. In some embodiments, nose front section 2313 can have a substantially planar shape. In various embodiments, nose front section 2313 can have a substantially arcuate shape, which allows for easy and thorough cleaning and/or disinfection because the lack of sharp corners and crevices prevents microorganisms from evading disinfectant. When nose front section 2313 has a substantially arcuate shape, laminar airflow can also be enhanced because air streams do not encounter sharp corners. As an example, the substantially arcuate shape of nose front section 2313 can be a concave shape or a convex shape. In the same or different embodiments, nose front bend 2314 extends between nose front section 2313 and nose riser section 2315. In some embodiments, nose front bend 2314 can have a substantially planar shape. In the same or different embodiments, nose front bend 2314 can have a substantially arcuate shape, which allows for easy and thorough cleaning and/or disinfection because the lack of sharp corners and crevices prevents microorganisms from evading disinfectant. When nose front bend 2314 has a substantially arcuate shape, laminar airflow can also be enhanced because air streams do not encounter sharp corners. As an example, the substantially arcuate shape of nose front bend 2314 can be a concave shape or a convex shape.

In the same or different embodiments, nose riser section 2315 can have a substantially planar shape. In various embodiments, nose riser section 2315 can have a substantially arcuate shape, which allows for easy and thorough cleaning and/or disinfection because the lack of sharp corners and crevices prevents microorganisms from evading disinfectant. When nose riser section 2315 has a substantially arcuate shape, laminar airflow can also be enhanced because air streams do not encounter sharp corners. As an example, the substantially arcuate shape of nose riser section 2315 can be a concave shape or a convex shape. In the same or different embodiments, nose riser section 2315 can form an obtuse angle with nose front section 2313. In some embodiments, nose riser section 2315 can form an acute angle with nose front section 2313. In various embodiments, nose riser section 2315 can form an approximately right angle with nose front section 2313. In further embodiments, nose riser section 2315 can be co-planar with nose front section 2313.

In some embodiments, nose riser bend 2316 extends between nose riser section 2315 and nose bottom section 2317. In some embodiments, nose riser bend 2316 can have a substantially planar shape. In the same or different embodiments, nose riser bend 2316 can have a substantially arcuate shape, which allows for easy and thorough cleaning and/or disinfection because the lack of sharp corners and crevices prevents microorganisms from evading disinfectant. When nose riser bend 2316 has a substantially arcuate shape, laminar airflow can also be enhanced because air streams do not encounter sharp corners.

In the same or various embodiments, nose bottom section 2317 can be substantially parallel to nose top section 2311. In various embodiments, nose bottom section 2317 can have a substantially planar shape. In some embodiments, nose bottom section 2317 can have a substantially arcuate shape, which allows for easy and thorough cleaning and/or disinfection because the lack of sharp corners and crevices prevents microorganisms from evading disinfectant. When nose bottom section 2317 has a substantially arcuate shape, laminar airflow can also be enhanced because air streams do not encounter sharp corners. As an example, the substantially arcuate shape of nose bottom section 2317 can be a concave shape or a convex shape.

In further embodiments, nose portion 2310 further comprises a spline nub 2318 extending from a lateral side of crown element 2300. As shown in FIG. 23A, nose portion 2310 can include two spline nubs 2318 at opposite lateral sides of nose portion 2310. In some embodiments, spline nub 2318 can comprise a variety of shapes configured to be inserted into a variety of spline receiver grooves such that inserting or otherwise locating spline nub 2317 in a spline receiver groove couples a crown element to crown element 2300. In various embodiments, spline nub 2318 can comprise a substantially rectangular shape, a substantially circular shape, a substantially triangular shape, a substantially ovoid shape, a substantially oval shape, and/or a substantially semi-circular shape. In the same or different embodiments, spline nub 2318 can comprise a top spline nub surface 2391, a plurality of spline nub bends 2392, a spline nub lateral surface 2397, and/or a spline nub edge 2398. In some embodiments, spline nub edge 2398 can circumscribe spline nub lateral surface 2397 and/or have a substantially arcuate or planar shape. When spline nub edge 2398 has a substantially arcuate shape, it is easier to insert spline nub 2318 into nose spline receiver grooves. In the same or different embodiments, plurality of spline nub bends 2392 can have a substantially arcuate or planar shape. When plurality of spline nub bends 2392 has a substantially arcuate shape, it is easier to insert spline nub 2318 into spline receiver grooves.

In some embodiments, riser portion 2320 can comprise riser bend bottom interface 2321, riser bend 2322, riser bend top interface 2323, and/or riser section 2324. In the same or different embodiments, riser bend bottom interface 2321 can extend from nose top section 2311. In the same or different embodiments, riser bend 2322 can extend from riser bend bottom interface 2323. In the same or different embodiments, riser bend 2322 can have a substantially arcuate shape, which allows for easy and thorough cleaning and/or disinfection because the lack of sharp corners and crevices prevents microorganisms from evading disinfectant. When riser bend 2322 has a substantially arcuate shape, laminar airflow can also be enhanced because air streams do not encounter sharp corners. As an example, the substantially arcuate shape of riser bend 2322 can be a concave shape or a convex shape. In some embodiments, riser bend top interface 2323 can extend from riser bend 2322. In the same or different embodiments, riser section 2324 can extend from riser top interface 2323. In various embodiments, riser section 2324 has a substantially planar shape, can be parallel to nose top section 2314, and/or be perpendicular to nose bottom section 2312.

In the same or different embodiments, wall groove portion 2330 can comprise a groove front section 2331, a groove bend 2332, a groove back section 2333, a groove front edge 2334, and/or a groove back edge 2335. In some embodiments, groove front section 2331 can extend from riser section 2324. As an example, groove front section 2331 and riser section 2324 can be coplanar with each other. In various embodiments, groove front section 2331 has a substantially planar shape, can be parallel to nose top section 2314, and/or be perpendicular to nose bottom section 2312. In the same or different embodiments, groove front section 2331 terminates at groove front edge 2334. In various embodiments, groove front edge 2334 can have a substantially planar shape or a substantially arcuate shape. In further embodiments, groove bend 2332 can extend from groove front end 2331. In various embodiments, groove bend 2332 can have a substantially planar or substantially arcuate shape. In the same or different embodiments, groove bend 2332 can form a 180 degree bend, such that groove back section 2333 can be approximately parallel to groove front section 2331. In various embodiments, groove back section 2333 can extend from groove bend 2332 and terminate at groove back edge 2335. In further embodiments, groove back edge 2335 can have a substantially planar shape or a substantially arcuate shape.

In the same or different embodiments, spline receiver portion 2340 can be a spline coupling portion. In some embodiments, the spline coupling portion can comprise one or more recesses or female portions, as described below, and in other embodiments (not shown in FIGS. 23A, 23B, and 23C), the spline coupling portion can comprise one or more male portions. As shown in FIGS. 23A, 23B. and 23C, spline receiver portion 2340 can comprise top receiver bend 2344, receiver groove 2343, bottom receiver bend 2342, riser section back surface 2345, and/or receiver notch 2341. In some embodiments, top receiver bend 2344 can extend between back ceiling section 2363 and receiver groove 2343. In various embodiments, top receiver bend 2344 can have a substantially planar shape. In various embodiments, top receiver bend 2344 can have a substantially arcuate shape. In the same or different embodiments, receiver groove 2343 can have a substantially arcuate, substantially circular, substantially planar, substantially triangular, or substantially rectangular shape. In the same or different embodiments, receiver groove 2343 can be configured to receive a male portion of a spline in order to aid in the coupling of crown element 2300 to a spline. In some embodiments, bottom receiver bend 2342 can extend from a back surface of riser section 2324 and receiver groove 2343. In various embodiments, bottom receiver bend 2342 can have a substantially planar shape. In various embodiments, bottom receiver bend 2342 can have a substantially arcuate shape. In various embodiments, receiver notch 2341 is offset from riser section back surface 2345 such that when a spline couples to crown element 2300, its back side lays flush with riser section back surface 2345.

In some embodiments, ceiling portion 2380 can comprise bottom ceiling bend 2364, front ceiling section 2361, top ceiling section 2362, and/or back ceiling section 2363. In the same or different embodiments, bottom ceiling bend 2364 can have a planar shape. In various embodiments, bottom ceiling bend 2364 can have a substantially arcuate shape. In other embodiments, bottom ceiling bend 2364 can have a substantially planar shape. As an example, the substantially arcuate shape of bottom ceiling bend 2364 can be a concave shape or a convex shape. In the same or different embodiments, bottom ceiling bend 2364 extends between nose top section 2311 and front ceiling section 2361. In some embodiments, front ceiling section 2361 is approximately perpendicular with nose top section 2311. In other embodiments, front ceiling section 2361 creates an acute angle with nose top section 2311. In further embodiments, front ceiling section 2361 creates an obtuse angle with nose top section 2311. In the same or different embodiments, front ceiling section 2361 is configured to be flush with a side of a ceiling surface (not shown). In some embodiments, top ceiling section 2322 extends between front ceiling section 2361 and back ceiling section 2333. In the same or different embodiments, back ceiling section 2333 is approximately parallel with front ceiling section 2361 and approximately perpendicular with nose top section 2311.

In some embodiments, corner portion 2360 can comprise corner top ceiling section 2371, corner front ceiling section 2372, corner nose top bend 2373, corner nose front section 2374, corner nose front bend 2375, corner nose riser section 2376, corner nose riser bend 2377, corner nose bottom section 2378, corner riser bend bottom interface 2379, corner riser bend 2380, corner riser bend top interface 2381, corner riser section 2382, and/or corner top surface 2383. In some embodiments, corner portion 2360 forms a right angle of an exterior corner. In the same or different embodiments, corner portion 2360 forms an acute angle of an exterior corner. In still other embodiments, corner portion 2360 forms an obtuse angle of an exterior corner.

In further embodiments, corner top ceiling section 2371 extends between a plurality of top ceiling sections 2362. In the same or different embodiments, corner top ceiling section 2371 can have a substantially planar shape. In some embodiments, corner bottom nose bend 2371 can have an arcuate shape, which allows for easy and thorough cleaning and/or disinfection because the lack of sharp corners and crevices prevents microorganisms from evading disinfectant. When corner top ceiling section 2371 has a substantially arcuate shape, laminar airflow can also be enhanced because air streams do not encounter sharp corners. As an example, the substantially arcuate shape of corner top ceiling section 2371 can be a concave shape or a convex shape.

In further embodiments, corner front ceiling section 2372 extends between a plurality of front ceiling sections 2361. In the same or different embodiments, corner front ceiling section 2372 can have a substantially planar shape. In some embodiments, corner front ceiling section 2372 can have an arcuate shape, which allows for easy and thorough cleaning and/or disinfection because the lack of sharp corners and crevices prevents microorganisms from evading disinfectant. When corner front ceiling section 2372 has a substantially arcuate shape, laminar airflow can also be enhanced because air streams do not encounter sharp corners. As an example, the substantially arcuate shape of corner front ceiling section 2372 can be a concave shape or a convex shape.

In further embodiments, corner nose top bend 2373 extends between a plurality of nose top bend 2312. In the same or different embodiments, corner nose top bend 2373 can have a substantially planar shape. In some embodiments, corner nose top bend 2373 can have an arcuate shape, which allows for easy and thorough cleaning and/or disinfection because the lack of sharp corners and crevices prevents microorganisms from evading disinfectant. When corner nose top bend 2373 has a substantially arcuate shape, laminar airflow can also be enhanced because air streams do not encounter sharp corners. As an example, the substantially arcuate shape of corner nose top bend 2373 can be a concave shape or a convex shape.

In further embodiments, corner nose front section 2374 extends between a plurality of nose front sections 2313. In the same or different embodiments, corner nose front section 2374 can have a substantially planar shape. In some embodiments, corner nose front section 2374 can have an arcuate shape, which allows for easy and thorough cleaning and/or disinfection because the lack of sharp corners and crevices prevents microorganisms from evading disinfectant. When corner nose front section 2374 has a substantially arcuate shape, laminar airflow can also be enhanced because air streams do not encounter sharp corners. As an example, the substantially arcuate shape of corner nose front section 2374 can be a concave shape or a convex shape.

In further embodiments, corner nose front bend 2375 extends between a plurality of corner nose front bends 2314. In the same or different embodiments, corner nose front bend 2375 can have a substantially planar shape. In some embodiments, corner nose front bend 2375 can have an arcuate shape, which allows for easy and thorough cleaning and/or disinfection because the lack of sharp corners and crevices prevents microorganisms from evading disinfectant. When corner nose front bend 2375 has a substantially arcuate shape, laminar airflow can also be enhanced because air streams do not encounter sharp corners. As an example, the substantially arcuate shape of corner nose front bend 2375 can be a concave shape or a convex shape.

In further embodiments, corner nose riser section 2376 extends between a plurality of nose riser sections 2315. In the same or different embodiments, corner nose riser section 2376 can have a substantially planar shape. In some embodiments, corner nose riser section 2376 can have an arcuate shape, which allows for easy and thorough cleaning and/or disinfection because the lack of sharp corners and crevices prevents microorganisms from evading disinfectant. When corner nose riser section 2376 has a substantially arcuate shape, laminar airflow can also be enhanced because air streams do not encounter sharp corners. As an example, the substantially arcuate shape of corner nose riser section 2376 can be a concave shape or a convex shape.

In further embodiments, corner nose riser bend 2377 extends between a plurality of nose riser bend 2317. In the same or different embodiments, corner nose riser bend 2377 can have a substantially planar shape. In some embodiments, corner nose riser bend 2377 can have an arcuate shape, which allows for easy and thorough cleaning and/or disinfection because the lack of sharp corners and crevices prevents microorganisms from evading disinfectant. When corner nose riser bend 2377 has a substantially arcuate shape, laminar airflow can also be enhanced because air streams do not encounter sharp corners. As an example, the substantially arcuate shape of corner nose riser bend 2377 can be a concave shape or a convex shape.

In further embodiments, corner nose bottom section 2378 extends between a plurality of nose bottom sections 2317. In the same or different embodiments, corner nose bottom section 2378 can have a substantially planar shape. In some embodiments, corner nose bottom section 2378 can have an arcuate shape, which allows for easy and thorough cleaning and/or disinfection because the lack of sharp corners and crevices prevents microorganisms from evading disinfectant. When corner nose bottom section 2378 has a substantially arcuate shape, laminar airflow can also be enhanced because air streams do not encounter sharp corners. As an example, the substantially arcuate shape of corner nose bottom section 2378 can be a concave shape or a convex shape.

In further embodiments, corner riser bend bottom interface 2379 extends between a plurality of riser bend bottom interfaces 2321. In the same or different embodiments, corner riser bend bottom interface 2379 can have a substantially planar shape. In some embodiments, corner riser bend bottom interface 2379 can have an arcuate shape, which allows for easy and thorough cleaning and/or disinfection because the lack of sharp corners and crevices prevents microorganisms from evading disinfectant. When corner riser bend bottom interface 2379 has a substantially arcuate shape, laminar airflow can also be enhanced because air streams do not encounter sharp corners. As an example, the substantially arcuate shape of corner nose bottom section 2378 can be a concave shape or a convex shape.

In further embodiments, corner riser bend 2380 extends between a plurality of riser bends 2322. In the same or different embodiments, corner riser bend 2380 can have a substantially planar shape. In some embodiments corner riser bend 2380 can have an arcuate shape, which allows for easy and thorough cleaning and/or disinfection because the lack of sharp corners and crevices prevents microorganisms from evading disinfectant. When corner riser bend 2380 has a substantially arcuate shape, laminar airflow can also be enhanced because air streams do not encounter sharp corners. As an example, the substantially arcuate shape of corner riser bend 2380 can be a concave shape or a convex shape.

In further embodiments, corner riser bend top interface 2381 extends between a plurality of riser bend top interface 2323. In the same or different embodiments, corner riser bend top interface 2381 can have a substantially planar shape. In some embodiments corner riser bend top interface 2381 can have an arcuate shape, which allows for easy and thorough cleaning and/or disinfection because the lack of sharp corners and crevices prevents microorganisms from evading disinfectant. When corner riser bend top interface 2381 has a substantially arcuate shape, laminar airflow can also be enhanced because air streams do not encounter sharp corners. As an example, the substantially arcuate shape of corner riser bend top interface 2381 can be a concave shape or a convex shape.

In further embodiments, corner riser section 2382 extends between a plurality of riser bend top interface 2323. In the same or different embodiments, corner riser section 2382 can have a substantially planar shape. In some embodiments corner riser section 2382 can have an arcuate shape, which allows for easy and thorough cleaning and/or disinfection because the lack of sharp corners and crevices prevents microorganisms from evading disinfectant. When corner riser section 2382 has a substantially arcuate shape, laminar airflow can also be enhanced because air streams do not encounter sharp corners. As an example, the substantially arcuate shape of corner riser section 2382 can be a concave shape or a convex shape.

In further embodiments, corner top surface 2383 extends between a plurality of groove bends 2332, groove front edge 2334, and/or a groove back edge 2335. In the same or different embodiments, corner top surface 2383 can have a substantially planar shape, such that it lays flush with a top surface of a wall corner element when a wall corner element is coupled to crown element 2300.

Figure 24A:
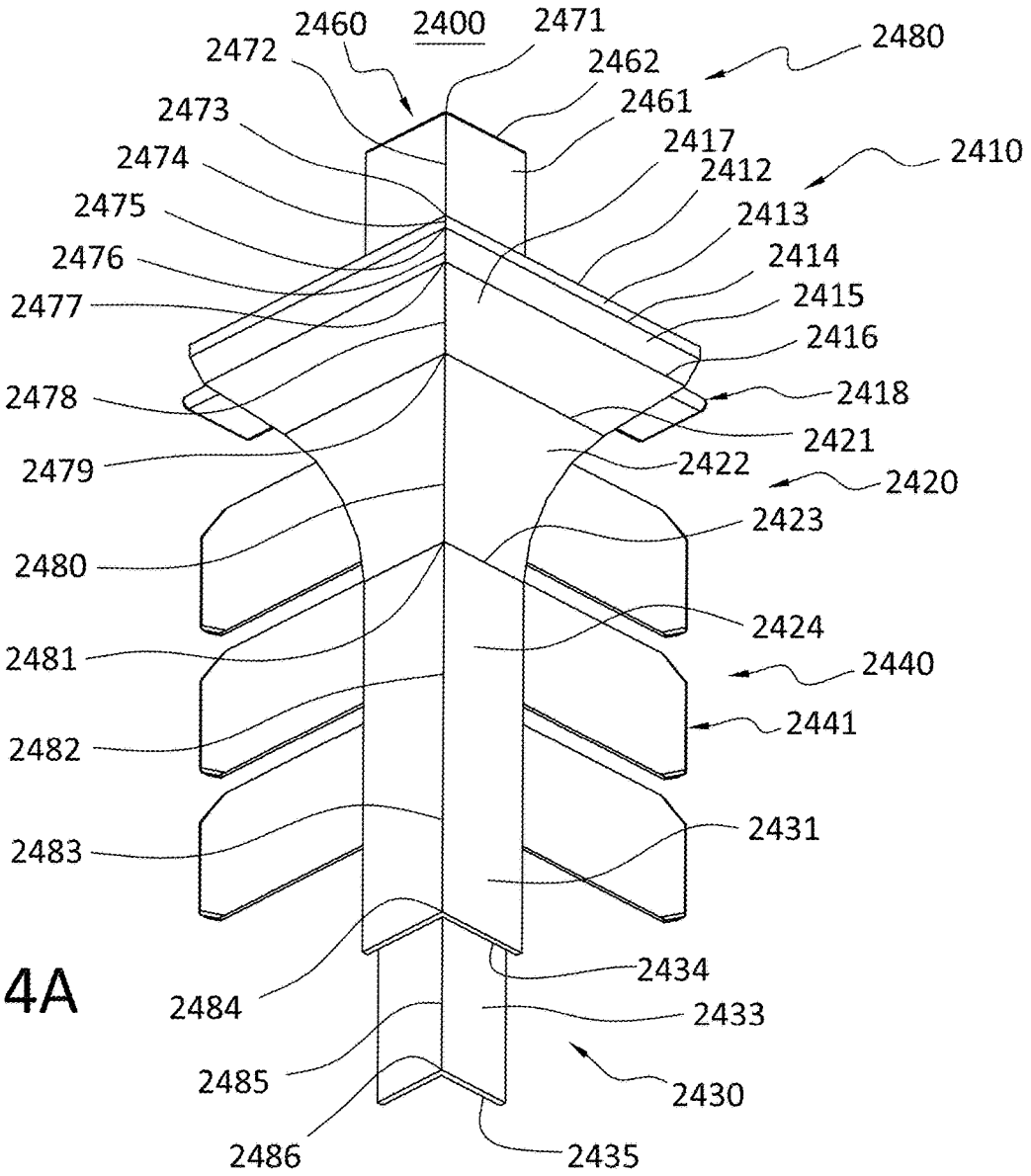
FIGS. 24A-26B representatively illustrate exemplary embodiments of splines.
Figure 24B:
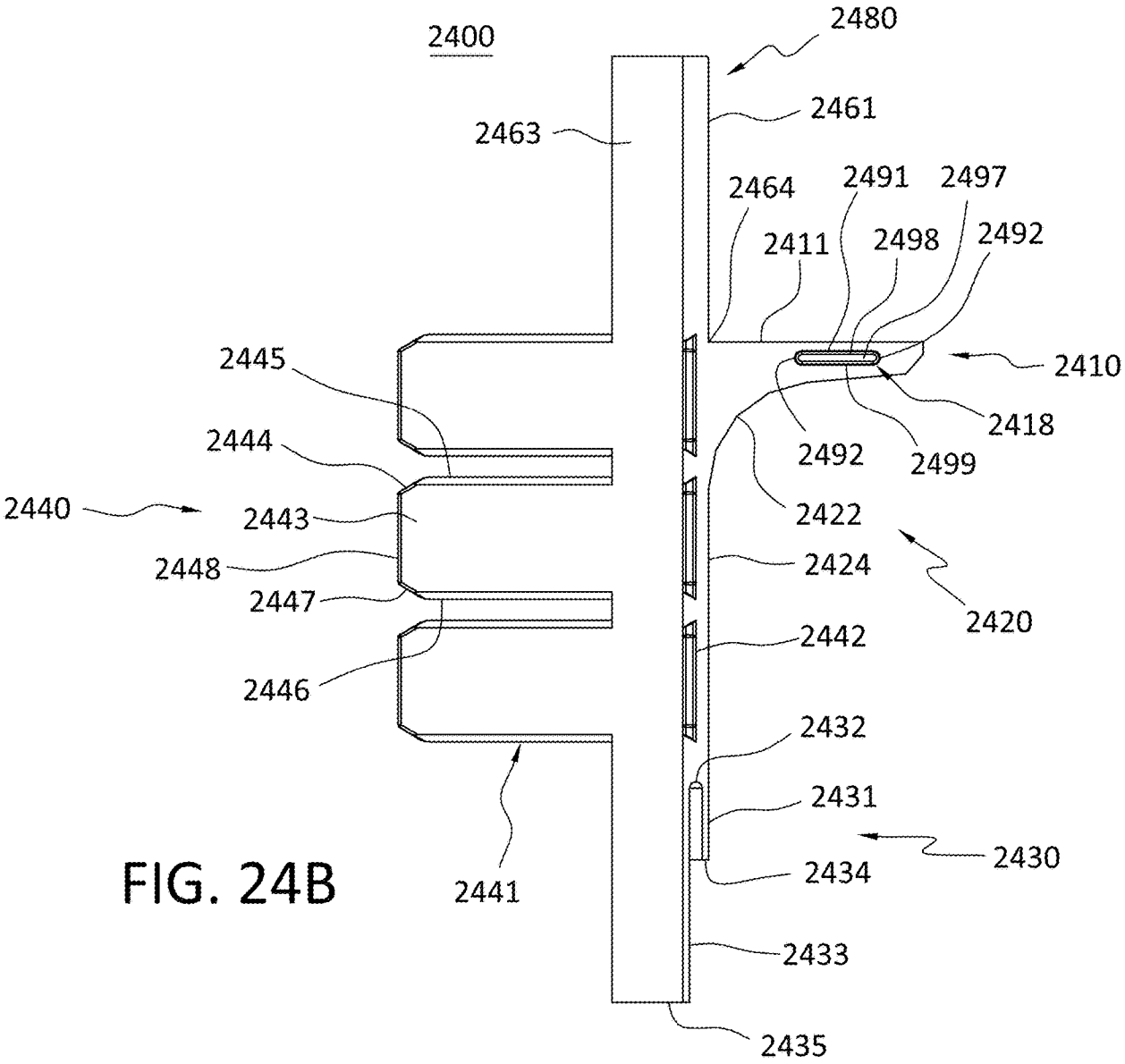

Turning now to FIGS. 24A and 24B, an exemplary embodiment of a spline 2400 is shown in a front isometric view. In many embodiments, spline 2400 can comprise a single, integrated piece. As an example, in embodiments where spline receiver portion 1640 (FIGS. 16A and 16B) comprises one or more recesses or female portions, spline 2400 can comprise one or more complementary male portions to couple with the one or more recesses or female portions. In other embodiments (not shown in FIGS. 24A and 24B), the spline receiver portion or spline coupling portion of the crown element comprises one or more male portions, the spline can comprise one or more complementary female portions to couple with the one or more male portions.

In some embodiments, spline 2400 can comprise nose portion 2410, riser portion 2420, groove portion 2430, spline portion 2440, corner portion 2460, and/or ceiling portion 2480. In some embodiments, nose portion 2410 can further comprise a nose top section 2411, a nose top bend 2412, nose front section 2413, nose front bend 2414, nose riser section 2415, nose riser bend 2416, nose bottom section 2417, and/or spline nub 2418. In the same or different embodiments, nose top section 2411 can have a substantially planar shape. In various embodiments, nose top section is configured to couple to a ceiling surface (not shown). In some embodiments, nose top section 2411 can comprise nose top grooves (not shown). In some embodiments, nose top grooves (not shown) can be configured to receive epoxy, glue, or sealant such that a spline 2400 is coupled to a ceiling surface (not shown). In some embodiments, the coupling of spline 2400 to ceiling surface (not shown) occurs in a way that is water tight and/or air tight. In the same or different embodiments, nose top section 2411 can extend approximately parallel to nose bottom section 2417 and approximately perpendicular to nose front section 2413. In various embodiments, nose top bend 242 extends between nose top section 2411 and nose front section 2413.

In various embodiments, nose front section extends approximately parallel to back ceiling section 2463 and/or perpendicular to nose top section 2411. In some embodiments, nose front section 2413 can have a substantially planar shape. In various embodiments, nose front section 2413 can have a substantially arcuate shape, which allows for easy and thorough cleaning and/or disinfection because the lack of sharp corners and crevices prevents microorganisms from evading disinfectant. When nose front section 2413 has a substantially arcuate shape, laminar airflow can also be enhanced because air streams do not encounter sharp corners. As an example, the substantially arcuate shape of nose front section 2413 can be a concave shape or a convex shape. In the same or different embodiments, nose front bend 2414 extends between nose front section 2413 and nose riser section 2415. In some embodiments, nose front bend 2414 can have a substantially planar shape. In the same or different embodiments, nose front bend 2414 can have a substantially arcuate shape, which allows for easy and thorough cleaning and/or disinfection because the lack of sharp corners and crevices prevents microorganisms from evading disinfectant. When nose front bend 2414 has a substantially arcuate shape, laminar airflow can also be enhanced because air streams do not encounter sharp corners. As an example, the substantially arcuate shape of nose front bend 2414 can be a concave shape or a convex shape.

In the same or different embodiments, nose riser section 2415 can have a substantially planar shape. In various embodiments, nose riser section 2415 can have a substantially arcuate shape, which allows for easy and thorough cleaning and/or disinfection because the lack of sharp corners and crevices prevents microorganisms from evading disinfectant. When nose riser section 2415 has a substantially arcuate shape, laminar airflow can also be enhanced because air streams do not encounter sharp corners. As an example, the substantially arcuate shape of nose riser section 2415 can be a concave shape or a convex shape. In the same or different embodiments, nose riser section 2415 can form an obtuse angle with nose front section 2413. In some embodiments, nose riser section 2415 can form an acute angle with nose front section 2413. In various embodiments, nose riser section 2415 can form an approximately right angle with nose front section 2413. In further embodiments, nose riser section 2415 can be co-planar with nose front section 2413.

In some embodiments, nose riser bend 2416 extends between nose riser section 2415 and nose bottom section 2417. In some embodiments, nose riser bend 2416 can have a substantially planar shape. In the same or different embodiments, nose riser bend 2416 can have a substantially arcuate shape, which allows for easy and thorough cleaning and/or disinfection because the lack of sharp corners and crevices prevents microorganisms from evading disinfectant. When nose riser bend 2416 has a substantially arcuate shape, laminar airflow can also be enhanced because air streams do not encounter sharp corners.

In the same or various embodiments, nose bottom section 2417 can be substantially parallel to nose top section 2411. In various embodiments, nose bottom section 2417 can have a substantially planar shape. In some embodiments, nose bottom section 2417 can have a substantially arcuate shape, which allows for easy and thorough cleaning and/or disinfection because the lack of sharp corners and crevices prevents microorganisms from evading disinfectant. When nose bottom section 2417 has a substantially arcuate shape, laminar airflow can also be enhanced because air streams do not encounter sharp corners. As an example, the substantially arcuate shape of nose bottom section 2417 can be a concave shape or a convex shape.

In further embodiments, nose portion 2410 further comprises a spline nub 2418 extending from a lateral side of spline 2400. As shown in FIG. 24A, nose portion 2410 can include two spline nubs 2418 at opposite lateral sides of nose portion 2410. In some embodiments, spline nub 2418 can comprise a variety of shapes configured to be inserted into a variety of spline receiver grooves such that inserting or otherwise locating spline nub 2417 in a spline receiver groove couples a crown element to spline 2400. In various embodiments, spline nub 2418 can comprise a substantially rectangular shape, a substantially circular shape, a substantially triangular shape, a substantially ovoid shape, a substantially oval shape, and/or a substantially semi-circular shape. In the same or different embodiments, spline nub 2418 can comprise a top spline nub surface 2491, a plurality of spline nub bends 2492, a spline nub lateral surface 2497, and/or a spline nub edge 2498. In some embodiments, spline nub edge 2498 can circumscribe spline nub lateral surface 2497 and/or have a substantially arcuate or planar shape. When spline nub edge 2498 has a substantially arcuate shape, it is easier to insert spline nub 2418 into nose spline receiver grooves. In the same or different embodiments, plurality of spline nub bends 2492 can have a substantially arcuate or planar shape. When plurality of spline nub bends 2492 has a substantially arcuate shape, it is easier to insert spline nub 2418 into spline receiver grooves.

In some embodiments, riser portion 2420 can comprise riser bend bottom interface 2421, riser bend 2422, riser bend top interface 2423, and/or riser section 2424. In the same or different embodiments, riser bend bottom interface 2421 can extend from nose top section 2411. In the same or different embodiments, riser bend 2422 can extend from riser bend bottom interface 2423. In the same or different embodiments, riser bend 2422 can have a substantially arcuate shape, which allows for easy and thorough cleaning and/or disinfection because the lack of sharp corners and crevices prevents microorganisms from evading disinfectant. When riser bend 2422 has a substantially arcuate shape, laminar airflow can also be enhanced because air streams do not encounter sharp corners. As an example, the substantially arcuate shape of riser bend 2422 can be a concave shape or a convex shape. In some embodiments, riser bend top interface 2423 can extend from riser bend 2422. In the same or different embodiments, riser section 2424 can extend from riser top interface 2423. In various embodiments, riser section 2424 has a substantially planar shape, can be parallel to nose top section 2414, and/or be perpendicular to nose bottom section 2412.

In the same or different embodiments, wall groove portion 2430 can comprise a groove front section 2431, a groove bend 2432, a groove back section 2433, a groove front edge 2434, and/or a groove back edge 2435. In some embodiments, groove front section 2431 can extend from riser section 2424. As an example, groove front section 2431 and riser section 2424 can be coplanar with each other. In various embodiments, groove front section 2431 has a substantially planar shape, can be parallel to nose top section 2414, and/or be perpendicular to nose bottom section 2412. In the same or different embodiments, groove front section 2431 terminates at groove front edge 2434. In various embodiments, groove front edge 2434 can have a substantially planar shape or a substantially arcuate shape. In further embodiments, groove bend 2432 can extend from groove front end 2431. In various embodiments, groove bend 2432 can have a substantially planar or substantially arcuate shape. In the same or different embodiments, groove bend 2432 can form a 180 degree bend, such that groove back section 2433 can be approximately parallel to groove front section 2431. In various embodiments, groove back section 2433 can extend from groove bend 2432 and terminate at groove back edge 2435. In further embodiments, groove back edge 2435 can have a substantially planar shape or a substantially arcuate shape.

In some embodiments, spline plate portion 2440 can comprise a spline plate 2441 extending out of lateral side 2418. In various embodiments, there can be a plurality of spline plates 2441 extending from opposite lateral sides of spline 2400, as shown in FIGS. 24A and 24B. In the same or different embodiments, spline plate 2441 can comprise a front spline plate surface 2442 and/or a back spline plate surface 2443. In further embodiments, spline plate 2441 can comprise a lateral spline edge 2448, top corner spline edge 2444, a top spline edge 2445, a bottom spline edge 2446, and a bottom corner spline edge 2447. In various embodiments, lateral spline edge 2448, top corner spline edge 2444, top spline edge 2445, bottom spline edge 2446, and/or bottom corner spline edge 2447 can have a substantially planar shape or a substantially arcuate shape. When lateral spline edge 2448, top corner spline edge 2444, top spline edge 2445, bottom spline edge 2446, and/or bottom corner spline edge 2447 have a substantially arcuate shape, it is easier to insert spline plate 2441 into receiver section 1645 as buffeted by top receiver nub 1646 and bottom receiver nub 1642. In various embodiments, back spline plate surface 2443 can span across and be contiguous and co-planar with back a spline surface.

In some embodiments, ceiling portion 2480 can comprise bottom ceiling bend 2464, front ceiling section 2461, top ceiling section 2462, and/or back ceiling section 2463. In the same or different embodiments, bottom ceiling bend 2464 can have a planar shape. In various embodiments, bottom ceiling bend 2464 can have a substantially arcuate shape. In other embodiments, bottom ceiling bend 2464 can have a substantially planar shape. As an example, the substantially arcuate shape of bottom ceiling bend 2464 can be a concave shape or a convex shape. In the same or different embodiments, bottom ceiling bend 2464 extends between nose top section 2411 and front ceiling section 2461. In some embodiments, front ceiling section 2461 is approximately perpendicular with nose top section 2411. In other embodiments, front ceiling section 2461 creates an acute angle with nose top section 2411. In further embodiments, front ceiling section 2461 creates an obtuse angle with nose top section 2411. In the same or different embodiments, front ceiling section 2461 is configured to be flush with a side of a ceiling surface (not shown). In some embodiments, top ceiling section 2422 extends between front ceiling section 2461 and back ceiling section 2433. In the same or different embodiments, back ceiling section 2433 is approximately parallel with front ceiling section 2461 and approximately perpendicular with nose top section 2411.

In some embodiments, corner portion 2460 can comprise corner top ceiling interface 2471, corner front ceiling interface 2472, corner nose top bend 2473, corner nose front interface 2474, corner nose front bend 2475, corner nose riser interface 2476, corner nose riser bend 2477, corner nose bottom interface 2478, corner riser bend bottom interface 2479, corner riser bend 2480, corner riser bend top interface 2481, corner riser interface 2482, corner groove front interface 2483, corner groove front edge interface 2484, corner groove back interface 2485, and/or corner groove back edge interface 2486. In some embodiments, corner portion 2460 forms a right angle of an exterior corner. In the same or different embodiments, corner portion 2460 forms an acute angle of an exterior corner. In still other embodiments, corner portion 2460 forms an obtuse angle of an exterior corner.

In further embodiments, corner top ceiling interface 2471 extends between a plurality of top ceiling sections 2462. In the same or different embodiments, corner top ceiling interface 2471 can have a substantially planar shape. In some embodiments, corner bottom nose bend 2471 can have an arcuate shape, which allows for easy and thorough cleaning and/or disinfection because the lack of sharp corners and crevices prevents microorganisms from evading disinfectant. When corner top ceiling interface 2471 has a substantially arcuate shape, laminar airflow can also be enhanced because air streams do not encounter sharp corners. As an example, the substantially arcuate shape of corner top ceiling interface 2471 can be a concave shape or a convex shape.

In further embodiments, corner front ceiling interface 2472 extends between a plurality of front ceiling sections 2461. In the same or different embodiments, corner front ceiling interface 2472 can have a substantially planar shape. In some embodiments, corner front ceiling interface 2472 can have an arcuate shape, which allows for easy and thorough cleaning and/or disinfection because the lack of sharp corners and crevices prevents microorganisms from evading disinfectant. When corner front ceiling interface 2472 has a substantially arcuate shape, laminar airflow can also be enhanced because air streams do not encounter sharp corners. As an example, the substantially arcuate shape of corner front ceiling interface 2472 can be a concave shape or a convex shape.

In further embodiments, corner nose top bend 2473 extends between a plurality of nose top bend 2412. In the same or different embodiments, corner nose top bend 2473 can have a substantially planar shape. In some embodiments, corner nose top bend 2473 can have an arcuate shape, which allows for easy and thorough cleaning and/or disinfection because the lack of sharp corners and crevices prevents microorganisms from evading disinfectant. When corner nose top bend 2473 has a substantially arcuate shape, laminar airflow can also be enhanced because air streams do not encounter sharp corners. As an example, the substantially arcuate shape of corner nose top bend 2473 can be a concave shape or a convex shape.

In further embodiments, corner nose front interface 2474 extends between a plurality of nose front sections 2413. In the same or different embodiments, corner nose front interface 2474 can have a substantially planar shape. In some embodiments, corner nose front interface 2474 can have an arcuate shape, which allows for easy and thorough cleaning and/or disinfection because the lack of sharp corners and crevices prevents microorganisms from evading disinfectant. When corner nose front interface 2474 has a substantially arcuate shape, laminar airflow can also be enhanced because air streams do not encounter sharp corners. As an example, the substantially arcuate shape of corner nose front interface 2474 can be a concave shape or a convex shape.

In further embodiments, corner nose front bend 2475 extends between a plurality of corner nose front bends 2414. In the same or different embodiments, corner nose front bend 2475 can have a substantially planar shape. In some embodiments, corner nose front bend 2475 can have an arcuate shape, which allows for easy and thorough cleaning and/or disinfection because the lack of sharp corners and crevices prevents microorganisms from evading disinfectant. When corner nose front bend 2475 has a substantially arcuate shape, laminar airflow can also be enhanced because air streams do not encounter sharp corners. As an example, the substantially arcuate shape of corner nose front bend 2475 can be a concave shape or a convex shape.

In further embodiments, corner nose riser interface 2476 extends between a plurality of nose riser sections 2415. In the same or different embodiments, corner nose riser interface 2476 can have a substantially planar shape. In some embodiments, corner nose riser interface 2476 can have an arcuate shape, which allows for easy and thorough cleaning and/or disinfection because the lack of sharp corners and crevices prevents microorganisms from evading disinfectant. When corner nose riser interface 2476 has a substantially arcuate shape, laminar airflow can also be enhanced because air streams do not encounter sharp corners. As an example, the substantially arcuate shape of corner nose riser interface 2476 can be a concave shape or a convex shape.

In further embodiments, corner nose riser bend 2477 extends between a plurality of nose riser bend 2417. In the same or different embodiments, corner nose riser bend 2477 can have a substantially planar shape. In some embodiments, corner nose riser bend 2477 can have an arcuate shape, which allows for easy and thorough cleaning and/or disinfection because the lack of sharp corners and crevices prevents microorganisms from evading disinfectant. When corner nose riser bend 2477 has a substantially arcuate shape, laminar airflow can also be enhanced because air streams do not encounter sharp corners. As an example, the substantially arcuate shape of corner nose riser bend 2477 can be a concave shape or a convex shape.

In further embodiments, corner nose bottom interface 2478 extends between a plurality of nose bottom sections 2417. In the same or different embodiments, corner nose bottom interface 2478 can have a substantially planar shape. In some embodiments, corner nose bottom interface 2478 can have an arcuate shape, which allows for easy and thorough cleaning and/or disinfection because the lack of sharp corners and crevices prevents microorganisms from evading disinfectant. When corner nose bottom interface 2478 has a substantially arcuate shape, laminar airflow can also be enhanced because air streams do not encounter sharp corners. As an example, the substantially arcuate shape of corner nose bottom interface 2478 can be a concave shape or a convex shape.

In further embodiments, corner riser bend bottom interface 2479 extends between a plurality of riser bend bottom interfaces 2421. In the same or different embodiments, corner riser bend bottom interface 2479 can have a substantially planar shape. In some embodiments, corner riser bend bottom interface 2479 can have an arcuate shape, which allows for easy and thorough cleaning and/or disinfection because the lack of sharp corners and crevices prevents microorganisms from evading disinfectant. When corner riser bend bottom interface 2479 has a substantially arcuate shape, laminar airflow can also be enhanced because air streams do not encounter sharp corners. As an example, the substantially arcuate shape of corner nose bottom interface 2478 can be a concave shape or a convex shape.

In further embodiments, corner riser bend 2480 extends between a plurality of riser bends 2422. In the same or different embodiments, corner riser bend 2480 can have a substantially planar shape. In some embodiments corner riser bend 2480 can have an arcuate shape, which allows for easy and thorough cleaning and/or disinfection because the lack of sharp corners and crevices prevents microorganisms from evading disinfectant. When corner riser bend 2480 has a substantially arcuate shape, laminar airflow can also be enhanced because air streams do not encounter sharp corners. As an example, the substantially arcuate shape of corner riser bend 2480 can be a concave shape or a convex shape.

In further embodiments, corner riser bend top interface 2481 extends between a plurality of riser bend top interface 2423. In the same or different embodiments, corner riser bend top interface 2481 can have a substantially planar shape. In some embodiments corner riser bend top interface 2481 can have an arcuate shape, which allows for easy and thorough cleaning and/or disinfection because the lack of sharp corners and crevices prevents microorganisms from evading disinfectant. When corner riser bend top interface 2481 has a substantially arcuate shape, laminar airflow can also be enhanced because air streams do not encounter sharp corners. As an example, the substantially arcuate shape of corner riser bend top interface 2481 can be a concave shape or a convex shape.

In further embodiments, corner riser interface 2482 extends between a plurality of riser bend top interface 2423. In the same or different embodiments, corner riser interface 2482 can have a substantially planar shape. In some embodiments corner riser interface 2482 can have an arcuate shape, which allows for easy and thorough cleaning and/or disinfection because the lack of sharp corners and crevices prevents microorganisms from evading disinfectant. When corner riser interface 2482 has a substantially arcuate shape, laminar airflow can also be enhanced because air streams do not encounter sharp corners. As an example, the substantially arcuate shape of corner riser interface 2482 can be a concave shape or a convex shape.

In further embodiments, corner groove front interface 2483 extends between a plurality of groove front sections 2431. In the same or different embodiments, corner groove front interface 2483 can have a substantially planar shape. In some embodiments corner front groove interface 2483 can have an arcuate shape, which allows for easy and thorough cleaning and/or disinfection because the lack of sharp corners and crevices prevents microorganisms from evading disinfectant. When corner groove front interface 2483 has a substantially arcuate shape, laminar airflow can also be enhanced because air streams do not encounter sharp corners. As an example, the substantially arcuate shape of corner groove front interface 2483 can be a concave shape or a convex shape.

In further embodiments, corner groove front edge interface 2484 extends between a plurality of a groove front edges 2434. In the same or different embodiments, corner groove front edge interface 2484 can have a substantially planar shape. In some embodiments corner front groove interface 2483 can have an arcuate shape, which allows for easy and thorough cleaning and/or disinfection because the lack of sharp corners and crevices prevents microorganisms from evading disinfectant. When corner groove front edge interface 2484 has a substantially arcuate shape, laminar airflow can also be enhanced because air streams do not encounter sharp corners. As an example, the substantially arcuate shape of corner groove front edge interface 2484 can be a concave shape or a convex shape.

In further embodiments, corner groove back interface 2485 extends between a plurality of a groove back sections 2433. In the same or different embodiments, corner groove back interface 2485 can have a substantially planar shape. In some embodiments corner groove back interface 2485 can have an arcuate shape.

In further embodiments, corner back edge interface 2486 extends between a plurality of groove back edges 2435. In the same or different embodiments, corner groove back interface 2485 can have a substantially planar shape. In some embodiments corner groove back interface 2485 can have an arcuate shape.

Figure 25A:
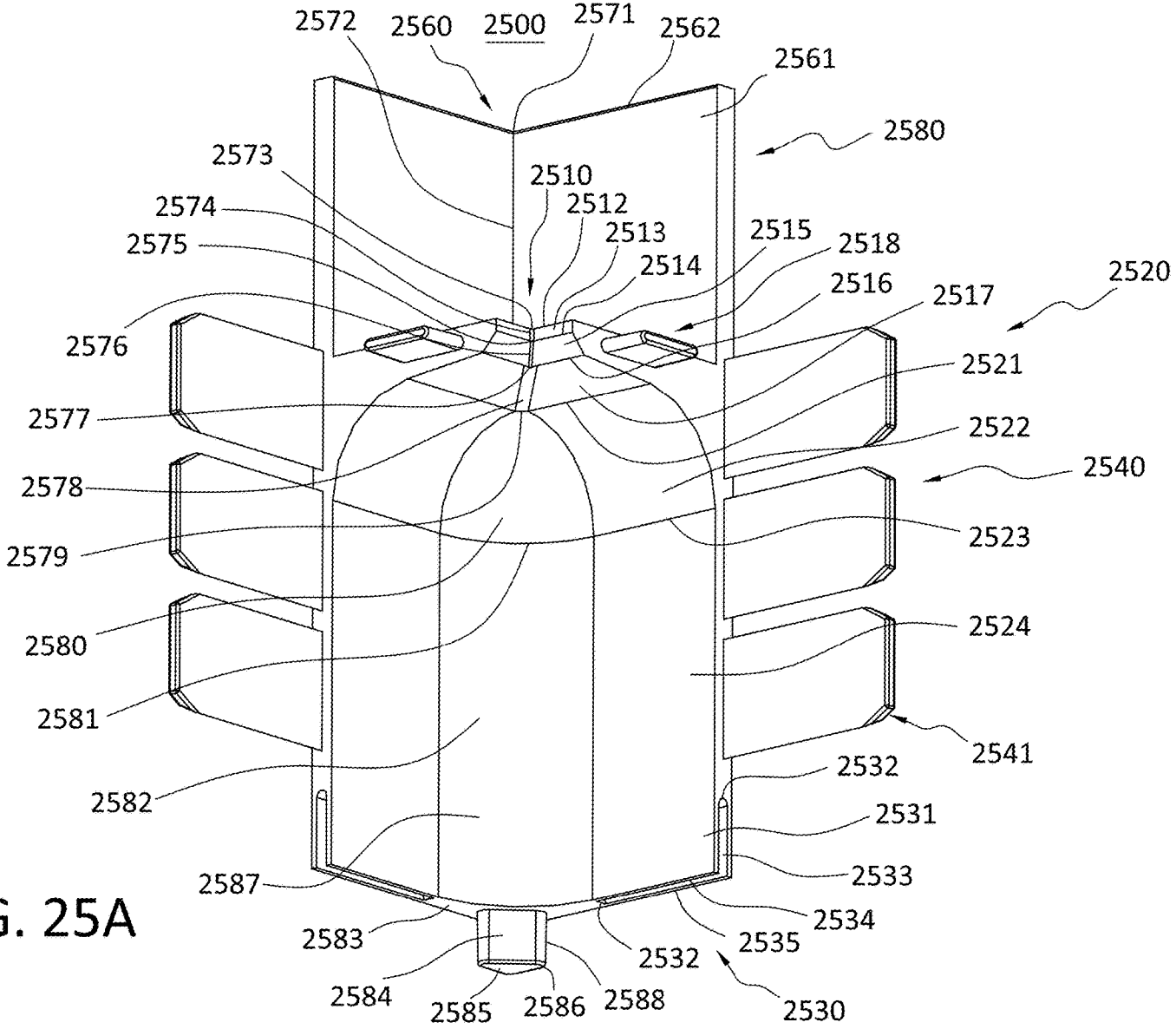
Figure 25B:
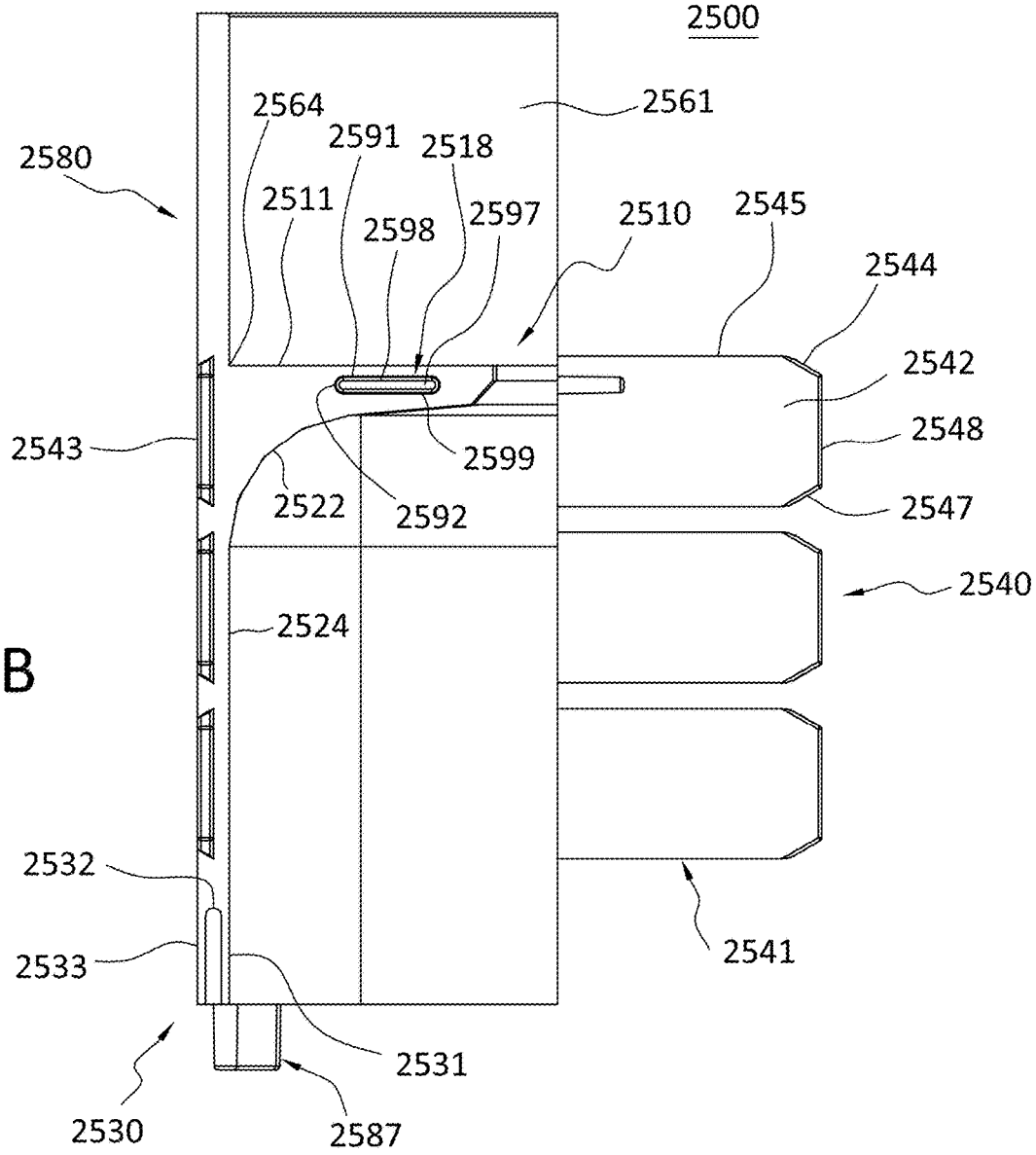

Turning now to FIGS. 25A and 25B, an exemplary embodiment of a spline 2500 is shown in a front isometric view. In many embodiments, spline 2500 can comprise a single, integrated piece. As an example, in embodiments where spline receiver portion 1640 (FIGS. 16A and 16B) comprises one or more recesses or female portions, spline 2500 can comprise one or more complementary male portions to couple with the one or more recesses or female portions. In other embodiments (not shown in FIGS. 25A and 25B), the spline receiver portion or spline coupling portion of the crown element comprises one or more male portions, the spline can comprise one or more complementary female portions to couple with the one or more male portions.

In some embodiments, spline 2500 can comprise nose portion 2510, riser portion 2520, groove portion 2530, spline portion 2540, corner portion 2560, and/or ceiling portion 2580. In some embodiments, nose portion 2510 can further comprise a nose top section 2511, a nose top bend 2512, nose front section 2513, nose front bend 2514, nose riser section 2515, nose riser bend 2516, nose bottom section 2517, and/or spline nub 2518. In the same or different embodiments, nose top section 2511 can have a substantially planar shape. In various embodiments, nose top section is configured to couple to a ceiling surface (not shown). In some embodiments, nose top section 2511 can comprise nose top grooves (not shown). In some embodiments, nose top grooves (not shown) can be configured to receive epoxy, glue, or sealant such that a spline 2500 is coupled to a ceiling surface (not shown). In some embodiments, the coupling of spline 2500 to ceiling surface (not shown) occurs in a way that is water tight and/or air tight. In the same or different embodiments, nose top section 2511 can extend approximately parallel to nose bottom section 2517 and approximately perpendicular to nose front section 2513. In various embodiments, nose top bend 2512 extends between nose top section 2511 and nose front section 2513.

In various embodiments, nose front section extends approximately parallel to back ceiling section 2563 and/or perpendicular to nose top section 2511. In some embodiments, nose front section 2513 can have a substantially planar shape. In various embodiments, nose front section 2513 can have a substantially arcuate shape, which allows for easy and thorough cleaning and/or disinfection because the lack of sharp corners and crevices prevents microorganisms from evading disinfectant. When nose front section 2513 has a substantially arcuate shape, laminar airflow can also be enhanced because air streams do not encounter sharp corners. As an example, the substantially arcuate shape of nose front section 2513 can be a concave shape or a convex shape. In the same or different embodiments, nose front bend 2514 extends between nose front section 2513 and nose riser section 2515. In some embodiments, nose front bend 2514 can have a substantially planar shape. In the same or different embodiments, nose front bend 2514 can have a substantially arcuate shape, which allows for easy and thorough cleaning and/or disinfection because the lack of sharp corners and crevices prevents microorganisms from evading disinfectant. When nose front bend 2514 has a substantially arcuate shape, laminar airflow can also be enhanced because air streams do not encounter sharp corners. As an example, the substantially arcuate shape of nose front bend 2514 can be a concave shape or a convex shape.

In the same or different embodiments, nose riser section 2515 can have a substantially planar shape. In various embodiments, nose riser section 2515 can have a substantially arcuate shape, which allows for easy and thorough cleaning and/or disinfection because the lack of sharp corners and crevices prevents microorganisms from evading disinfectant. When nose riser section 2515 has a substantially arcuate shape, laminar airflow can also be enhanced because air streams do not encounter sharp corners. As an example, the substantially arcuate shape of nose riser section 2515 can be a concave shape or a convex shape. In the same or different embodiments, nose riser section 2515 can form an obtuse angle with nose front section 2513. In some embodiments, nose riser section 2515 can form an acute angle with nose front section 2513. In various embodiments, nose riser section 2515 can form an approximately right angle with nose front section 2513. In further embodiments, nose riser section 2515 can be co-planar with nose front section 2513.

In some embodiments, nose riser bend 2516 extends between nose riser section 2515 and nose bottom section 2517. In some embodiments, nose riser bend 2516 can have a substantially planar shape. In the same or different embodiments, nose riser bend 2516 can have a substantially arcuate shape, which allows for easy and thorough cleaning and/or disinfection because the lack of sharp corners and crevices prevents microorganisms from evading disinfectant. When nose riser bend 2516 has a substantially arcuate shape, laminar airflow can also be enhanced because air streams do not encounter sharp corners.

In the same or various embodiments, nose bottom section 2517 can be substantially parallel to nose top section 2511. In various embodiments, nose bottom section 2517 can have a substantially planar shape. In some embodiments, nose bottom section 2517 can have a substantially arcuate shape, which allows for easy and thorough cleaning and/or disinfection because the lack of sharp corners and crevices prevents microorganisms from evading disinfectant. When nose bottom section 2517 has a substantially arcuate shape, laminar airflow can also be enhanced because air streams do not encounter sharp corners. As an example, the substantially arcuate shape of nose bottom section 2517 can be a concave shape or a convex shape.

In further embodiments, nose portion 2510 further comprises a spline nub 2518 extending from a lateral side of spline 2500. As shown in FIG. 25A, nose portion 2510 can include two spline nubs 2518 at opposite lateral sides of nose portion 2510. In some embodiments, spline nub 2518 can comprise a variety of shapes configured to be inserted into a variety of spline receiver grooves such that inserting or otherwise locating spline nub 2518 in a spline receiver groove couples a crown element to spline 2500. In various embodiments, spline nub 2518 can comprise a substantially rectangular shape, a substantially circular shape, a substantially triangular shape, a substantially ovoid shape, a substantially oval shape, and/or a substantially semi-circular shape. In the same or different embodiments, spline nub 2518 can comprise a top spline nub surface 2591, a plurality of spline nub bends 2592, a spline nub lateral surface 2597, and/or a spline nub edge 2598. In some embodiments, spline nub edge 2598 can circumscribe spline nub lateral surface 2597 and/or have a substantially arcuate or planar shape. When spline nub edge 2598 has a substantially arcuate shape, it is easier to insert spline nub 2518 into nose spline receiver grooves. In the same or different embodiments, plurality of spline nub bends 2592 can have a substantially arcuate or planar shape. When plurality of spline nub bends 2592 has a substantially arcuate shape, it is easier to insert spline nub 2518 into spline receiver grooves.

In some embodiments, riser portion 2520 can comprise riser bend bottom interface 2521, riser bend 2522, riser bend top interface 2523, and/or riser section 2524. In the same or different embodiments, riser bend bottom interface 2521 can extend from nose top section 2511. In the same or different embodiments, riser bend 2522 can extend from riser bend bottom interface 2523. In the same or different embodiments, riser bend 2522 can have a substantially arcuate shape, which allows for easy and thorough cleaning and/or disinfection because the lack of sharp corners and crevices prevents microorganisms from evading disinfectant. When riser bend 2522 has a substantially arcuate shape, laminar airflow can also be enhanced because air streams do not encounter sharp corners. As an example, the substantially arcuate shape of riser bend 2522 can be a concave shape or a convex shape. In some embodiments, riser bend top interface 2523 can extend from riser bend 2522. In the same or different embodiments, riser section 2524 can extend from riser top interface 2523. In various embodiments, riser section 2524 has a substantially planar shape, can be parallel to nose top section 2514, and/or be perpendicular to nose bottom section 2512.

In the same or different embodiments, wall groove portion 2530 can comprise a groove front section 2531, a groove bend 2532, a groove back section 2533, a groove front edge 2534, and/or a groove back edge 2535. In some embodiments, groove front section 2531 can extend from riser section 2524. As an example, groove front section 2531 and riser section 2524 can be coplanar with each other. In various embodiments, groove front section 2531 has a substantially planar shape, can be parallel to nose top section 2514, and/or be perpendicular to nose bottom section 2512. In the same or different embodiments, groove front section 2531 terminates at groove front edge 2534. In various embodiments, groove front edge 2534 can have a substantially planar shape or a substantially arcuate shape. In further embodiments, groove bend 2532 can extend from groove front end 2531. In various embodiments, groove bend 2532 can have a substantially planar or substantially arcuate shape. In the same or different embodiments, groove bend 2532 can form a 180 degree bend, such that groove back section 2533 can be approximately parallel to groove front section 2531. In various embodiments, groove back section 2533 can extend from groove bend 2532 and terminate at groove back edge 2535. In further embodiments, groove back edge 2535 can have a substantially planar shape or a substantially arcuate shape.

In some embodiments, spline plate portion 2540 can comprise a spline plate 2541 extending out of lateral side 2518. In various embodiments, there can be a plurality of spline plates 2541 extending from opposite lateral sides of spline 2500, as shown in FIGS. 25A and 25B. In the same or different embodiments, spline plate 2541 can comprise a front spline plate surface 2542 and/or a back spline plate surface 2543. In further embodiments, spline plate 2541 can comprise a lateral spline edge 2548, top corner spline edge 2544, a top spline edge 2545, a bottom spline edge 2546, and a bottom corner spline edge 2547. In various embodiments, lateral spline edge 2548, top corner spline edge 2544, top spline edge 2545, bottom spline edge 2546, and/or bottom corner spline edge 2547 can have a substantially planar shape or a substantially arcuate shape. When lateral spline edge 2548, top corner spline edge 2544, top spline edge 2545, bottom spline edge 2546, and/or bottom corner spline edge 2547 have a substantially arcuate shape, it is easier to insert spline plate 2541 into receiver section 1645 as buffeted by top receiver nub 1646 and bottom receiver nub 1642. In various embodiments, back spline plate surface 2543 can span across and be contiguous and co-planar with back a spline surface.

In some embodiments, ceiling portion 2580 can comprise bottom ceiling bend 2564, front ceiling section 2561, top ceiling section 2562, and/or back ceiling section 2563. In the same or different embodiments, bottom ceiling bend 2564 can have a planar shape. In various embodiments, bottom ceiling bend 2564 can have a substantially arcuate shape. In other embodiments, bottom ceiling bend 2564 can have a substantially planar shape. As an example, the substantially arcuate shape of bottom ceiling bend 2564 can be a concave shape or a convex shape. In the same or different embodiments, bottom ceiling bend 2564 extends between nose top section 2511 and front ceiling section 2561. In some embodiments, front ceiling section 2561 is approximately perpendicular with nose top section 2511. In other embodiments, front ceiling section 2561 creates an acute angle with nose top section 2511. In further embodiments, front ceiling section 2561 creates an obtuse angle with nose top section 2511. In the same or different embodiments, front ceiling section 2561 is configured to be flush with a side of a ceiling surface (not shown). In some embodiments, top ceiling section 2522 extends between front ceiling section 2561 and back ceiling section 2533. In the same or different embodiments, back ceiling section 2533 is approximately parallel with front ceiling section 2561 and approximately perpendicular with nose top section 2511.

In some embodiments, corner portion 2560 can comprise corner top ceiling section 2571, corner front ceiling section 2572, corner nose top bend 2573, corner nose front section 2574, corner nose front bend 2575, corner nose riser section 2576, corner nose riser bend 2577, corner nose bottom section 2578, corner riser bend bottom interface 2579, corner riser bend 2580, corner riser bend top interface 2581, corner riser section 2582, corner top surface 2583, and/or corner nub 2587. In some embodiments, corner portion 2560 forms a right angle of an interior corner. In the same or different embodiments, corner portion 2560 forms an acute angle of an interior corner. In still other embodiments, corner portion 2560 forms an obtuse angle of an interior corner.

In further embodiments, corner top ceiling section 2571 extends between a plurality of top ceiling sections 2562. In the same or different embodiments, corner top ceiling section 2571 can have a substantially planar shape. In some embodiments, corner bottom nose bend 2571 can have an arcuate shape, which allows for easy and thorough cleaning and/or disinfection because the lack of sharp corners and crevices prevents microorganisms from evading disinfectant. When corner top ceiling section 2571 has a substantially arcuate shape, laminar airflow can also be enhanced because air streams do not encounter sharp corners. As an example, the substantially arcuate shape of corner top ceiling section 2571 can be a concave shape or a convex shape.

In further embodiments, corner front ceiling section 2572 extends between a plurality of front ceiling sections 2561. In the same or different embodiments, corner front ceiling section 2572 can have a substantially planar shape. In some embodiments, corner front ceiling section 2572 can have an arcuate shape, which allows for easy and thorough cleaning and/or disinfection because the lack of sharp corners and crevices prevents microorganisms from evading disinfectant. When corner front ceiling section 2572 has a substantially arcuate shape, laminar airflow can also be enhanced because air streams do not encounter sharp corners. As an example, the substantially arcuate shape of corner front ceiling section 2572 can be a concave shape or a convex shape.

In further embodiments, corner nose top bend 2573 extends between a plurality of nose top bend 2512. In the same or different embodiments, corner nose top bend 2573 can have a substantially planar shape. In some embodiments, corner nose top bend 2573 can have an arcuate shape, which allows for easy and thorough cleaning and/or disinfection because the lack of sharp corners and crevices prevents microorganisms from evading disinfectant. When corner nose top bend 2573 has a substantially arcuate shape, laminar airflow can also be enhanced because air streams do not encounter sharp corners. As an example, the substantially arcuate shape of corner nose top bend 2573 can be a concave shape or a convex shape.

In further embodiments, corner nose front section 2574 extends between a plurality of nose front sections 2513. In the same or different embodiments, corner nose front section 2574 can have a substantially planar shape. In some embodiments, corner nose front section 2574 can have an arcuate shape, which allows for easy and thorough cleaning and/or disinfection because the lack of sharp corners and crevices prevents microorganisms from evading disinfectant. When corner nose front section 2574 has a substantially arcuate shape, laminar airflow can also be enhanced because air streams do not encounter sharp corners. As an example, the substantially arcuate shape of corner nose front section 2574 can be a concave shape or a convex shape.

In further embodiments, corner nose front bend 2575 extends between a plurality of corner nose front bends 2514. In the same or different embodiments, corner nose front bend 2575 can have a substantially planar shape. In some embodiments, corner nose front bend 2575 can have an arcuate shape, which allows for easy and thorough cleaning and/or disinfection because the lack of sharp corners and crevices prevents microorganisms from evading disinfectant. When corner nose front bend 2575 has a substantially arcuate shape, laminar airflow can also be enhanced because air streams do not encounter sharp corners. As an example, the substantially arcuate shape of corner nose front bend 2575 can be a concave shape or a convex shape.

In further embodiments, corner nose riser section 2576 extends between a plurality of nose riser sections 2515. In the same or different embodiments, corner nose riser section 2576 can have a substantially planar shape. In some embodiments, corner nose riser section 2576 can have an arcuate shape, which allows for easy and thorough cleaning and/or disinfection because the lack of sharp corners and crevices prevents microorganisms from evading disinfectant. When corner nose riser section 2576 has a substantially arcuate shape, laminar airflow can also be enhanced because air streams do not encounter sharp corners. As an example, the substantially arcuate shape of corner nose riser section 2576 can be a concave shape or a convex shape.

In further embodiments, corner nose riser bend 2577 extends between a plurality of nose riser bend 2517. In the same or different embodiments, corner nose riser bend 2577 can have a substantially planar shape. In some embodiments, corner nose riser bend 2577 can have an arcuate shape, which allows for easy and thorough cleaning and/or disinfection because the lack of sharp corners and crevices prevents microorganisms from evading disinfectant. When corner nose riser bend 2577 has a substantially arcuate shape, laminar airflow can also be enhanced because air streams do not encounter sharp corners. As an example, the substantially arcuate shape of corner nose riser bend 2577 can be a concave shape or a convex shape.

In further embodiments, corner nose bottom section 2578 extends between a plurality of nose bottom sections 2517. In the same or different embodiments, corner nose bottom section 2578 can have a substantially planar shape. In some embodiments, corner nose bottom section 2578 can have an arcuate shape, which allows for easy and thorough cleaning and/or disinfection because the lack of sharp corners and crevices prevents microorganisms from evading disinfectant. When corner nose bottom section 2578 has a substantially arcuate shape, laminar airflow can also be enhanced because air streams do not encounter sharp corners. As an example, the substantially arcuate shape of corner nose bottom section 2578 can be a concave shape or a convex shape.

In further embodiments, corner riser bend bottom interface 2579 extends between a plurality of riser bend bottom interfaces 2521. In the same or different embodiments, corner riser bend bottom interface 2579 can have a substantially planar shape. In some embodiments, corner riser bend bottom interface 2579 can have an arcuate shape, which allows for easy and thorough cleaning and/or disinfection because the lack of sharp corners and crevices prevents microorganisms from evading disinfectant. When corner riser bend bottom interface 2579 has a substantially arcuate shape, laminar airflow can also be enhanced because air streams do not encounter sharp corners. As an example, the substantially arcuate shape of corner nose bottom section 2578 can be a concave shape or a convex shape.

In further embodiments, corner riser bend 2580 extends between a plurality of riser bends 2522. In the same or different embodiments, corner riser bend 2580 can have a substantially planar shape. In some embodiments corner riser bend 2580 can have an arcuate shape, which allows for easy and thorough cleaning and/or disinfection because the lack of sharp corners and crevices prevents microorganisms from evading disinfectant. When corner riser bend 2580 has a substantially arcuate shape, laminar airflow can also be enhanced because air streams do not encounter sharp corners. As an example, the substantially arcuate shape of corner riser bend 2580 can be a concave shape or a convex shape.

In further embodiments, corner riser bend top interface 2581 extends between a plurality of riser bend top interface 2523. In the same or different embodiments, corner riser bend top interface 2581 can have a substantially planar shape. In some embodiments corner riser bend top interface 2581 can have an arcuate shape, which allows for easy and thorough cleaning and/or disinfection because the lack of sharp corners and crevices prevents microorganisms from evading disinfectant. When corner riser bend top interface 2581 has a substantially arcuate shape, laminar airflow can also be enhanced because air streams do not encounter sharp corners. As an example, the substantially arcuate shape of corner riser bend top interface 2581 can be a concave shape or a convex shape.

In further embodiments, corner riser section 2582 extends between a plurality of riser bend top interface 2523. In the same or different embodiments, corner riser section 2582 can have a substantially planar shape. In some embodiments corner riser section 2582 can have an arcuate shape, which allows for easy and thorough cleaning and/or disinfection because the lack of sharp corners and crevices prevents microorganisms from evading disinfectant. When corner riser section 2582 has a substantially arcuate shape, laminar airflow can also be enhanced because air streams do not encounter sharp corners. As an example, the substantially arcuate shape of corner riser section 2582 can be a concave shape or a convex shape.

In further embodiments, corner top surface 2583 extends between a plurality of groove bends 2532, groove front edge 2534, and/or a groove back edge 2535. In the same or different embodiments, corner top surface 2583 can have a substantially planar shape, such that it lays flush with a top surface of a wall corner element when a wall corner element is coupled to spline 2500.

In some embodiments, corner nub 2587 extends out of top surface 2583. In the same or different embodiments, corner nub 2587 comprises a plurality of corner nub surfaces 2584, corner nub top surface 2585, and/or a plurality of corner nub bends 2588. In some embodiments, corner nub edge 2586 can circumscribe corner nub top surface 2569 and/or have a substantially arcuate or planar shape. When corner nub edge 2586 has a substantially arcuate shape, it is easier to insert corner nub 2587 into nub receiver grooves. In some embodiments, corner nub 2587 can comprise a variety of shapes configured to be inserted into a variety of nub receiver grooves, such that inserting or otherwise locating corner nub 2587 into nub receiver grooves couples a wall corner element to spline 2500 while a wall corner element remains substantially immobile. In various embodiments, corner nub 2587 can comprise a substantially rectangular shape, a substantially circular shape, a substantially triangular shape, a substantially ovoid shape, a substantially oval shape, and/or a substantially semi-circular shape.

Figure 26A:
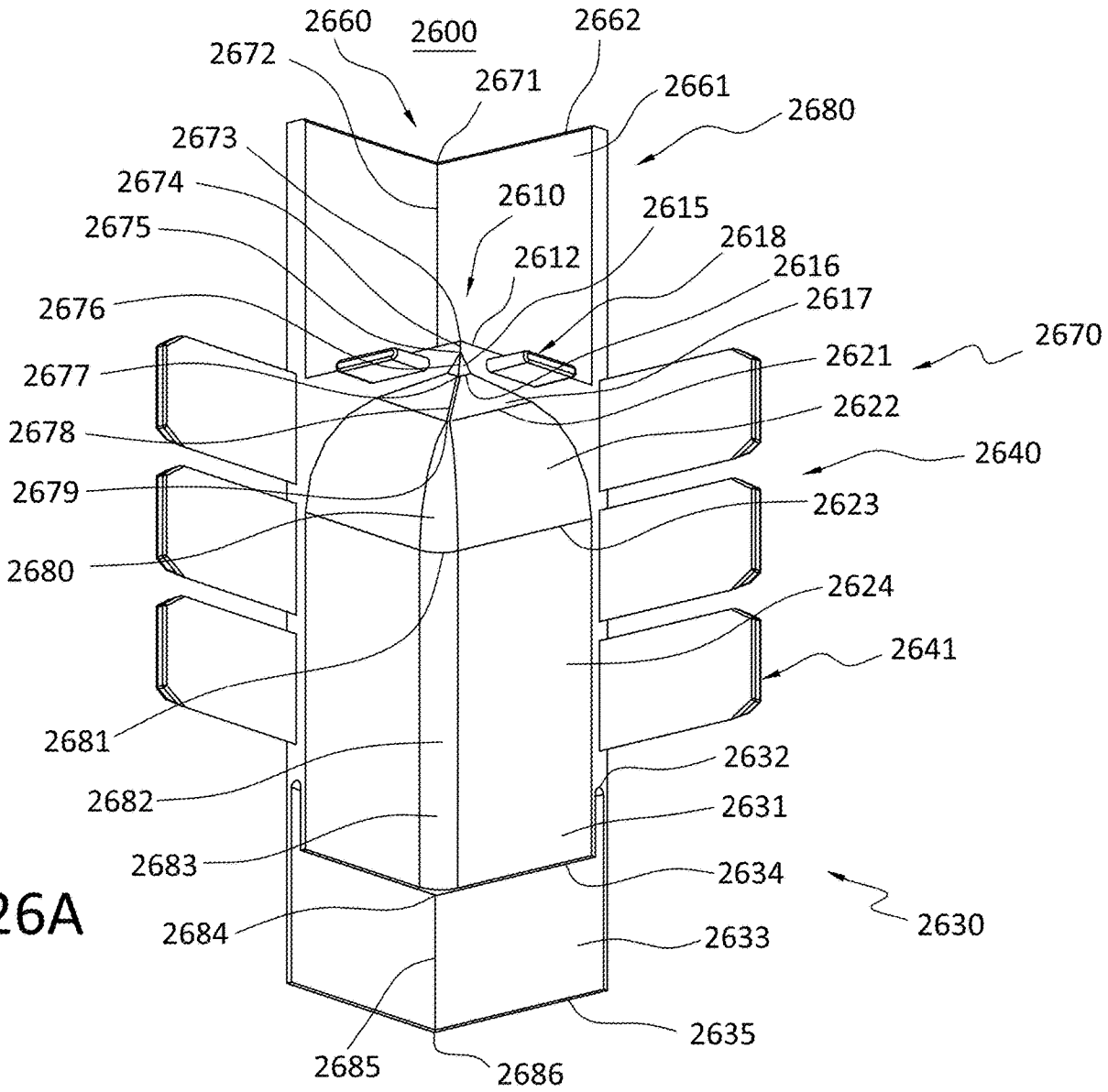
Figure 26B:
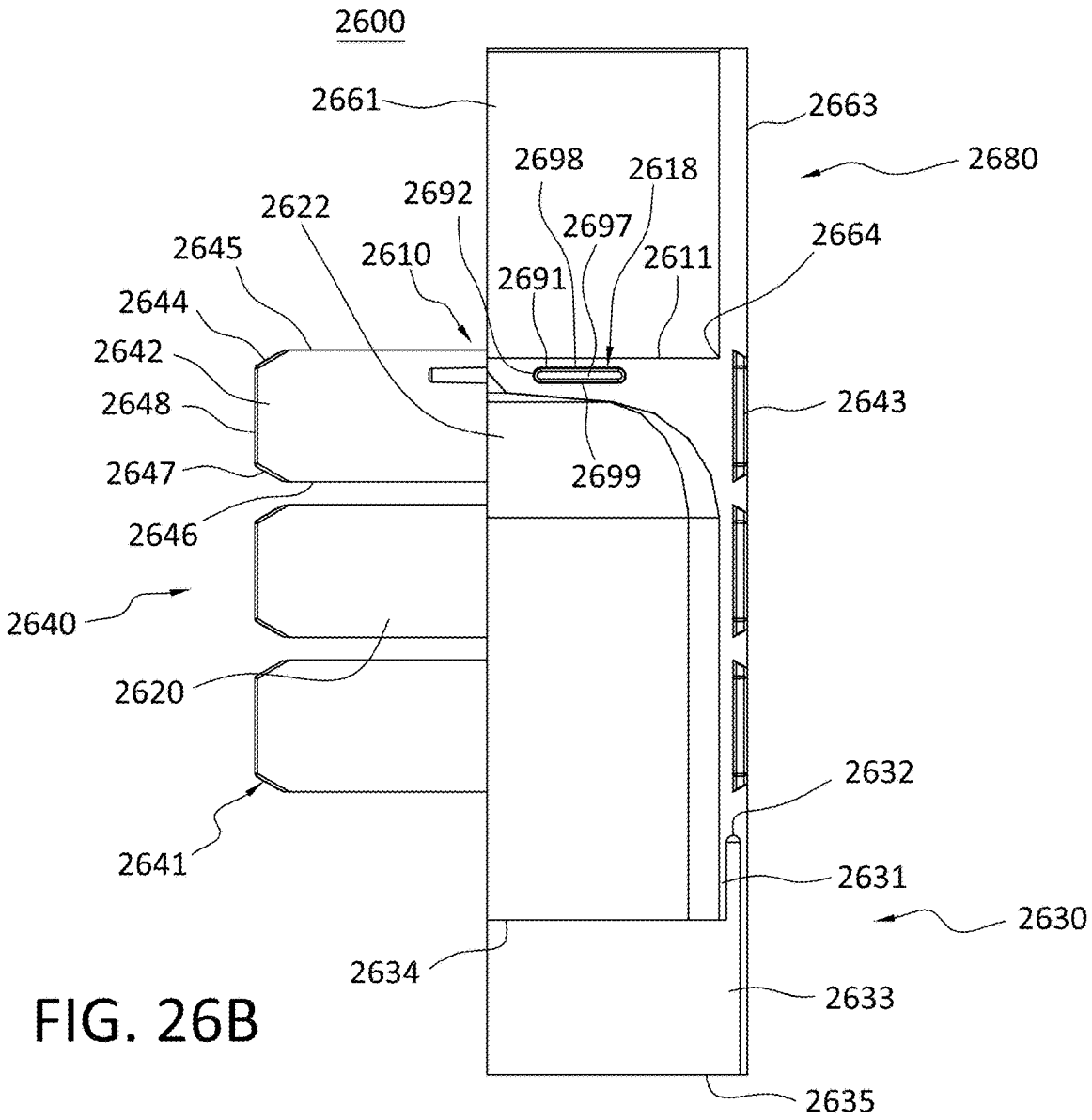

Turning now to FIGS. 26A and 26B, an exemplary embodiment of a spline 2600 is shown in a front isometric view. In many embodiments, spline 2600 can comprise a single, integrated piece. As an example, in embodiments where spline receiver portion 1640 (FIGS. 16A and 16B) comprises one or more recesses or female portions, spline 2600 can comprise one or more complementary male portions to couple with the one or more recesses or female portions. In other embodiments (not shown in FIGS. 26A and 26B), the spline receiver portion or spline coupling portion of the crown element comprises one or more male portions, the spline can comprise one or more complementary female portions to couple with the one or more male portions.

In some embodiments, spline 2600 can comprise nose portion 2610, riser portion 2620, groove portion 2630, spline portion 2640, corner portion 2660, and/or ceiling portion 2680. In some embodiments, nose portion 2610 can further comprise a nose top section 2611, a nose top bend 2612, nose front section 2613, nose front bend 2614, nose riser section 2615, nose riser bend 2616, nose bottom section 2617, and/or spline nub 2618. In the same or different embodiments, nose top section 2611 can have a substantially planar shape. In various embodiments, nose top section is configured to couple to a ceiling surface (not shown). In some embodiments, nose top section 2611 can comprise nose top grooves (not shown). In some embodiments, nose top grooves (not shown) can be configured to receive epoxy, glue, or sealant such that a spline 2600 is coupled to a ceiling surface (not shown). In some embodiments, the coupling of spline 2600 to ceiling surface (not shown) occurs in a way that is water tight and/or air tight. In the same or different embodiments, nose top section 2611 can extend approximately parallel to nose bottom section 2617 and approximately perpendicular to nose front section 2613. In various embodiments, nose top bend 2612 extends between nose top section 2611 and nose front section 2613.

In various embodiments, nose front section extends approximately parallel to back ceiling section 2663 and/or perpendicular to nose top section 2611. In some embodiments, nose front section 2613 can have a substantially planar shape. In various embodiments, nose front section 2613 can have a substantially arcuate shape, which allows for easy and thorough cleaning and/or disinfection because the lack of sharp corners and crevices prevents microorganisms from evading disinfectant. When nose front section 2613 has a substantially arcuate shape, laminar airflow can also be enhanced because air streams do not encounter sharp corners. As an example, the substantially arcuate shape of nose front section 2613 can be a concave shape or a convex shape. In the same or different embodiments, nose front bend 2614 extends between nose front section 2613 and nose riser section 2615. In some embodiments, nose front bend 2614 can have a substantially planar shape. In the same or different embodiments, nose front bend 2614 can have a substantially arcuate shape, which allows for easy and thorough cleaning and/or disinfection because the lack of sharp corners and crevices prevents microorganisms from evading disinfectant. When nose front bend 2614 has a substantially arcuate shape, laminar airflow can also be enhanced because air streams do not encounter sharp corners. As an example, the substantially arcuate shape of nose front bend 2614 can be a concave shape or a convex shape.

In the same or different embodiments, nose riser section 2615 can have a substantially planar shape. In various embodiments, nose riser section 2615 can have a substantially arcuate shape, which allows for easy and thorough cleaning and/or disinfection because the lack of sharp corners and crevices prevents microorganisms from evading disinfectant. When nose riser section 2615 has a substantially arcuate shape, laminar airflow can also be enhanced because air streams do not encounter sharp corners. As an example, the substantially arcuate shape of nose riser section 2615 can be a concave shape or a convex shape. In the same or different embodiments, nose riser section 2615 can form an obtuse angle with nose front section 2613. In some embodiments, nose riser section 2615 can form an acute angle with nose front section 2613. In various embodiments, nose riser section 2615 can form an approximately right angle with nose front section 2613. In further embodiments, nose riser section 2615 can be co-planar with nose front section 2613.

In some embodiments, nose riser bend 2616 extends between nose riser section 2615 and nose bottom section 2617. In some embodiments, nose riser bend 2616 can have a substantially planar shape. In the same or different embodiments, nose riser bend 2616 can have a substantially arcuate shape, which allows for easy and thorough cleaning and/or disinfection because the lack of sharp corners and crevices prevents microorganisms from evading disinfectant. When nose riser bend 2616 has a substantially arcuate shape, laminar airflow can also be enhanced because air streams do not encounter sharp corners.

In the same or various embodiments, nose bottom section 2617 can be substantially parallel to nose top section 2611. In various embodiments, nose bottom section 2617 can have a substantially planar shape. In some embodiments, nose bottom section 2617 can have a substantially arcuate shape, which allows for easy and thorough cleaning and/or disinfection because the lack of sharp corners and crevices prevents microorganisms from evading disinfectant. When nose bottom section 2617 has a substantially arcuate shape, laminar airflow can also be enhanced because air streams do not encounter sharp corners. As an example, the substantially arcuate shape of nose bottom section 2617 can be a concave shape or a convex shape.

In further embodiments, nose portion 2610 further comprises a spline nub 2618 extending from a lateral side of spline 2600. As shown in FIG. 26A, nose portion 2610 can include two spline nubs 2618 at opposite lateral sides of nose portion 2610. In some embodiments, spline nub 2618 can comprise a variety of shapes configured to be inserted into a variety of spline receiver grooves such that inserting or otherwise locating spline nub 2617 in a spline receiver groove couples a crown element to spline 2600. In various embodiments, spline nub 2618 can comprise a substantially rectangular shape, a substantially circular shape, a substantially triangular shape, a substantially ovoid shape, a substantially oval shape, and/or a substantially semi-circular shape. In the same or different embodiments, spline nub 2618 can comprise a top spline nub surface 2691, a plurality of spline nub bends 2692, a spline nub lateral surface 2697, and/or a spline nub edge 2698. In some embodiments, spline nub edge 2698 can circumscribe spline nub lateral surface 2697 and/or have a substantially arcuate or planar shape. When spline nub edge 2698 has a substantially arcuate shape, it is easier to insert spline nub 2618 into nose spline receiver grooves. In the same or different embodiments, plurality of spline nub bends 2692 can have a substantially arcuate or planar shape. When plurality of spline nub bends 2692 has a substantially arcuate shape, it is easier to insert spline nub 2618 into spline receiver grooves.

In some embodiments, riser portion 2620 can comprise riser bend bottom interface 2621, riser bend 2622, riser bend top interface 2623, and/or riser section 2624. In the same or different embodiments, riser bend bottom interface 2621 can extend from nose top section 2611. In the same or different embodiments, riser bend 2622 can extend from riser bend bottom interface 2623. In the same or different embodiments, riser bend 2622 can have a substantially arcuate shape, which allows for easy and thorough cleaning and/or disinfection because the lack of sharp corners and crevices prevents microorganisms from evading disinfectant. When riser bend 2622 has a substantially arcuate shape, laminar airflow can also be enhanced because air streams do not encounter sharp corners. As an example, the substantially arcuate shape of riser bend 2622 can be a concave shape or a convex shape. In some embodiments, riser bend top interface 2623 can extend from riser bend 2622. In the same or different embodiments, riser section 2624 can extend from riser top interface 2623. In various embodiments, riser section 2624 has a substantially planar shape, can be parallel to nose top section 2614, and/or be perpendicular to nose bottom section 2612.

In the same or different embodiments, wall groove portion 2630 can comprise a groove front section 2631, a groove bend 2632, a groove back section 2633, a groove front edge 2634, and/or a groove back edge 2635. In some embodiments, groove front section 2631 can extend from riser section 2624. As an example, groove front section 2631 and riser section 2624 can be coplanar with each other. In various embodiments, groove front section 2631 has a substantially planar shape, can be parallel to nose top section 2614, and/or be perpendicular to nose bottom section 2612. In the same or different embodiments, groove front section 2631 terminates at groove front edge 2634. In various embodiments, groove front edge 2634 can have a substantially planar shape or a substantially arcuate shape. In further embodiments, groove bend 2632 can extend from groove front end 2631. In various embodiments, groove bend 2632 can have a substantially planar or substantially arcuate shape. In the same or different embodiments, groove bend 2632 can form a 180 degree bend, such that groove back section 2633 can be approximately parallel to groove front section 2631. In various embodiments, groove back section 2633 can extend from groove bend 2632 and terminate at groove back edge 2635. In further embodiments, groove back edge 2635 can have a substantially planar shape or a substantially arcuate shape.

In some embodiments, spline plate portion 2640 can comprise a spline plate 2641 extending out of lateral side 2618. In various embodiments, there can be a plurality of spline plates 2641 extending from opposite lateral sides of spline 2600, as shown in FIGS. 26A and 26B. In the same or different embodiments, spline plate 2641 can comprise a front spline plate surface 2642 and/or a back spline plate surface 2643. In further embodiments, spline plate 2641 can comprise a lateral spline edge 2648, top corner spline edge 2644, a top spline edge 2645, a bottom spline edge 2646, and a bottom corner spline edge 2647. In various embodiments, lateral spline edge 2648, top corner spline edge 2644, top spline edge 2645, bottom spline edge 2646, and/or bottom corner spline edge 2647 can have a substantially planar shape or a substantially arcuate shape. When lateral spline edge 2648, top corner spline edge 2644, top spline edge 2645, bottom spline edge 2646, and/or bottom corner spline edge 2647 have a substantially arcuate shape, it is easier to insert spline plate 2641 into receiver section 1645 as buffeted by top receiver nub 1646 and bottom receiver nub 1642. In various embodiments, back spline plate surface 2643 can span across and be contiguous and co-planar with back a spline surface.

In some embodiments, ceiling portion 2680 can comprise bottom ceiling bend 2664, front ceiling section 2661, top ceiling section 2662, and/or back ceiling section 2663. In the same or different embodiments, bottom ceiling bend 2664 can have a planar shape. In various embodiments, bottom ceiling bend 2664 can have a substantially arcuate shape. In other embodiments, bottom ceiling bend 2664 can have a substantially planar shape. As an example, the substantially arcuate shape of bottom ceiling bend 2664 can be a concave shape or a convex shape. In the same or different embodiments, bottom ceiling bend 2664 extends between nose top section 2611 and front ceiling section 2661. In some embodiments, front ceiling section 2661 is approximately perpendicular with nose top section 2611. In other embodiments, front ceiling section 2661 creates an acute angle with nose top section 2611. In further embodiments, front ceiling section 2661 creates an obtuse angle with nose top section 2611. In the same or different embodiments, front ceiling section 2661 is configured to be flush with a side of a ceiling surface (not shown). In some embodiments, top ceiling section 2622 extends between front ceiling section 2661 and back ceiling section 2633. In the same or different embodiments, back ceiling section 2633 is approximately parallel with front ceiling section 2661 and approximately perpendicular with nose top section 2611.

In some embodiments, corner portion 2660 can comprise corner top ceiling interface 2671, corner front ceiling interface 2672, corner nose top bend 2673, corner nose front interface 2674, corner nose front bend 2675, corner nose riser interface 2676, corner nose riser bend 2677, corner nose bottom interface 2678, corner riser bend bottom interface 2679, corner riser bend 2680, corner riser bend top interface 2681, corner riser interface 2682, corner groove front interface 2683, corner groove front edge interface 2684, corner groove back interface 2685, and/or corner groove back edge interface 2686. In some embodiments, corner portion 2660 forms a right angle of an interior corner. In the same or different embodiments, corner portion 2660 forms an acute angle of an interior corner. In still other embodiments, corner portion 2660 forms an obtuse angle of an interior corner.

In further embodiments, corner top ceiling interface 2671 extends between a plurality of top ceiling sections 2662. In the same or different embodiments, corner top ceiling interface 2671 can have a substantially planar shape. In some embodiments, corner bottom nose bend 2671 can have an arcuate shape, which allows for easy and thorough cleaning and/or disinfection because the lack of sharp corners and crevices prevents microorganisms from evading disinfectant. When corner top ceiling interface 2671 has a substantially arcuate shape, laminar airflow can also be enhanced because air streams do not encounter sharp corners. As an example, the substantially arcuate shape of corner top ceiling interface 2671 can be a concave shape or a convex shape.

In further embodiments, corner front ceiling interface 2672 extends between a plurality of front ceiling sections 2661. In the same or different embodiments, corner front ceiling interface 2672 can have a substantially planar shape. In some embodiments, corner front ceiling interface 2672 can have an arcuate shape, which allows for easy and thorough cleaning and/or disinfection because the lack of sharp corners and crevices prevents microorganisms from evading disinfectant. When corner front ceiling interface 2672 has a substantially arcuate shape, laminar airflow can also be enhanced because air streams do not encounter sharp corners. As an example, the substantially arcuate shape of corner front ceiling interface 2672 can be a concave shape or a convex shape.

In further embodiments, corner nose top bend 2673 extends between a plurality of nose top bend 2612. In the same or different embodiments, corner nose top bend 2673 can have a substantially planar shape. In some embodiments, corner nose top bend 2673 can have an arcuate shape, which allows for easy and thorough cleaning and/or disinfection because the lack of sharp corners and crevices prevents microorganisms from evading disinfectant. When corner nose top bend 2673 has a substantially arcuate shape, laminar airflow can also be enhanced because air streams do not encounter sharp corners. As an example, the substantially arcuate shape of corner nose top bend 2673 can be a concave shape or a convex shape.

In further embodiments, corner nose front interface 2674 extends between a plurality of nose front sections 2613. In the same or different embodiments, corner nose front interface 2674 can have a substantially planar shape. In some embodiments, corner nose front interface 2674 can have an arcuate shape, which allows for easy and thorough cleaning and/or disinfection because the lack of sharp corners and crevices prevents microorganisms from evading disinfectant. When corner nose front interface 2674 has a substantially arcuate shape, laminar airflow can also be enhanced because air streams do not encounter sharp corners. As an example, the substantially arcuate shape of corner nose front interface 2674 can be a concave shape or a convex shape.

In further embodiments, corner nose front bend 2675 extends between a plurality of corner nose front bends 2614. In the same or different embodiments, corner nose front bend 2675 can have a substantially planar shape. In some embodiments, corner nose front bend 2675 can have an arcuate shape, which allows for easy and thorough cleaning and/or disinfection because the lack of sharp corners and crevices prevents microorganisms from evading disinfectant. When corner nose front bend 2675 has a substantially arcuate shape, laminar airflow can also be enhanced because air streams do not encounter sharp corners. As an example, the substantially arcuate shape of corner nose front bend 2675 can be a concave shape or a convex shape.

In further embodiments, corner nose riser interface 2676 extends between a plurality of nose riser sections 2615. In the same or different embodiments, corner nose riser interface 2676 can have a substantially planar shape. In some embodiments, corner nose riser interface 2676 can have an arcuate shape, which allows for easy and thorough cleaning and/or disinfection because the lack of sharp corners and crevices prevents microorganisms from evading disinfectant. When corner nose riser interface 2676 has a substantially arcuate shape, laminar airflow can also be enhanced because air streams do not encounter sharp corners. As an example, the substantially arcuate shape of corner nose riser interface 2676 can be a concave shape or a convex shape.

In further embodiments, corner nose riser bend 2677 extends between a plurality of nose riser bend 2617. In the same or different embodiments, corner nose riser bend 2677 can have a substantially planar shape. In some embodiments, corner nose riser bend 2677 can have an arcuate shape, which allows for easy and thorough cleaning and/or disinfection because the lack of sharp corners and crevices prevents microorganisms from evading disinfectant. When corner nose riser bend 2677 has a substantially arcuate shape, laminar airflow can also be enhanced because air streams do not encounter sharp corners. As an example, the substantially arcuate shape of corner nose riser bend 2677 can be a concave shape or a convex shape.

In further embodiments, corner nose bottom interface 2678 extends between a plurality of nose bottom sections 2617. In the same or different embodiments, corner nose bottom interface 2678 can have a substantially planar shape. In some embodiments, corner nose bottom interface 2678 can have an arcuate shape, which allows for easy and thorough cleaning and/or disinfection because the lack of sharp corners and crevices prevents microorganisms from evading disinfectant. When corner nose bottom interface 2678 has a substantially arcuate shape, laminar airflow can also be enhanced because air streams do not encounter sharp corners. As an example, the substantially arcuate shape of corner nose bottom interface 2678 can be a concave shape or a convex shape.

In further embodiments, corner riser bend bottom interface 2679 extends between a plurality of riser bend bottom interfaces 2621. In the same or different embodiments, corner riser bend bottom interface 2679 can have a substantially planar shape. In some embodiments, corner riser bend bottom interface 2679 can have an arcuate shape, which allows for easy and thorough cleaning and/or disinfection because the lack of sharp corners and crevices prevents microorganisms from evading disinfectant. When corner riser bend bottom interface 2679 has a substantially arcuate shape, laminar airflow can also be enhanced because air streams do not encounter sharp corners. As an example, the substantially arcuate shape of corner nose bottom interface 2678 can be a concave shape or a convex shape.

In further embodiments, corner riser bend 2680 extends between a plurality of riser bends 2622. In the same or different embodiments, corner riser bend 2680 can have a substantially planar shape. In some embodiments corner riser bend 2680 can have an arcuate shape, which allows for easy and thorough cleaning and/or disinfection because the lack of sharp corners and crevices prevents microorganisms from evading disinfectant. When corner riser bend 2680 has a substantially arcuate shape, laminar airflow can also be enhanced because air streams do not encounter sharp corners. As an example, the substantially arcuate shape of corner riser bend 2680 can be a concave shape or a convex shape.

In further embodiments, corner riser bend top interface 2681 extends between a plurality of riser bend top interface 2623. In the same or different embodiments, corner riser bend top interface 2681 can have a substantially planar shape. In some embodiments corner riser bend top interface 2681 can have an arcuate shape, which allows for easy and thorough cleaning and/or disinfection because the lack of sharp corners and crevices prevents microorganisms from evading disinfectant. When corner riser bend top interface 2681 has a substantially arcuate shape, laminar airflow can also be enhanced because air streams do not encounter sharp corners. As an example, the substantially arcuate shape of corner riser bend top interface 2681 can be a concave shape or a convex shape.

In further embodiments, corner riser interface 2682 extends between a plurality of riser bend top interface 2623. In the same or different embodiments, corner riser interface 2682 can have a substantially planar shape. In some embodiments corner riser interface 2682 can have an arcuate shape, which allows for easy and thorough cleaning and/or disinfection because the lack of sharp corners and crevices prevents microorganisms from evading disinfectant. When corner riser interface 2682 has a substantially arcuate shape, laminar airflow can also be enhanced because air streams do not encounter sharp corners. As an example, the substantially arcuate shape of corner riser interface 2682 can be a concave shape or a convex shape.

In further embodiments, corner groove front interface 2683 extends between a plurality of groove front sections 2631. In the same or different embodiments, corner groove front interface 2683 can have a substantially planar shape. In some embodiments corner front groove interface 2683 can have an arcuate shape, which allows for easy and thorough cleaning and/or disinfection because the lack of sharp corners and crevices prevents microorganisms from evading disinfectant. When corner groove front interface 2683 has a substantially arcuate shape, laminar airflow can also be enhanced because air streams do not encounter sharp corners. As an example, the substantially arcuate shape of corner groove front interface 2683 can be a concave shape or a convex shape.

In further embodiments, corner groove front edge interface 2684 extends between a plurality of a groove front edges 2634. In the same or different embodiments, corner groove front edge interface 2684 can have a substantially planar shape. In some embodiments corner front groove interface 2683 can have an arcuate shape, which allows for easy and thorough cleaning and/or disinfection because the lack of sharp corners and crevices prevents microorganisms from evading disinfectant. When corner groove front edge interface 2684 has a substantially arcuate shape, laminar airflow can also be enhanced because air streams do not encounter sharp corners. As an example, the substantially arcuate shape of corner groove front edge interface 2684 can be a concave shape or a convex shape.

In further embodiments, corner groove back interface 2685 extends between a plurality of a groove back sections 2633. In the same or different embodiments, corner groove back interface 2685 can have a substantially planar shape. In some embodiments corner groove back interface 2685 can have an arcuate shape.

In further embodiments, corner back edge interface 2686 extends between a plurality of groove back edges 2635. In the same or different embodiments, corner groove back interface 2685 can have a substantially planar shape. In some embodiments corner groove back interface 2685 can have an arcuate shape.

Figure 27A:
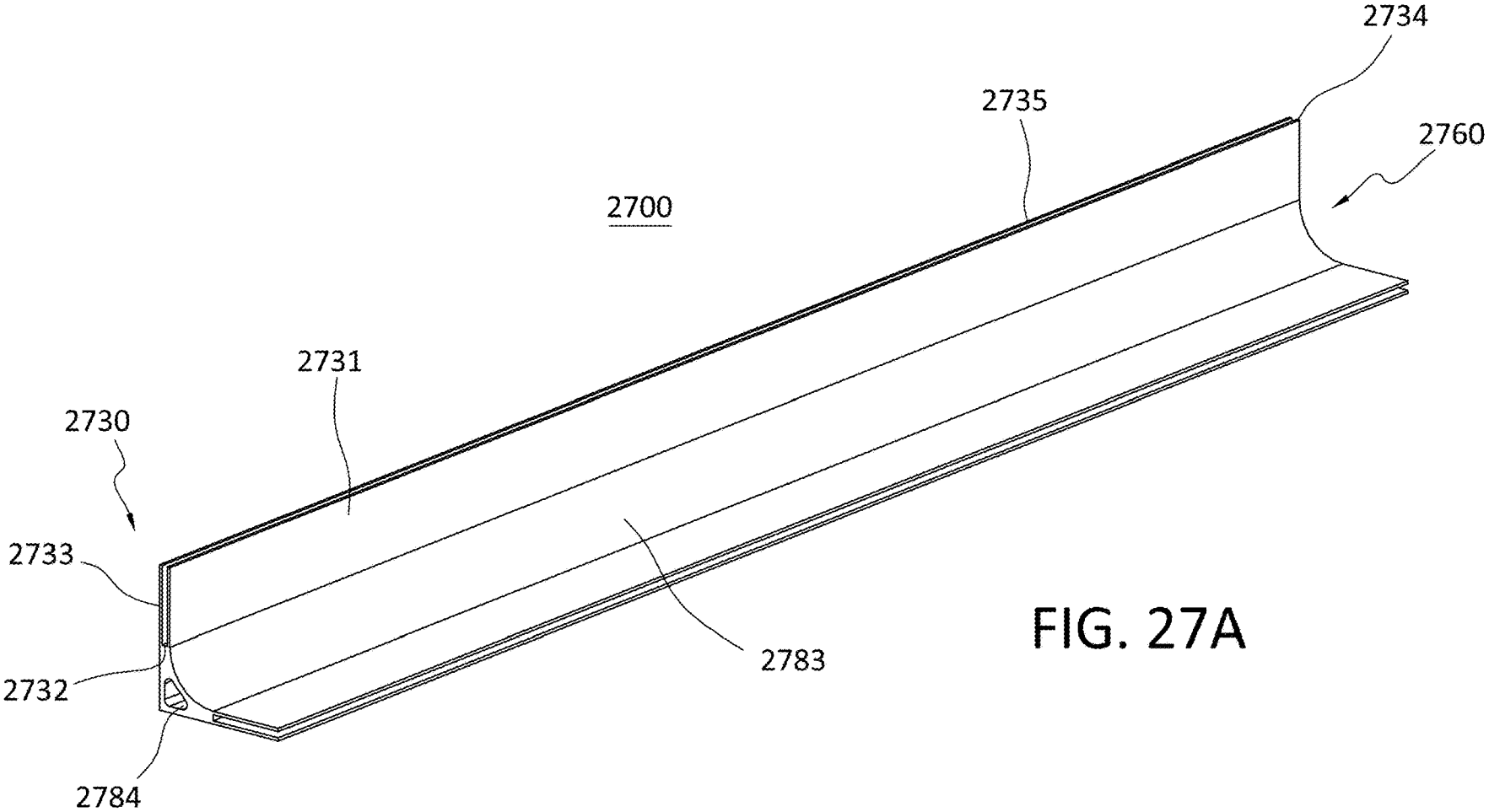
FIGS. 27A-28B representatively illustrate exemplary embodiments of wall elements.
Figure 27B:
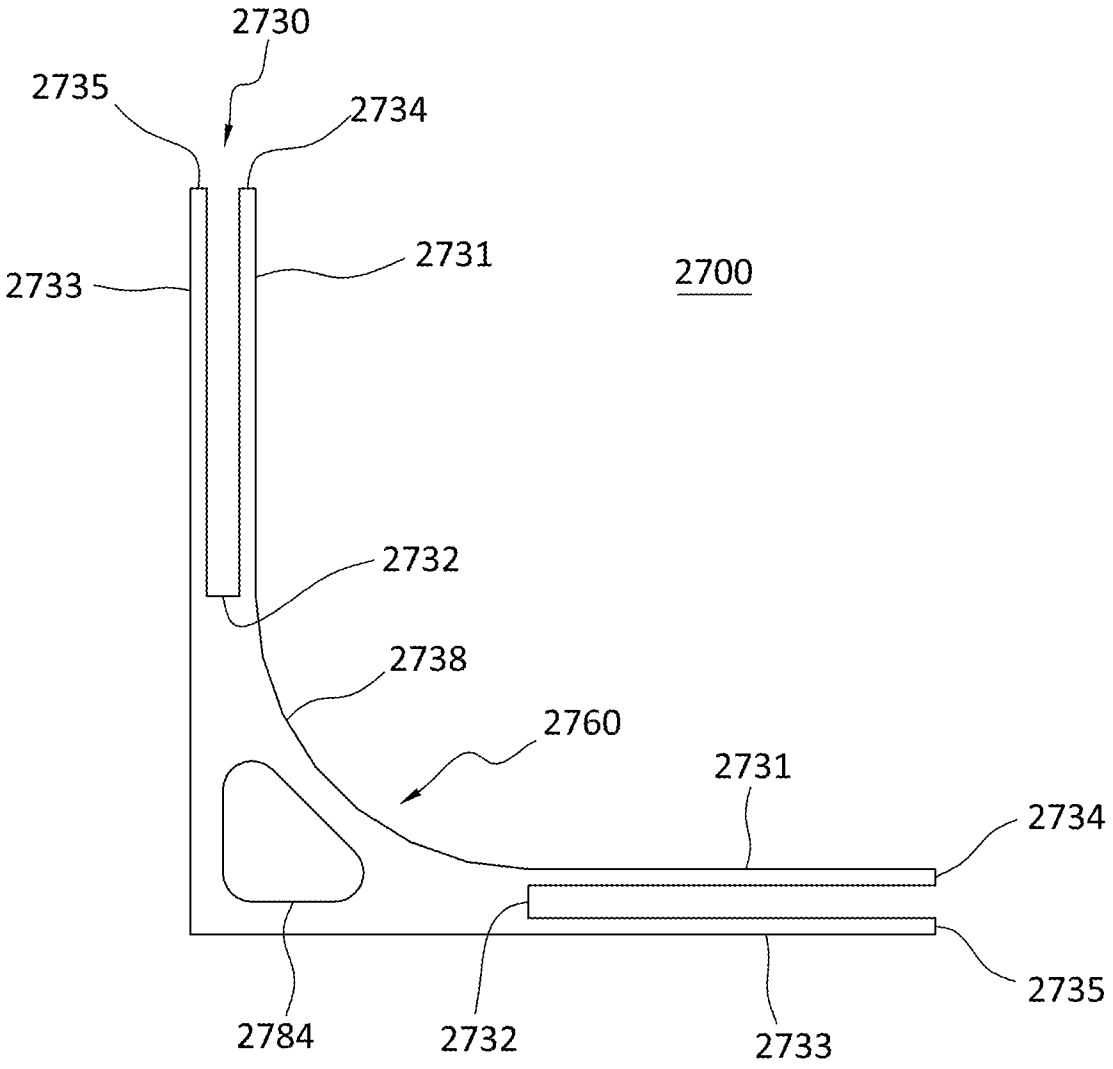

Turning now to FIGS. 27A and 27B, an exemplary embodiment of a wall corner element 2700 is shown in a front isometric view. In some embodiments, wall corner element 2700 can comprise a wall groove portion 2730 and a corner portion 2760. In the same or different embodiments, wall groove portion 2730 can comprise a groove front section 2731, a groove bend 2732, a groove back section 2733, a groove front edge 2734, and/or a groove back edge 2735. In some embodiments, groove front section 2731 can extend from corner groove front section 2783 (FIG. 27A). In various embodiments, groove front section 2731 has a substantially planar shape. In the same or different embodiments, groove front section 2731 terminates at groove front edge 2734. In various embodiments, groove front edge 2734 can have a substantially planar shape or a substantially arcuate shape. In further embodiments, groove bend 2732 can extend from groove front end 2731. In various embodiments, groove bend 2732 can have a substantially planar or substantially arcuate shape. In the same or different embodiments, groove bend 2732 can form a 180 degree bend, such that groove back section 2733 can be approximately parallel to groove front section 2731. In various embodiments, groove back section 2733 can extend from groove bend 2732 and terminate at groove back edge 2735. In further embodiments, groove back edge 2735 can have a substantially planar shape or a substantially arcuate shape.

In various embodiments, corner portion 2760 can comprise corner groove front section 2783 and/or nub receiver groove 2784. In some embodiments, corner portion 2760 forms a right angle of an interior corner. In the same or different embodiments, corner portion 2760 forms an acute angle of an interior corner. In still other embodiments, corner portion 2760 forms an obtuse angle of an interior corner. In the same or different embodiments, corner groove front section 2783 can have a substantially planar shape. In some embodiments, corner groove front section 2783 corner groove front section 2783 can have an arcuate shape, which allows for easy and thorough cleaning and/or disinfection because the lack of sharp corners and crevices prevents microorganisms from evading disinfectant. When corner groove front section 2783 has a substantially arcuate shape, laminar airflow can also be enhanced because air streams do not encounter sharp corners. As an example, the substantially arcuate shape of corner groove front section 2783 can be a concave shape or a convex shape. Nub receiver groove 2784 can be a spline coupling portion. In some embodiments, the spline coupling portion can comprise one or more recesses or female portions, as described below, and in other embodiments (not shown in FIGS. 27A and 27B), the spline coupling portion can comprise one or more male portions. As shown in FIGS. 27A and 27B, nub receiver groove 2784 can comprise a variety of shapes configured to receive a variety of corner nub shapes, such that inserting a corner nub into nub receiver groove 2784 couples wall corner element 2700 to a spline. Incorporation of nub receiver groove 2784 into wall corner element 2700 can save on production costs and weight due to reducing material used to manufacture wall corner element 2700. In various embodiments, nub receiver groove 2784 can comprise a substantially rectangular shape, a substantially circular shape, a substantially triangular shape, a substantially ovoid shape, a substantially oval shape, and/or a substantially semi-circular shape.

Figure 28A:
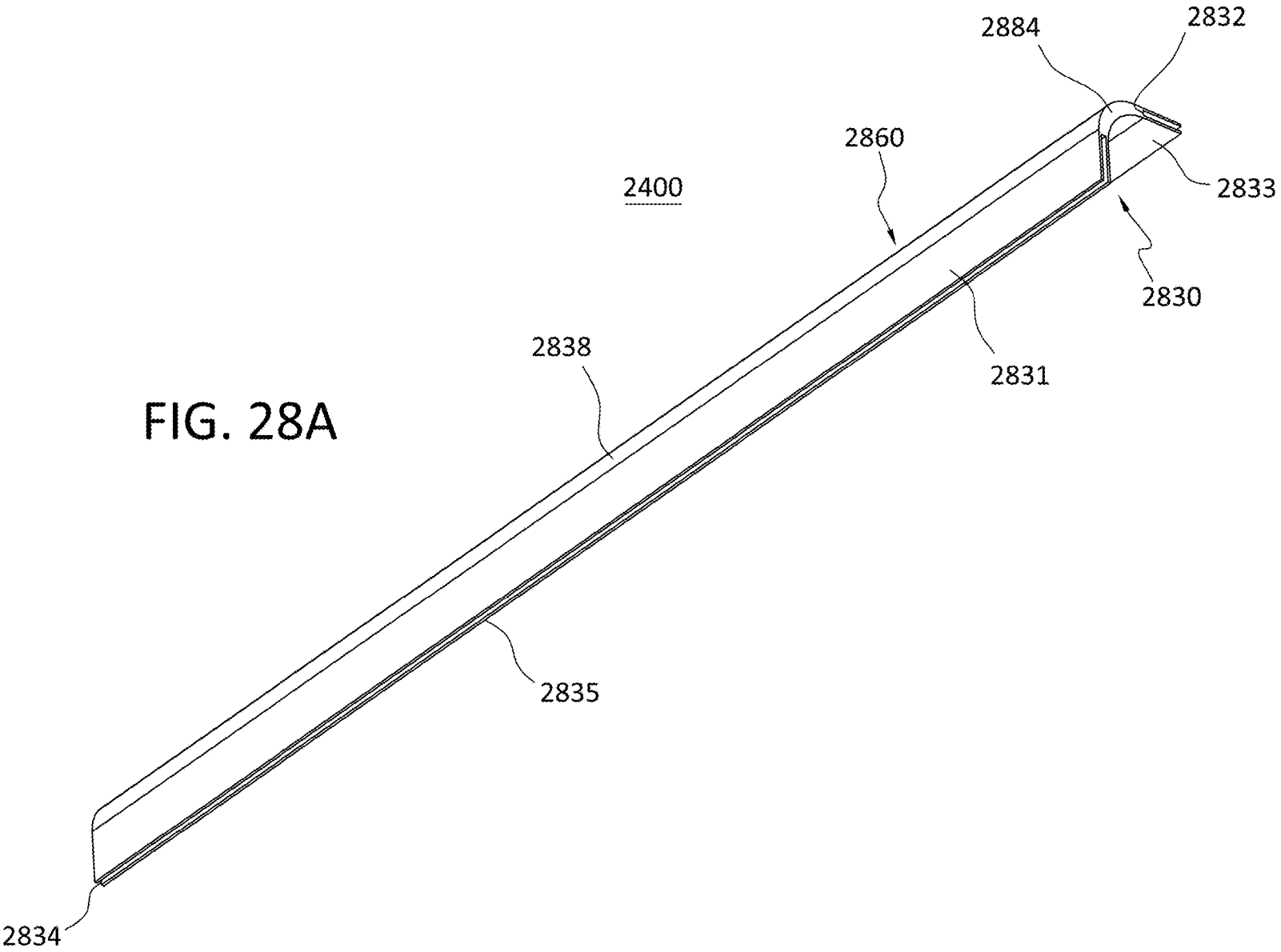
Figure 28B:
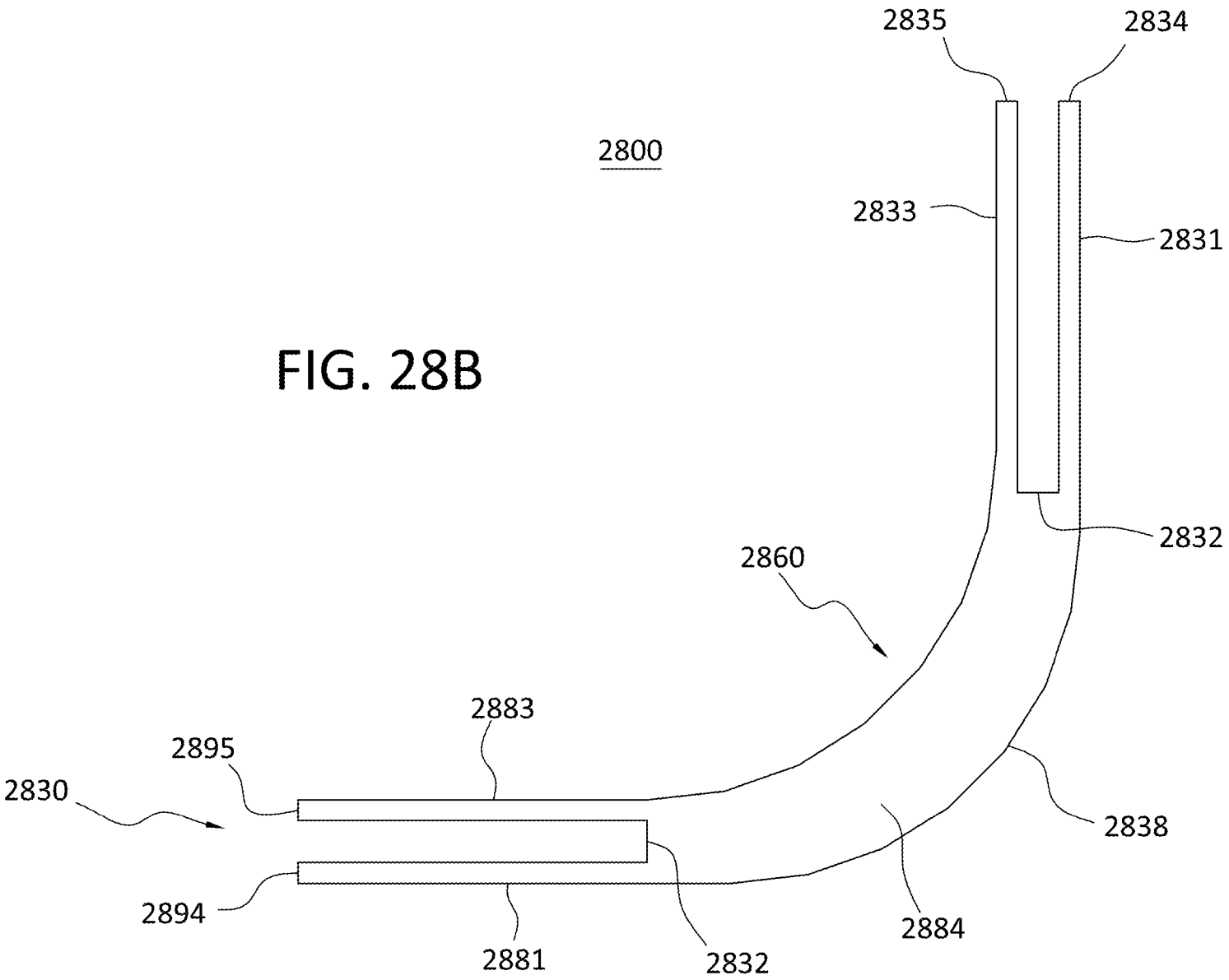

Turning now to FIGS. 28A and 28B, an exemplary embodiment of a wall corner element 2800 is shown in a front isometric view. In some embodiments, wall corner element 2800 can comprise a wall groove portion 2830 and a corner portion 2860. In the same or different embodiments, wall groove portion 2830 can comprise a groove front section 2831, a groove bend 2832, a groove back section 2833, a groove front edge 2834, and/or a groove back edge 2835. In some embodiments, groove front section 2831 can extend from corner groove front section 2683. In various embodiments, groove front section 2831 has a substantially planar shape. In the same or different embodiments, groove front section 2831 terminates at groove front edge 2834. In various embodiments, groove front edge 2834 can have a substantially planar shape or a substantially arcuate shape. In further embodiments, groove bend 2832 can extend from groove front end 2831. In various embodiments, groove bend 2832 can have a substantially planar or substantially arcuate shape. In the same or different embodiments, groove bend 2832 can form a 180 degree bend, such that groove back section 2833 can be approximately parallel to groove front section 2831. In various embodiments, groove back section 2833 can extend from groove bend 2832 and terminate at groove back edge 2835. In further embodiments, groove back edge 2835 can have a substantially planar shape or a substantially arcuate shape.

In various embodiments, corner portion 2860 can comprise corner groove front section 2883 and/or a nub receiver groove (not shown). In some embodiments, corner portion 2860 forms a right angle of an exterior corner. In the same or different embodiments, corner portion 2860 forms an acute angle of an exterior corner. In still other embodiments, corner portion 2860 forms an obtuse angle of an exterior corner. In the same or different embodiments, corner groove front section 2883 can have a substantially planar shape. In some embodiments, corner groove front section 2883 corner groove front section 2883 can have an arcuate shape, which allows for easy and thorough cleaning and/or disinfection because the lack of sharp corners and crevices prevents microorganisms from evading disinfectant. When corner groove front section 2883 has a substantially arcuate shape, laminar airflow can also be enhanced because air streams do not encounter sharp corners. As an example, the substantially arcuate shape of corner groove front section 2883 can be a concave shape or a convex shape. In some embodiments, nub receiver groove (not shown) can comprise a variety of shapes configured to receive a variety of corner nub shapes, such that inserting a corner nub into nub receiver groove (not shown) couples wall corner element 2800 to a spline. Incorporation of nub receiver groove (not shown) into wall corner element 2800 can save on production costs and weight due to reducing material used to manufacture wall corner element 2800. In various embodiments, nub receiver groove (not shown) can comprise a substantially rectangular shape, a substantially circular shape, a substantially triangular shape, a substantially ovoid shape, a substantially oval shape, and/or a substantially semi-circular shape.

Figure 29A:
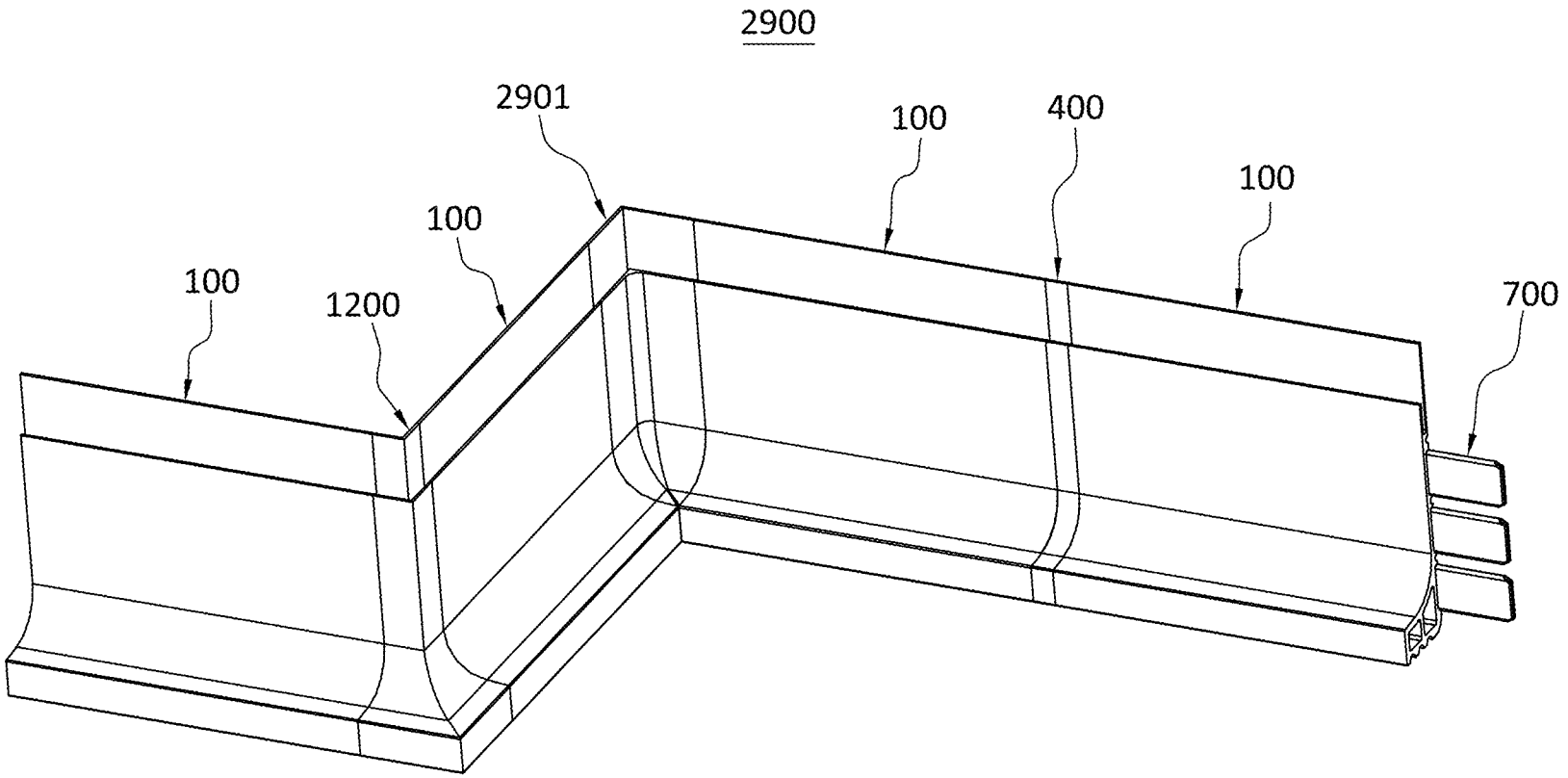
FIGS. 29A-33B representatively illustrate exemplary embodiments of baseboard assemblies.

Turning now to FIG. 29A, an exemplary baseboard assembly 2900 is shown in a front isometric view. In some embodiments, baseboard assembly 2900 can comprise spline 700, baseboard element 100, spline 400, spline 2901, and/or spline 1200. In various embodiments, baseboard assembly 2900 can comprise other baseboard elements and splines that have complementary spline receiver portions and spline plate portions such that the splines and baseboard elements can couple together. While spline 2901 has not been described in detail in the foregoing specification, it should be understood that it could be created by interchanging and/or swapping various elements of the aforementioned splines. For example, spline 2901 could comprise nose portion 1510 (FIG. 15A), riser portion 1520 (FIG. 15A), wall groove portion 1530 (FIG. 15A), spline plate portion 1440 (FIG. 14A), and/or corner portion 1560 (FIG. 15A). Other combinations of nose portions, riser portions, wall groove portions, spline plate portions, and/or corner portions are also possible. When assembled together, base assembly 2900 can have a coplanar and smooth front surface such that, for example (1) nose front sections 113 (FIG. 1A) and 413 (FIG. 4A) of adjacent ones of baseboard element 100 and spline 400 form a smooth and coplanar surface; (2) nose top sections 111 (FIG. 1A) and 411 (FIG. 4A) of adjacent ones of baseboard element 100 and spline 400 form a smooth and coplanar surface; (3) riser bends 122 (FIG. 1A) and 422 (FIG. 4A) of adjacent ones of baseboard element 100 and spline 400 form a smooth and coplanar surface; (4) riser sections 124 (FIG. 1A) and 424 (FIG. 4A) and grove front sections 131 (FIG. 1A) and 431 (FIG. 4A) of adjacent ones of baseboard element 100 and spline 400 form a smooth and coplanar surface.

Figure 29B:
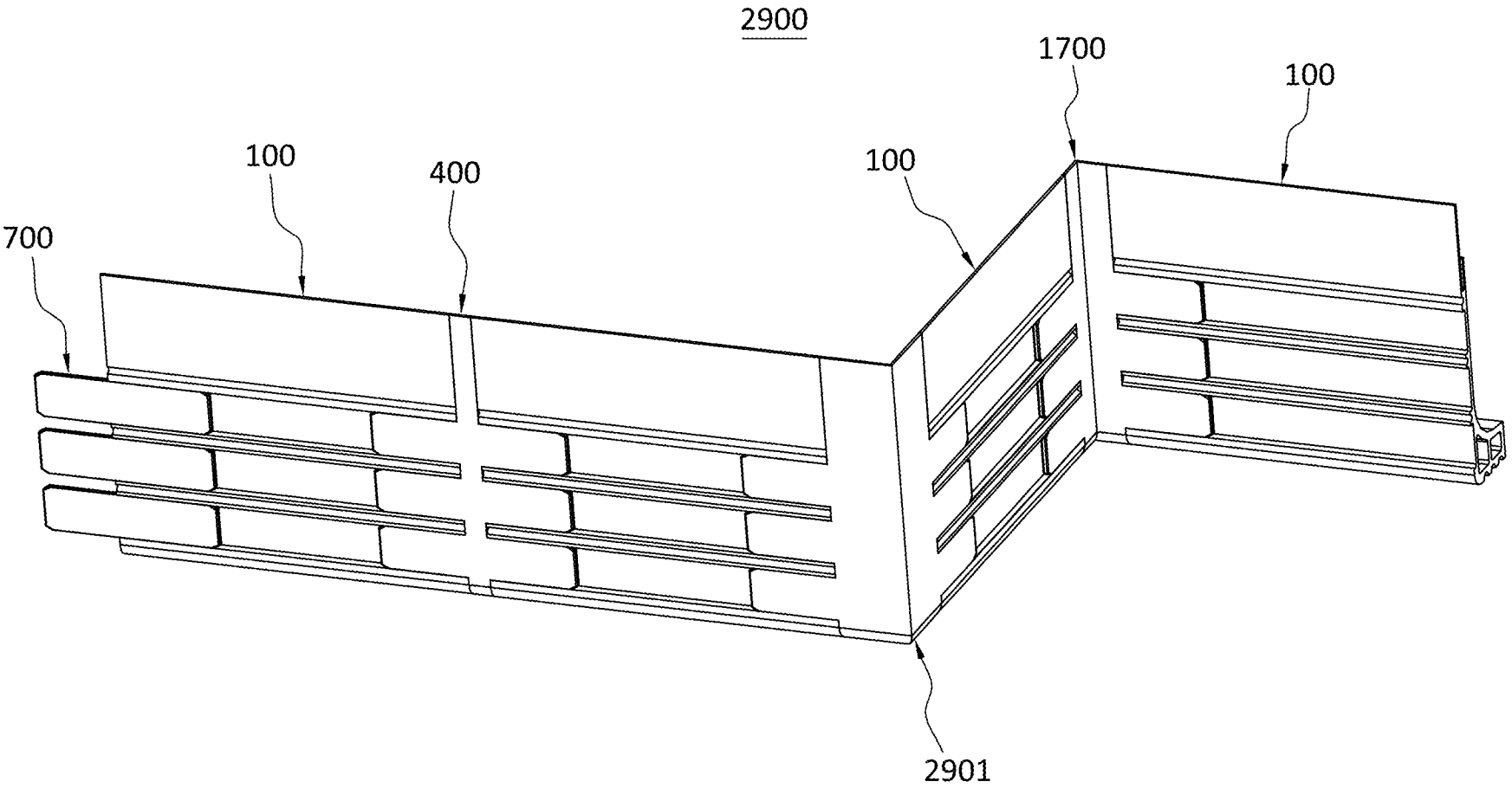

Turning now to FIG. 29B, a back isometric view of baseboard assembly 2900 is shown. The coupling of spline 700, baseboard element 100, spline 400, spline 2901, and/or spline 1200 can be seen in detail in FIG. 29B.

Figure 30A:
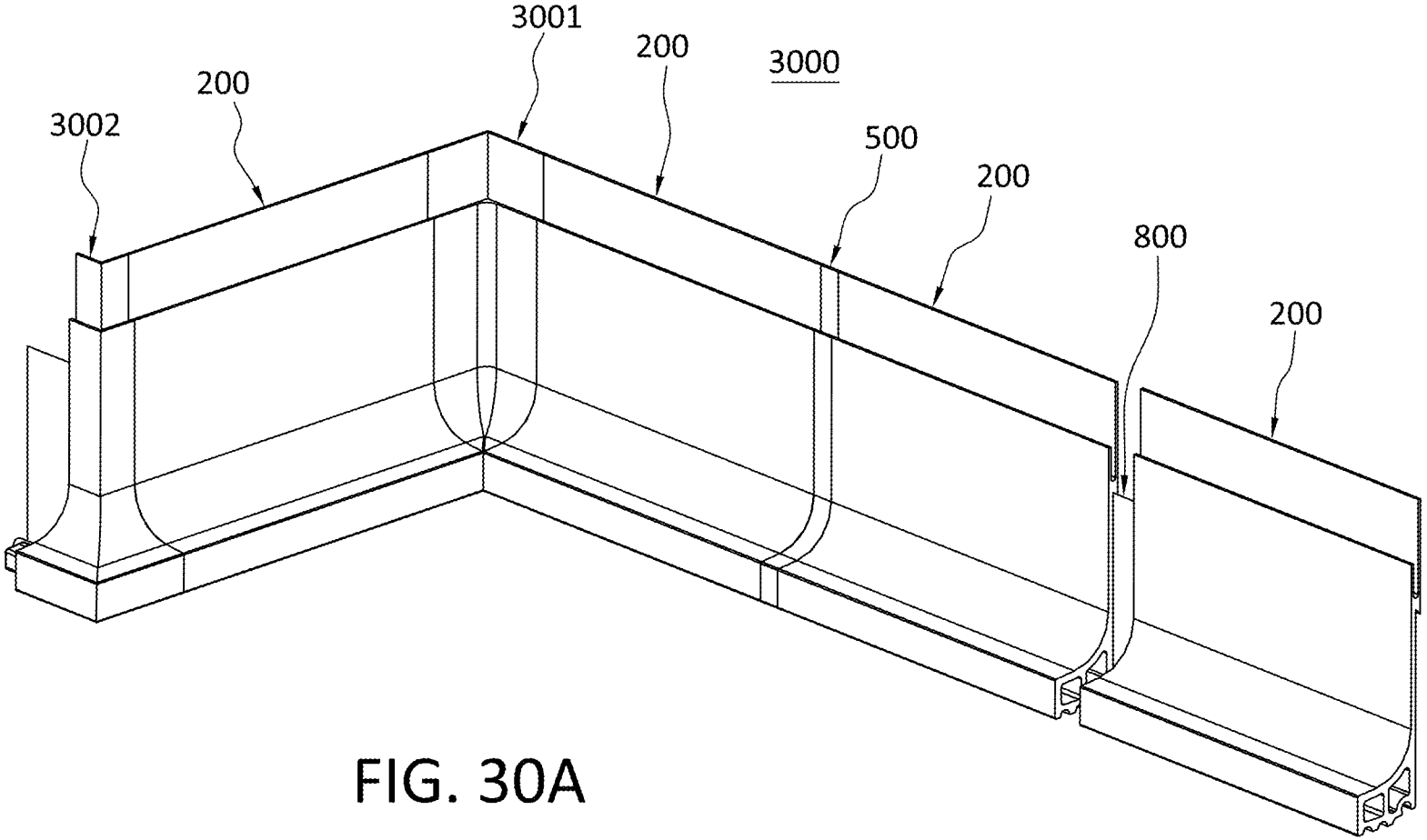

Turning now to FIG. 30A, an exemplary baseboard assembly 3000 is shown in a front isometric view. In some embodiments, baseboard assembly 3000 can comprise spline 800, baseboard element 200, spline 500, spline 3001, and/or spline 3002. In various embodiments, baseboard assembly 3000 can comprise various baseboard elements and splines that have complementary spline receiver portions and spline plate portions such that the splines and baseboard elements can couple together. While spline 3001 has not been described in detail in the foregoing specification, it should be understood that it could be created by interchanging and/or swapping various elements of the aforementioned splines. For example, spline 3001 could comprise nose portion 1510 (FIG. 15A), riser portion 1520 (FIG. 15A), wall groove portion 1530 (FIG. 15A), spline plate portion 540 (FIG. 5A), and/or corner portion 1560 (FIG. 15A). Further, while spline 3002 has not been described in detail in the foregoing specification, it should be understood that it could be created by interchanging and/or swapping various elements of the aforementioned splines. For example, spline 3002 could comprise nose portion 1210 (FIG. 12A), riser portion 1220 (FIG. 12A), wall groove portion 1230 (FIG. 12A), spline plate portion 540 (FIG. 5A), and/or corner portion 1260 (FIG. 12A). Other combinations of nose portions, riser portions, wall groove portions, spline plate portions, and/or corner portions are also possible. When assembled together, base assembly 3000 can have a coplanar and smooth front surface such that, for example (1) nose front sections 213 (FIG. 2A) and 513 (FIG. 5A) of adjacent ones of baseboard element 200 and spline 500 form a smooth and coplanar surface; (2) nose top sections 211 (FIG. 2A) and 511 (FIG. 5A) of adjacent ones of baseboard element 200 and spline 500 form a smooth and coplanar surface; (3) riser bends 222 (FIG. 2A) and 522 (FIG. 5A) of adjacent ones of baseboard element 200 and spline 500 form a smooth and coplanar surface; (4) riser sections 224 (FIG. 2A) and 524 (FIG. 5A) and grove front sections 231 (FIG. 2A) and 531 (FIG. 5A) of adjacent ones of baseboard element 200 and spline 500 form a smooth and coplanar surface.

Figure 30B:
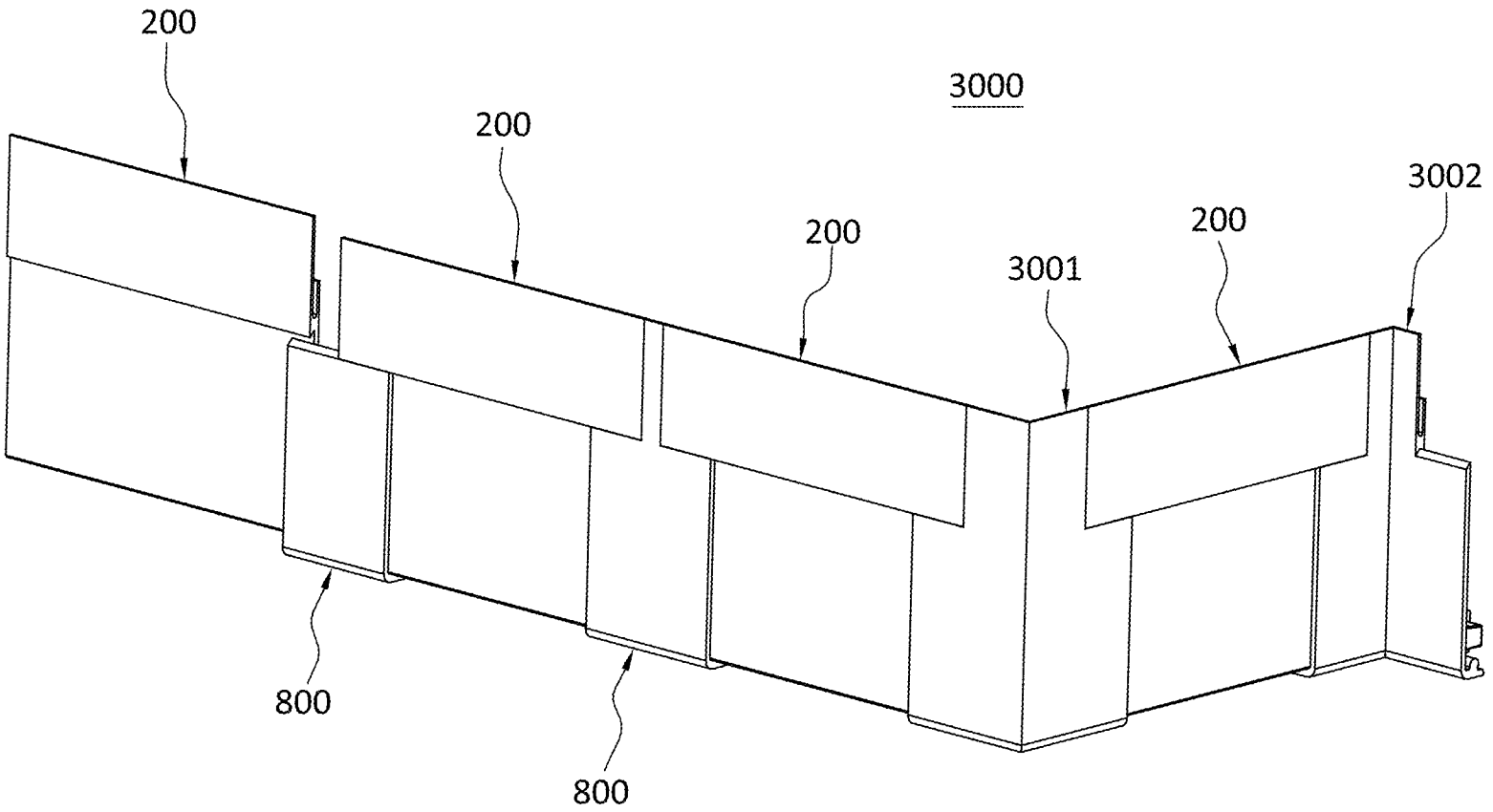

Turning now to FIG. 30B, a back isometric view of baseboard assembly 3000 is shown. The coupling of spline 800, baseboard element 200, spline 500, spline 3001, and/or spline 3002 can be seen in detail in FIG. 30B.

Figure 31A:
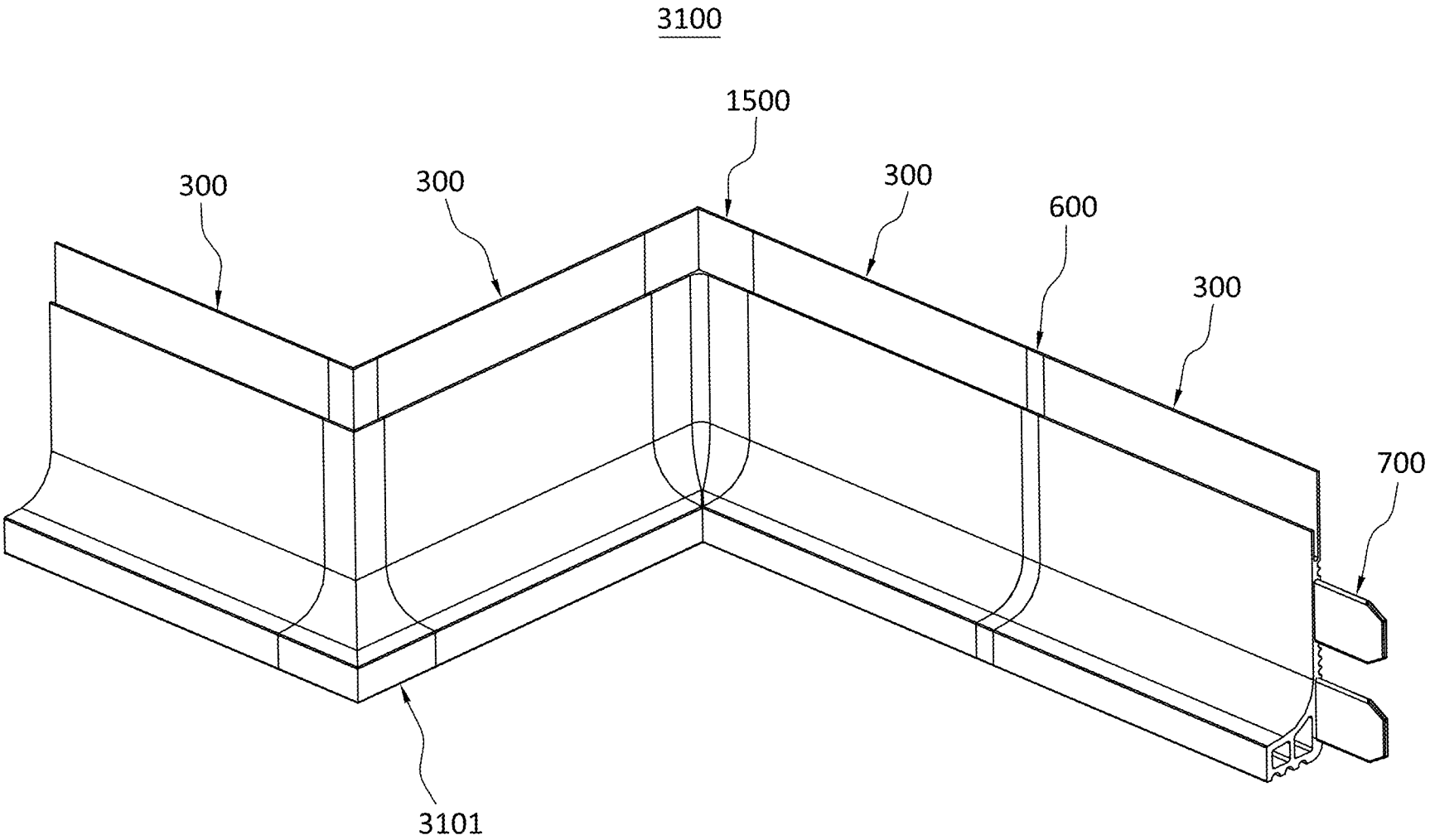

Turning now to FIG. 31A, an exemplary baseboard assembly 3100 is shown in a front isometric view. In some embodiments, baseboard assembly 3100 can comprise spline 700, baseboard element 300, spline 600, spline 1500, and/or spline 3101. In various embodiments, baseboard assembly 3100 can comprise various baseboard elements and splines that have complementary spline receiver portions and spline plate portions such that the splines and baseboard elements can couple together. While spline 3101 has not been described in detail in the foregoing specification, it should be understood that it could be created by interchanging and/or swapping various elements of the aforementioned splines. For example, spline 3101 could comprise nose portion 1210 (FIG. 12A), riser portion 1220 (FIG. 12A), wall groove portion 1230 (FIG. 12A), spline plate portion 640 (FIG. 6A), and/or corner portion 1260 (FIG. 12A). Other combinations of nose portions, riser portions, wall groove portions, spline plate portions, and/or corner portions are also possible. When assembled together, base assembly 3100 can have a coplanar and smooth front surface such that, for example (1) nose front sections 313 (FIG. 3A) and 613 (FIG. 6A) of adjacent ones of baseboard element 300 and spline 600 form a smooth and coplanar surface; (2) nose top sections 311 (FIG. 3A) and 611 (FIG. 6A) of adjacent ones of baseboard element 300 and spline 600 form a smooth and coplanar surface; (3) riser bends 322 (FIG. 3A) and 622 (FIG. 6A) of adjacent ones of baseboard element 300 and spline 600 form a smooth and coplanar surface; (4) riser sections 324 (FIG. 3A) and 624 (FIG. 6A) and grove front sections 331 (FIG. 3A) and 631 (FIG. 6A) of adjacent ones of baseboard element 300 and spline 600 form a smooth and coplanar surface.

Figure 31B:
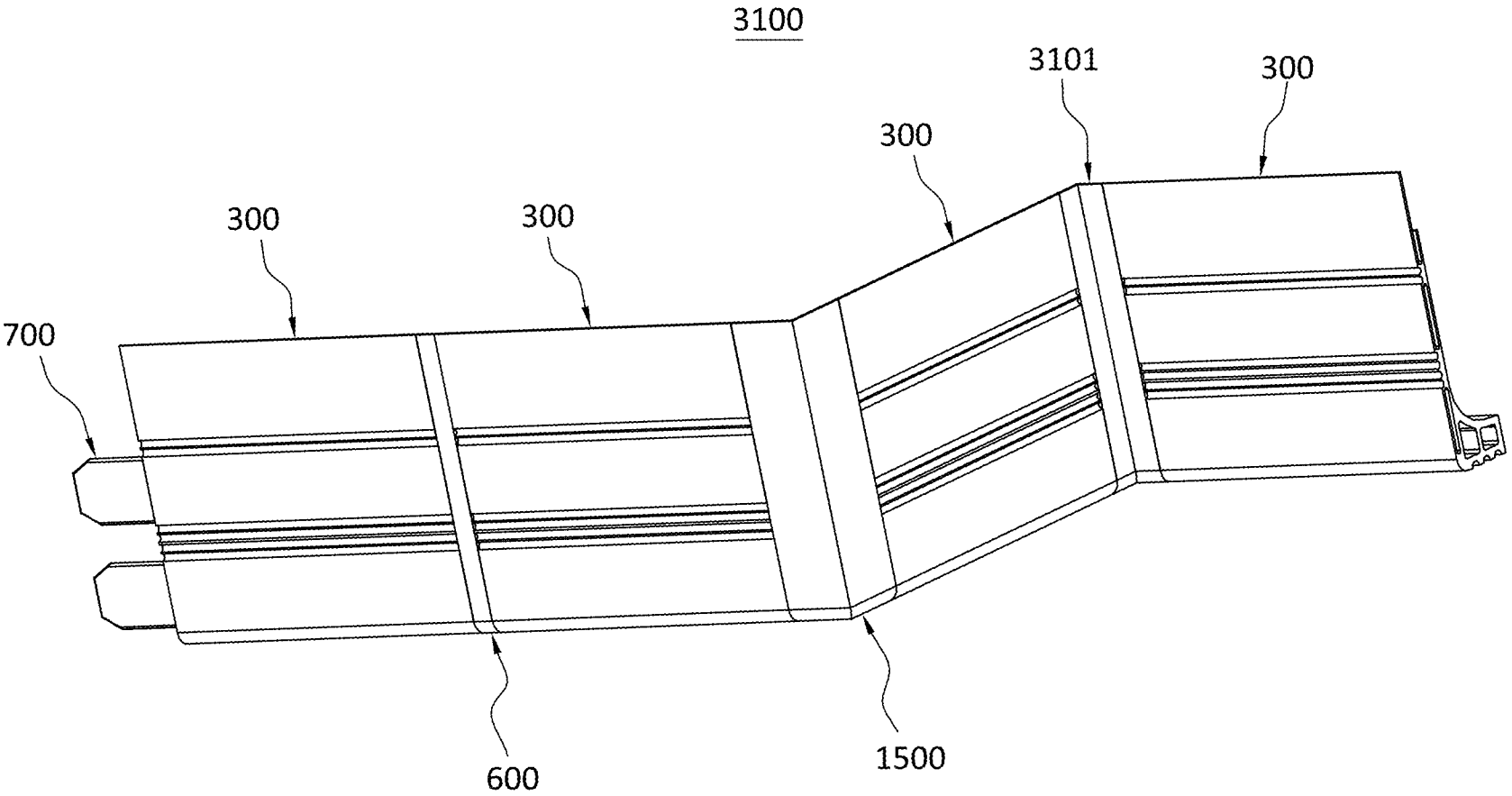

Turning now to FIG. 31B, a back isometric view of baseboard assembly 3100 is shown. The coupling of spline 400, baseboard element 300, spline 600, spline 1500, and/or spline 3101 can be seen in detail in FIG. 31B.

Figure 32A:
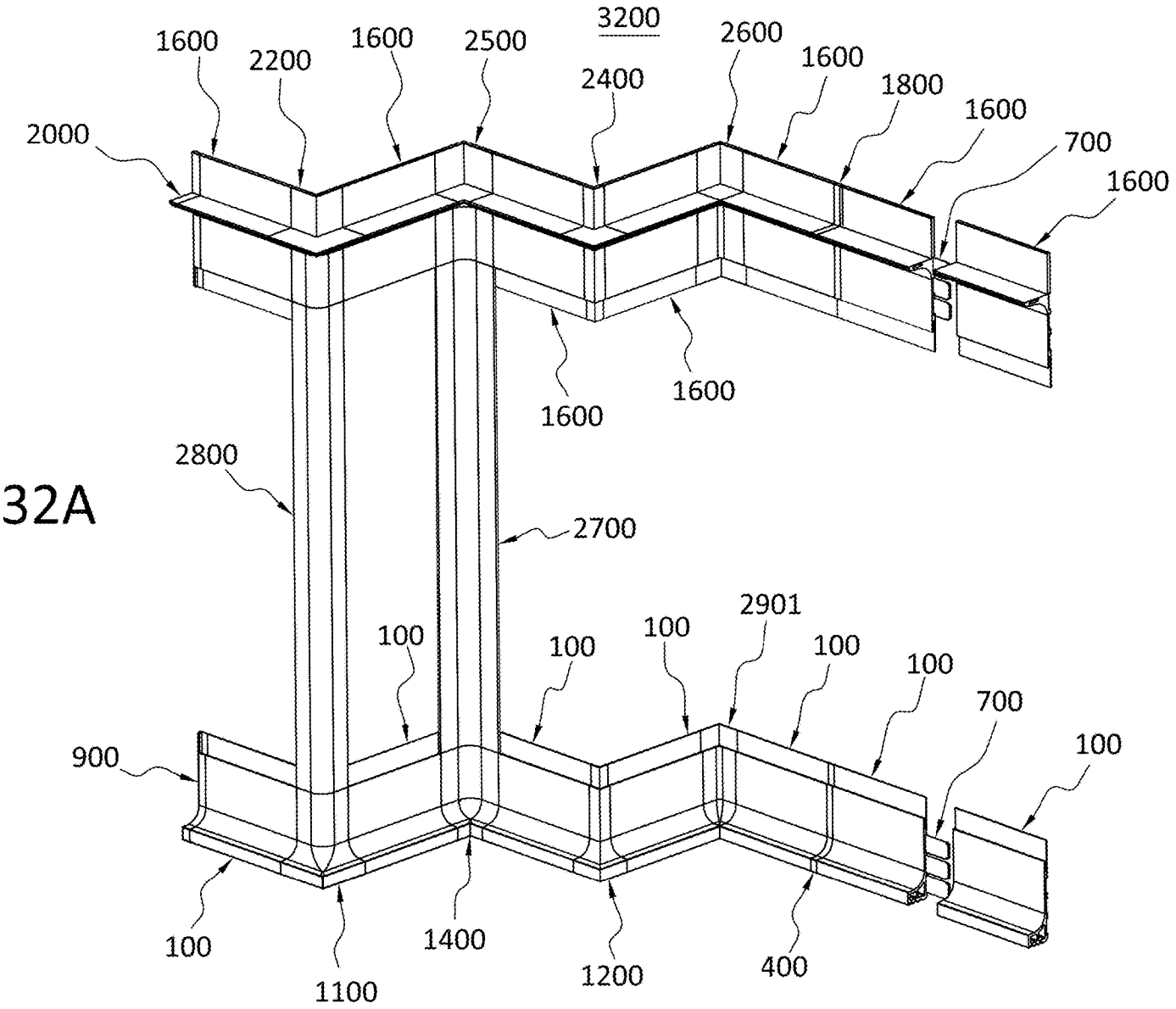

Turning now to FIG. 32A, an exemplary assembly 3200 is shown in a front isometric view. In some embodiments, assembly 3200 can comprise baseboard element 100, spline 700, spline 400, spline 2901, spline 1200, spline 1400, spline 1100, spline 900, wall corner element 2700, wall corner element 3201, crown element 1600, spline 1800, spline 2600, spline 2400, spline 2500, spline 2200, and/or spline 2000. In various embodiments, assembly 3200 can comprise various elements and splines that have complementary spline receiver portions and spline plate portions such that the splines and elements can couple together. When assembled together, base assembly 3100 can have a coplanar and smooth front surface such that, for example (1) nose front sections 113 (FIG. 1A) and 413 (FIG. 4A) of adjacent ones of baseboard element 100 and spline 400 form a smooth and coplanar surface; (2) nose top sections 111 (FIG. 1A) and 411 (FIG. 4A) of adjacent ones of baseboard element 100 and spline 400 form a smooth and coplanar surface; (3) riser bends 122 (FIG. 1A) and 422 (FIG. 4A) of adjacent ones of baseboard element 100 and spline 400 form a smooth and coplanar surface; (4) riser sections 124 (FIG. 1A) and 424 (FIG. 4A) and grove front sections 131 (FIG. 1A) and 431 (FIG. 4A) of adjacent ones of baseboard element 100 and spline 400 form a smooth and coplanar surface. As another example, (1) nose front sections 1613 (FIG. 16A) and 1813 (FIG. 18A) of adjacent ones of crown element 1600 and spline 1800 form a smooth and coplanar surface; (2) nose bottom section 1617 (FIG. 16A) and 1817 (FIG. 16A) of adjacent ones of crown element 1600 and spline 1800 form a smooth and coplanar surface; (3) riser bends 1622 (FIG. 16A) and 1822 (FIG. 18A) of adjacent ones of crown element 1600 and spline 1800 form a smooth and coplanar surface; (4) riser sections 1624 (FIG. 16A) and 1824 (FIG. 18A) and grove front sections 1631 (FIG. 16A) and 1831 (FIG. 18A) of adjacent ones of crown element 1600 and spline 1800 form a smooth and coplanar surface.

While wall corner element 3201 has not been described in detail in the foregoing specification, it should be understood that it could be created by interchanging and/or swapping various elements of the aforementioned splines. For example, wall corner element 3201 could comprise wall corner element 2800 and nub receiver groove 2784. Other combinations wall elements and receiver grooves are also possible.

Figure 32B:
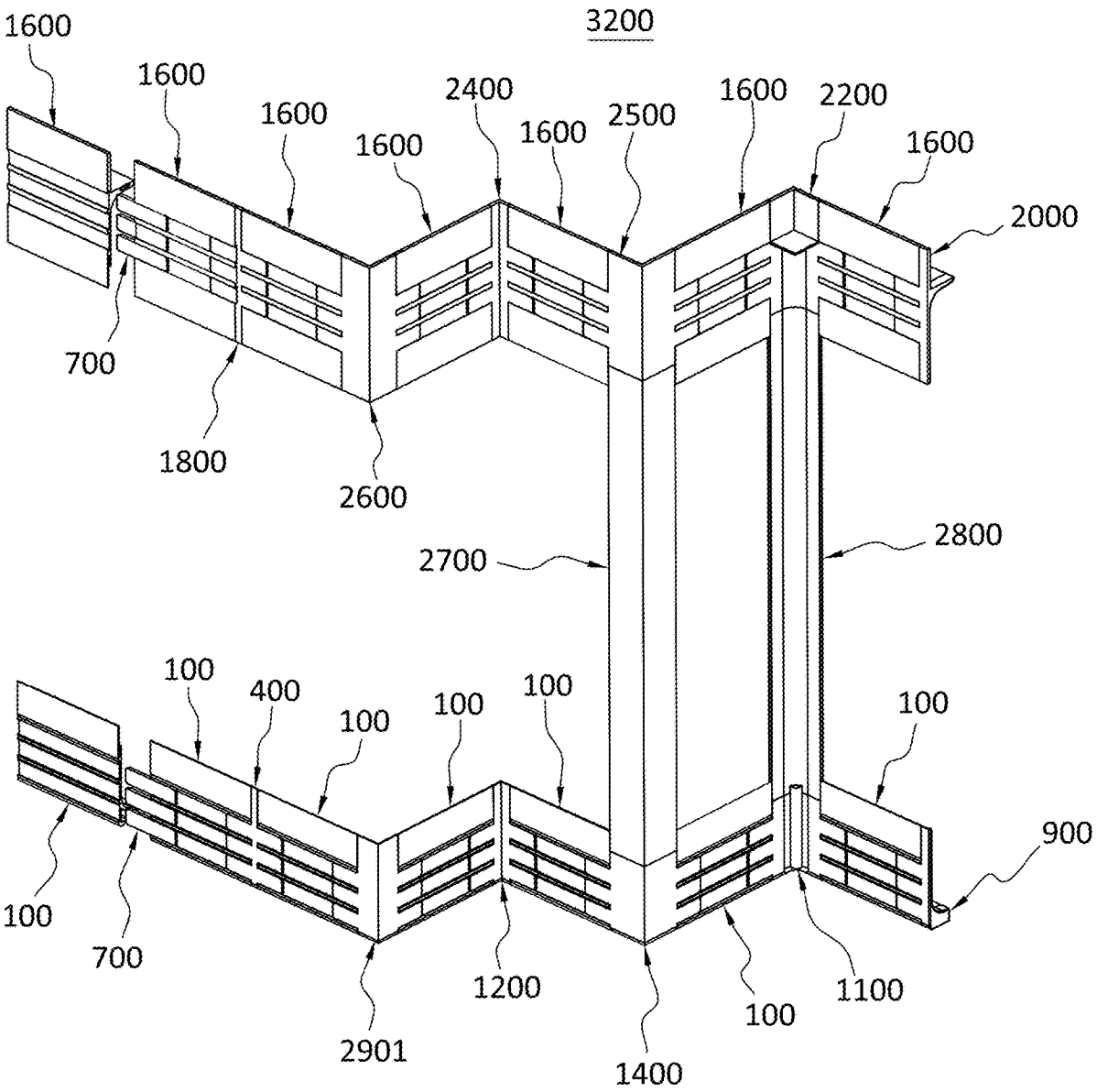

Turning now to FIG. 32B, a back isometric view of baseboard assembly 3200 is shown. The coupling of baseboard element 100, spline 700, spline 400, spline 400, spline 2901, spline 1200, spline 1400, spline 1100, spline 900, wall corner element 2700, wall corner element 3201, crown element 1600, spline 1800, spline 2600, spline 2400, spline 2500, spline 2200, and/or spline 2000 can be seen in detail in FIG. 32B.

Figure 33A:
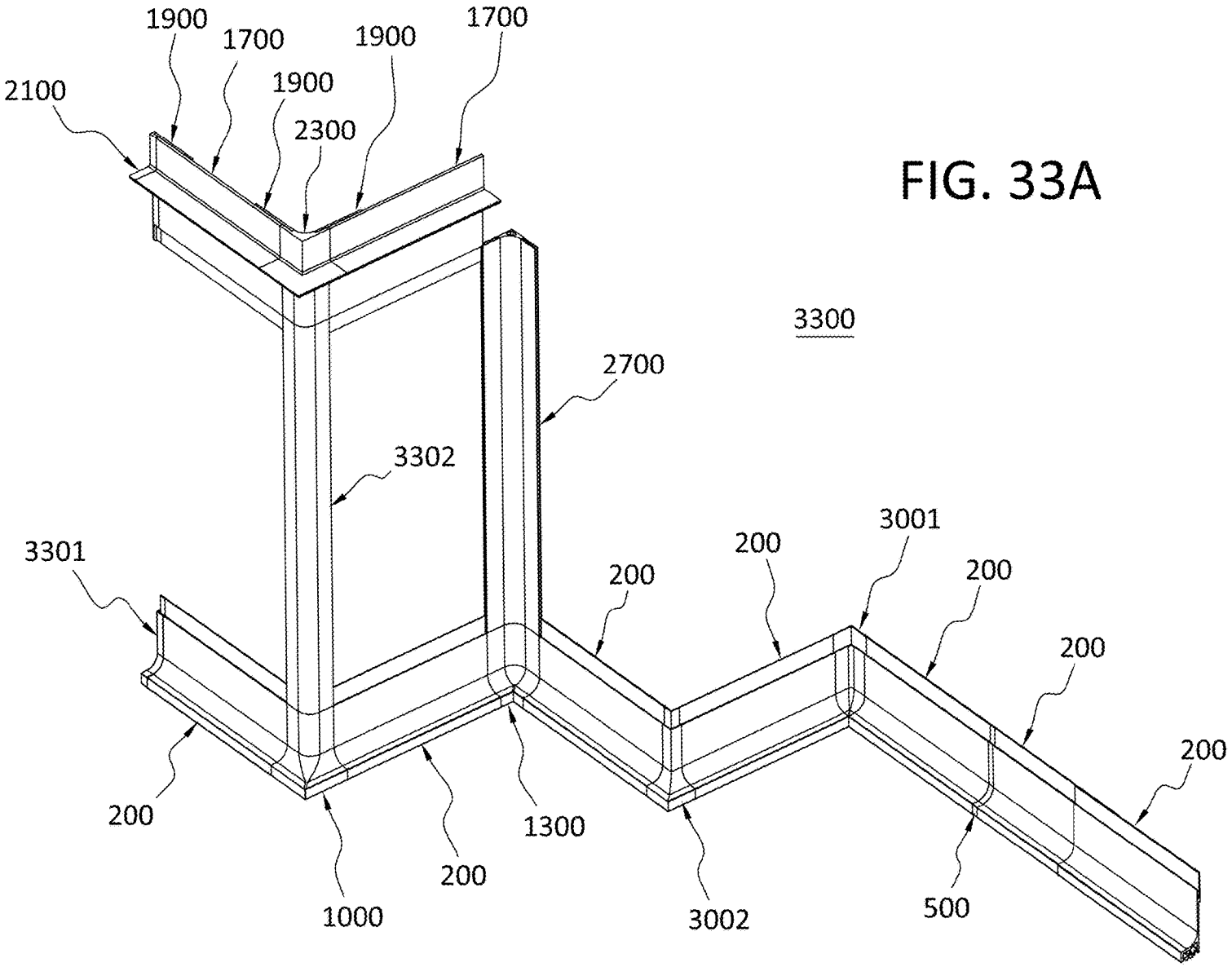

Turning now to FIG. 33A, an exemplary assembly 3300 is shown in a front isometric view. In some embodiments, assembly 3300 can comprise baseboard element 200, spline 800, spline 500, spline 3001, spline 3002, spline 1300, spline 1000, spline 3301, wall corner element 2700, wall corner element 3201, crown element 1700, crown corner element 3302, spline 1900, and/or crown element 2100. In various embodiments, assembly 3300 can comprise various elements and splines that have complementary spline receiver portions and spline plate portions such that the splines and elements can couple together. When assembled together, base assembly 3100 can have a coplanar and smooth front surface such that, for example (1) nose front sections 213 (FIG. 2A) and 513 (FIG. 5A) of adjacent ones of baseboard element 200 and spline 500 form a smooth and coplanar surface; (2) nose top sections 211 (FIG. 2A) and 511 (FIG. 5A) of adjacent ones of baseboard element 200 and spline 500 form a smooth and coplanar surface; (3) riser bends 222 (FIG. 2A) and 522 (FIG. 5A) of adjacent ones of baseboard element 200 and spline 500 form a smooth and coplanar surface; (4) riser sections 224 (FIG. 2A) and 524 (FIG. 5A) and grove front sections 231 (FIG. 2A) and 531 (FIG. 5A) of adjacent ones of baseboard element 200 and spline 500 form a smooth and coplanar surface. As another example, (1) nose front sections 1713 (FIG. 17A) and 2113 (FIG. 21A) of adjacent ones of crown elements 1700 and 2100 form a smooth and coplanar surface; (2) nose bottom section 1717 (FIG. 17A) and 2117 (FIG. 17A) of adjacent ones of crown elements 1700 and 2100 form a smooth and coplanar surface; (3) riser bends 1722 (FIG. 17A) and 2122 (FIG. 21A) of adjacent ones of crown elements 1700 and 2100 form a smooth and coplanar surface; (4) riser sections 1724 (FIG. 17A) and 2124 (FIG. 21A) and grove front sections 1731 (FIG. 17A) and 2131 (FIG. 21A) of adjacent ones of crown elements 1700 and 2100 form a smooth and coplanar surface.

While spline 3301 has not been described in detail in the foregoing specification, it should be understood that it could be created by interchanging and/or swapping various elements of the aforementioned splines. For example, spline 3301 could be similar to spline 900 (FIG. 9A), and could comprise nose portion 910 (FIG. 9A), riser portion 920

(FIG. 9A), wall groove portion 930 (FIG. 9A), cap portion 940 (FIG. 9A), and/or spline plate portion 540 (FIG. 5A). Other combinations wall elements and receiver grooves are also possible. Similarly, while crown element 3302 has not been described in detail in the foregoing specification, it should be understood that it could be created by interchanging and/or swapping various elements of the aforementioned splines. For example, spline 3302 could be similar to spline 2200 (FIG. 22A), and could comprise nose portion 2210 (FIG. 22A), riser portion 2220 (FIG. 22A), wall groove portion 2230 (FIG. 9A, and/or spline plate portion 23 (FIG. 23A).

Figure 33B:
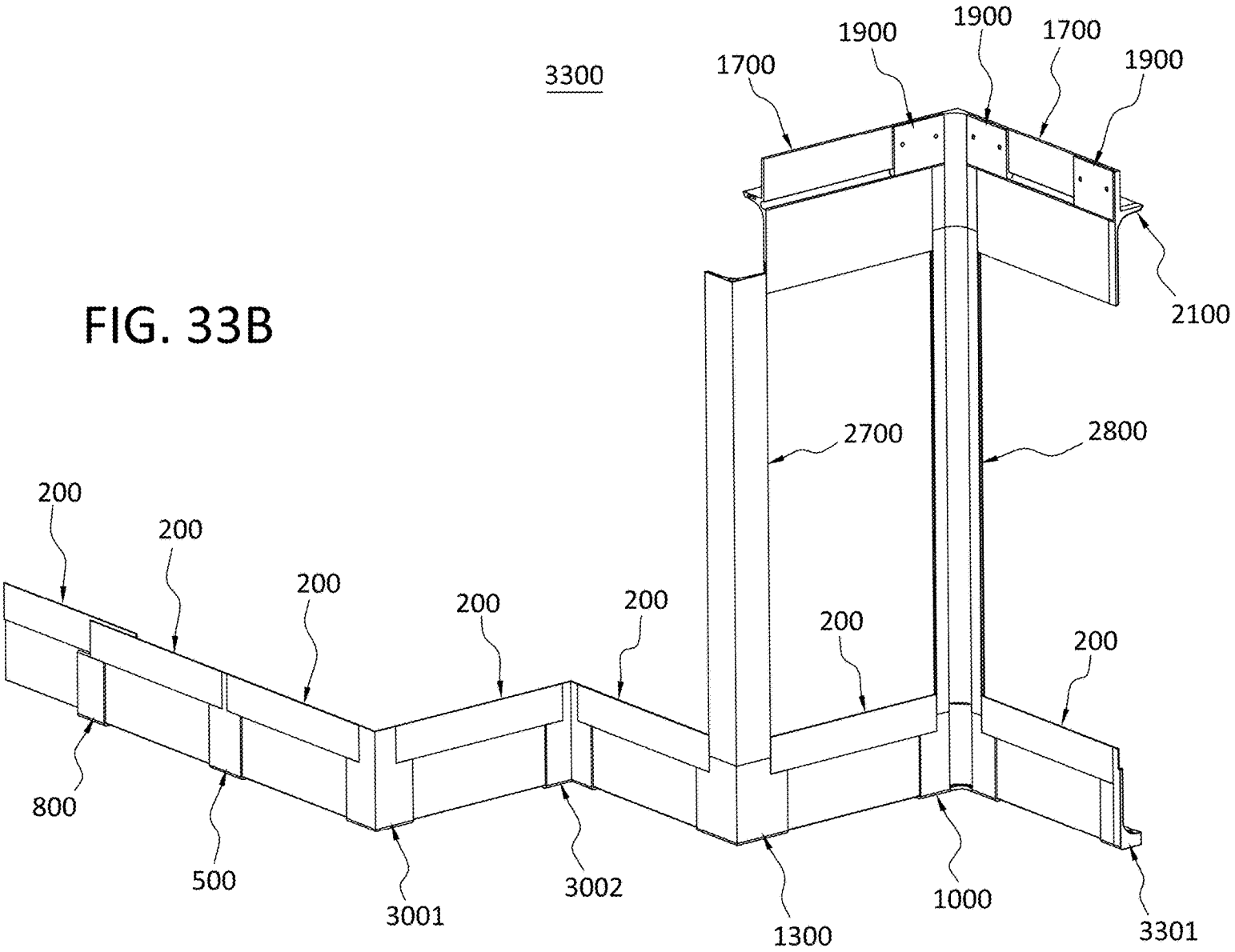

Turning now to FIG. 33B, a back isometric view of baseboard assembly 3300 is shown. The coupling of baseboard element 200, spline 800, spline 500, spline 3001, spline 3002, spline 1300, spline 1000, spline 3301, wall corner element 2700, wall corner element 3201, crown element 1700, crown corner element 3302, spline 1900, and/or crown element 2100 can be seen in detail in FIG. 33B.

Figure 34:
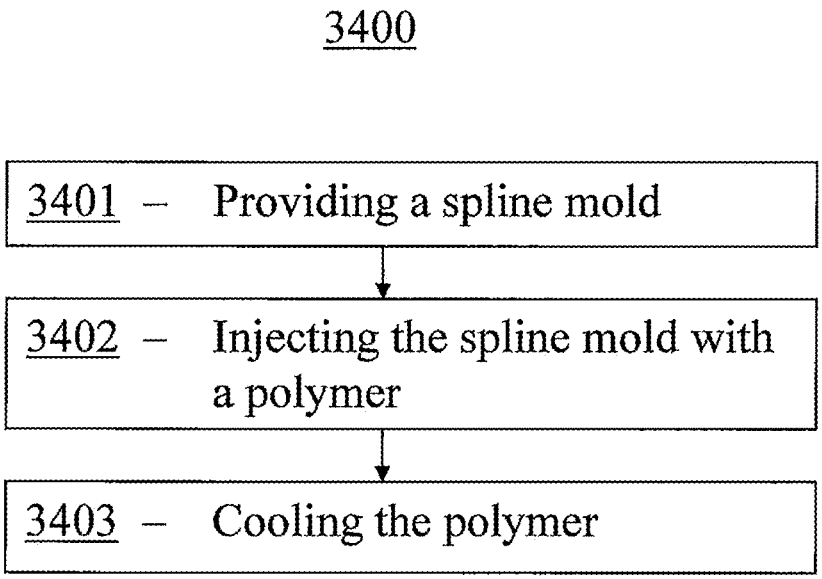
FIGS. 34-36 representatively illustrate exemplary embodiments of methods associated with the above referenced and below described crown elements, baseboard elements, and splines.

Turning now to FIG. 34, a block diagram 3400 displaying an exemplary embodiment of a method of providing a spline is shown. In some embodiments, block diagram 3400 can be used to provide splines described in the aforementioned paragraphs. In various embodiments, splines that are combinations of the different portions of the splines described in the aforementioned paragraphs can be created. In the same or different embodiments, block diagram 3400 can comprise block 3401 providing a spline mold. A spline mold can be configured in such a way that, when it is injected with a polymer, it produces a spline. In some embodiments, block diagram 3400 can comprise block 3402 filling the spline mold with a polymer. In the same or different embodiments, a polymer can be a plastic. For example, a polymer can be polyvinyl chloride (PVC) or any other suitable plastic know or used in the art. In some embodiments, block diagram 3400 can comprise block 3403 cooling the polymer.

Figure 35:
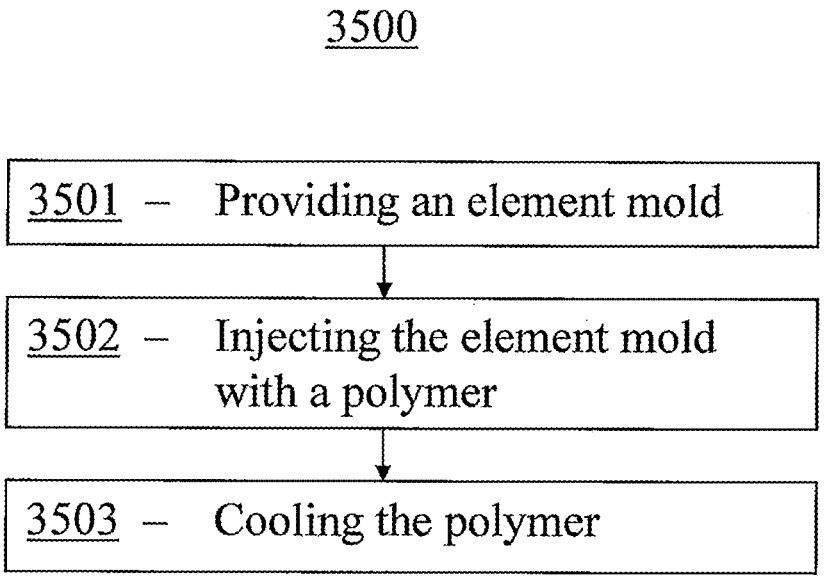

Turning now to FIG. 35, a block diagram 3500 displaying an exemplary embodiment of a method of providing an element is shown. In some embodiments, block diagram 3500 can be used to provide elements (e.g., wall corner elements, crown elements, baseboard elements, etc.) described in the aforementioned paragraphs. In various embodiments, elements that are combinations of the different portions of the elements described in the aforementioned paragraphs can be created. In the same or different embodiments, block diagram 3500 can comprise block 3501 providing an element mold. An element mold can be configured in such a way that, when it is injected with a polymer or metal, it produces an element. In some embodiments, block diagram 3500 can comprise block 3502 filling the element mold with a polymer or metal. In the same or different embodiments, a polymer can be a plastic. For example, a polymer can be polyvinyl chloride (PVC) or any other suitable plastic know or used in the art. In other embodiments, the metal can comprise aluminum, magnesium, copper alloys, tin, zinc, lead alloys, iron, and/or steel. In some embodiments, block diagram 3500 can comprise block 3503 cooling the polymer or metal.

Figure 36:
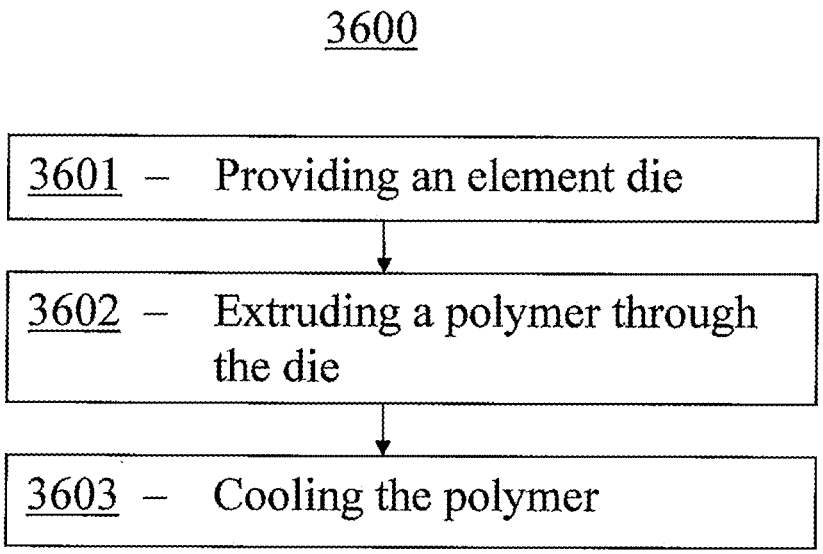

Turning now to FIG. 36, a block diagram 3600 displaying an exemplary embodiment of a method of providing an element or spline is shown. In some embodiments, block diagram 3600 can be used to provide splines and/or elements (e.g., wall corner elements, crown elements, baseboard elements etc.) described in the aforementioned paragraphs. In various embodiments, elements and splines that are combinations of the different portions of the elements and splines described in the aforementioned paragraphs can be created. In the same or different embodiments, block diagram 3600 can comprise block 3601 providing an element or spline die. An element or spline die can be configured in such a way that, when it has polymer, metal, or ceramic extruded through it, an element or spline is produced. In some embodiments, block diagram 3600 can comprise block 3602 extruding a polymer, metal, or ceramic through the die. In the same or different embodiments, a polymer can be a plastic. For example, a polymer can be polyvinyl chloride (PVC) or any other suitable plastic know or used in the art. In other embodiments, the metal can comprise aluminum, brass, copper, lead, magnesium, zinc, steel, titanium, and/or alloys of any of the foregoing. In some embodiments, block diagram 3600 can comprise block 3603 cooling the polymer, metal, or ceramic.

In the foregoing specification, crown elements, baseboard elements, splines, and their related methods have been described with reference to a number of exemplary embodiments. Various modifications and changes may be made, however, without departing from the scope of the construction element as set forth in the claims. The specification and figures are illustrative, rather than restrictive, and modifications are intended to be included within the scope of any construction element. Accordingly, the scope of any construction element should be determined by the claims and their legal equivalents rather than by merely the exemplary embodiments described.

For example, the steps recited in any method or process claims may be executed in any order and are not limited to the specific order presented in the claims. Additionally, the components and/or elements recited in any physical embodiment claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

Although the crown elements, baseboard elements, splines, and their related methods have been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that any element of FIGS. 1-36 may be modified, and that the foregoing discussion of certain of these embodiments does not necessarily represent a complete description of all possible embodiments. For example, one or more of the procedures, processes, or activities of FIGS. 34-36 may include different procedures, processes, and/or activities and be performed in many different orders.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims, and (2) are or are potentially equivalents of express elements and/or limitations in the claims under the doctrine of equivalents.

We claim:

1. A system, comprising:

a first baseboard element comprising:

a first nose portion comprising a first nose bottom section;

a first riser portion coupled to the first nose portion, the first riser portion comprising a first riser section extending approximately perpendicular to the first nose bottom section; and a first wall groove portion comprising:

a first groove front section extending approximately parallel to the first riser section along a first direction approximately perpendicular to the first nose bottom section; and a first groove back section extending approximately parallel to the first groove front section along the first direction;

a second baseboard element comprising:

a second nose portion comprising a second nose bottom section;

a second riser portion coupled to the second nose portion, the second riser portion comprising a second riser section extending approximately perpendicular to the second nose bottom section; and a second wall groove portion comprising:

a second groove front section extending approximately parallel to the second riser section along a second direction approximately perpendicular to the second nose bottom section; and a second groove back section extending approximately parallel to the second groove front section along the second direction; and a spline comprising:

a spline nose portion;

a spline riser portion;

a first pair of spline wings extending from opposite lateral sides of the spline nose portion and configured to be coupled to the first baseboard element and to the second baseboard element, wherein the first pair of spline wings comprises:

a first spline nub configured to be located within a first spline nose receiver groove of the first baseboard element, extending from a first lateral side of the opposite lateral sides of the spline nose portion; and a second spline nub configured to be located within a second spline nose receiver groove of the second baseboard element, extending from a second lateral side of the opposite lateral sides of the spline nose portion; and a second pair of spline wings extending from opposite lateral sides of the spline riser portion and configured to be coupled to the first riser portion of the first baseboard element and to the second riser portion of the second baseboard element.

2. The system of claim 1, wherein:

the first baseboard element further comprises a first spline coupling portion;

the first spline coupling portion comprises a first spline receiver groove configured to accept a first wing of the first pair of spline wings of the spline;

the second baseboard element further comprises a second spline coupling portion; and the second spline coupling portion comprises a second spline receiver groove configured to accept a second wing of the first pair of spline wings of the spline.

3. The system of claim 1, wherein:

the spline nose portion comprises a spline nose bottom section;

the spline riser portion is coupled to the spline nose portion, the spline riser portion comprising:

a spline riser section extending approximately perpendicular to the spline nose bottom section; and the system further comprises a spline wall groove portion comprising:

a spline groove front section extending approximately parallel to the spline riser section; and a spline groove back section extending approximately parallel to the spline groove front section.

4. The system of claim 1, wherein:

the second pair of spline wings further comprises:

a first spline plate extending from a first lateral side of the opposite lateral sides of the spline riser portion; and a second spline plate extending from a second lateral side of the opposite lateral sides of the spline riser portion;

the first spline plate is configured to be located within a first spline receiver groove of the first baseboard element; and the second spline plate is configured to be located within a second spline receiver groove of the second baseboard element.

5. The system of claim 1, wherein the first pair of spline wings further comprises:

a wing nose portion comprising:

a wing nose bottom section extending from a lateral side of opposite lateral sides of the wing nose portion and parallel to a wing nose top section; and a wing riser portion comprising a wing riser section extending from a lateral side of the opposite lateral sides of the spline riser portion; and a wing key extending from the wing nose bottom section, the wing key having a substantially arcuate shape.

6. The system of claim 1, wherein the system further comprises:

a wall corner element coupled to (1) the spline and (2) a crown spline of a crown element system.

7. The system of claim 1, wherein the spline further comprises:

a spline corner bend extending from a first lateral side of opposite lateral sides of the spline to a second lateral side of the opposite lateral sides of the spline.

8. The system of claim 7, wherein the spline corner bend comprises at least one of:

a convex corner bend; or a concave corner bend.

9. The system of claim 1, wherein:

the spline further comprises:

a spline riser bend extending between the spline nose portion and the spline rise portion;

the first riser portion of the first baseboard element further comprises a first riser bend extending between the first nose portion and the first riser section; and the second riser portion of the second baseboard element further comprises a second riser bend extending between the second nose portion and the second riser section.

10. The system of claim 9, wherein:

a first wing of the first pair of spline wings is configured to be located within a first spline riser receiver groove of the first riser bend; and a second wing of the first pair of spline wings is configured to be located within a second spline riser receiver groove of the second riser bend.

11. A system comprising:

a first crown element comprising:

a first nose portion comprising a first nose top section;

a first ceiling portion extending from and approximately perpendicular to the first nose top section;

a first riser portion coupled to the first nose portion, the first riser portion comprising a first riser section extending approximately perpendicular to the first nose top section; and a first wall groove portion comprising:

a first groove front section extending approximately perpendicular to the first nose top section; and a first groove back section extending approximately parallel to the first groove front section;

a second crown element comprising:

a second nose portion comprising a second nose top section;

a second ceiling portion extending from and approximately perpendicular to the a second riser portion coupled to the second nose portion, the second riser portion comprising a second riser section extending approximately perpendicular to the second nose top section; and a second wall groove portion comprising:

a second groove front section extending approximately perpendicular to the second nose top section; and a second groove back section extending approximately parallel to the second groove front section; and a spline comprising:

a spline nose portion;

a spline riser portion;

a first pair of spline wings extending from opposite lateral sides of the spline nose portion and configured to be coupled to the first crown element and to the second crown element, wherein the first pair of spline wings comprises:

a first spline nub configured to be located within a first spline nose receiver groove of the first crown element, extending from a first lateral side of the opposite lateral sides of the spline nose portion; and a second spline nub configured to be located within a second spline nose receiver groove of the second crown element, extending from a second lateral side of the opposite lateral sides of the spline nose portion; and a second pair of spline wings extending from opposite lateral sides of the spline riser portion and configured to be coupled to the first riser portion of the first crown element and to the second riser portion of the second crown element.

12. The system of claim 11, wherein:

the first crown element further comprises a first spline coupling portion;

the first spline coupling portion comprises a first spline receiver groove configured to accept a first wing of the first pair of spline wings of the spline;

the second crown element further comprises a second spline coupling portion; and the second spline coupling portion comprises a second spline receiver groove configured to accept a second wing of the first pair of spline wings of the spline.

13. The system of claim 11, wherein:

the spline nose portion comprises a spline nose top section;

the spline riser portion is coupled to the spline nose portion, the spline rise portion comprising:

a spline riser section extending approximately perpendicular to the spline nose top section;

the spline further comprises a spline ceiling portion extending from and approximately perpendicular to the spline nose top section; and the system further comprises a spline wall groove portion comprising:

a spline groove front section extending approximately parallel to the spline riser section; and a spline groove back section extending approximately parallel to the spline groove front section.

14. The system of claim 11, wherein:

the second pair of spline wings further comprises:

a first spline plate extending from a first lateral side of the opposite lateral sides of the spline riser portion; and a second spline plate extending from a second lateral side of the opposite lateral sides of the spline riser portion;

the first spline plate is configured to be located within a first spline receiver groove of the first crown element; and the second spline plate is configured to be located within a second spline receiver groove of the second crown element.

15. The system of claim 11, wherein the first pair of spline wings further comprises:

a wing nose portion comprising:

a wing nose top section extending from a lateral side of opposite lateral sides of the wing nose portion; and a wing riser portion comprising a wing riser section extending from a lateral side of the opposite lateral sides of the spline riser portion.

16. The system of claim 11, wherein the system further comprises:

a wall corner element coupled to (1) the spline and (2) a baseboard spline of a baseboard element system.

17. The system of claim 11, wherein the spline further comprises:

a spline corner bend extending from a first lateral side of opposite lateral sides of the spline to a second lateral side of the opposite lateral sides of the spline.

18. The system of claim 17, wherein the spline corner bend comprises at least one of:

a convex corner bend; or a concave corner bend.

19. The system of claim 11, wherein:

the spline further comprises:

a spline riser bend extending between the spline nose portion and the spline rise portion;

the first riser portion of the first crown element further comprises a first riser bend extending between the first nose portion and the first riser section; and the second riser portion of the second crown element further comprises a second riser bend extending between the second nose portion and the second riser section.

20. The system of claim 19, wherein:

a first wing of the first pair of spline wings is configured to be located within a first spline riser receiver groove of the first riser bend; and a second wing of the first pair of spline wings is configured to be located within a second spline riser receiver groove of the second riser bend.

* * * * *